US008768690B2

(12) United States Patent
Gupta et al.

(10) Patent No.: US 8,768,690 B2
(45) Date of Patent: Jul. 1, 2014

(54) CODING SCHEME SELECTION FOR LOW-BIT-RATE APPLICATIONS

(75) Inventors: Alok Kumar Gupta, Encinitas, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 933 days.

(21) Appl. No.: 12/261,750

(22) Filed: Oct. 30, 2008

(65) Prior Publication Data

US 2009/0319262 A1 Dec. 24, 2009

Related U.S. Application Data

(63) Continuation-in-part of application No. 12/261,518, filed on Oct. 30, 2008, which is a continuation-in-part of application No. 12/143,719, filed on Jun. 20, 2008.

(51) Int. Cl.
*G10L 21/00* (2013.01)

(52) U.S. Cl.
USPC ..... 704/207

(58) Field of Classification Search
USPC ..... 704/207
See application file for complete search history.

(56) References Cited

U.S. PATENT DOCUMENTS 5,127,053 A * 6/1992 Koch ..... 704/207
5,187,745 A * 2/1993 Yip et al. ..... 704/219
5,704,003 A 12/1997 Kleijn et al.
5,745,871 A 4/1998 Chen
5,878,388 A * 3/1999 Nishiguchi et al. ..... 704/214
5,884,253 A 3/1999 Kleijn
5,963,897 A 10/1999 Alpuente et al.
6,073,092 A 6/2000 Kwon
6,173,265 B1 1/2001 Takahashi
6,240,386 B1 * 5/2001 Thyssen et al. ..... 704/220
6,311,154 B1 10/2001 Gersho et al.
6,324,505 B1 11/2001 Choy et al.
6,480,822 B2 * 11/2002 Thyssen ..... 704/220
6,584,438 B1 6/2003 Manjunath et al.
6,691,084 B2 2/2004 Manjunath et al.
6,754,630 B2 6/2004 Das et al.
6,961,698 B1 11/2005 Gao et al.
6,973,424 B1 12/2005 Ozawa
7,039,581 B1 * 5/2006 Stachurski et al. ..... 704/205
7,136,812 B2 11/2006 Manjunath et al.

(Continued)

FOREIGN PATENT DOCUMENTS

EP 0153787 A2 9/1985
EP 1132892 A1 9/2001

(Continued)

OTHER PUBLICATIONS

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 1-3, pp. 1-1 to 1-4, 2-1 to 2-19, 3-1 to 3-3.

(Continued)

*Primary Examiner* — Michael N Opsasnick
(74) *Attorney, Agent, or Firm* — Heejong Yoo

(57) ABSTRACT

Systems, methods, and apparatus for low-bit-rate coding of transitional speech frames are disclosed.

58 Claims, 87 Drawing Sheets

(56) References Cited

U.S. PATENT DOCUMENTS

| | | | | |
|---|---|---|---|---|
| 7,167,828 | B2 * | 1/2007 | Ehara | 704/223 |
| 7,203,638 | B2 | 4/2007 | Jelinek et al. | |
| 7,236,927 | B2 | 6/2007 | Chen | |
| 7,957,958 | B2 | 6/2011 | Sato | |
| 8,135,047 | B2 | 3/2012 | Rajendran et al. | |
| 8,260,609 | B2 | 9/2012 | Rajendran et al. | |
| 2001/0023396 | A1 | 9/2001 | Gersho et al. | |
| 2002/0103640 | A1 | 8/2002 | Macho et al. | |
| 2002/0111798 | A1 | 8/2002 | Huang | |
| 2004/0002856 | A1 | 1/2004 | Bhaskar et al. | |
| 2004/0181397 | A1 | 9/2004 | Gao | |
| 2004/0260542 | A1 | 12/2004 | Ananthapadmanabhan et al. | |
| 2005/0053130 | A1 | 3/2005 | Jabri et al. | |
| 2005/0065788 | A1 | 3/2005 | Stachurski | |
| 2005/0071153 | A1 | 3/2005 | Tammi et al. | |
| 2005/0154584 | A1 | 7/2005 | Jelinek et al. | |
| 2005/0228648 | A1 | 10/2005 | Heikkinen | |
| 2006/0206318 | A1 | 9/2006 | Kapoor et al. | |
| 2006/0206334 | A1 | 9/2006 | Kapoor et al. | |
| 2007/0174047 | A1 | 7/2007 | Anderson et al. | |
| 2008/0040121 | A1 | 2/2008 | Wang et al. | |
| 2008/0052068 | A1 | 2/2008 | Aguilar et al. | |
| 2009/0319261 | A1 | 12/2009 | Gupta et al. | |
| 2009/0319263 | A1 | 12/2009 | Gupta et al. | |
| 2009/0326930 | A1 | 12/2009 | Kawashima et al. | |
| 2010/0241425 | A1 | 9/2010 | Eksler et al. | |

FOREIGN PATENT DOCUMENTS

| | | | |
|---|---|---|---|
| EP | 2101320 | A1 | 9/2009 |
| JP | 1097294 | A | 4/1989 |
| JP | 2123400 | A | 5/1990 |
| JP | 3211599 | A | 9/1991 |
| JP | 9034499 | A | 2/1997 |
| JP | 9185397 | A | 7/1997 |
| JP | 11259098 | A | 9/1999 |
| JP | 2000214900 | A | 8/2000 |
| JP | 2002505450 | A | 2/2002 |
| JP | 2002198870 | A | 7/2002 |
| JP | 2003015699 | A | 1/2003 |
| JP | 2003509707 | A | 3/2003 |
| JP | 2004109803 | A | 4/2004 |
| JP | 2004355015 | A | 12/2004 |
| JP | 2004538525 | A | 12/2004 |
| JP | 2005534950 | A | 11/2005 |
| JP | 2009545778 | A | 12/2009 |
| JP | 2010501080 | A | 1/2010 |
| JP | 2010507818 | A | 3/2010 |
| TW | 419645 | B | 1/2001 |
| TW | 200638336 | | 11/2006 |
| TW | 200703235 | | 1/2007 |
| TW | 200822062 | A | 5/2008 |
| WO | WO0038179 | A2 | 6/2000 |
| WO | WO2008007699 | A1 | 1/2008 |
| WO | 2008016935 | | 2/2008 |
| WO | 2008016947 | | 2/2008 |
| WO | WO2008049221 | A1 | 5/2008 |
| WO | WO2008072736 | A1 | 6/2008 |
| WO | WO2009155569 | | 2/2010 |

OTHER PUBLICATIONS

3rd Generation Partnership Project 2 (3GPP2), Enhanced Variable Rate Codec, Speech Service Options 3, 68, and 70 for Wideband Spread Spectrum Digital Systems, 3GPP2 C.S0014-C, Version 1.0, Jan. 2007, ch. 4, pp. 4-1 to 4-181.

A.M. Kondoz., "Digital Speech Coding for Low Bit Rate Communication Systems" 2004, John Wiley & Sons Ltd. , XP002549256 pp. 292-297, p. 292-p. 297.

Atal B.S., "The history of linear prediction", IEEE Signal Processing Magazine, vol. 23 (2), Mar. 2006, pp. 154-161.

Atal. et al., "Predictive Coding of Speech at Low Bit Rates", IEEE Transactions on Communications, vol. Com-30, No. 4, Apr. 1982. pp. 600-614.

Fengying Yao, et al., "A Fixed-point DSP Implementation for a Low Bit Rate Vocoder", 5th International Conference on Solid-State and Integrated Circuit Technology, Oct. 21-23, 1998, pp. 365-368.

International Search Report—PCT/US2009/062559—International Search Authority, European Patent Office, Mar. 19, 2003.

Kleijn W.B, et al., Methods for Waveform Interpolation in Speech Coding, Digital Signal Processing 1, 1991, pp. 215-230.

Kohler M. A., "A Comparison of the New 2400 bps MELP Federal Standard with Other Standard Coders", IEEE International Conference on Acoustics, Speech, and Signal Processing ("ICASSP-97"), Apr. 21-24, 1997, vol. 2, pp. 1587-1590.

Supplee L. M., et al., "MELP: the New Federal Standard at 2400 bps", IEEE International Conference on Acoustics, Speech, and Signal Processing ("ICASSP-97"), Apr. 21-24, 1997, vol. 2, pp. 1591-1594.

Viswanathan V., et al., "A Harmonic Deviations Linear Prediction Vocoder for Improved Narrowband Speech Transmission", IEEE International Conference on Acoustics, Speech, and Signal Processing ("ICASSP '82"), vol. 7, May 1982, pp. 610-613.

Written Opinion—PCT/US2009/062559, International Search Authority, European Patent Office, Mar. 19, 2010.

Taiwan Search Report—TW098137040—TIPO—Jan. 23, 2013.

Krishnan V., "EVRC-Wideband: The New 3GPP2 Wideband Vocoder Standard", IEEE International Conference on Acoustics, Speech and Signal Processing, ICASSP, 2007, vol. 2, Apr. 20, 2007, pp. II-333-II-336.

* cited by examiner

FIG. 19A
| feature | value | | |
|---|---|---|---|
| correlation result | ≥0.65 | ≥0.55 | ≥0.45 |
| sample energy/frame avg. | ≥T-3 | ≥T-2 | ≥T |
| sample energy/terminal pitch peak energy | >0.35 | >0.50 | >0.40 |
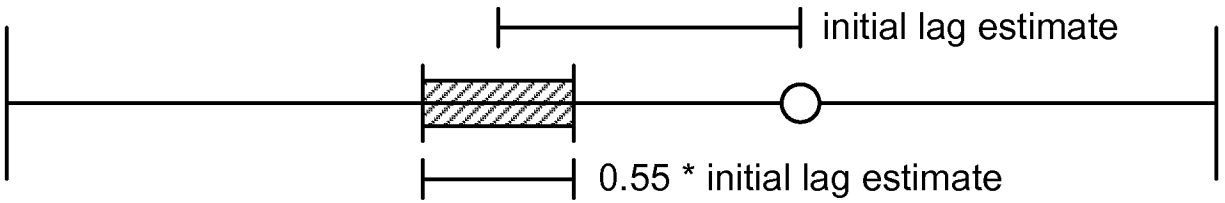
FIG. 19B
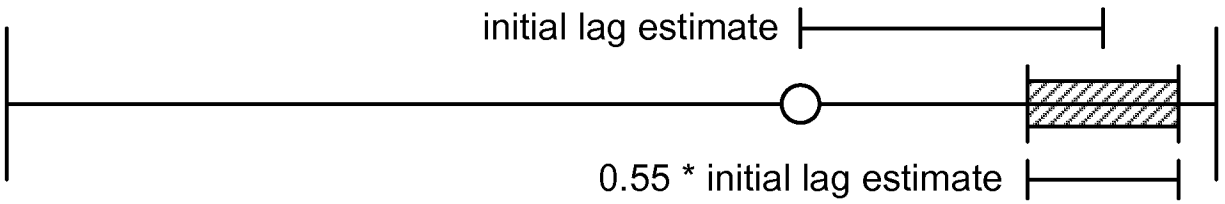
FIG. 19C

| feature | value | | | | |
|---|---|---|---|---|---|
| correlation result | ≥0.65 | ≥0.65 | ≥0.45 | ≥0.45 | ≥0.45 |
| no. of confirmed pulses | 1 | >1 | 1 | >1 | |
| sample energy/ frame avg. | ≥T-4 | ≥T-5 | ≥T-3 | ≥T-3 | |
| candidate distance | ≥20 | X | ≥20 | X | |

| | transitional | QPPP | QNELP | silence |
|---|---|---|---|---|
| LSP vectors | 13 | 16 | 16 | 8 |
| lag | 7 | 4 | 0 | 0 |
| pulse shape | 7 | 0 | 0 | 0 |
| amplitude, gain | 4 | 18 | 17 | 12 |
| peak position | 7 | 0 | 0 | 0 |
| filter shape | 0 | 0 | 2 | 0 |
| mode | 2 | 1 | 1 | 0 |
| reserved | 0 | 1 | 4 | 3 |

FIG. 26

| Feature name | description |
|---|---|
| curr_ns_snr | This feature is extracted from the noise suppressor. It is the band SNRs derived from the FFT. Low band (curr_ns_snr[0]) is from 0 to 2 kHz, high band (curr_ns_snr[1]) is from 2 to 4 kHz. |
| curr_snr | This is the band SNRs derived from VAD, after noise suppression. |
| curr_snr_diff | Band SNR difference, defined as curr_snr[0]-curr_snr[1]. |
| zcr | The zero crossing rate of the current frame, defined as the number of sign changes in speech. |
| E | Current frame energy |
| Enext | Look ahead frame energy |
| bER | Band energy ratio, defined as log2(EL/EH), where EL is the low band current frame energy from 0 to 2k, and EH is the high band current frame energy from 2k to 4k |
| vEav | 3-frame average voiced energy, updated only if current frame is voiced, or reset to 0.1 at unvoiced or inactive speech |
| vEprev | Previous valid 3-frame average voiced energy |
| vER | Current energy to previous 3-frame average voiced energy ratio, defined as 10*log10(E/vEprev) |
| vER2 | Defined as MIN(20,10*log10(E/vEav)) |
| maxsfe_idx | Current frame is evenly divided into 10 subframes, RMS value is computed on each subframe. This is the index to the subframe that has the largest RMS value in the second half of the current frame |

FIG. 51

```
if ( nacf_ap[2]>=VOICEDTH ) { // 2nd subframe NACF high
 switch (prev_mode) {

 case SILENCE:
  m.speech_type=UP_TRANSIENT;
  if (nacf_ap[3]<UNVOICEDTH && zcr>70 && bER<0) m.speech_type=UNVOICED;
  if (nacf_ap[3]<UNVOICEDTH && zcr>100 && vER<-20) m.speech_type=UNVOICED;
  if (vER<-25) m.speech_type=UNVOICED;
 break;

 case UNVOICED:
  m.speech_type=UP_TRANSIENT;
  if (nacf_ap[3]<UNVOICEDTH && nacf_ap[4]<UNVOICEDTH && zcr>70 && bER<0)
m.speech_type=UNVOICED;
  if (nacf_ap[3]<UNVOICEDTH && zcr>100 && vER<-20 && E<Eprev)
m.speech_type=UNVOICED;
  if (vER<-25) m.speech_type=UNVOICED;
 break;

 case VOICED:
  m.speech_type=VOICED;
  /* if ((nacf_ap[2]-nacf_ap[3]>0.3) && nacf_ap[3]<LOWVOICEDTH && E>=2*Eavg)
m.speech_type=TRANSIENT; */
  if ((nacf_ap[2]-nacf_ap[1]>0.3) && nacf_ap[1]<LOWVOICEDTH && E>0.5*Eprev)
m.speech_type=TRANSIENT;
  if (vER<-18 && nacf_ap[3]<VOICEDTH) m.speech_type=DOWN_TRANSIENT;
  if (vER<-30 && E<Eprev) m.speech_type=UNVOICED;
 break;
```

FIG. 55

```
 case DOWN_TRANSIENT:
  m.speech_type=DOWN_TRANSIENT;
  // if (E>0.2*vEav) m.speech_type=TRANSIENT;
  if (vER<-30) m.speech_type=UNVOICED;
  if (E>Eprev) m.speech_type=TRANSIENT;
 break;

 default: // previous is transient
  m.speech_type=VOICED;
  if ((nacf_ap[2]-nacf_ap[1]>0.45) || nacf_ap[1]<UNVOICEDTH ) m.speech_type=TRANSIENT;
  if (nacf_ap[1]-nacf_ap[0]>0.3 && nacf_ap[1]<VOICEDTH && prev_mode !=TRANSIENT)
m.speech_type=TRANSIENT;
  if (((nacf_ap[1]-nacf_ap[0]>0.3)||(nacf_ap[2]-nacf_ap[1]>0.3)) && nacf_ap[1]<LOWVOICEDTH
&& nacf_ap[0]<UNVOICEDTH) m.speech_type=TRANSIENT;
  if (E<0.05*vEav && nacf_ap[3]<VOICEDTH) m.speech_type=DOWN_TRANSIENT;
  if (vER<-30 && E<Eprev) m.speech_type=UNVOICED;
 break;
 }
}
```

FIG. 56

```
if ( nacf_ap[2]<=UNVOICEDTH ) {
 switch (prev_mode) {

 case SILENCE:
  m.speech_type=UNVOICED;
 if (nacf_ap[3]>nacf_ap[2] && nacf_ap[4]>nacf_ap[3] && nacf_ap[4]>LOWVOICEDTH && zcr<110 && vER>-21 &&
(nacf_ap[3]>UNVOICEDTH || bER>-2)) m.speech_type=UP_TRANSIENT;
 if (zcr<60 && bER>6 && vER>-13 && curr_snr_diff>13.5463) m.speech_type=UP_TRANSIENT;
 if ((nacf_ap[3]>LOWVOICEDTH || nacf_ap[4]>LOWVOICEDTH) && bER>3 && zcr<60 && vER>0)
m.speech_type=UP_TRANSIENT;
 if (nacf_ap[3]>LOWVOICEDTH && nacf_ap[4]>LOWVOICEDTH && bER>3 && zcr<40 && vER>-15)
m.speech_type=UP_TRANSIENT;
 break;

 case UNVOICED:
 m.speech_type=UNVOICED;
 if (nacf_ap[3]>nacf_ap[2] && nacf_ap[4]>nacf_ap[3] && nacf_ap[4]>LOWVOICEDTH && zcr<110 && vER>-21 &&
(nacf_ap[3]>UNVOICEDTH || bER>-2)) m.speech_type=UP_TRANSIENT;
 if (nacf_ap[3]>nacf_ap[2] && nacf_ap[4]>nacf_ap[3] && E>5*Eprev && bER>3 && vER>-16)
m.speech_type=UP_TRANSIENT;
 if (nacf_ap[4]>VOICEDTH && bER>3 && zcr<80 && E>2*Eprev && vER>20) m.speech_type=UP_TRANSIENT;
 if (nacf_ap[3]>VOICEDTH && bER>0 && zcr<80 && E>2*Eprev && vER>16) m.speech_type=UP_TRANSIENT;
 if ((nacf_ap[3]>LOWVOICEDTH || nacf_ap[4]>LOWVOICEDTH) && bER>0 && zcr<80 && maxsfe_idx==SFNUM
&& vER>-16) m.speech_type=UP_TRANSIENT;
 if (nacf_ap[3]>UNVOICEDTH && nacf_ap[4]>UNVOICEDTH && zcr<80 && bER>4 && vER>-20 &&
curr_snr_diff>0 && curr_ns_snr[0]>=SNR_THLD) // Clean condition
 m.speech_type=UP_TRANSIENT;
 if (nacf_ap[3]>LOWVOICEDTH && nacf_ap[4]>LOWVOICEDTH && zcr<80 && E>Eprev && vER>-20)
m.speech_type=UP_TRANSIENT;
```

FIG. 57

```
 if (nacf_ap[3]>VOICEDTH && nacf_ap[4]>VOICEDTH && vER>-20) m.speech_type=UP_TRANSIENT;
 if (bER>0 && zcr<80 && E>10*Eprev && vER>-10) m.speech_type=UP_TRANSIENT;
 if (((bER>5 && vER>-10) || (bER>3 && vER>-6) || (bER>0 && vER>-3)) && zcr<80 && curr_snr_diff>0 &&
curr_ns_snr[0]>=SNR_THLD) // Clean condition
 m.speech_type=UP_TRANSIENT;
 if (bER>-3 && vER>-14 && zcr<80 && curr_ns_snr[0]<SNR_THLD) //Noisy condition
 m.speech_type=UP_TRANSIENT;
 if (zcr<60 && bER>2 && vER>-5 && curr_ns_snr[0]<SNR_THLD) //Noisy condition
 m.speech_type=UP_TRANSIENT;
 if (bER>-5 && vER>-4 && nacf_ap[3]>UNVOICEDTH && nacf_ap[4]>nacf_ap[3] && zcr<100 &&
curr_ns_snr[0]<SNR_THLD) // Noisy condition
 m.speech_type=UP_TRANSIENT;
 break;

 case DOWN_TRANSIENT: // following down_transient
 m.speech_type=UNVOICED;
 if (bER>0) {
  if (vER>-20 && zcr<70) m.speech_type=DOWN_TRANSIENT;
  if ((nacf_ap[3]>LOWVOICEDTH || nacf_ap[4]>LOWVOICEDTH) && E>=2*Eprev && vER>-15)
m.speech_type=TRANSIENT;
  if (nacf_ap[3]>nacf_ap[2] && nacf_ap[4]>nacf_ap[3] && nacf_ap[4]>VOICEDTH && vER>-15 &&
E>Eprev) m.speech_type=TRANSIENT;
 }
 else {
  if (nacf_ap[3]>nacf_ap[2] && nacf_ap[4]>nacf_ap[3] && nacf_ap[4]>VOICEDTH && vER>-15
&& E>2*Eprev) m.speech_type=TRANSIENT;
 }
 break;
```

FIG. 58

```
 case VOICED:
 default:
 if (bER>0) {
  m.speech_type=TRANSIENT;
  if (vER2<-15 && zcr<90 && E<Eprev && nacf_ap[3]<VOICEDTH) m.speech_type=DOWN_TRANSIENT;
  if (vER<-25 && E<Eprev) m.speech_type=UNVOICED;
 }
 else {
  m.speech_type=UNVOICED;
  if (nacf_ap[3]>nacf_ap[2] && nacf_ap[4]>nacf_ap[3] && nacf_ap[4]>UNVOICEDTH && zcr<100 &&
vER>-20 && curr_ns_snr[0]<SNR_THLD) //Noisy condition
  m.speech_type=TRANSIENT;
  if (nacf_ap[3]>nacf_ap[2] && nacf_ap[4]>nacf_ap[3] && nacf_ap[4]>LOWVOICEDTH && zcr<100 &&
vER>-20 && curr_ns_snr[0]>=SNR_THLD) //Clean condition
  m.speech_type=TRANSIENT;
  if (((bER>-1 && vER>-12 && zcr<80) || (bER>-3 && vER>-10 && zcr<90) || (bER>-7 && vER>-3 &&
zcr<105)) && curr_ns_snr[0]<SNR_THLD) //Noisy condition
  m.speech_type=TRANSIENT;
  if (bER>-3 && vER>-10 && zcr<90 && curr_ns_snr[0]>=SNR_THLD) //Clean condition
  m.speech_type=TRANSIENT;
 }
 break;
 }
}
```

FIG. 59

```
if ( nacf_ap[2] >= UNVOICEDTH && nacf_ap[2] <= VOICEDTH ) {
 switch (prev_mode) {

 case SILENCE:
 m.speech_type=UNVOICED;
 if (nacf_ap[3]>nacf_ap[2] && nacf_ap[4]>nacf_ap[3] && nacf_ap[4]>LOWVOICEDTH && zcr<110 &&
vER>-22) m.speech_type=UP_TRANSIENT;
 if (nacf_ap[2]>LOWVOICEDTH && curr_snr_diff>0 && E>2*Eprev && zcr<70 && vER>-20)
m.speech_type=UP_TRANSIENT;
 if (nacf_ap[2]>LOWVOICEDTH && nacf_ap[3]>LOWVOICEDTH && zcr<70 && vER>-20)
m.speech_type=UP_TRANSIENT;
 if ((nacf_ap[4]>VOICEDTH || nacf_ap[3]>VOICEDTH) && nacf_ap[3]>UNVOICEDTH && zcr<70 &&
vER>-20) m.speech_type=UP_TRANSIENT;
 if ((nacf_ap[3]-nacf_ap[2]>0.3) && E>2*Eprev && zcr<70 && bER>0 && vER>-20)
m.speech_type=UP_TRANSIENT;
 if (nacf_ap[4]>VOICEDTH && (nacf_ap[2]>LOWVOICEDTH || nacf_ap[3]>LOWVOICEDTH) &&
E>2*Eprev && curr_snr_diff>0 && vER>-20) m.speech_type=UP_TRANSIENT;
 if (nacf_ap[3]>LOWVOICEDTH && nacf_ap[4]>LOWVOICEDTH && bER>3 && zcr<40 && vER>-15)
m.speech_type=UP_TRANSIENT;
 break;

 case UNVOICED:
 m.speech_type=UNVOICED;
 if (nacf_ap[3]>nacf_ap[2] && nacf_ap[4]>nacf_ap[3] && nacf_ap[4]>LOWVOICEDTH && zcr<110 &&
vER>-22) m.speech_type=UP_TRANSIENT;
 if ((nacf_ap[4]>LOWVOICEDTH || nacf_ap[3]>LOWVOICEDTH) && zcr<100 && E>Eprev && bER>0 &&
vER>-20) m.speech_type=UP_TRANSIENT;
 if (nacf_ap[4]>VOICEDTH && nacf>UNVOICEDTH && zcr<100 && E>Eprev && bER>1 && vER>-16)
m.speech_type=UP_TRANSIENT;
```

FIG. 60

```
 if (zcr<60 && bER>3 && E>5*Eprev && curr_snr_diff>9.0309 && vER>20)
m.speech_type=UP_TRANSIENT;
 if ((nacf_ap[3]>UNVOICEDTH || nacf_ap[4]>UNVOICEDTH) && bER>1 && vER>-16 && zcr<80 &&
curr_snr_diff>-6.0206) m.speech_type=UP_TRANSIENT;
 if (nacf_ap[2]>LOWVOICEDTH && curr_snr_diff>0 && E>2*Eprev && zcr<70 && vER>-20)
m.speech_type=UP_TRANSIENT;
 if (nacf_ap[2]>LOWVOICEDTH && nacf_ap[3]>LOWVOICEDTH && zcr<100 && vER>-20)
m.speech_type=UP_TRANSIENT;
 if ((nacf_ap[4]>VOICEDTH || nacf_ap[3]>VOICEDTH) && nacf_ap[3]>UNVOICEDTH && zcr<80 && vER>-
20) m.speech_type=UP_TRANSIENT;
 if ((nacf_ap[3]>LOWVOICEDTH || nacf_ap[4]>LOWVOICEDTH) && bER>0 && zcr<100 &&
maxsfe_idx==SFNUM && vER>-20) m.speech_type=UP_TRANSIENT;
 if (nacf_ap[3]>UNVOICEDTH && nacf_ap[4]>UNVOICEDTH && zcr<100 && vER>-3 && bER>-5 &&
curr_ns_snr[0]<SNR_THLD) // Noisy condition
m.speech_type=UP_TRANSIENT;
 if (bER>4 && zcr<100 && maxsfe_idx==SFNUM && vER>-20) m.speech_type=UP_TRANSIENT;
 if ((nacf_ap[3]-nacf_ap[2]>0.3) && E>2*Eprev && zcr<70 && bER>0 && vER>-20)
m.speech_type=UP_TRANSIENT;
 if (nacf_ap[4]>VOICEDTH && (nacf_ap[2]>LOWVOICEDTH || nacf_ap[3]>LOWVOICEDTH) && E>2*Eprev
&& curr_snr_diff>0 && vER>-20) m.speech_type=UP_TRANSIENT;
 if (((bER>5 && vER>-10) || (bER>3 && vER>-6) || (bER>0 && vER>-3)) && zcr<80 &&
curr_ns_snr[0]>=SNR_THLD ) // Clean condition
m.speech_type=UP_TRANSIENT;
 if (bER>-3 && vER>-14 && zcr<80 && curr_ns_snr[0]<SNR_THLD) //Noisy condition
m.speech_type=UP_TRANSIENT;
 break;
```

FIG. 61

```
 case DOWN_TRANSIENT:
 m.speech_type=UNVOICED;
 if (bER>0) {
  if (vER>-20 && zcr<70) m.speech_type=DOWN_TRANSIENT;
  if ((nacf_ap[3]>LOWVOICEDTH || nacf_ap[4]>LOWVOICEDTH) && E>=2*Eprev && vER>-15)
m.speech_type=TRANSIENT;
  if (nacf_ap[3]>nacf_ap[2] && nacf_ap[4]>nacf_ap[3] && nacf_ap[4]>VOICEDTH && vER>-15)
m.speech_type=TRANSIENT;
 }
 else {
  if (nacf_ap[3]>nacf_ap[2] && nacf_ap[4]>nacf_ap[3] && nacf_ap[4]>VOICEDTH && vER>-15
&& E>2*Eprev) m.speech_type=TRANSIENT;
 }
 break;

 case VOICED:
 default:
 if (nacf_ap[2]>=LOWVOICEDTH) {
  m.speech_type=VOICED;
  if (nacf_ap[1]<LOWVOICEDTH || (nacf_ap[1]<VOICEDTH && nacf_ap[1]-nacf_ap[0]>0.3) || bER<0)
m.speech_type=TRANSIENT;
  if (vER<-15 && nacf_ap[3]<LOWVOICEDTH && E<Eprev) m.speech_type=DOWN_TRANSIENT;
  if (bER<0 && vER<-20 && Enext<E && nacf_ap[3]<UNVOICEDTH && nacf_ap[4]<UNVOICEDTH)
m.speech_type=UNVOICED;
  if (bER<-30 && E<Eprev) m.speech_type=UNVOICED;
  if ((nacf_ap[2]-nacf_ap[3]>0.3) && nacf_ap[3]<0.3 && nacf_ap[4]<0.25) m.speech_type=TRANSIENT;
 }
```

FIG. 62

```
 else {
  if (bER>0) {
   m.speech_type=TRANSIENT;
   if (vER2<-15 && zcr<90 && E<Eprev && nacf_ap[3]<VOICEDTH)
m.speech_type=DOWN_TRANSIENT;
   if (vER<-25 && E<Eprev) m.speech_type=UNVOICED;
  }
  else {
   m.speech_type=UNVOICED;
   if (nacf_ap[3]>nacf_ap[2] && nacf_ap[4]>nacf_ap[3] && zcr<100 && vER>-20 &&
curr_ns_snr[0]>=SNR_THLD) // Clean condition
m.speech_type=TRANSIENT;
   if (nacf_ap[3]>nacf_ap[2] && nacf_ap[4]>nacf_ap[3] && zcr<110 && vER>-15 &&
curr_ns_snr[0]<SNR_THLD) // Noisy condition
m.speech_type=TRANSIENT;
   if (bER>-1 && vER>-12 && zcr<80) m.speech_type=TRANSIENT;
   if (bER>-3 && vER>-10 && zcr<90) m.speech_type=TRANSIENT;
   if (bER>-7 && vER>-3 && zcr<105 && curr_ns_snr[0]<SNR_THLD) //Noisy condition
m.speech_type=TRANSIENT;
  }
 }
 break;
 }
}
```

FIG. 63

| feature | value | | | | | | | |
|---|---|---|---|---|---|---|---|---|
| max. sample/ RMS energy | <20 | <20 | <24 | <24 | <24 | <24 | <24 | <30 |
| nacf_ap[2] | X | X | <0.50 | <0.50 | <0.55 | <0.55 | <0.55 | <0.35 |
| nacf_ap[3] | <0.20 | <0.55 | <0.35 | <0.50 | <0.20 | <0.55 | <0.35 | <0.35 |
| nacf_ap[4] | <0.55 | <0.20 | <0.50 | <0.35 | <0.55 | <0.20 | <0.35 | <0.35 |

reclassify frame from uptransient to unvoiced

FIG. 64

| feature | value | | | | | | | | | |
|---|---|---|---|---|---|---|---|---|---|---|
| max. sample/ RMS energy | ≤14 | ≤14 | ≤14 | ≤14 | ≤14 | ≤14 | ≤14 | ≤14 | ≤14 | ≤14 |
| nacf_ap[2] | <0.50 | X | X | <0.75 | <0.75 | X | X | <0.80 | X | X |
| nacf_ap[3] | X | <0.75 | X | <0.85 | X | <0.75 | <0.85 | X | <0.90 | X |
| nacf_ap[4] | X | X | <0.75 | X | <0.85 | <0.85 | <0.75 | X | X | <0.90 |
| peak count | ≤5 | ≤5 | ≤5 | ≤5 | ≤5 | ≤5 | ≤5 | ≤4 | ≤4 | ≤4 |
| vER | <–6 | <–6 | <–6 | <–6 | <–6 | <–6 | <–6 | X | X | X |

reclassify frame from uptransient to unvoiced

FIG. 65

| feature | value | | | | | | | | | | |
|---|---|---|---|---|---|---|---|---|---|---|---|
| max. sample/ RMS energy | <16 | <24 | <24 | <24 | ≤14 | ≤14 | ≤14 | ≤14 | ≤14 | ≤14 | ≤14 |
| nacf_ap[0] | X | X | X | X | X | X | X | <0.85 | X | <0.85 | X |
| nacf_ap[1] | X | X | X | X | X | X | X | X | <0.65 | X | <0.65 |
| nacf_ap[2] | <0.45 | <0.45 | <0.45 | <0.45 | <0.75 | X | X | <0.85 | <0.85 | <0.85 | <0.85 |
| nacf_ap[3] | <0.45 | <0.25 | <0.10 | <0.55 | X | <0.75 | X | <0.75 | <0.75 | X | X |
| nacf_ap[4] | <0.45 | <0.25 | <0.55 | <0.10 | X | X | <0.75 | X | X | <0.75 | <0.75 |
| peak count | X | X | X | X | ≤4 | ≤4 | ≤4 | X | X | X | X |
| vER | <–10 | <–10 | <–10 | <–10 | <–6 | <–6 | <–6 | <–6 | <–6 | <–6 | <–6 |

reclassify frame from transient to unvoiced

FIG. 66

| feature | value | | | | | | | | | | |
|---|---|---|---|---|---|---|---|---|---|---|---|
| max. sample/ RMS energy | ≤14 | ≤14 | ≤14 | ≤14 | ≤14 | ≤14 | ≤14 | ≤14 | ≤14 | ≤14 | ≤14 |
| nacf_ap[0] | X | X | X | <0.85 | X | X | <0.85 | X | X | <0.85 | X |
| nacf_ap[1] | X | X | X | X | <0.65 | X | X | <0.65 | X | X | <0.65 |
| nacf_ap[2] | <0.35 | <0.50 | <0.50 | <0.50 | <0.50 | <0.75 | <0.75 | <0.75 | <0.75 | <0.75 | <0.75 |
| nacf_ap[3] | X | <0.35 | X | X | X | X | <0.85 | <0.85 | <0.35 | X | X |
| nacf_ap[4] | X | X | <0.35 | X | X | <0.35 | X | X | X | <0.85 | <0.85 |
| vER | <–6 | <–6 | <–6 | <–6 | <–6 | <–6 | <–6 | <–6 | <–6 | <–6 | <–6 |

reclassify frame from transient to unvoiced

FIG. 67

| feature | value | | | |
|---|---|---|---|---|
| nacf_ap[1] | <0.75 | X | X | X |
| nacf_ap[2] | X | <0.75 | X | X |
| nacf_ap[3] | X | X | <0.75 | X |
| nacf_ap[4] | X | X | X | <0.75 |
| vER | <–3 | <–3 | <–3 | <–3 |
| zcr | >80 | >80 | >80 | >80 |

reclassify frame from voiced to unvoiced

FIG. 68

| feature | value |
|---|---|
| prev_mode | V |
| bER | ≥–3 |
| vER | ≥–20 |
| max. sample/ RMS energy | >40 |

reclassify frame from down-transient to voiced

FIG. 71A

| feature | value |
|---|---|
| prev_mode | ≠ V |
| bER | ≥–3 |
| vER | ≥–20 |
| max. sample/ RMS energy | >40 |

reclassify frame from down-transient to transient

FIG. 71B

| feature | value | | | | | | |
|---|---|---|---|---|---|---|---|
| prev_mode | S | UN | DOWN | S | UN | DOWN | UN |
| nacf_ap[3] | >0.60 | X | X | X | X | X | X |
| nacf_ap[4] | >0.60 | X | X | X | X | X | X |
| bER | ≥–2 | ≥–2 | ≥–2 | ≥–2 | ≥–2 | ≥–2 | ≥–4 |
| vER | ≥–8 | ≥–8 | ≥–8 | ≥–8 | ≥–8 | ≥–8 | ≥–10 |
| zcr | ≤65 | ≤65 | ≤65 | X | X | X | X |
| max. sample/ RMS energy | >25 | >25 | >25 | >60 | >40 | >40 | >35 |

reclassify frame from unvoiced to up-transient

FIG. 69

| feature | value | | | | | | | | |
|---|---|---|---|---|---|---|---|---|---|
| prev_mode | V | TR | UP | V | TR | UP | V | V | TR |
| nacf_ap[0] | X | X | X | X | X | X | >0.85 | X | X |
| nacf_ap[1] | X | X | X | X | X | X | >0.70 | X | X |
| bER | ≥–2 | ≥–2 | ≥–2 | ≥–2 | ≥–2 | ≥–2 | ≥3 | ≥–4 | ≥–4 |
| vER | ≥–8 | ≥–8 | ≥–8 | ≥–8 | ≥–8 | ≥–8 | ≥–12 | ≥–10 | ≥–10 |
| zcr | ≤65 | ≤65 | ≤65 | X | X | X | ≤65 | X | X |
| max. sample/ RMS energy | >25 | >25 | >25 | >40 | >40 | >40 | >40 | >35 | >35 |

reclassify frame from unvoiced to transient

FIG. 70

```
if (
 (mode == VOICED || mode == TRANSIENT) &&
 number_of_pulses > 1 &&
 abs(mod_lag - orig_lag) <= (int)(0.10*mod_lag+0.5) &&
 fabs(pdelay_transient_coding-orig_lag) <= 0.20*pdelay_transient_coding &&
 energy/prev_energy < 40 &&
 NEED_TRANSIENT_CODING_ON_NEXT_FRAME == 0 &&
 (prev_mode != UP_TRANSIENT || (prev_mode == UP_TRANSIENT && PREV_TRANSIENT_FRAME_E ==
1)) &&
 prev_mode != DOWN_TRANSIENT &&
 (PREV_TRANSIENT_FRAME_E==0 || (PREV_TRANSIENT_FRAME_E == 1 && pdelay_transient_coding
!= 127)) &&
 (int)loc[0]/mod_lag == number_of_pulses – 1 ) {
QUIT TRANSIENT_CODING;
}

else if (
 pitch_doubling_error_detected == 1 &&
 (mode == 3 || mode == 4) &&
 number_of_pulses > 1 &&
 abs(mod_lag - (orig_lag/2)) <= (int)(0.05*mod_lag+0.5) &&
 fabs(pdelay_transient_coding-(orig_lag/2)) <= 0.15*pdelay_transient_coding &&
 energy/prev_energy < 40 &&
 NEED_TRANSIENT_CODING_ON_NEXT_FRAME == 0 &&
 (prev_mode != UP_TRANSIENT || (prev_mode == UP_TRANSIENT && PREV_TRANSIENT_FRAME_E ==
1)) &&
 prev_mode != DOWN_TRANSIENT &&
 (PREV_TRANSIENT_FRAME_E==0 || (PREV_TRANSIENT_FRAME_E == 1 && pdelay_transient_coding
!= 127))) {
QUIT TRANSIENT_CODING;
}
```

FIG. 76

| feature | value | | | |
|---|---|---|---|---|
| curr_mode | V or T | | | |
| number_of_pulses | >1 | | | |
| fully_voiced | TRUE | | X | |
| pitch_doubling | X | | TRUE | |
| delta_lag_intra | ≤T1A | | ≤T1B | |
| delta_lag_inter | ≤T2A | | ≤T2B | |
| E/Eprev | <T3 | | | |
| NEED_TRANS | FALSE | | | |
| prev_mode | ≠ DOWN | ≠ DOWN, ≠ ONSET | ≠ DOWN | ≠ DOWN, ≠ ONSET |
| prev_no_of_pulses | >1 | X | >1 | X |
| TRANS_USED | TRUE | FALSE | TRUE | FALSE |

FIG. 77

FIG. 84B
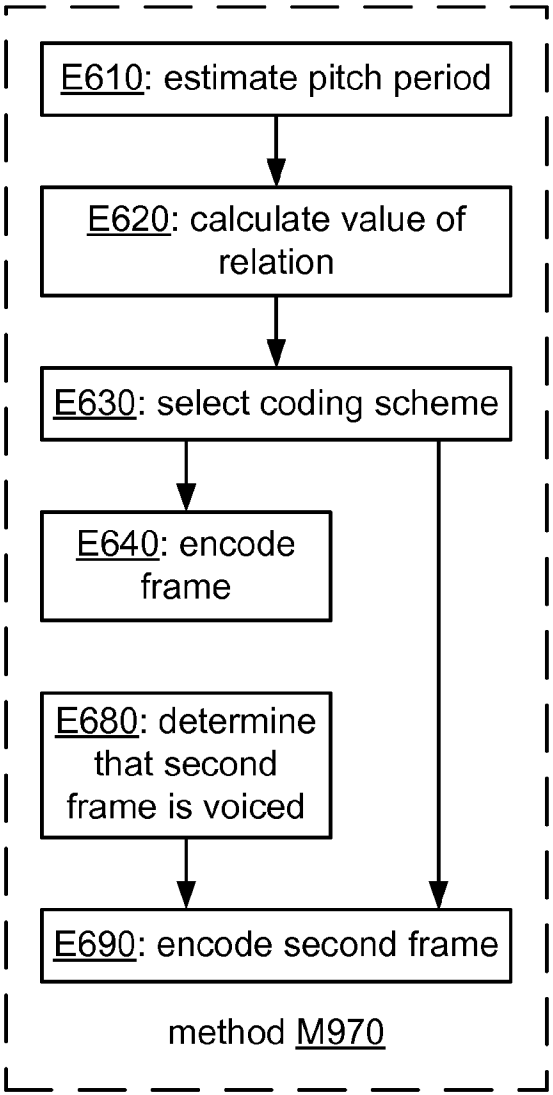
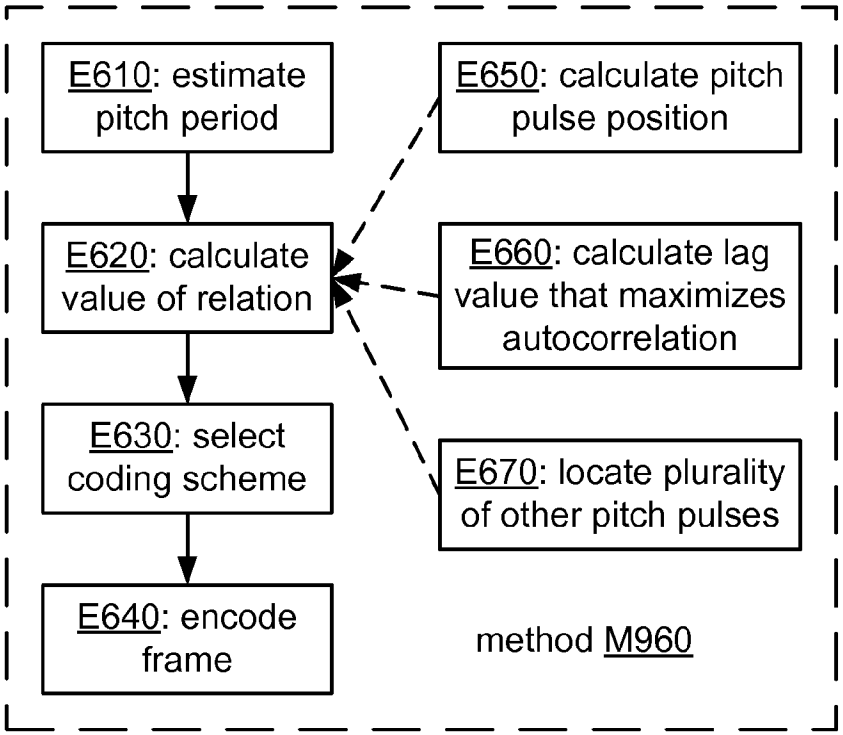
FIG. 84A

CODING SCHEME SELECTION FOR LOW-BIT-RATE APPLICATIONS

CLAIM OF PRIORITY UNDER 35 U.S.C. §120

The present Application for Patent is a continuation-in-part of patent application Ser. No. 12/261,518 entitled "CODING OF TRANSITIONAL SPEECH FRAMES FOR LOW-BIT-RATE-APPLICATIONS," filed Oct. 30, 2008, 2008, pending, and assigned to the assignee, which is a continuation-in-part of patent application Ser. No. 12/143,719 entitled "CODING OF TRANSITIONAL SPEECH FRAMES FOR LOW-BIT-RATE APPLICATIONS," filed Jun. 20, 2008.

FIELD

This disclosure relates to processing of speech signals.

BACKGROUND

Transmission of audio signals, such as voice and music, by digital techniques has become widespread, particularly in long distance telephony, packet-switched telephony such as Voice over IP (also called VoIP, where IP denotes Internet Protocol), and digital radio telephony such as cellular telephony. Such proliferation has created interest in reducing the amount of information used to transfer a voice communication over a transmission channel while maintaining the perceived quality of the reconstructed speech. For example, it is desirable to make the best use of available wireless system bandwidth. One way to use system bandwidth efficiently is to employ signal compression techniques. For wireless systems which carry speech signals, speech compression (or "speech coding") techniques are commonly employed for this purpose.

Devices that are configured to compress speech by extracting parameters that relate to a model of human speech generation are often called vocoders, "audio coders," or "speech coders." (These three terms are used interchangeably herein.) A speech coder generally includes an encoder and a decoder. The encoder typically divides the incoming speech signal (a digital signal representing audio information) into segments of time called "frames," analyzes each frame to extract certain relevant parameters, and quantizes the parameters into an encoded frame. The encoded frames are transmitted over a transmission channel (i.e., a wired or wireless network connection) to a receiver that includes a decoder. The decoder receives and processes encoded frames, dequantizes them to produce the parameters, and recreates speech frames using the dequantized parameters.

In a typical conversation, each speaker is silent for about sixty percent of the time. Speech encoders are usually configured to distinguish frames of the speech signal that contain speech ("active frames") from frames of the speech signal that contain only silence or background noise ("inactive frames"). Such an encoder may be configured to use different coding modes and/or rates to encode active and inactive frames. For example, speech encoders are typically configured to use fewer bits to encode an inactive frame than to encode an active frame. A speech coder may use a lower bit rate for inactive frames to support transfer of the speech signal at a lower average bit rate with little to no perceived loss of quality.

Examples of bit rates used to encode active frames include 171 bits per frame, eighty bits per frame, and forty bits per frame. Examples of bit rates used to encode inactive frames include sixteen bits per frame. In the context of cellular telephony systems (especially systems that are compliant with Interim Standard (IS)-95 as promulgated by the Telecommunications Industry Association, Arlington, Va., or a similar industry standard), these four bit rates are also referred to as "full rate," "half rate," "quarter rate," and "eighth rate," respectively.

SUMMARY

A method of encoding a speech signal frame according to one configuration includes calculating a peak energy of a residual of the frame and calculating an average energy of the residual. This method includes selecting, based on a relation between the calculated peak energy and the calculated average energy, one from the set of (A) a noise-excited coding scheme and (B) a nondifferential pitch prototype coding scheme, and encoding the frame according to the selected coding scheme. In this method, encoding the frame according to the nondifferential pitch prototype coding scheme includes producing an encoded frame that includes representations of a time-domain shape of a pitch pulse of the frame, a position of a pitch pulse of the frame, and a estimated pitch period of the frame.

A method of encoding a speech signal frame according to another configuration includes estimating a pitch period of the frame and calculating a value of a relation between (A) a first value that is based on the estimated pitch period and (B) a second value that is based on another parameter of the frame. This method includes selecting, based on the calculated value, one from the set of (A) a noise-excited coding scheme and (B) a nondifferential pitch prototype coding scheme, and encoding the frame according to the selected coding scheme. In this method, encoding the frame according to the nondifferential pitch prototype coding scheme includes producing an encoded frame that includes representations of a time-domain shape of a pitch pulse of the frame, a position of a pitch pulse of the frame, and the estimated pitch period.

Apparatus and other means configured to perform such methods, and computer-readable media having instructions which when executed by a processor cause the processor to execute the elements of such methods, are also expressly contemplated and disclosed herein.

BRIEF DESCRIPTION OF THE DRAWINGS

FIG. 19A shows a table of test conditions for task L214.

FIGS. 19B and 19C illustrate search operations of iterations of task L222.

FIG. 26 shows a table of bit allocations for various coding schemes of an implementation of speech encoder AE10.

FIG. 51 shows a list of features used in a frame classification scheme.

FIGS. 55-56, 57-59, and 60-63 show code listings for three different procedures of a frame classification scheme.

FIGS. 64-71B show conditions for frame reclassification.

FIG. 76 shows a code listing.

FIG. 77 shows four different conditions for canceling a decision to use transitional frame coding.

FIG. 82A shows a block diagram of an apparatus A900 according to a general configuration.

FIG. 82B shows a block diagram of an implementation A910 of apparatus A900.

FIG. 83A shows a block diagram of an implementation A920 of apparatus A900.

FIG. 83B shows a flowchart of a method M950 according to a general configuration.

FIG. 84A shows a flowchart of an implementation M960 of method M950.

FIG. 84B shows a flowchart of an implementation M970 of method M950.

FIG. 85A shows a block diagram of an apparatus MF950 according to a general configuration.

FIG. 85B shows a block diagram of an implementation MF960 of apparatus MF950.

FIG. 86A shows a block diagram of an implementation MF970 of apparatus MF950.

FIG. 86B shows a block diagram of an apparatus A950 according to a general configuration.

FIG. 87A shows a block diagram of an implementation A960 of apparatus A950.

FIG. 87B shows a block diagram of an implementation A970 of apparatus A950.

Figure 1:
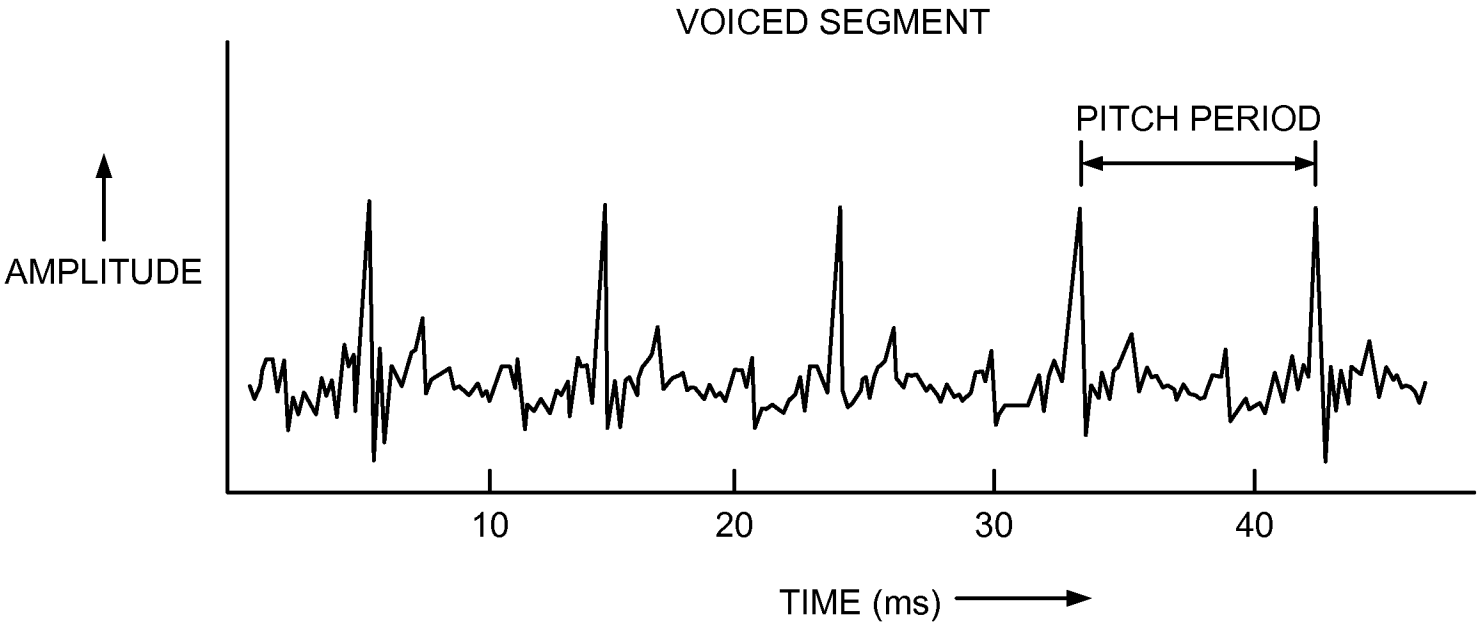
FIG. 1 shows an example of a voiced segment of a speech signal.

A reference label may appear in more than one figure to indicate the same structure.

DETAILED DESCRIPTION

Systems, methods, and apparatus as described herein (e.g., methods M100, M200, M300, M400, M500, M550, M560, M600, M650, M700, M800, M900, and/or M950) may be used to support speech coding at a low constant bit rate, or at a low maximum bit rate, such as two kilobits per second. Applications for such constrained-bit-rate speech coding include the transmission of voice telephony over satellite links (also called "voice over satellite"), which may be used to support telephone service in remote areas that lack the communications infrastructure for cellular or wireline telephony. Satellite telephony may also be used to support continuous wide-area coverage for mobile receivers such as vehicle fleets, enabling services such as push-to-talk. More generally, applications for such constrained-bit-rate speech coding are not limited to applications that involve satellites and may extend to any power-limited channel.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, generating, and/or selecting from a set of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "estimating" is used to indicate any of its ordinary meanings, such as computing and/or evaluating. Where the term "comprising" or "including" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). Any incorporation by reference of a portion of a document shall also be understood to incorporate definitions of terms or variables that are referenced within the portion, where such definitions appear elsewhere in the document.

Unless indicated otherwise, any disclosure of a speech encoder having a particular feature is also expressly intended to disclose a method of speech encoding having an analogous feature (and vice versa), and any disclosure of a speech encoder according to a particular configuration is also expressly intended to disclose a method of speech encoding according to an analogous configuration (and vice versa). Unless indicated otherwise, any disclosure of an apparatus for performing operations on frames of a speech signal is also expressly intended to disclose a corresponding method for performing operations on frames of a speech signal (and vice versa. Unless indicated otherwise, any disclosure of a speech decoder having a particular feature is also expressly intended to disclose a method of speech decoding having an analogous feature (and vice versa), and any disclosure of a speech decoder according to a particular configuration is also expressly intended to disclose a method of speech decoding according to an analogous configuration (and vice versa). The terms "coder," "codec," and "coding system" are used interchangeably to denote a system that includes at least one encoder configured to receive a frame of a speech signal (possibly after one or more pre-processing operations, such as a perceptual weighting and/or other filtering operation) and a corresponding decoder configured to produce a decoded representation of the frame.

For speech coding purposes, a speech signal is typically digitized (or quantized) to obtain a stream of samples. The digitization process may be performed in accordance with any of various methods known in the art including, for example, pulse code modulation (PCM), companded mu-law PCM, and companded A-law PCM. Narrowband speech encoders typically use a sampling rate of 8 kHz, while wideband speech encoders typically use a higher sampling rate (e.g., 12 or 16 kHz).

A speech encoder is configured to process the digitized speech signal as a series of frames. This series is usually implemented as a nonoverlapping series, although an operation of processing a frame or a segment of a frame (also called a subframe) may also include segments of one or more neighboring frames in its input. The frames of a speech signal are typically short enough that the spectral envelope of the signal may be expected to remain relatively stationary over the frame. A frame typically corresponds to between five and thirty-five milliseconds of the speech signal (or about forty to 200 samples), with ten, twenty, and thirty milliseconds being common frame sizes. The actual size of the encoded frame may change from frame to frame with the coding bit rate.

A frame length of twenty milliseconds corresponds to 140 samples at a sampling rate of seven kilohertz (kHz), 160 samples at a sampling rate of eight kHz, and 320 samples at a sampling rate of 16 kHz, although any sampling rate deemed suitable for the particular application may be used. Another example of a sampling rate that may be used for speech coding is 12.8 kHz, and further examples include other rates in the range of from 12.8 kHz to 38.4 kHz.

Typically all frames have the same length, and a uniform frame length is assumed in the particular examples described herein. However, it is also expressly contemplated and hereby disclosed that nonuniform frame lengths may be used. For example, implementations of the various apparatus and methods described herein may also be used in applications that employ different frame lengths for active and inactive frames and/or for voiced and unvoiced frames.

As noted above, it may be desirable to configure a speech encoder to use different coding modes and/or rates to encode active frames and inactive frames. In order to distinguish active frames from inactive frames, a speech encoder typically includes a speech activity detector (commonly called a voice activity detector or VAD) or otherwise performs a method of detecting speech activity. Such a detector or method may be configured to classify a frame as active or inactive based on one or more factors such as frame energy, signal-to-noise ratio, periodicity, and zero-crossing rate. Such classification may include comparing a value or magnitude of such a factor to a threshold value and/or comparing the magnitude of a change in such a factor to a threshold value.

A speech activity detector or method of detecting speech activity may also be configured to classify an active frame as one of two or more different types, such as voiced (e.g., representing a vowel sound), unvoiced (e.g., representing a fricative sound), or transitional (e.g., representing the beginning or end of a word). Such classification may be based on factors such as autocorrelation of speech and/or residual, zero crossing rate, first reflection coefficient, and/or other features as described in more detail herein (e.g., with respect to coding scheme selector C200 and/or frame reclassifier RC10). It may be desirable for a speech encoder to use different coding modes and/or bit rates to encode different types of active frames.

Frames of voiced speech tend to have a periodic structure that is long-term (i.e., that continues for more than one frame period) and is related to pitch. It is typically more efficient to encode a voiced frame (or a sequence of voiced frames) using a coding mode that encodes a description of this long-term spectral feature. Examples of such coding modes include code-excited linear prediction (CELP) and waveform interpolation techniques such as prototype waveform interpolation (PWI). One example of a PWI coding mode is called prototype pitch period (PPP). Unvoiced frames and inactive frames, on the other hand, usually lack any significant long-term spectral feature, and a speech encoder may be configured to encode these frames using a coding mode that does not attempt to describe such a feature. Noise-excited linear prediction (NELP) is one example of such a coding mode.

A speech encoder or method of speech encoding may be configured to select among different combinations of bit rates and coding modes (also called "coding schemes"). For example, a speech encoder may be configured to use a full-rate CELP scheme for frames containing voiced speech and transitional frames, a half-rate NELP scheme for frames containing unvoiced speech, and an eighth-rate NELP scheme for inactive frames. Other examples of such a speech encoder support multiple coding rates for one or more coding schemes, such as full-rate and half-rate CELP schemes and/or full-rate and quarter-rate PPP schemes.

An encoded frame as produced by a speech encoder or a method of speech encoding typically contains values from which a corresponding frame of the speech signal may be reconstructed. For example, an encoded frame may include a description of the distribution of energy within the frame over a frequency spectrum. Such a distribution of energy is also called a "frequency envelope" or "spectral envelope" of the frame. An encoded frame typically includes an ordered sequence of values that describes a spectral envelope of the frame. In some cases, each value of the ordered sequence indicates an amplitude or magnitude of the signal at a corresponding frequency or over a corresponding spectral region. One example of such a description is an ordered sequence of Fourier transform coefficients.

In other cases, the ordered sequence includes values of parameters of a coding model. One typical example of such an ordered sequence is a set of values of coefficients of a linear prediction coding (LPC) analysis. These LPC coefficient values encode the resonances of the encoded speech (also called "formants") and may be configured as filter coefficients or as reflection coefficients. The encoding portion of most modem speech coders includes an analysis filter that extracts a set of LPC coefficient values for each frame. The number of coefficient values in the set (which is usually arranged as one or more vectors) is also called the "order" of the LPC analysis. Examples of a typical order of an LPC analysis as performed by a speech encoder of a communications device (such as a cellular telephone) include four, six, eight, ten, 12, 16, 20, 24, 28, and 32.

A speech coder is typically configured to transmit the description of a spectral envelope across a transmission channel in quantized form (e.g., as one or more indices into corresponding lookup tables or "codebooks"). Accordingly, it may be desirable for a speech encoder to calculate a set of LPC coefficient values in a form that may be quantized efficiently, such as a set of values of line spectral pairs (LSPs), line spectral frequencies (LSFs), immittance spectral pairs (ISPs), immittance spectral frequencies (ISFs), cepstral coefficients, or log area ratios. A speech encoder may also be configured to perform other operations, such as perceptual weighting, on the ordered sequence of values before conversion and/or quantization.

In some cases, a description of a spectral envelope of a frame also includes a description of temporal information of the frame (e.g., as in an ordered sequence of Fourier transform coefficients). In other cases, the set of speech parameters of an encoded frame may also include a description of temporal information of the frame. The form of the description of temporal information may depend on the particular coding mode used to encode the frame. For some coding modes (e.g., for a CELP coding mode), the description of temporal information includes a description of a residual of the LPC analysis (also called a description of an excitation signal). A corresponding speech decoder uses the excitation signal to excite an LPC model (e.g., as defined by the description of the spectral envelope). A description of an excitation signal typically appears in an encoded frame in quantized form (e.g., as one or more indices into corresponding codebooks).

The description of temporal information may also include information relating to a pitch component of the excitation signal. For a PPP coding mode, for example, the encoded temporal information may include a description of a prototype to be used by a speech decoder to reproduce a pitch component of the excitation signal. A description of information relating to a pitch component typically appears in an encoded frame in quantized form (e.g., as one or more indices into corresponding codebooks). For other coding modes (e.g., for a NELP coding mode), the description of temporal information may include a description of a temporal envelope of the frame (also called an "energy envelope" or "gain envelope" of the frame).

Figure 2A:
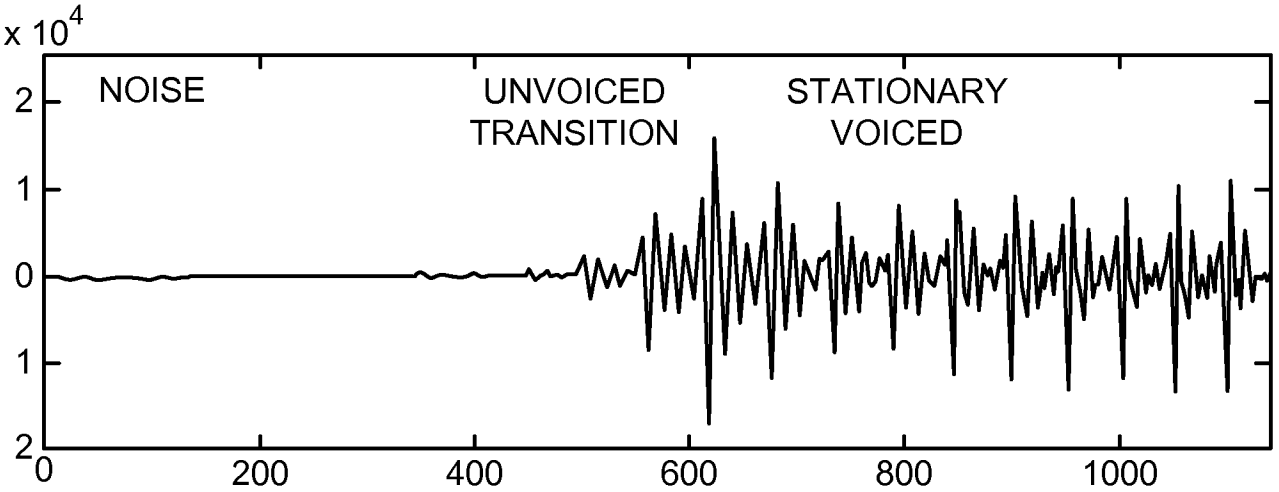
FIG. 2A shows an example of amplitude over time for a speech segment.
Figure 2B:
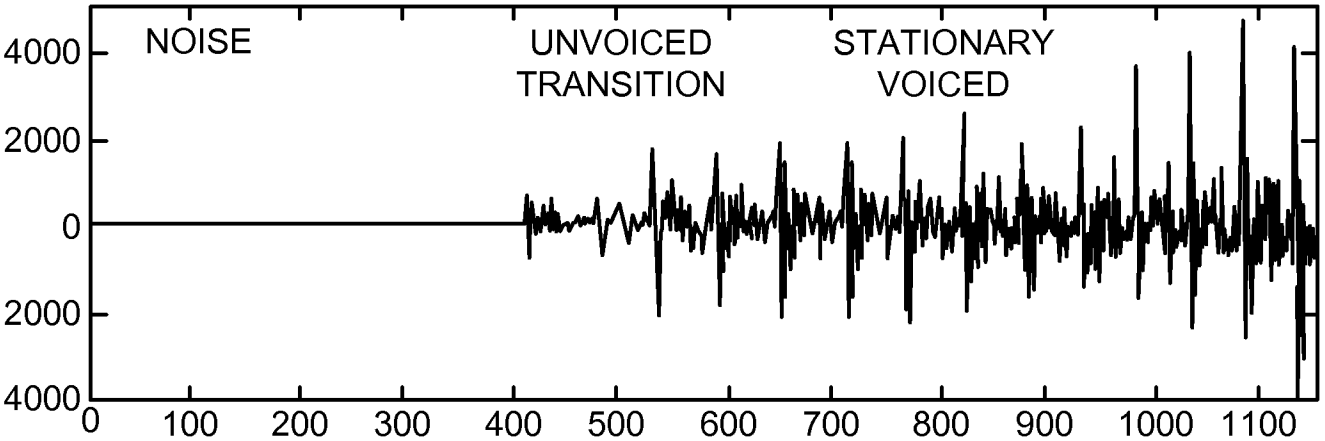
FIG. 2B shows an example of amplitude over time for an LPC residual.

FIG. 1 shows one example of the amplitude of a voiced speech segment (such as a vowel) over time. For a voiced frame, the excitation signal typically resembles a series of pulses that is periodic at the pitch frequency, while for an unvoiced frame the excitation signal is typically similar to white Gaussian noise. A CELP or PWI coder may exploit the higher periodicity that is characteristic of voiced speech segments to achieve better coding efficiency. FIG. 2A shows an example of amplitude over time for a speech segment that transitions from background noise to voiced speech, and FIG. 2B shows an example of amplitude over time for an LPC residual of a speech segment that transitions from background noise to voiced speech. As coding of the LPC residual occupies much of the encoded signal stream, various schemes have been developed to reduce the bit rate needed to code the residual. Such schemes include CELP, NELP, PWI, and PPP.

It may be desirable to perform constrained-bit-rate encoding of a speech signal at a low bit rate (e.g., two kilobits per second) in a manner that provides a toll-quality decoded signal. Toll quality is typically characterized as having a bandwidth of approximately 200-3200 Hz and a signal-to-noise ratio (SNR) greater than 30 dB. In some cases, toll quality is also characterized as having less than two or three percent harmonic distortion. Unfortunately, existing techniques for encoding speech at bit rates near two kilobits per second typically produce synthesized speech that sounds artificial (e.g., robotic), noisy, and/or overly harmonic (e.g., buzzy).

High-quality encoding of nonvoiced frames, such as silence and unvoiced frames, can usually be performed at low bit rates using a noise-excited linear prediction (NELP) coding mode. However, it may be more difficult to perform high-quality encoding of voiced frames at a low bit rate. Good results have been obtained by using a higher bit rate for difficult frames, such as frames that include transitions from unvoiced to voiced speech (also called onset frames or up-transient frames), and a lower bit rate for subsequent voiced frames, to achieve a low average bit rate. For a constrained-bit-rate vocoder, however, the option of using a higher bit rate for difficult frames may not be available.

Existing variable-rate vocoders such as Enhanced Variable Rate Codec (EVRC) typically encode such difficult frames using a waveform coding mode such as CELP at a higher bit rate. Other coding schemes that may be used for storage or transmission of voiced speech segments at low bit rates include PWI coding schemes, such as PPP coding schemes. Such PWI coding schemes periodically locate a prototype waveform having a length of one pitch period in the residual signal. At the decoder, the residual signal is interpolated over the pitch periods between the prototypes to obtain an approximation of the original highly periodic residual signal. Some applications of PPP coding use mixed bit rates, such that a high-bit-rate encoded frame provides a reference for one or more subsequent low-bit-rate encoded frames. In such case, at least some of the information in the low-bit-rate frames may be differentially encoded.

It may be desirable to encode a transitional frame, such as an onset frame, in a non-differential manner that provides a good prototype (i.e., a good pitch pulse shape reference) and/or pitch pulse phase reference for differential PWI (e.g., PPP) encoding of subsequent frames in the sequence.

It may be desirable to provide a coding mode for onset frames and/or other transitional frames in a bit-rate-constrained coding system. For example, it may be desirable to provide such a coding mode in a coding system that is constrained to have a low constant bit rate or a low maximum bit rate. A typical example of an application for such a coding system is a satellite communications link (e.g., as described herein with reference to FIG. 14).

As discussed above, a frame of a speech signal may be classified as voiced, unvoiced, or silence. Voiced frames are typically highly periodic, while unvoiced and silence frames are typically aperiodic. Other possible frame classifications include onset, transient, and down-transient. Onset frames (also called up-transient frames) typically occur at the beginnings of words. An onset frame may be aperiodic (e.g., unvoiced) at the start of the frame and become periodic (e.g., voiced) by the end of the frame, as in the region between 400 and 600 samples in FIG. 2B. The transient class includes frames that have voiced but less periodic speech. Transient frames exhibit changes in pitch and/or reduced periodicity and typically occur at the middle or end of a voiced segment (e.g., where the pitch of the speech signal is changing). A typical down-transient frame has low-energy voiced speech and occurs at the end of a word. Onset, transient, and down-transient frames may also be referred to as "transitional" frames.

It may be desirable for a speech encoder to encode locations, amplitudes, and shapes of pulses in a nondifferential manner. For example, it may be desirable to encode an onset frame, or the first of a series of voiced frames, such that the encoded frame provides a good reference prototype for excitation signals of subsequent encoded frames. Such an encoder may be configured to locate the final pitch pulse of the frame, to locate a pitch pulse adjacent to the final pitch pulse, to estimate the lag value according to the distance between the peaks of the pitch pulses, and to produce an encoded frame that indicates the location of the final pitch pulse and the estimated lag value. This information may be used as a phase reference in decoding a subsequent frame that has been encoded without phase information. The encoder may also be configured to produce the encoded frame to include an indication of the shape of a pitch pulse, which may be used as a reference in decoding a subsequent frame that has been differentially encoded (e.g., using a QPPP coding scheme).

In coding a transitional frame (e.g., an onset frame), it may be more important to provide a good reference for subsequent frames than to achieve an accurate reproduction of the frame. Such an encoded frame may be used to provide a good reference for subsequent voiced frames that are encoded using PPP or other encoding schemes. For example, it may be desirable for the encoded frame to include a description of a shape of a pitch pulse (e.g., to provide a good shape reference), an indication of the pitch lag (e.g., to provide a good lag reference), and an indication of the location of the final pitch pulse of the frame (e.g., to provide a good phase reference), while other features of the onset frame may be encoded using fewer bits or even ignored.

Figure 3B:
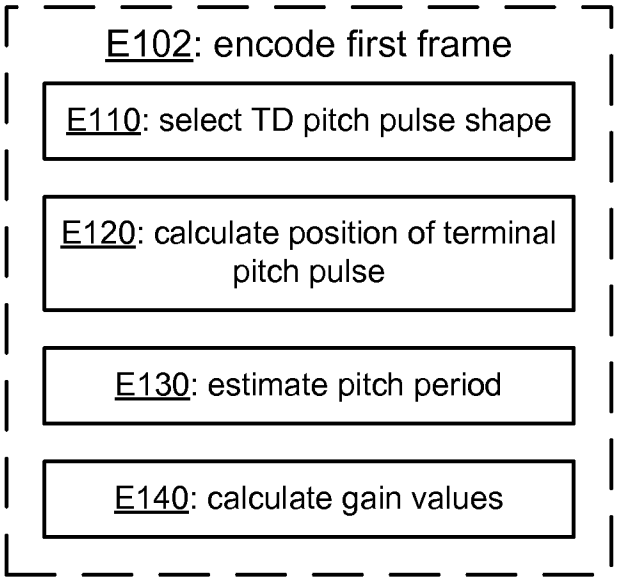
FIG. 3B shows a flowchart of an implementation E102 of encoding task E100.
Figure 3A:
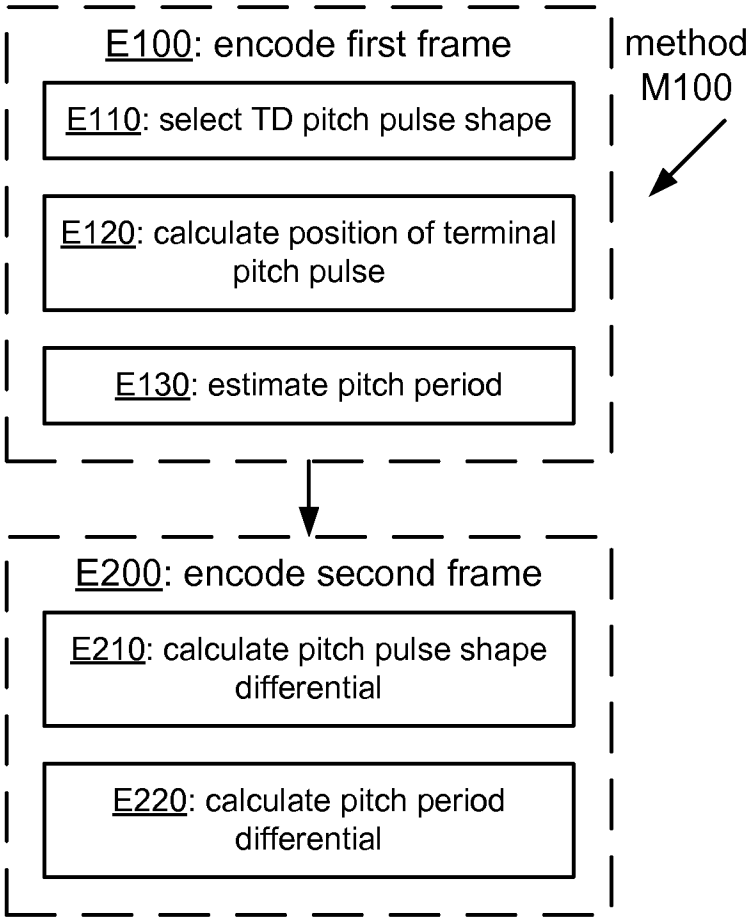
FIG. 3A shows a flowchart of a method of speech encoding M100 according to a general configuration.

FIG. 3A shows a flowchart of a method of speech encoding M100 according to a configuration that includes encoding tasks E100 and E200. Task E100 encodes a first frame of a speech signal, and task E200 encodes a second frame of the speech signal, where the second frame follows the first frame. Task E100 may be implemented as a reference coding mode that encodes the first frame nondifferentially, and task E200 may be implemented as a relative coding mode (e.g., a differential coding mode) that encodes the second frame relative to the first frame. In one example, the first frame is an onset frame and the second frame is a voiced frame that immediately follows the onset frame. The second frame may also be the first of a series of consecutive voiced frames that immediately follows the onset frame.

Encoding task E100 produces a first encoded frame that includes a description of an excitation signal. This description includes a set of values that indicate the shape of a pitch pulse (i.e., a pitch prototype) in the time domain and the locations at which the pitch pulse is repeated. The pitch pulse locations are indicated by encoding the lag value along with a reference point, such as the position of a terminal pitch pulse of the frame. In this description, the position of a pitch pulse is indicated using the position of its peak, although the scope of this disclosure expressly includes contexts in which the position of a pitch pulse is equivalently indicated by the position of another feature of the pulse, such as its first or last sample. The first encoded frame may also include representations of other information, such as a description of a spectral envelope of the frame (e.g., one or more LSP indices). Task E100 may be configured to produce the encoded frame as a packet that conforms to a template. For example, task E100 may include an instance of packet generation task E320, E340, and/or E440 as described herein.

Task E100 includes a subtask E110 that selects one among a set of time-domain pitch pulse shapes, based on information from at least one pitch pulse of the first frame. Task E110 may be configured to select the shape that most closely matches (e.g., in a least-squares sense) the pitch pulse having the highest peak in the frame. Alternatively, task E110 may be configured to select the shape that most closely matches the pitch pulse having the highest energy (e.g., the highest sum of squared sample values) in the frame. Alternatively, task E110 may be configured to select the shape that most closely matches an average of two or more pitch pulses of the frame (e.g., the pulses having the highest peaks and/or energies). Task E110 may be implemented to include a search through a codebook (i.e., a quantization table) of pitch pulse shapes (also called "shape vectors"). For example, task E110 may be implemented as an instance of pulse shape vector selection task T660 or E430 as described herein.

Encoding task T100 also includes a subtask E120 that calculates a position of a terminal pitch pulse of the frame (e.g., the position of the initial pitch peak of the frame or the final pitch peak of the frame). The position of the terminal pitch pulse may be indicated relative to the start of the frame, relative to the end of the frame, or relative to another reference location within the frame. Task E120 may be configured to find the terminal pitch pulse peak by selecting a sample near the frame boundary (e.g., based on a relation between the amplitude or energy of the sample and a frame average, where energy is typically calculated as the square of the sample value) and searching within an area next to this sample for the sample having the maximum value. For example, task E120 may be implemented according to any of the configurations of terminal pitch peak locating task L100 described below.

Encoding task E100 also includes a subtask E130 that estimates a pitch period of the frame. The pitch period (also called "pitch lag value," "lag value," "pitch lag," or simply "lag") indicates a distance between pitch pulses (i.e., a distance between the peaks of adjacent pitch pulses). Typical pitch frequencies range from about 70 to 100 Hz for a male speaker to about 150 to 200 Hz for a female speaker. For a sampling rate of 8 kHz, these pitch frequency ranges correspond to lag ranges of about 40 to 50 samples for a typical female speaker and about 90 to 100 samples for a typical male speaker. To accommodate speakers having pitch frequencies outside these ranges, it may be desirable to support a pitch frequency range of about 50 to 60 Hz to about 300 to 400 Hz. For a sampling rate of 8 kHz, this frequency range corresponds to a lag range of about 20 to 25 samples to about 130 to 160 samples.

Pitch period estimation task E130 may be implemented to estimate the pitch period using any suitable pitch estimation procedure (e.g., as an instance of an implementation of lag estimation task L200 as described below). Such a procedure typically includes finding a pitch peak that is adjacent to the terminal pitch peak (or otherwise finding at least two adjacent pitch peaks) and calculating the lag as the distance between the peaks. Task E130 may be configured to identify a sample as a pitch peak based on a measure of its energy (e.g., a ratio between sample energy and frame average energy) and/or a measure of how well a neighborhood of the sample is correlated with a similar neighborhood of a confirmed pitch peak (e.g., the terminal pitch peak).

Encoding task E100 produces a first encoded frame that includes representations of features of an excitation signal for the first frame, such as the time-domain pitch pulse shape selected by task E110, the terminal pitch pulse position calculated by task E120, and the lag value estimated by task E130. Typically task E100 will be configured to perform pitch pulse position calculation task E120 before pitch period estimation task E130, and to perform pitch period estimation task E130 before pitch pulse shape selection task E110.

The first encoded frame may include a value that indicates the estimated lag value directly. Alternatively, it may be desirable for the encoded frame to indicate the lag value as an offset relative to a minimum value. For a minimum lag value of twenty samples, for example, a seven-bit number may be used to indicate any possible integer lag value in the range of twenty to 147 (i.e., 20+0 to 20+127) samples. For a minimum lag value of 25 samples, a seven-bit number may be used to indicate any possible integer lag value in the range of 25 to 152 (i.e., 25+0 to 25+127) samples. In such manner, encoding the lag value as an offset relative to a minimum value may be used to maximize coverage of a range of expected lag values while minimizing the number of bits required to encode the range of values. Other examples may be configured to support encoding of non-integer lag values. It is also possible for the first encoded frame to include more than one value relating to pitch lag, such as a second lag value or a value that otherwise indicates a change in the lag value from one side of the frame (e.g., the beginning or end of the frame) to the other.

It is likely that the amplitudes of the pitch pulses of a frame will differ from one another. In an onset frame, for example, the energy may increase over time, such that a pitch pulse near the end of the frame will have a larger amplitude than a pitch pulse near the beginning of the frame. At least in such a case, it may be desirable for the first encoded frame to include a description of variation in the average energy of the frame over time (also called a "gain profile"), such as a description of the relative amplitudes of the pitch pulses.

Figure 4:
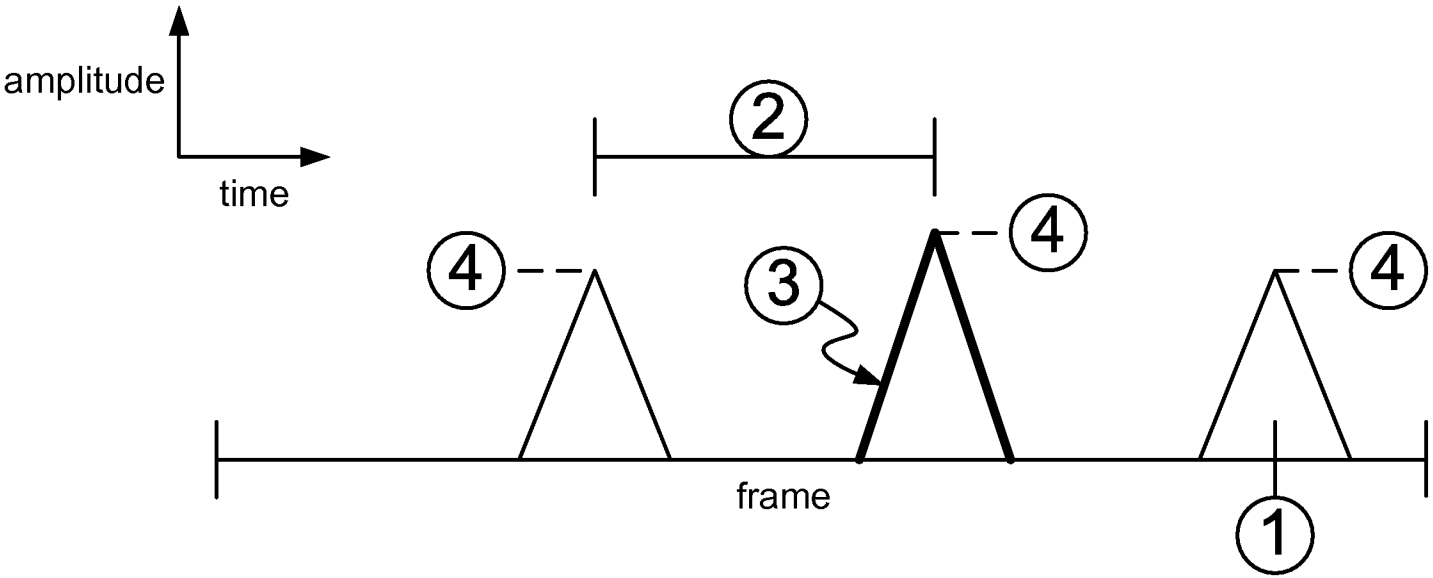
FIG. 4 shows a schematic representation of features in a frame.

FIG. 3B shows a flowchart of an implementation E102 of encoding task E100 that includes a subtask E140. Task E140 calculates a gain profile of the frame as a set of gain values that correspond to different pitch pulses of the first frame. For example, each of the gain values may correspond to a different pitch pulse of the frame. Task E140 may include a search through a codebook (e.g., a quantization table) of gain profiles and selection of the codebook entry that most closely matches (e.g., in a least-squares sense) a gain profile of the frame. Encoding task E102 produces a first encoded frame that includes representations of the time-domain pitch pulse shape selected by task E110, the terminal pitch pulse position calculated by task E120, the lag value estimated by task E130, and the set of gain values calculated by task E140. FIG. 4 shows a schematic representation of these features in a frame, where the label "1" indicates the terminal pitch pulse position, the label "2" indicates the estimated lag value, the label "3" indicates the selected time-domain pitch pulse shape, and the label "4" indicates the values encoded in the gain profile (e.g., the relative amplitudes of the pitch pulses). Typically task E102 will be configured to perform pitch period estimation task E130 before gain value calculation task E140, which may be performed in series with or in parallel to pitch pulse shape selection task E110. In one example (as shown in the table of FIG. 26), encoding task E102 operates at quarter-rate to produce a forty-bit encoded frame that includes seven bits indicating a reference pulse position, seven bits indicating a reference pulse shape, seven bits indicating a reference lag value, four bits indicating a gain profile, thirteen bits that carry one or more LSP indices, and two bits indicating the coding mode for the frame (e.g., "00" to indicate an unvoiced coding mode such as NELP, "01" to indicate a relative coding mode such as QPPP, and "10" to indicate the reference coding mode E102).

The first encoded frame may include an explicit indication of the number of pitch pulses (or pitch peaks) in the frame. Alternatively, the number of pitch pulses or pitch peaks in the frame may be encoded implicitly. For example, the first encoded frame may indicate the positions of all of the pitch pulses in the frame using only the pitch lag and the position of the terminal pitch pulse (e.g., the position of the terminal pitch peak). A corresponding decoder may be configured to calculate potential positions for the pitch pulses from the lag value and the position of the terminal pitch pulse and to obtain an amplitude for each potential pulse position from the gain profile. For a case in which the frame contains fewer pulses than potential pulse positions, the gain profile may indicate a gain value of zero (or other very small value) for one or more of the potential pulse positions.

As noted herein, an onset frame may begin as unvoiced and end as voiced. It may be more desirable for the corresponding encoded frame to provide a good reference for subsequent frames than to support an accurate reproduction of the entire onset frame, and method M100 may be implemented to provide only limited support for encoding the initial unvoiced portion of such an onset frame. For example, task E140 may be configured to select a gain profile that indicates a gain value of zero (or close to zero) for any pitch pulse periods within the unvoiced portion. Alternatively, task E140 may be configured to select a gain profile that indicates nonzero gain values for pitch periods within the unvoiced portion. In one such example, task E140 selects a generic gain profile that begins at or close to zero and rises monotonically to the gain level of the first pitch pulse of the voiced portion of the frame.

Task E140 may be configured to calculate the set of gain values as an index to one of a set of gain vector quantization (VQ) tables, with different gain VQ tables being used for different numbers of pulses. The set of tables may be configured such that each gain VQ table contains the same number of entries, and different gain VQ tables contain vectors of different lengths. In such a coding system, task E140 computes an estimated number of pitch pulses based on the location of the terminal pitch pulse and the pitch lag, and this estimated number is used to select one among the set of gain VQ tables. In this case, an analogous operation may also be performed by a corresponding method of decoding the encoded frame. If the estimated number of pitch pulses is greater than the actual number of pitch pulses in the frame, task E140 may also convey this information by setting the gain for each additional pitch pulse period in the frame to a small value or to zero as described above.

Encoding task E200 encodes a second frame of the speech signal that follows the first frame. Task E200 may be implemented as a relative coding mode (e.g., a differential coding mode) that encodes features of the second frame relative to corresponding features of the first frame. Task E200 includes a subtask E210 that calculates a pitch pulse shape differential between a pitch pulse shape of the current frame and a pitch pulse shape of a previous frame. For example, task E210 may be configured to extract a pitch prototype from the second frame and to calculate the pitch pulse shape differential as a difference between the extracted prototype and the pitch prototype of the first frame (i.e., the selected pitch pulse shape). Examples of prototype extraction operations that may be performed by task E210 include those described in U.S. Pat. No. 6,754,630 (Das et al.), issued Jun. 22, 2004, and U.S. Pat. No. 7,136,812 (Manjunath et al.), issued Nov. 14, 2006.

Figure 5B:
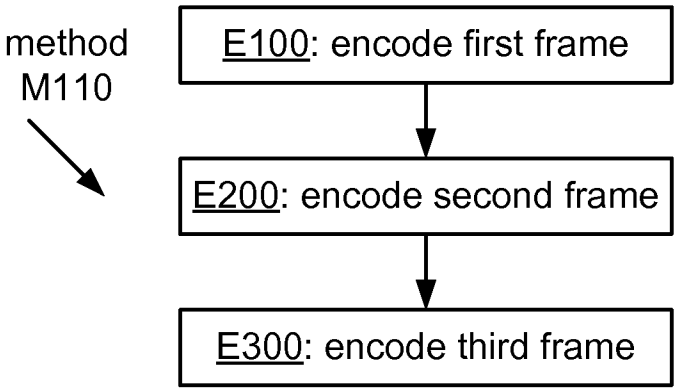
FIG. 5B shows a flowchart of an implementation M110 of method M100.

It may be desirable to configure task E210 to calculate the pitch pulse shape differential as a difference between the two prototypes in the frequency domain. FIG. 5A shows a diagram of an implementation E202 of encoding task E200 that includes an implementation E212 of pitch pulse shape differential calculation task E210. Task E212 includes a subtask E214 that calculates a frequency-domain pitch prototype of the current frame. For example, task E214 may be configured to perform a fast Fourier transform operation on the extracted prototype or to otherwise convert the extracted prototype to the frequency domain. Such an implementation of task E212 may also be configured to calculate the pitch pulse shape differential by dividing the frequency-domain prototype into a number of frequency bins (e.g., a set of nonoverlapping bins), calculating a corresponding frequency magnitude vector whose elements are the average magnitude in each bin, and calculating the pitch pulse shape differential as a vector difference between the frequency magnitude vector of the prototype and the frequency magnitude vector of the prototype of the previous frame. In such case, task E212 may also be configured to vector quantize the pitch pulse shape differential such that the corresponding encoded frame includes the quantized differential.

Encoding task E200 also includes a subtask E220 that calculates a pitch period differential between a pitch period of the current frame and a pitch period of a previous frame. For example, task E220 may be configured to estimate a pitch lag of the current frame and to subtract the pitch lag value of the previous frame to obtain the pitch period differential. In one such example, task E220 is configured to calculate the pitch period differential as (current lag estimate−previous lag estimate+7). To estimate the pitch lag, task E220 may be configured to use any suitable pitch estimation technique, such as an instance of pitch period estimation task E130 described above, an instance of lag estimation task L200 described below, or a procedure as described in section 4.6.3 (pp. 4-44 to 4-49) of the EVRC document C.S0014-C referenced above, which section is hereby incorporated by reference as an example. For a case in which the unquantized pitch lag value of the previous frame is different than the dequantized pitch lag value of the previous frame, it may be desirable for task E220 to calculate the pitch period differential by subtracting the dequantized value from the current lag estimate.

Encoding task E200 may be implemented using a coding scheme having limited time-synchrony, such as quarter-rate PPP (QPPP). An implementation of QPPP is described in sections 4.2.4 (pp. 4-10 to 4-17) and 4.12.28 (pp. 4-132 to 4-138) Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," January 2007 (available online at www-dot-3gpp-dot-org), which sections are hereby incorporated by reference as an example. This coding scheme calculates the frequency magnitude vector of a prototype using a nonuniform set of twenty-one frequency bins whose bandwidths increase with frequency. The forty bits of an encoded frame produced using QPPP include sixteen bits that carry one or more LSP indices, four bits that carry a delta lag value, eighteen bits that carry amplitude information for the frame, one bit to indicate mode, and one reserved bit (as shown in the table of FIG. 26). This example of a relative coding scheme includes no bits for pulse shape and no bits for phase information.

As noted above, the frame encoded in task E100 may be an onset frame, and the frame encoded in task E200 may be the first of a series of consecutive voiced frames that immediately follows the onset frame. FIG. 5B shows a flowchart of an implementation M110 of method M100 that includes a subtask E300. Task E300 encodes a third frame that follows the second frame. For example, the third frame may be the second in a series of consecutive voiced frames that immediately follows the onset frame. Encoding task E300 may be implemented as an instance of an implementation of task E200 as described herein (e.g., as an instance of QPPP encoding). In one such example, task E300 includes an instance of task E210 (e.g., of task E212) that is configured to calculate a pitch pulse shape differential between a pitch prototype of the third frame and a pitch prototype of the second frame, and an instance of task E220 that is configured to calculate a pitch period differential between a pitch period of the third frame and a pitch period of the second frame. In another such example, task E300 includes an instance of task E210 (e.g., of task E212) that is configured to calculate a pitch pulse shape differential between a pitch prototype of the third frame and the selected pitch pulse shape of the first frame, and an instance of task E220 that is configured to calculate a pitch period differential between a pitch period of the third frame and a pitch period of the first frame.

Figure 5C:
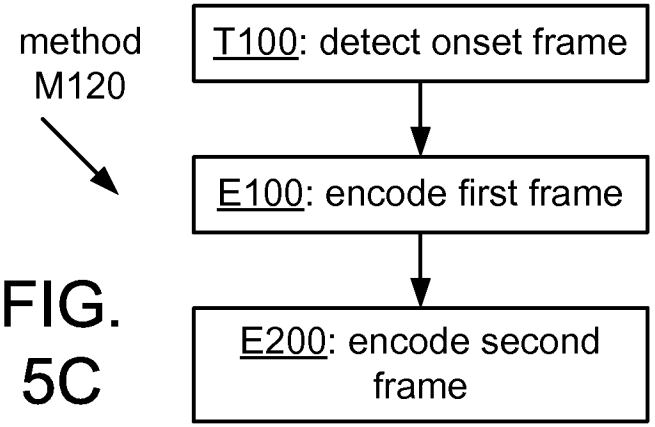
FIG. 5C shows a flowchart of an implementation M120 of method M100.
Figure 5A:
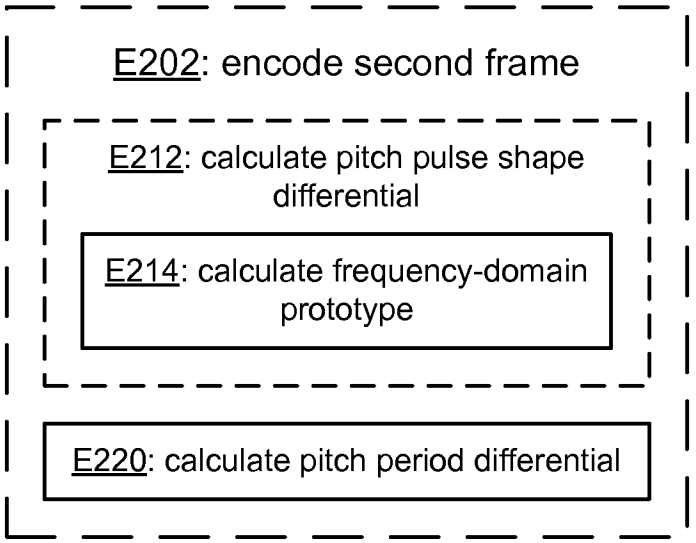
FIG. 5A shows a diagram of an implementation E202 of encoding task E200.

FIG. 5C shows a flowchart of an implementation M120 of method M100 that includes a subtask T100. Task T100 detects a frame that includes a transition from nonvoiced speech to voiced speech (also called an up-transient or onset frame). Task T100 may be configured to perform frame classification according to the EVRC classification scheme described below (e.g., with reference to coding scheme selector C200) and may also be configured to reclassify a frame (e.g., as described below with reference to frame reclassifier RC10).

Figure 6A:
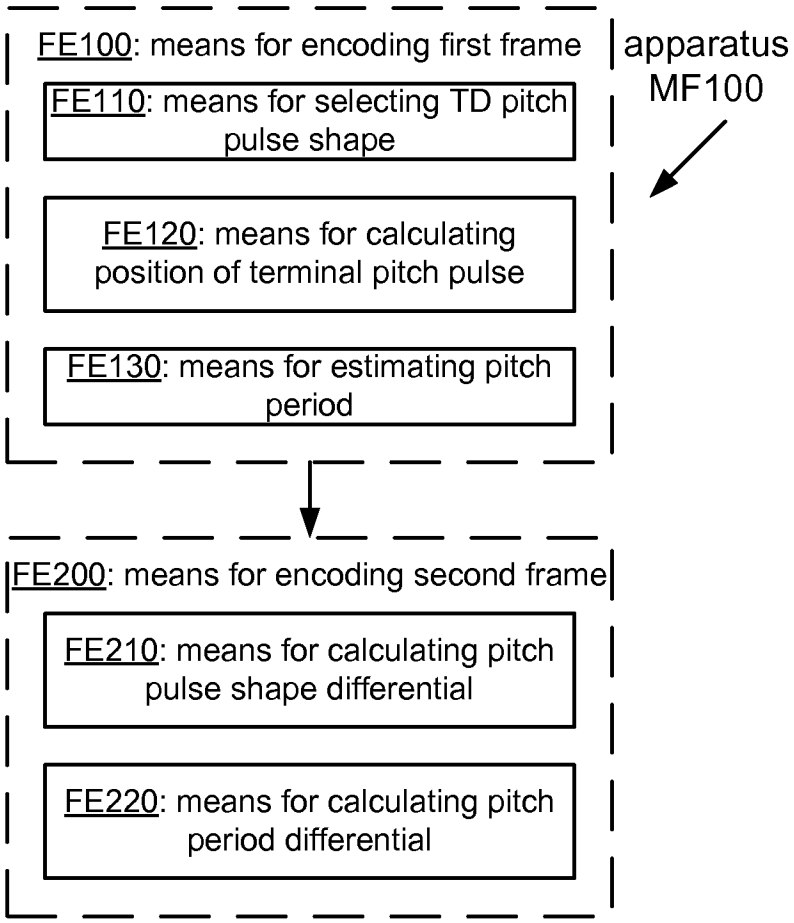
FIG. 6A shows a block diagram of an apparatus MF100 according to a general configuration.
Figure 6B:
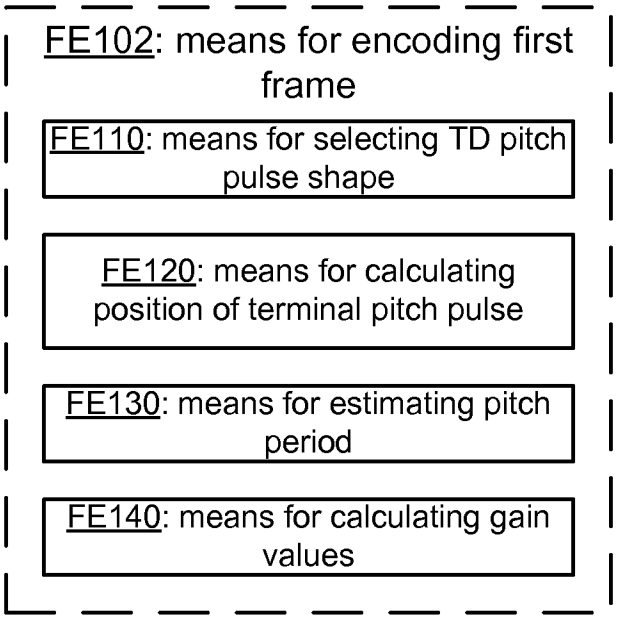
FIG. 6B shows a block diagram of an implementation FE102 of means FE100.

FIG. 6A shows a block diagram of an apparatus MF100 that is configured to encode frames of a speech signal. Apparatus MF100 includes means for encoding a first frame of the speech signal FE100 and means for encoding a second frame of the speech signal FE200, where the second frame follows the first frame. Means FE100 includes means FE110 for selecting one among a set of time-domain pitch pulse shapes based on information from at least one pitch pulse of the first frame (e.g., as described above with reference to various implementations of task E110). Means FE100 also includes means FE120 for calculating a position of a terminal pitch pulse of the first frame (e.g., as described above with reference to various implementations of task E120). Means FE100 also includes means FE130 for estimating a pitch period of the first frame (e.g., as described above with reference to various implementations of task E130). FIG. 6B shows a block diagram of an implementation FE102 of means FE100 that also includes means FE140 for calculating a set of gain values that correspond to different pitch pulses of the first frame (e.g., as described above with reference to various implementations of task E140).

Means FE200 includes means FE210 for calculating a pitch pulse shape differential between a pitch pulse shape of the second frame and a pitch pulse shape of the first frame (e.g., as described above with reference to various implementations of task E210). Means FE200 also includes means FE220 for calculating a pitch period differential between a pitch period of the second frame and a pitch period of the first frame (e.g., as described above with reference to various implementations of task E220).

Figure 7B:
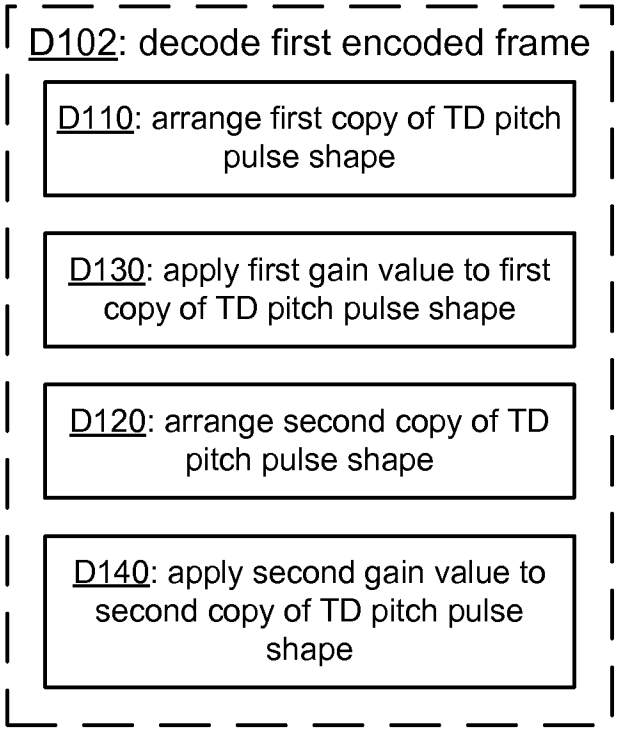
FIG. 7B shows a flowchart of an implementation D102 of decoding task D100.
Figure 7A:
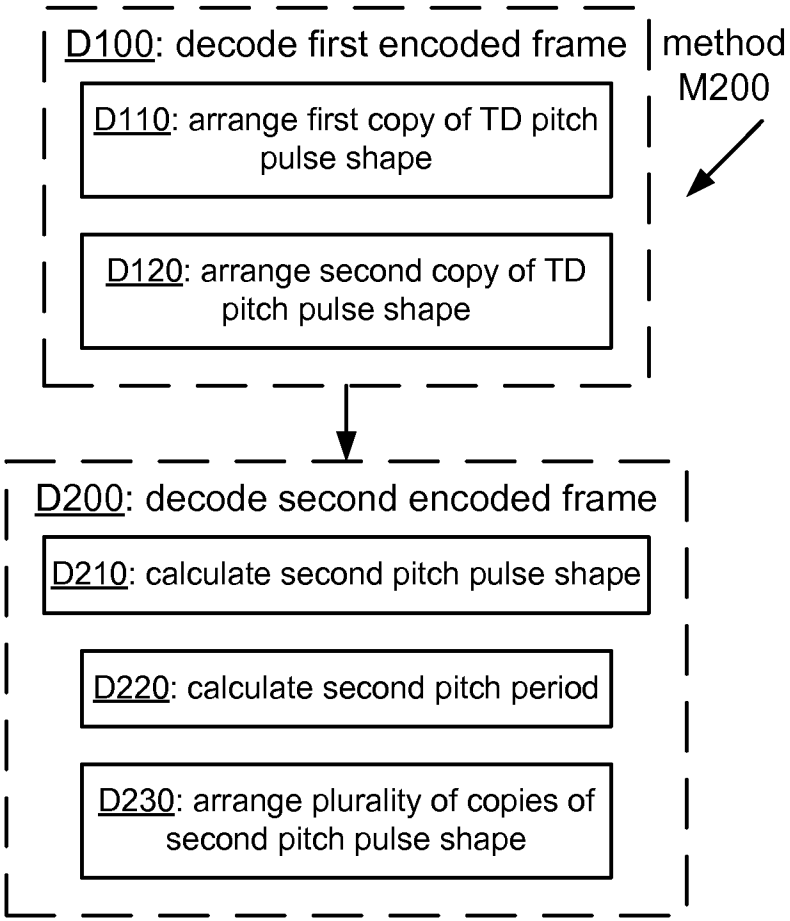
FIG. 7A shows a flowchart of a method of decoding excitation signals of a speech signal M200 according to a general configuration.

FIG. 7A shows a flowchart of a method of decoding excitation signals of a speech signal M200 according to a general configuration. Method M200 includes a task D100 that decodes a portion of a first encoded frame to obtain a first excitation signal, where the portion includes representations of a time-domain pitch pulse shape, a pitch pulse position, and a pitch period. Task D100 includes a subtask D110 that arranges a first copy of the time-domain pitch pulse shape within the first excitation signal according to the pitch pulse position. Task D100 also includes a subtask D120 that arranges a second copy of the time-domain pitch pulse shape within the first excitation signal according to the pitch pulse position and the pitch period. In one example, tasks D110 and D120 obtain the time-domain pitch pulse shape from a codebook (e.g., according to an index from the first encoded frame that represents the shape) and copy it to an excitation signal buffer. Task D100 and/or method M200 may also be implemented to include tasks that obtain a set of LPC coefficient values from the first encoded frame (e.g., by dequantizing one or more quantized LSP vectors from the first encoded frame and inverse transforming the result), configure a synthesis filter according to the set of LPC coefficient values, and apply the first excitation signal to the configured synthesis filter to obtain a first decoded frame.

FIG. 7B shows a flowchart of an implementation D102 of decoding task D100. In this case, the portion of the first encoded frame also includes a representation of a set of gain values. Task D102 includes a subtask D130 that applies one of the set of gain values to the first copy of the time-domain pitch pulse shape. Task D102 also includes a subtask D140 that applies a different one of the set of gain values to the second copy of the time-domain pitch pulse shape. In one example, task D130 applies its gain value to the shape during task D110 and task D140 applies its gain value to the shape during task D120. In another example, task D130 applies its gain value to a corresponding portion of an excitation signal buffer after task D110 has executed, and task D140 applies its gain value to a corresponding portion of the excitation signal buffer after task D120 has executed. An implementation of method M200 that includes task D102 may be configured to include a task that applies the resulting gain-adjusted excitation signal to a configured synthesis filter to obtain a first decoded frame.

Method M200 also includes a task D200 that decodes a portion of a second encoded frame to obtain a second excitation signal, where the portion includes representations of a pitch pulse shape differential and a pitch period differential. Task D200 includes a subtask D210 that calculates a second pitch pulse shape based on the time-domain pitch pulse shape and the pitch pulse shape differential. Task D200 also includes a subtask D220 that calculates a second pitch period based on the pitch period and the pitch period differential. Task D200 also includes a subtask D230 that arranges two or more copies of the second pitch pulse shape within the second excitation signal according to the pitch pulse position and the second pitch period. Task D230 may include calculating a position for each of the copies within the second excitation signal as a corresponding offset from the pitch pulse position, where each offset is an integer multiple of the second pitch period. Task D200 and/or method M200 may also be implemented to include tasks that obtain a set of LPC coefficient values from the second encoded frame (e.g., by dequantizing one or more quantized LSP vectors from the second encoded frame and inverse transforming the result), configure a synthesis filter according to the set of LPC coefficient values, and apply the second excitation signal to the configured synthesis filter to obtain a second decoded frame.

Figure 8B:
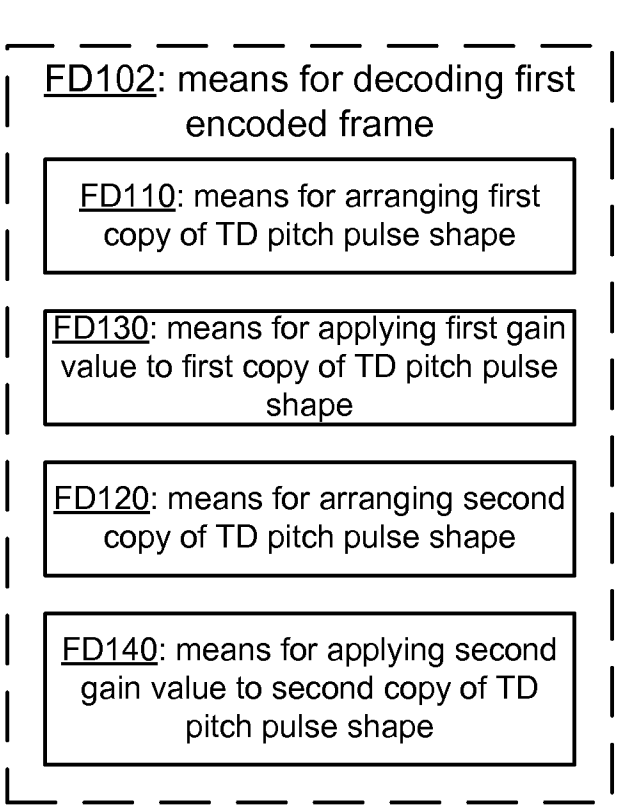
FIG. 8B shows a flowchart of an implementation FD102 of means for decoding FD100.
Figure 8A:
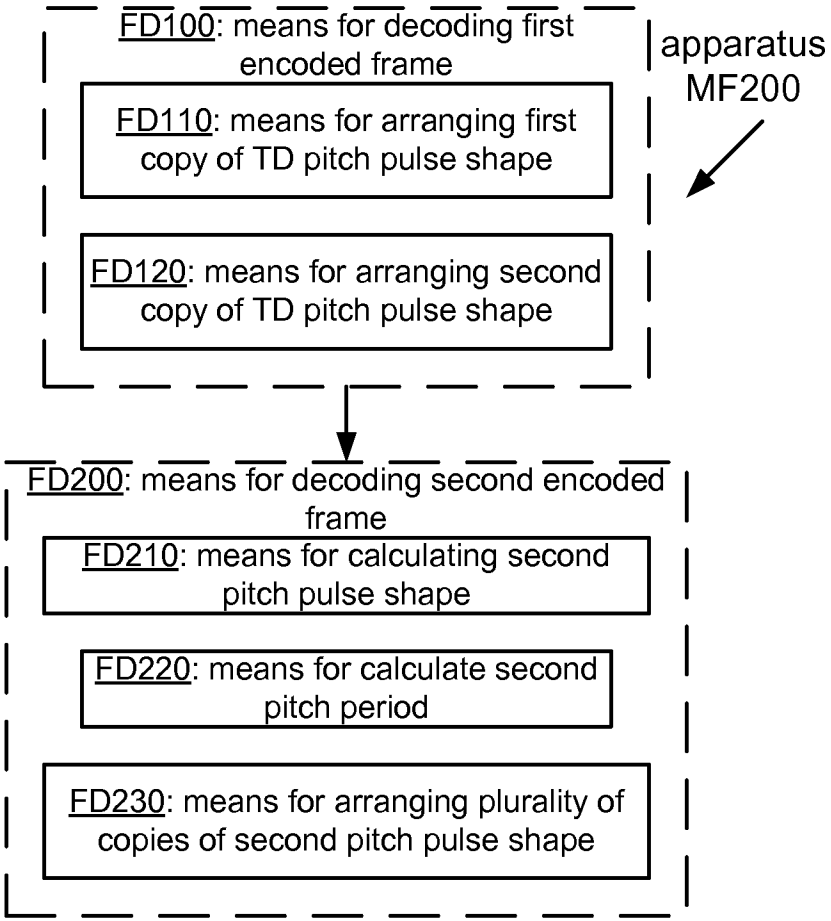
FIG. 8A shows a block diagram of an apparatus MF200 according to a general configuration.

FIG. 8A shows a block diagram of an apparatus MF200 for decoding excitation signals of a speech signal. Apparatus MF200 includes means FD100 for decoding a portion of a first encoded frame to obtain a first excitation signal, where the portion includes representations of a time-domain pitch pulse shape, a pitch pulse position, and a pitch period. Means FD100 includes means FD110 for arranging a first copy of the time-domain pitch pulse shape within the first excitation signal according to the pitch pulse position. Means FD100 also includes means FD120 for arranging a second copy of the time-domain pitch pulse shape within the first excitation signal according to the pitch pulse position and the pitch period. In one example, means FD110 and FD120 are configured to obtain the time-domain pitch pulse shape from a codebook (e.g., according to an index from the first encoded frame that represents the shape) and copy it to an excitation signal buffer. Means FD200 and/or apparatus MF200 may also be implemented to include means for obtaining a set of LPC coefficient values from the first encoded frame (e.g., by dequantizing one or more quantized LSP vectors from the first encoded frame and inverse transforming the result), means for configuring a synthesis filter according to the set of LPC coefficient values, and means for applying the first excitation signal to the configured synthesis filter to obtain a first decoded frame.

FIG. 8B shows a flowchart of an implementation FD102 of means for decoding FD100. In this case, the portion of the first encoded frame also includes a representation of a set of gain values. Means FD102 includes means FD130 for applying one of the set of gain values to the first copy of the time-domain pitch pulse shape. Means FD102 also includes means FD140 for applying a different one of the set of gain values to the second copy of the time-domain pitch pulse shape. In one example, means FD130 applies its gain value to the shape within means FD110 and means FD140 applies its gain value to the shape within means FD120. In another example, means FD130 applies its gain value to a portion of an excitation signal buffer to which means FD110 has arranged the first copy, and means FD140 applies its gain value to a portion of the excitation signal buffer to which means FD120 has arranged the second copy. An implementation of apparatus MF200 that includes means FD102 may be configured to include means for applying the resulting gain-adjusted excitation signal to a configured synthesis filter to obtain a first decoded frame.

Apparatus MF200 also includes means FD200 for decoding a portion of a second encoded frame to obtain a second excitation signal, where the portion includes representations of a pitch pulse shape differential and a pitch period differential. Means FD200 includes means FD210 for calculating a second pitch pulse shape based on the time-domain pitch pulse shape and the pitch pulse shape differential. Means FD200 also includes means FD220 for calculating a second pitch period based on the pitch period and the pitch period differential. Means FD200 also includes means FD230 for arranging two or more copies of the second pitch pulse shape within the second excitation signal according to the pitch pulse position and the second pitch period. Means FD230 may be configured to calculate a position for each of the copies within the second excitation signal as a corresponding offset from the pitch pulse position, where each offset is an integer multiple of the second pitch period. Means FD200 and/or apparatus MF200 may also be implemented to include means for obtaining a set of LPC coefficient values from the second encoded frame (e.g., by dequantizing one or more quantized LSP vectors from the second encoded frame and inverse transforming the result), means for configuring a synthesis filter according to the set of LPC coefficient values, and means for applying the second excitation signal to the configured synthesis filter to obtain a second decoded frame.

Figure 9A:
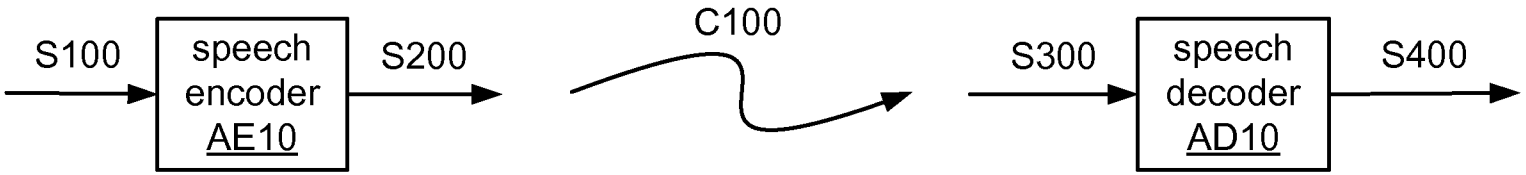
FIG. 9A shows a speech encoder AE10 and a corresponding speech decoder AD10.

FIG. 9A shows a speech encoder AE10 that is arranged to receive a digitized speech signal S100 (e.g., as a series of frames) and to produce a corresponding encoded signal S200 (e.g., as a series of corresponding encoded frames) for transmission on a communication channel C100 (e.g., a wired, optical, and/or wireless communications link) to a speech decoder AD10. Speech decoder AD10 is arranged to decode a received version S300 of encoded speech signal S200 and to synthesize a corresponding output speech signal S400. Speech encoder AE10 may be implemented to include an instance of apparatus MF100 and/or to perform an implementation of method M100. Speech decoder AD10 may be implemented to include an instance of apparatus MF200 and/or to perform an implementation of method M200.

As described above, speech signal S100 represents an analog signal (e.g., as captured by a microphone) that has been digitized and quantized in accordance with any of various methods known in the art, such as pulse code modulation (PCM), companded mu-law, or A-law. The signal may also have undergone other pre-processing operations in the analog and/or digital domain, such as noise suppression, perceptual weighting, and/or other filtering operations. Additionally or alternatively, such operations may be performed within speech encoder AE10. An instance of speech signal S100 may also represent a combination of analog signals (e.g., as captured by an array of microphones) that have been digitized and quantized.

Figure 9B:
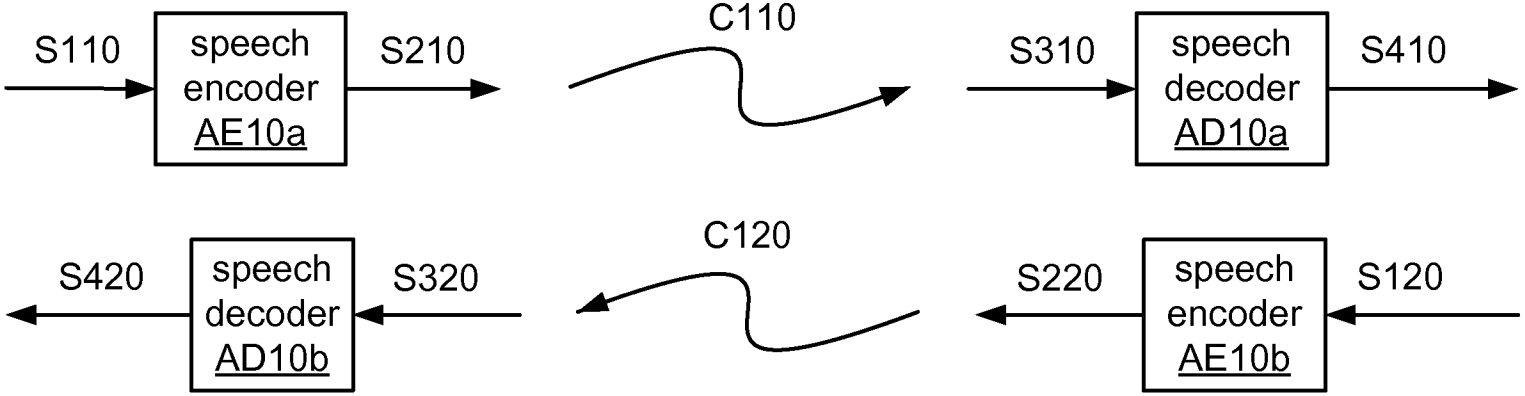
FIG. 9B shows instances AE10*a*, AE10*b* of speech encoder AE10 and instances AD10*a*, AD10*b* of speech decoder AD10.

FIG. 9B shows a first instance AE10*a* of speech encoder AE10 that is arranged to receive a first instance S110 of digitized speech signal S100 and to produce a corresponding instance S210 of encoded signal S200 for transmission on a first instance C110 of communication channel C100 to a first instance AD10*a* of speech decoder AD10. Speech decoder AD10*a* is arranged to decode a received version S310 of encoded speech signal S210 and to synthesize a corresponding instance S410 of output speech signal S400.

FIG. 9B also shows a second instance AE10*b* of speech encoder AE10 that is arranged to receive a second instance S120 of digitized speech signal S100 and to produce a corresponding instance S220 of encoded signal S200 for transmission on a second instance C120 of communication channel C100 to a second instance AD10*b* of speech decoder AD10. Speech decoder AD10*b* is arranged to decode a received version S320 of encoded speech signal S220 and to synthesize a corresponding instance S420 of output speech signal S400.

Speech encoder AE10*a* and speech decoder AD10*b* (similarly, speech encoder AE10*b* and speech decoder AD10*a*) may be used together in any communication device for transmitting and receiving speech signals, including, for example, the user terminals, ground stations, or gateways described below with reference to FIG. 14. As described herein, speech encoder AE10 may be implemented in many different ways, and speech encoders AE10*a* and AE10*b* may be instances of different implementations of speech encoder AE10. Likewise, speech decoder AD10 may be implemented in many different ways, and speech decoders AD10*a* and AD10*b* may be instances of different implementations of speech decoder AD10.

Figure 10B:
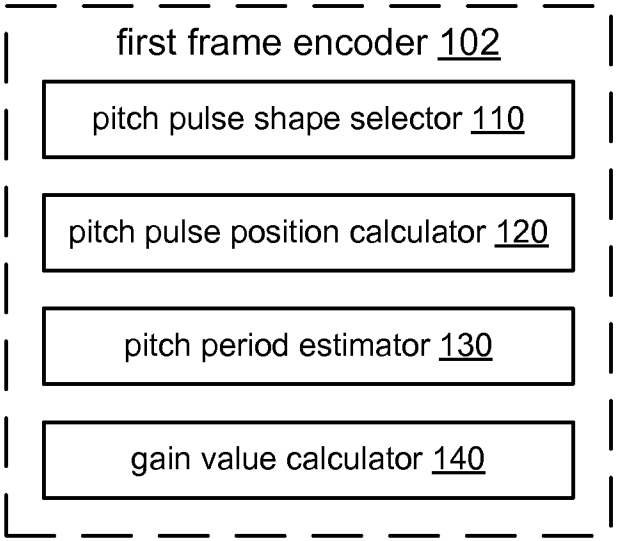
FIG. 10B shows a block diagram of an implementation 102 of encoder 100.
Figure 10A:
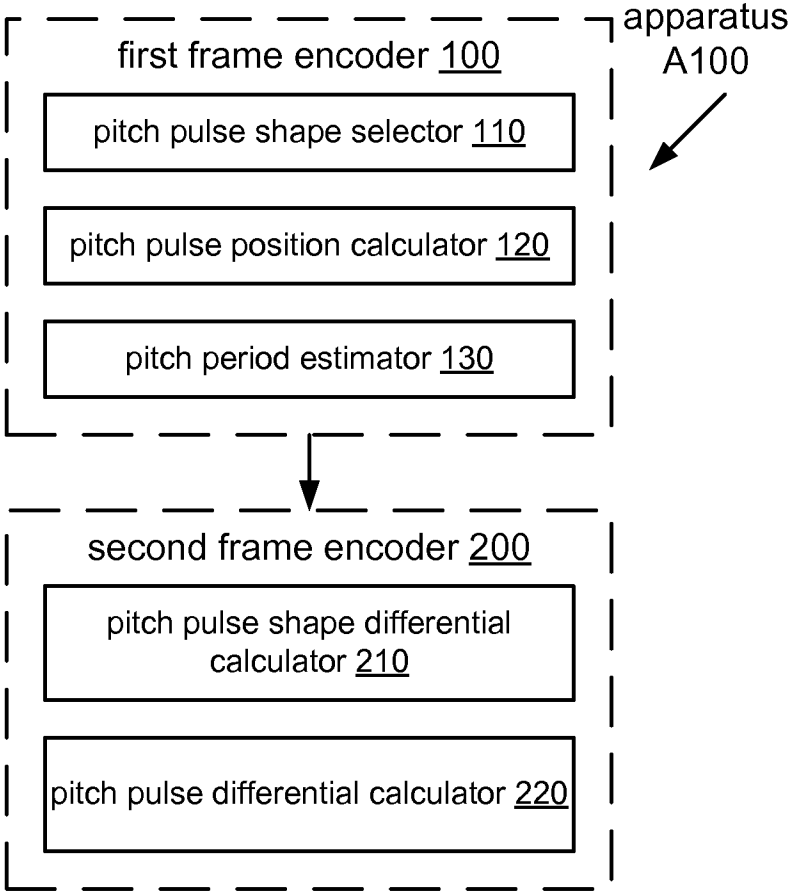
FIG. 10A shows a block diagram of an apparatus for encoding frames of a speech signal A100 according to a general configuration.

FIG. 10A shows a block diagram of an apparatus for encoding frames of a speech signal A100 according to a general configuration that includes a first frame encoder 100 that is configured to encode a first frame of the speech signal as a first encoded frame and a second frame encoder 200 that is configured to encode a second frame of the speech signal as a second encoded frame, where the second frame follows the first frame. Speech encoder AE10 may be implemented to include an instance of apparatus A100. First frame encoder 100 includes a pitch pulse shape selector 110 that is configured to select one among a set of time-domain pitch pulse shapes based on information from at least one pitch pulse of the first frame (e.g., as described above with reference to various implementations of task E110). Encoder 100 also includes a pitch pulse position calculator 120 that is configured to calculate a position of a terminal pitch pulse of the first frame (e.g., as described above with reference to various implementations of task E120). Encoder 100 also includes a pitch period estimator 130 that is configured to estimate a pitch period of the first frame (e.g., as described above with reference to various implementations of task E130). Encoder 100 may be configured to produce the encoded frame as a packet that conforms to a template. For example, encoder 100 may include an instance of packet generator 170 and/or 570 as described herein. FIG. 10B shows a block diagram of an implementation 102 of encoder 100 that also includes a gain value calculator 140 that is configured to calculate a set of gain values that correspond to different pitch pulses of the first frame (e.g., as described above with reference to various implementations of task E140).

Second frame encoder 200 includes a pitch pulse shape differential calculator 210 that is configured to calculate a pitch pulse shape differential between a pitch pulse shape of the second frame and a pitch pulse shape of the first frame (e.g., as described above with reference to various implementations of task E210). Encoder 200 also includes a pitch pulse differential calculator 220 that is configured to calculate a pitch period differential between a pitch period of the second frame and a pitch period of the first frame (e.g., as described above with reference to various implementations of task E220).

Figure 11A:
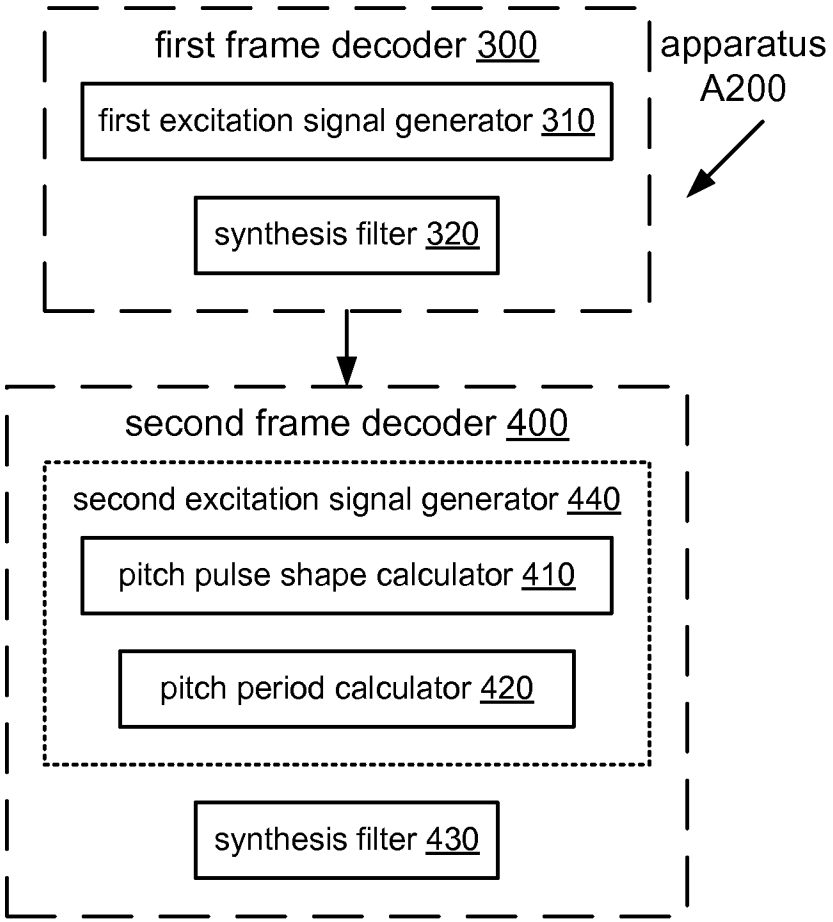
FIG. 11A shows a block diagram of an apparatus for decoding excitation signals of a speech signal A200 according to a general configuration.

FIG. 11A shows a block diagram of an apparatus for decoding excitation signals of a speech signal A200 according to a general configuration that includes a first frame decoder 300 and a second frame decoder 400. Decoder 300 is configured to decode a portion of a first encoded frame to obtain a first excitation signal, where the portion includes representations of a time-domain pitch pulse shape, a pitch pulse position, and a pitch period. Decoder 300 includes a first excitation signal generator 310 configured to arrange a first copy of the time-domain pitch pulse shape within the first excitation signal according to the pitch pulse position. Excitation generator 310 is also configured to arrange a second copy of the time-domain pitch pulse shape within the first excitation signal according to the pitch pulse position and the pitch period. For example, generator 310 may be configured to perform implementations of tasks D110 and D120 as described herein. In this example, decoder 300 also includes a synthesis filter 320 that is configured according to a set of LPC coefficient values obtained by decoder 300 from the first encoded frame (e.g., by dequantizing one or more quantized LSP vectors from the first encoded frame and inverse transforming the result) and arranged to filter the excitation signal to obtain a first decoded frame.

Figure 11B:
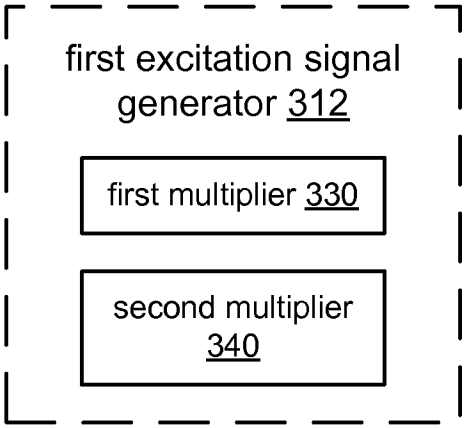
FIG. 11B shows a block diagram of an implementation 302 of first frame decoder 300.

FIG. 11B shows a block diagram of an implementation 312 of first excitation signal generator 310 that includes first and second multipliers 330, 340 for a case in which the portion of the first encoded frame also includes a representation of a set of gain values. First multiplier 330 is configured to apply one of the set of gain values to the first copy of the time-domain pitch pulse shape. For example, first multiplier 330 may be configured to perform an implementation of task D130 as described herein. Second multiplier 340 is configured to apply a different one of the set of gain values to the second copy of the time-domain pitch pulse shape. For example, second multiplier 340 may be configured to perform an implementation of task D140 as described herein. In an implementation of decoder 300 that includes generator 312, synthesis filter 320 may be arranged to filter the resulting gain-adjusted excitation signal to obtain the first decoded frame. First and second multipliers 330, 340 may be implemented using different structures or using the same structure at different times.

Second frame decoder 400 is configured to decode a portion of a second encoded frame to obtain a second excitation signal, where the portion includes representations of a pitch pulse shape differential and a pitch period differential. Decoder 400 includes a second excitation signal generator 440 that includes a pitch pulse shape calculator 410 and a pitch period calculator 420. Pitch pulse shape calculator 410 is configured to calculate a second pitch pulse shape based on the time-domain pitch pulse shape and the pitch pulse shape differential. For example, pitch pulse shape calculator 410 may be configured to perform an implementation of task D210 as described herein. Pitch period calculator 420 is configured to calculate a second pitch period based on the pitch period and the pitch period differential. For example, pitch period calculator 420 may be configured to perform an implementation of task D220 as described herein. Excitation generator 440 is configured to arrange two or more copies of the second pitch pulse shape within the second excitation signal according to the pitch pulse position and the second pitch period. For example, generator 440 may be configured to perform an implementation of task D230 described herein. In this example, decoder 400 also includes a synthesis filter 430 that is configured according to a set of LPC coefficient values obtained by decoder 400 from the first encoded frame (e.g., by dequantizing one or more quantized LSP vectors from the first encoded frame and inverse transforming the result) and arranged to filter the second excitation signal to obtain a second decoded frame. Synthesis filters 320, 430 may be implemented using different structures or using the same structure at different times. Speech decoder AD10 may be implemented to include an instance of apparatus A200.

Figure 12A:
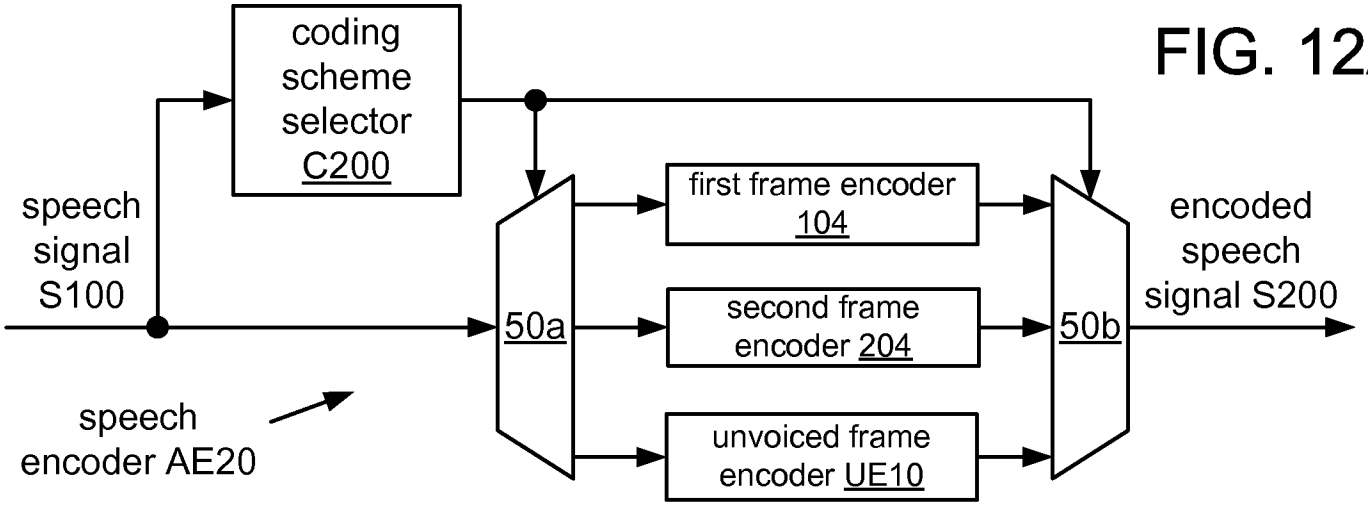
FIG. 12A shows a block diagram of a multi-mode implementation AE20 of speech encoder AE10.
Figure 12B:
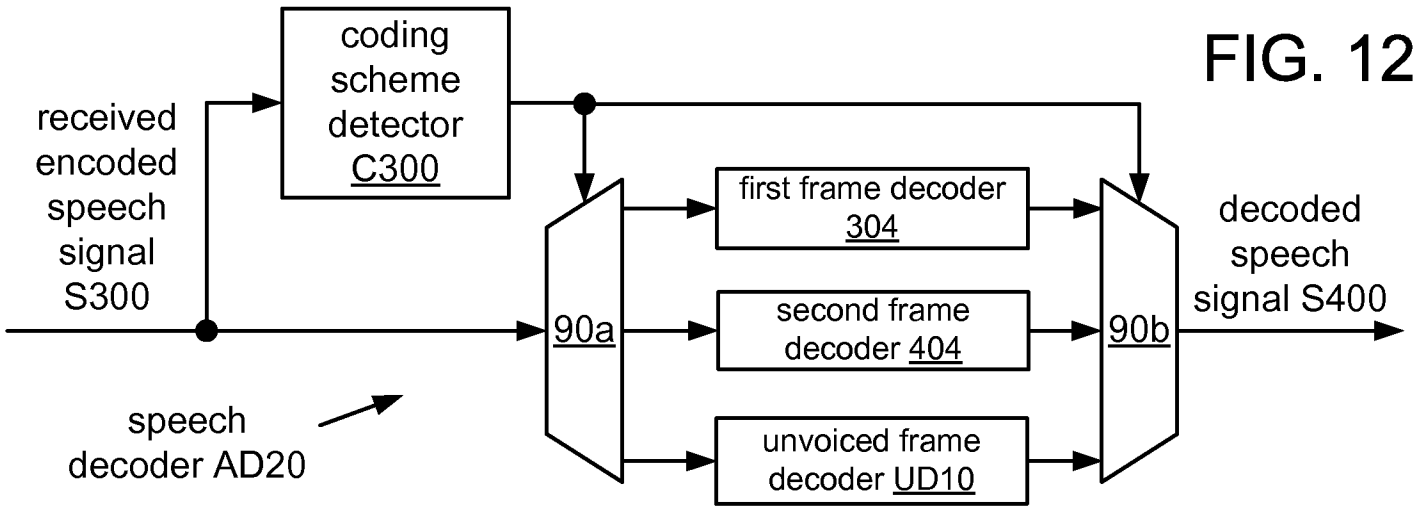
FIG. 12B shows a block diagram of a multi-mode implementation AD20 of speech decoder AD10.

FIG. 12A shows a block diagram of a multi-mode implementation AE20 of speech encoder AE10. Encoder AE20 includes an implementation of first frame encoder 100 (e.g., encoder 102), an implementation of second frame encoder 200, an unvoiced frame encoder UE10 (e.g., a QNELP encoder), and a coding scheme selector C200. Coding scheme selector C200 is configured to analyze characteristics of incoming frames of speech signal S100 (e.g., according to a modified EVRC frame classification scheme as described below) to select an appropriate one of encoders 100, 200, and UE10 for each frame via selectors 50*a*, 50*b*. It may be desirable to implement second frame encoder 200 to apply a quarter-rate PPP (QPPP) coding scheme and to implement unvoiced frame encoder UE10 to apply a quarter-rate NELP (QNELP) coding scheme. FIG. 12B shows a block diagram of an analogous multi-mode implementation AD20 of speech encoder AD10 that includes an implementation of first frame decoder 300 (e.g., decoder 302), an implementation of second frame encoder 400, an unvoiced frame decoder UD10 (e.g., a QNELP decoder), and a coding scheme detector C300. Coding scheme detector C300 is configured to determine formats of encoded frames of received encoded speech signal S300 (e.g., according to one or more mode bits of the encoded frame, such as the first and/or last bits) to select an appropriate corresponding one of decoders 300, 400, and UD10 for each encoded frame via selectors 90*a*, 90*b*.

Figure 13:
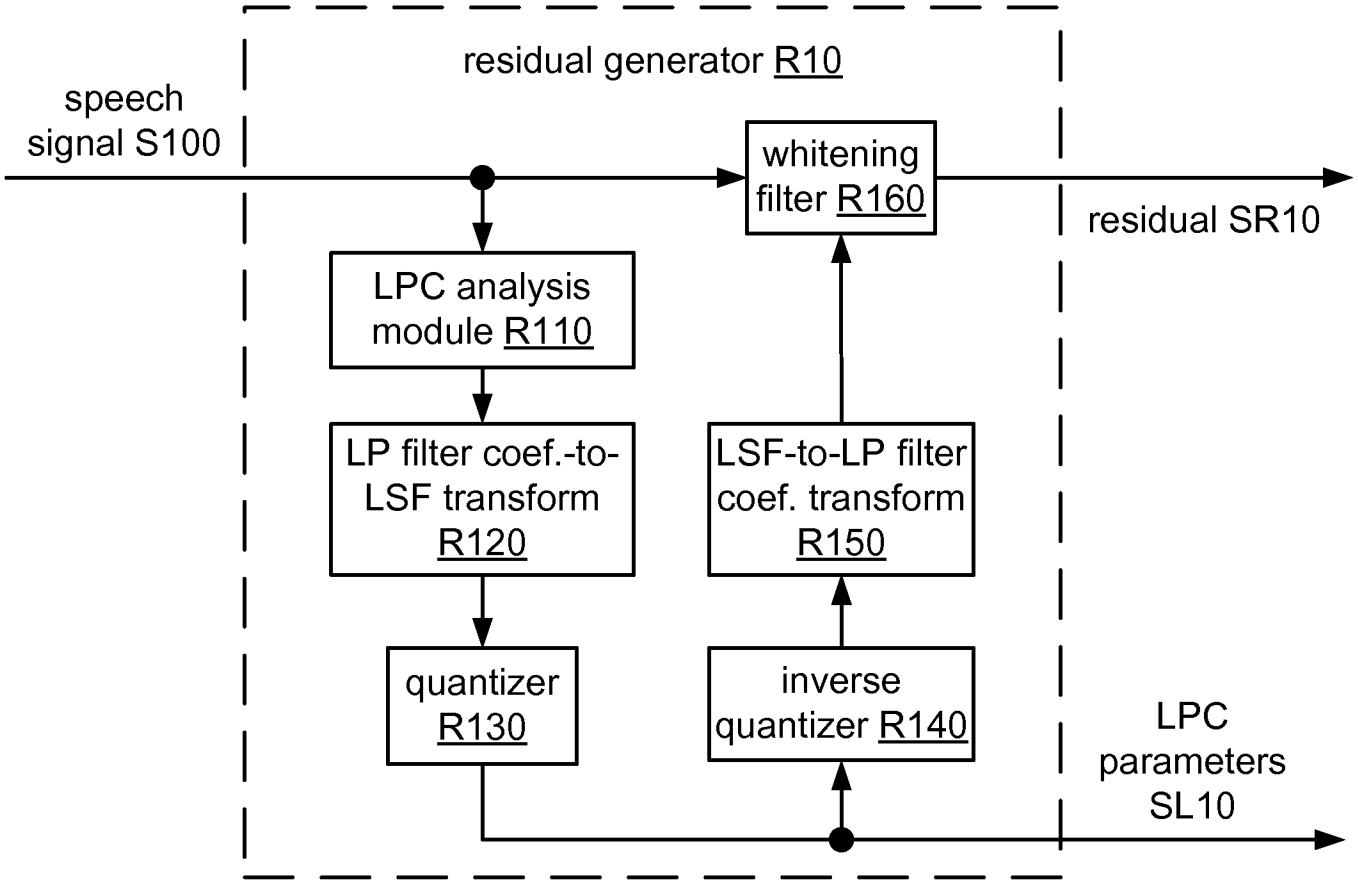
FIG. 13 shows a block diagram of a residual generator R10.

FIG. 13 shows a block diagram of a residual generator R10 that may be included within an implementation of speech encoder AE10. Generator R10 includes an LPC analysis module R110 configured to calculate a set of LPC coefficient values based on a current frame of speech signal S100. Transform block R120 is configured to convert the set of LPC coefficient values to a set of LSFs, and quantizer R130 is configured to quantize the LSFs (e.g., as one or more codebook indices) to produce LPC parameters SL10. Inverse quantizer R140 is configured to obtain a set of decoded LSFs from the quantized LPC parameters SL10, and inverse transform block R150 is configured to obtain a set of decoded LPC coefficient values from the set of decoded LSFs. A whitening filter R160 (also called an analysis filter) that is configured according to the set of decoded LPC coefficient values processes speech signal S100 to produce an LPC residual SR10. Residual generator R10 may also be implemented to generate an LPC residual according to any other design deemed suitable for the particular application. An instance of residual generator R10 may be implemented within and/or shared among any one or more of frame encoders 104, 204, and UE10.

Figure 14:
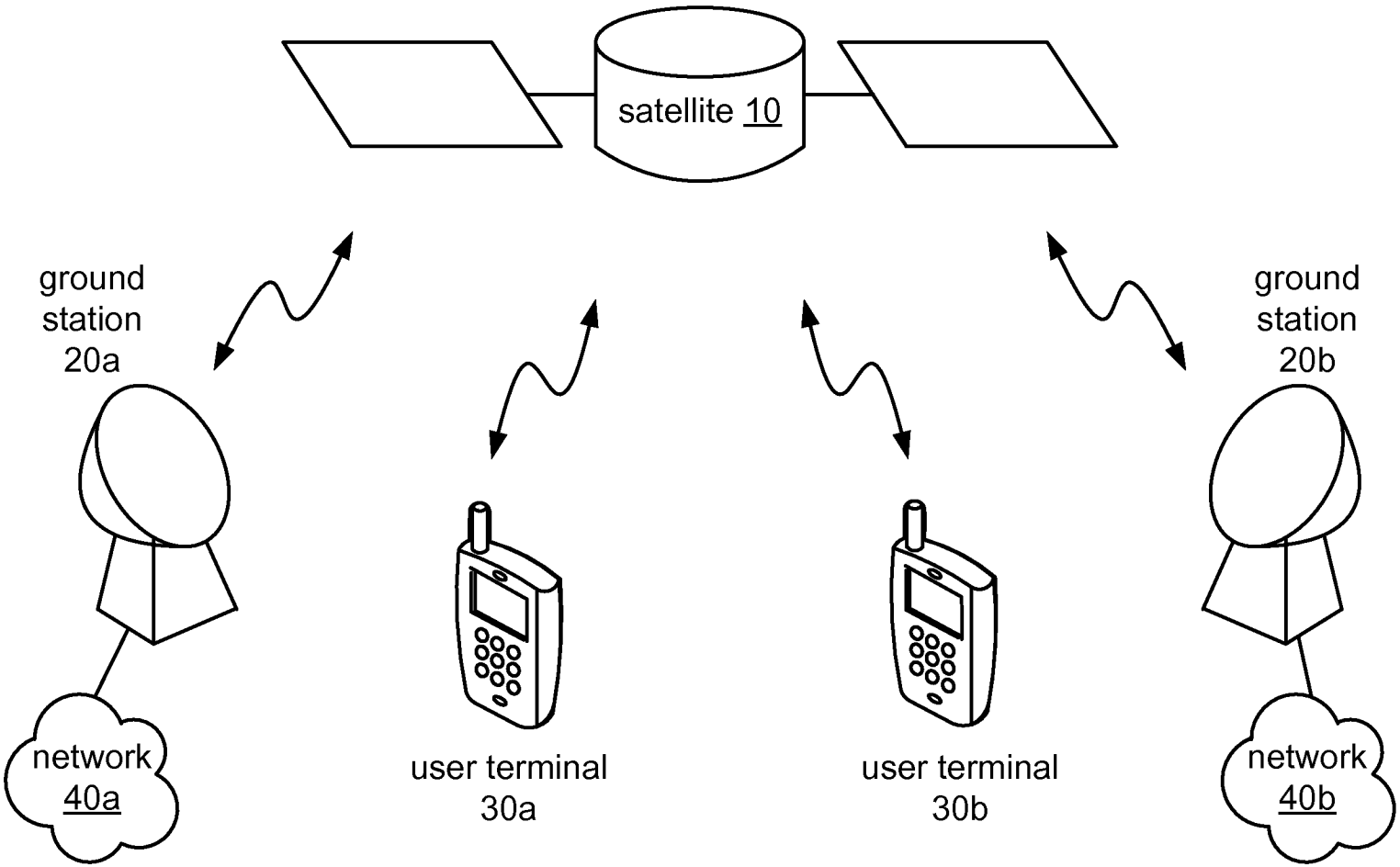
FIG. 14 shows a schematic diagram of a system for satellite communications.

FIG. 14 shows a schematic diagram of a system for satellite communications that includes a satellite 10, ground stations 20*a*, 20*b*, and user terminals 30*a*, 30*b*. Satellite 10 may be configured to relay voice communications over a half-duplex or full-duplex channel between ground stations 20*a* and 20*b*, between user terminals 30*a* and 30*b*, or between a ground station and a user terminal, possibly via one or more other satellites. Each of the user terminals 30*a*, 30*b* may be a portable device for wireless satellite communications, such as a mobile telephone or a portable computer equipped with a wireless modem, a communications unit mounted within a terrestrial or space vehicle, or another device for satellite voice communications. Each of the ground stations 20*a*, 20*b* is configured to route the voice communications channel to a respective network 40*a*, 40*b*, which may be an analog or pulse code modulation (PCM) network (e.g., a public switched telephone network or PSTN) and/or a data network (e.g., the Internet, a local area network (LAN), a campus area network (CAN), a metropolitan area network (MAN), a wide area network (WAN), a ring network, a star network, and/or a token ring network). One or both of the ground stations 20*a*, 20*b* may also include a gateway that is configured to transcode the voice communications signal to and/or from another form (e.g., analog, PCM, a higher-bit-rate coding scheme, etc.). One or more of the methods described herein may be performed by any one or more of the devices 10, 20*a*, 20*b*, 30*a*, and 30*b* shown in FIG. 14, and one or more of the apparatus described herein may be included in any one or more of such devices.

The length of the prototype extracted during PWI encoding is typically equal to the current value of the pitch lag, which may vary from frame to frame. Quantizing the prototype for transmission to the decoder thus presents a problem of quantizing a vector whose dimension is variable. In conventional PWI and PPP coding schemes, quantization of the variable-dimension prototype vector is typically performed by converting the time-domain vector to a complex-valued frequency-domain vector (e.g., using a discrete-time Fourier transform (DTFT) operation). Such an operation is described above with reference to pitch pulse shape differential calculation task E210. The amplitude of this complex-valued variable-dimension vector is then sampled to obtain a vector of fixed dimension. The sampling of the amplitude vector may be nonuniform. For example, it may be desirable to sample the vector with higher resolution at low frequencies than at high frequencies.

It may be desirable to perform differential PWI encoding of voiced frames that follow the onset frame. In a full-rate PPP coding mode, the phase of the frequency-domain vector is sampled in a similar manner as the amplitude to obtain a fixed-dimension vector. In a QPPP coding mode, however, no bits are available to carry such phase information to the decoder. In this case, the pitch lag is encoded differentially (e.g., relative to the pitch lag of the previous frame), and the phase information must also be estimated based on information from one or more previous frames. For example, when a transitional frame coding mode (e.g., task E100) is used to encode the onset frame, the phase information for a subsequent frame may be derived from pitch lag and pulse location information.

For encoding onset frames, it may be desirable to perform a procedure that can be expected to detect all of the pitch pulses within the frame. For example, the use of a robust pitch peak detection operation may be expected to provide a better lag estimate and/or phase reference for subsequent frames. Reliable reference values may be especially important for cases in which a subsequent frame is encoded using a relative coding scheme such as a differential coding scheme (e.g., task E200), as such schemes are typically susceptible to error propagation. As noted above, in this description the position of a pitch pulse is indicated by the position of its peak, although in another context the position of a pitch pulse may be equivalently indicated by the position of another feature of the pulse, such as its first or last sample.

Figure 15A:
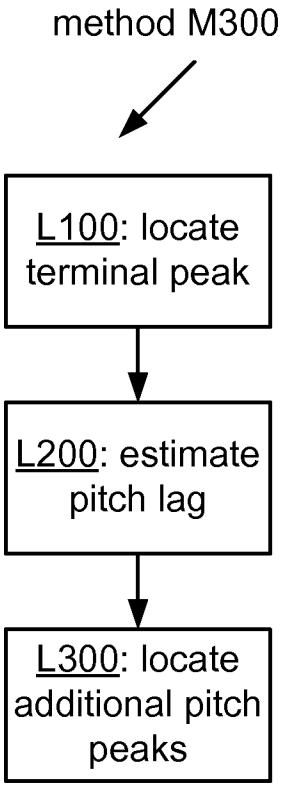
FIG. 15A shows a flowchart of a method M300 according to a general configuration.

FIG. 15A shows a flowchart of a method M300 according to a general configuration that includes tasks L100, L200, and L300. Task L100 locates a terminal pitch peak of the frame. In a particular implementation, task L100 is configured to select a sample as the terminal pitch peak according to a relation between (A) a quantity that is based on sample amplitude and (B) an average of the quantity for the frame. In one such example, the quantity is sample magnitude (i.e., absolute value), and in this case the frame average may be calculated as $$\frac{\sum_{i<N} |s_i|}{N},$$

where s denotes sample value (i.e., amplitude), N denotes the number of samples in the frame, and i is a sample index. In another such example, the quantity is sample energy (i.e., amplitude squared), and in this case the frame average may be calculated as $$\frac{\sum_{i<N} s_i^2}{N}.$$

In the description below, energy is used.

Task L100 may be configured to locate the terminal pitch peak as the initial pitch peak of the frame or as the final pitch peak of the frame. To locate the initial pitch peak, task L100 may be configured to begin at the first sample of the frame and work forward in time. To locate the final pitch peak, task L100 may be configured to begin at the last sample of the frame and work backward in time. In the particular examples described below, task L100 is configured to locate the terminal pitch peak as the final pitch peak of the frame.

Figure 15B:
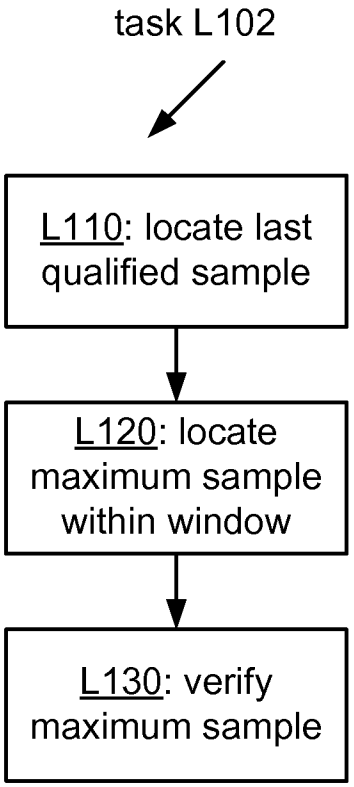
FIG. 15B shows a block diagram of an implementation L102 of task L100.
Figure 16A:
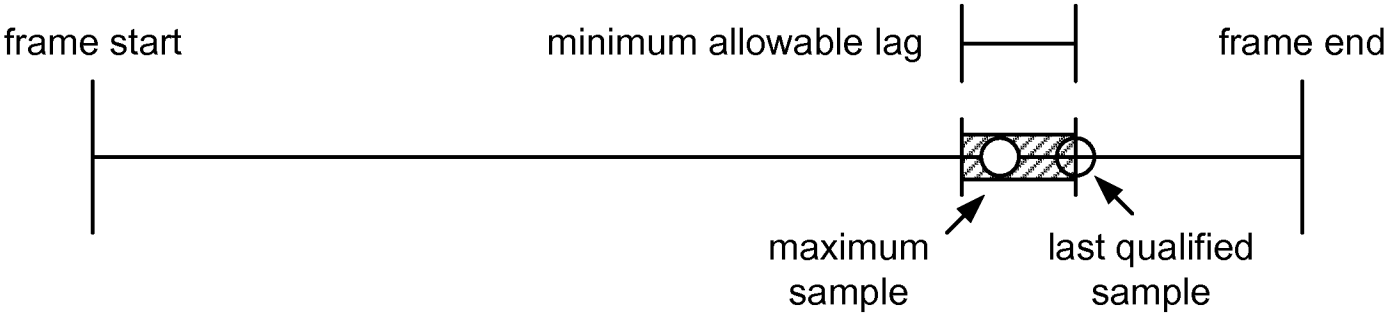
FIG. 16A shows an example of a search by task L120.

FIG. 15B shows a block diagram of an implementation L102 of task L100 that includes subtasks L110, L120, and L130. Task L110 locates the last sample in the frame that qualifies to be a terminal pitch peak. In this example, task L110 locates the last sample whose energy relative to the frame average exceeds (alternatively, is not less than) a corresponding threshold value TH1. In one example, the value of TH1 is six. If no such sample is found in the frame, method M300 is terminated and another coding mode (e.g., QPPP) is used for the frame. Otherwise, task L120 searches within a window prior to this sample (as shown in FIG. 16A) to find a sample having the greatest amplitude and selects this sample as a provisional peak candidate. It may be desirable for the search window in task L120 to have a width WL1 equal to a minimum allowable lag value. In one example, the value of WL1 is twenty samples. For a case in which more than one sample in the search window has the greatest amplitude, task L120 may be variously configured to select the first such sample, the last such sample, or any other such sample.

Figure 16B:
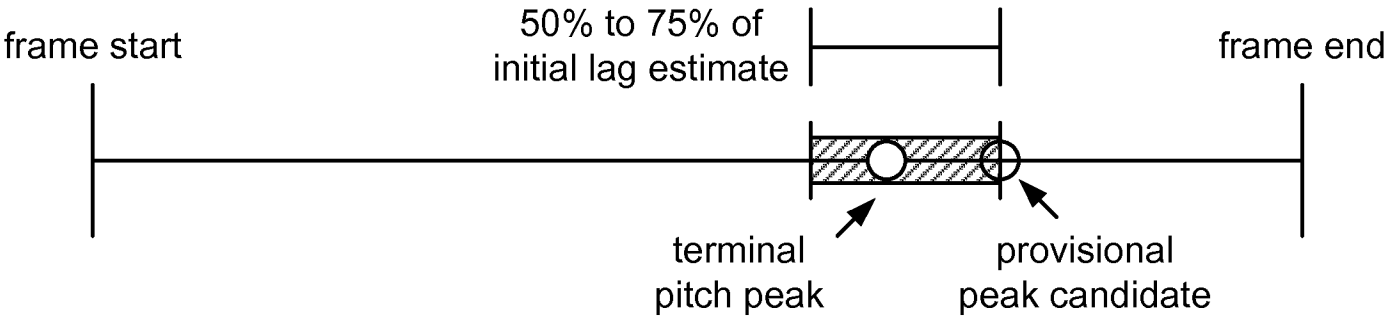
FIG. 16B shows an example of a search by task L130.

Task L130 verifies the final pitch peak selection by finding the sample having the greatest amplitude within a window prior to the provisional peak candidate (as shown in FIG. 16B). It may be desirable for the search window in task L130 to have a width WL2 that is between 50% and 100%, or between 50% and 75%, of an initial lag estimate. The initial lag estimate is typically equal to the most recent lag estimate (i.e., from a previous frame). In one example, the value of WL2 is equal to five-eighths of the initial lag estimate. If the amplitude of the new sample is greater than that of the provisional peak candidate, task L130 selects the new sample instead as the final pitch peak. In another implementation, if the amplitude of the new sample is greater than that of the provisional peak candidate, task L130 selects the new sample as a new provisional peak candidate and repeats the search within a window of width WL2 prior to the new provisional peak candidate until no such sample is found.

Task L200 calculates an estimated lag value for the frame. Task L200 is typically configured to locate the peak of a pitch pulse that is adjacent to the terminal pitch peak and to calculate the lag estimate as the distance between these two peaks. It may be desirable to configure task L200 to search only within the frame boundaries and/or to require the distance between the terminal pitch peak and the adjacent pitch peak to be greater than (alternatively, not less than) a minimum allowable lag value (e.g., twenty samples).

It may be desirable to configure task L200 to use the initial lag estimate to find the adjacent peak. First, however, it may be desirable for task L200 to check the initial lag estimate for pitch doubling errors (which may include pitch tripling and/or pitch quadrupling errors). Typically the initial lag estimate will have been determined using a correlation-based method.

Figure 15C:
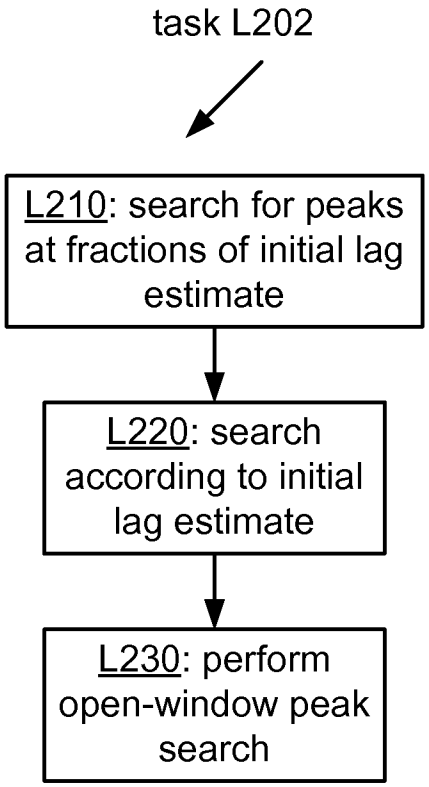
FIG. 15C shows a flowchart of an implementation L202 of task L200.

Pitch doubling errors are common to correlation-based methods of pitch estimation and are typically quite audible. FIG. 15C shows a flowchart of an implementation L202 of task L200. Task L202 includes an optional but recommended subtask L210 that checks the initial lag estimate for pitch doubling errors. Task L210 is configured to search for pitch peaks within narrow windows at distances of, e.g., ½, ⅓, and ¼ lag from the terminal pitch peak and may be iterated as described below.

Figure 17A:
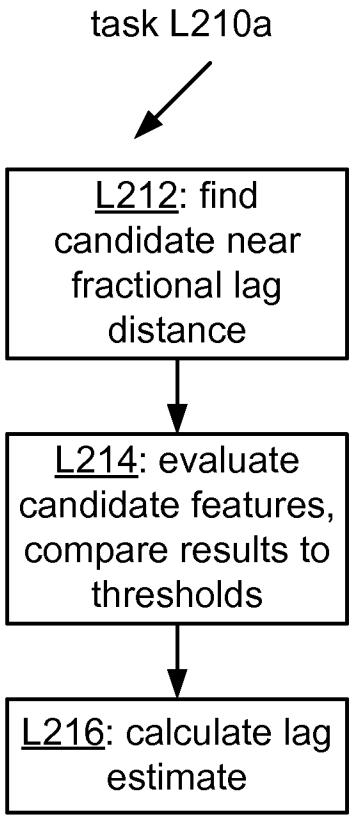
FIG. 17A shows a flowchart of an implementation L210*a* of task L210.
Figures 18A, 18B, 18C, 18D, 18E, 18F:
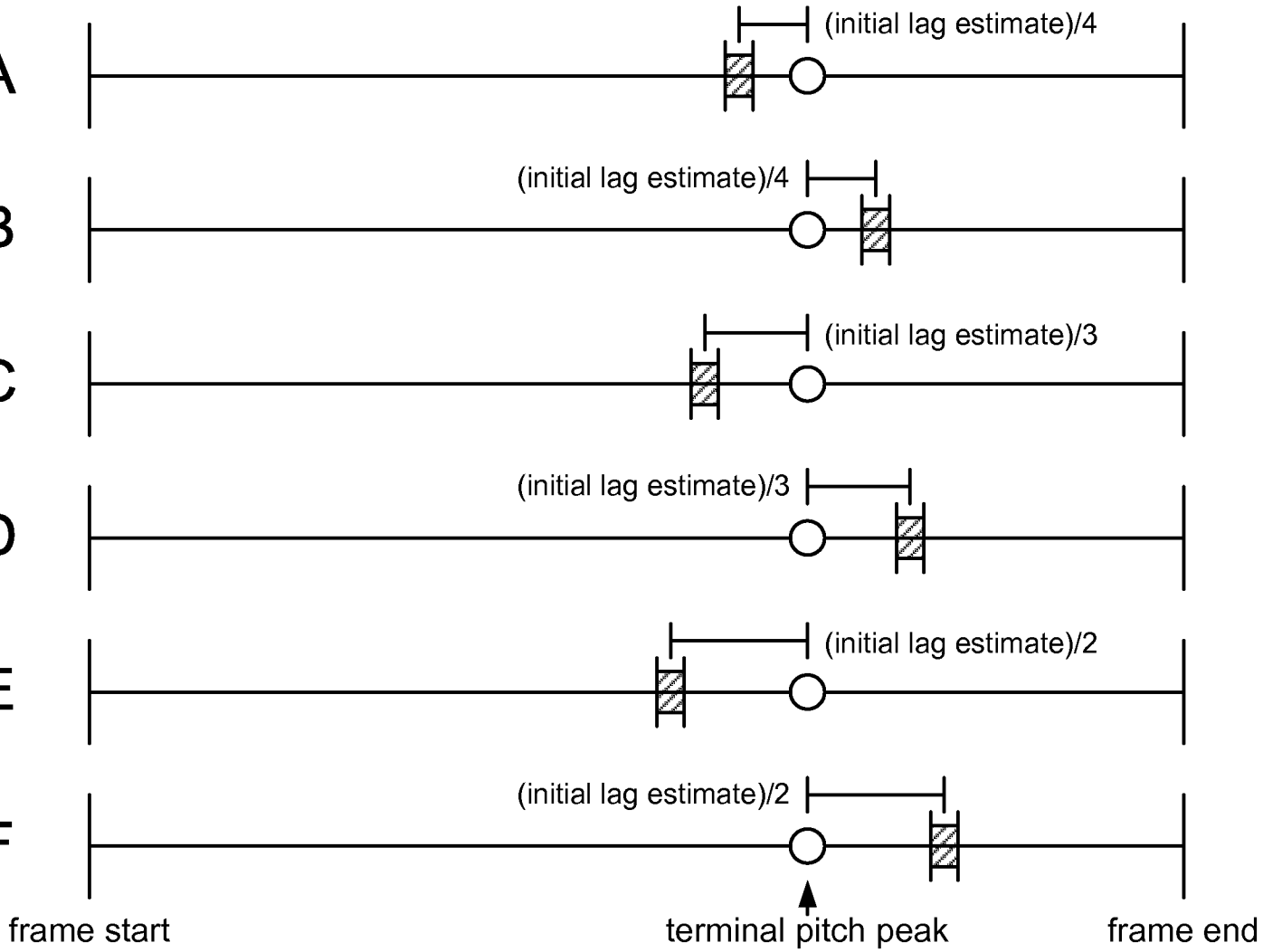
FIGS. 18A-F illustrate search operations of iterations of task L212.

FIG. 17A shows a flowchart of an implementation L210*a* of task L210 that includes subtasks L212, L214, and L216. For the smallest pitch fraction to be checked (e.g., lag/4), task L212 searches within a small window (e.g., five samples) whose center is offset from the terminal pitch peak by a distance substantially equal to the pitch fraction (e.g., within a truncation or rounding error) to find the sample having the maximum value (e.g., in terms of amplitude, magnitude, or energy). FIG. 18A illustrates such an operation.

Task T214 evaluates one or more features of the maximum-valued sample (i.e., the "candidate") and compares these values to respective threshold values. The evaluated features may include the sample energy of the candidate, the ratio of the candidate energy to the average frame energy (e.g., the peak-to-RMS energy), and/or the ratio of candidate energy to terminal peak energy. Task L214 may be configured to perform such evaluations in any order, and the evaluations may be performed serially and/or in parallel to each other.

It may also be desirable for task L214 to correlate a neighborhood of the candidate with a similar neighborhood of the terminal pitch peak. For this feature evaluation, task L214 is typically configured to correlate a segment of length N1 samples that is centered at the candidate with a segment of equal length that is centered at the terminal pitch peak. In one example, the value of N1 is equal to seventeen samples. It may be desirable to configure task L214 to perform a normalized correlation (e.g., having a result in the range of from zero to one). It may be desirable to configure task L214 to repeat the correlation for segments of length N1 that are centered at, e.g., one sample before and after the candidate (for example, to account for timing offset and/or sampling error), and to select the largest correlation result. For a case in which the correlation window would extend beyond a frame boundary, it may be desirable to shift or truncate the correlation window. (For a case in which the correlation window is truncated, it may be desirable to normalize the correlation result, unless it is normalized already.) In one example, the candidate is accepted as the adjacent pitch peak if any of the three sets of conditions shown as columns in FIG. 19A are satisfied, where the threshold value T may be equal to six.

If task T214 finds an adjacent pitch peak, task L216 calculates the current lag estimate as the distance between the terminal pitch peak and the adjacent pitch peak. Otherwise, task L210*a* iterates on the other side of the terminal peak (as shown in FIG. 18B), then alternates between the two sides of the terminal peak for the other pitch fractions to be checked, from smallest to largest, until an adjacent pitch peak is found (as shown in FIGS. 18C to 18F). If the adjacent pitch peak is found between the terminal pitch peak and the closest frame boundary, then the terminal pitch peak is re-labeled as the adjacent pitch peak, and the new peak is labeled as the terminal pitch peak. In an alternative implementation, task L210 is configured to search on the trailing side of the terminal pitch peak (i.e., the side that was already searched in task L100) before the leading side.

Figure 17B:
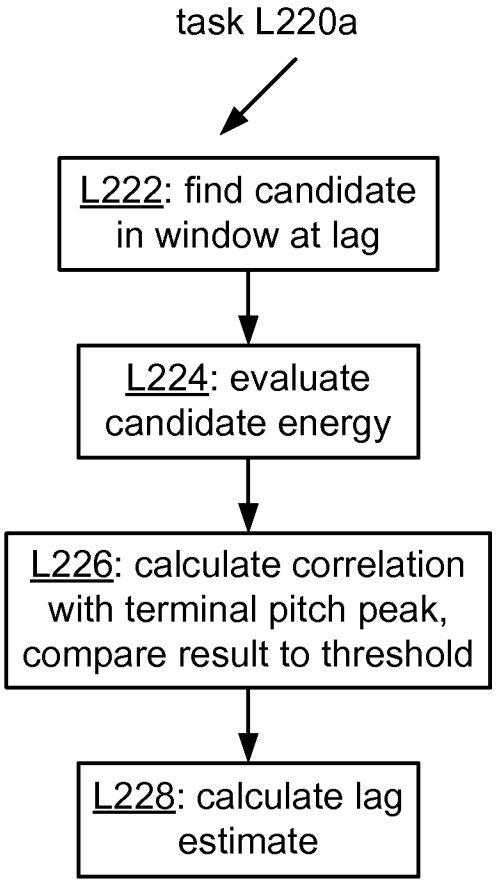
FIG. 17B shows a flowchart of an implementation L220*a* of task L220.

If fractional lag test task L210 does not locate a pitch peak, task L220 searches for a pitch peak adjacent to the terminal pitch peak according to the initial lag estimate (e.g., within a window that is offset from the terminal peak position by the initial lag estimate). FIG. 17B shows a flowchart of an implementation L220*a* of task L220 that includes subtasks L222, L224, L226, and L228. Task L222 finds a candidate (e.g., the sample having the maximum value in terms of amplitude or magnitude) within a window of width WL3 centered around a distance of one lag to the left of the final peak (as shown in FIG. 19B, where the open circle indicates the terminal pitch peak). In one example, the value of WL3 is equal to 0.55 times the initial lag estimate. Task L224 evaluates the energy of the candidate sample. For example, task L224 may be configured to determine whether a measure of the energy of the candidate (e.g., a ratio of sample energy to frame average energy, such as peak-to-RMS energy) is greater than (alternatively, not less than) a corresponding threshold TH3. Example values of TH3 include 1, 1.5, 3, and 6.

Task L226 correlates a neighborhood of the candidate with a similar neighborhood of the terminal pitch peak. Task L226 is typically configured to correlate a segment of length N2 samples that is centered at the candidate with a segment of equal length that is centered at the terminal pitch peak. Examples of values for N2 include ten, eleven, and seventeen samples. It may be desirable to configure task L226 to perform a normalized correlation. It may be desirable to configure task L226 to repeat the correlation for segments centered at, e.g., one sample before and after the candidate (for example, to account for timing offset and/or sampling error), and to select the largest correlation result. For a case in which the correlation window would extend beyond a frame boundary, it may be desirable to shift or truncate the correlation window. (For a case in which the correlation window is truncated, it may be desirable to normalize the correlation result, unless it is normalized already.) Task L226 also determines whether the correlation result is greater than (alternatively, not less than) a corresponding threshold TH4. Example values of TH4 include 0.75, 0.65, and 0.45. The tests of tasks L224 and L226 may be combined according to different sets of values for TH3 and TH4. In one such example, the results of L224 and L226 are positive if any of the following sets of values produces positive results: TH3=1 and TH4=0.75; TH3=1.5 and TH4=0.65; TH3=3 and TH4=0.45; TH3=6 (in this case, the result of task L226 is taken to be positive).

If the results of tasks L224 and L226 are positive, the candidate is accepted as the adjacent pitch peak, and task T228 calculates the current lag estimate as the distance between this sample and the terminal pitch peak. Tasks L224 and L226 may execute in either order and/or parallel with one another. Task L220 may also be implemented to include only one of tasks L224 and L226. If task L220 concludes without finding an adjacent pitch peak, it may be desirable to iterate task L220 on the trailing side of the terminal pitch peak (as shown in FIG. 19C, where the open circle indicates the terminal pitch peak).

Figure 17C:
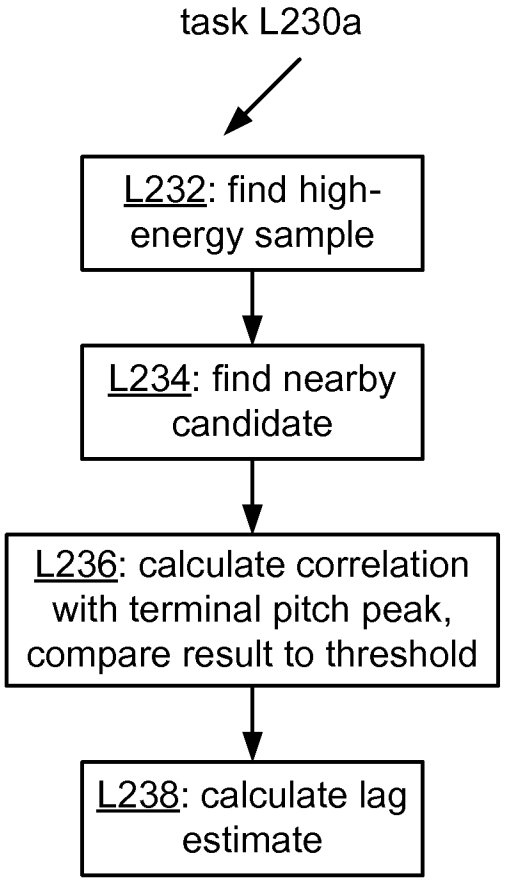
FIG. 17C shows a flowchart of an implementation L230*a* of task L230.
Figure 20A:
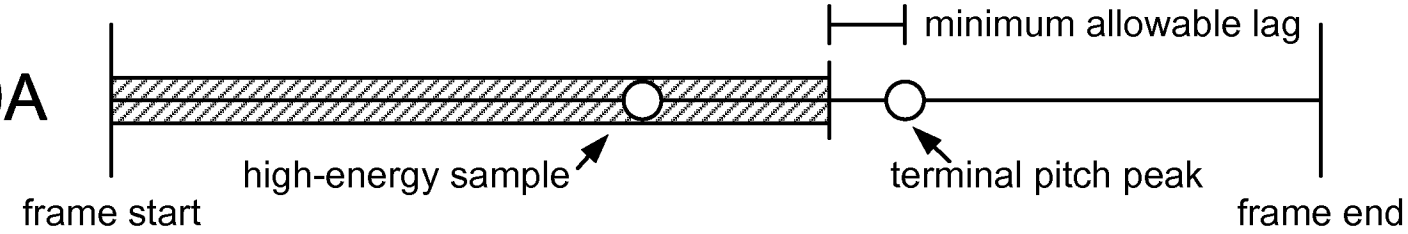
FIG. 20A illustrates a search operation of task L232.
Figure 20B:
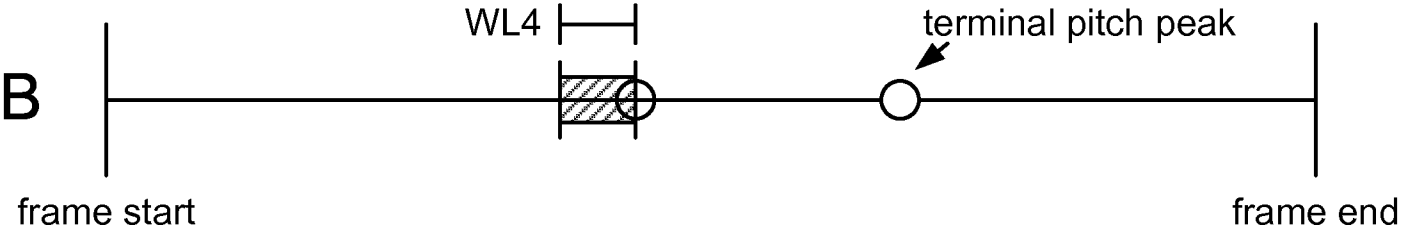
FIG. 20B illustrates a search operation of task L234.

If neither one of tasks L210 and L220 locates a pitch peak, task L230 performs an open window search for a pitch peak on the leading side of the terminal pitch peak. FIG. 17C shows a flowchart of an implementation L230*a* of task L230 that includes subtasks L232, L234, L236, and L238. Starting at a sample some distance D1 away from the terminal pitch peak, task L232 finds a sample whose energy relative to the average frame energy exceeds (alternatively, is not less than) a threshold value (e.g., TH1). FIG. 20A illustrates such an operation. In one example, the value of D1 is a minimum allowable lag value, such as twenty samples. Task L234 finds a candidate (e.g., the sample having the maximum value in terms of amplitude or magnitude) within a window of width WL4 of this sample (as shown in FIG. 20B). In one example, the value of WL4 is equal to twenty samples.

Figure 20C:
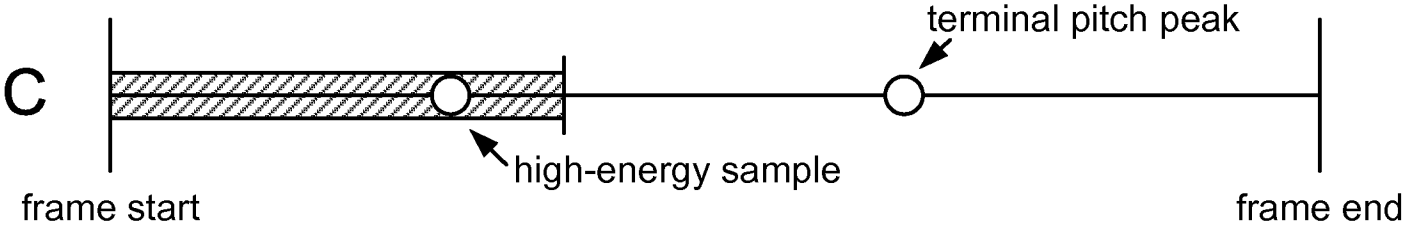
FIG. 20C illustrates a search operation of an iteration of task L232.

Task L236 correlates a neighborhood of the candidate with a similar neighborhood of the terminal pitch peak. Task L236 is typically configured to correlate a segment of length N3 samples that is centered at the candidate with a segment of equal length that is centered at the terminal pitch peak. In one example, the value of N3 is equal to eleven samples. It may be desirable to configure task L326 to perform a normalized correlation. It may be desirable to configure task L326 to repeat the correlation for segments centered at, e.g., one sample before and after the candidate (for example, to account for timing offset and/or sampling error) and to select the largest correlation result. For a case in which the correlation window would extend beyond a frame boundary, it may be desirable to shift or truncate the correlation window. (For a case in which the correlation widow is truncated, it may be desirable to normalize the correlation result, unless it is already normalized.) Task T326 determines whether the correlation result exceeds (alternatively, is not less than) a threshold value TH5. In one example, the value of TH5 is equal to 0.45. If the result of task L236 is positive, the candidate is accepted as the adjacent pitch peak, and task T238 calculates the current lag estimate as the distance between this sample and the terminal pitch peak. Otherwise, task L230*a* iterates across the frame (e.g., starting at the left side of the previous search window, as shown in FIG. 20C) until a pitch peak is found or the search is exhausted.

When lag estimation task L200 has concluded, task L300 executes to locate any other pitch pulses in the frame. Task L300 may be implemented to use correlation and the current lag estimate to locate more pulses. For example, task L300 may be configured to use criteria such as correlation and sample-to-RMS energy values to test maximum-valued samples within narrow windows around the lag estimate. As compared to lag estimation task L200, task L300 may be configured to use a smaller search window and/or relaxed criteria (e.g., lower threshold values), especially if a peak adjacent to the terminal pitch peak has already been found. For example, in an onset or other transitional frame, the pulse shape may change such that some pulses within the frame may not be strongly correlated, and it may be desirable to relax or even to ignore the correlation criterion for pulses after the second one, so long as the amplitude of the pulse is sufficiently high and the location is correct (e.g., according to the current lag value). It may be desirable to minimize the probability of missing a valid pulse, and especially for large lag values, the voiced part of a frame may not be very peaky. In one example, method M300 allows a maximum of eight pitch pulses per frame.

Figure 21:
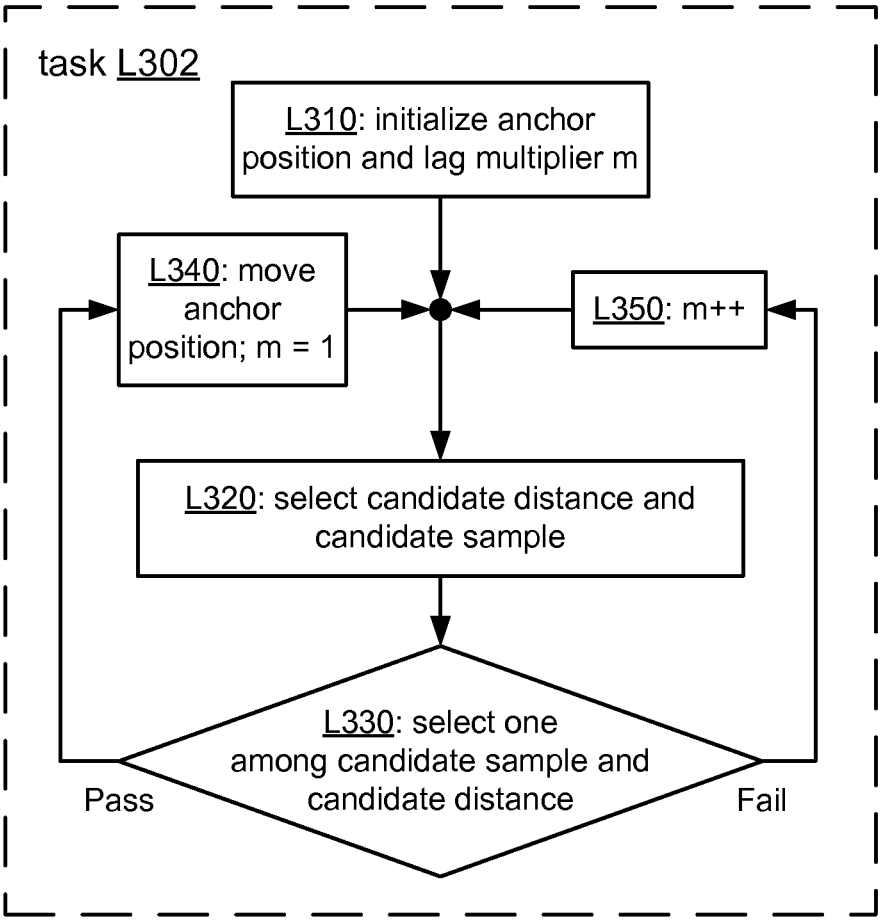
FIG. 21 shows a flowchart for an implementation L302 of task L300.

Task L300 may be implemented to calculate two or more different candidates for the next pitch peak and to select the pitch peak according to one of these candidates. For example, task L300 may be configured to select a candidate sample, based on the sample value, and to calculate a candidate distance, based on a correlation result. FIG. 21 shows a flowchart for an implementation L302 of task L300 that includes subtasks L310, L320, L330, L340, and L350. Task L310 initializes an anchor position for the candidate search. For example, task L310 may be configured to use the position of the most recently accepted pitch peak as the initial anchor position. In a first iteration of task L302, for example, the anchor position may be the position of the pitch peak adjacent to the terminal pitch peak, if such a peak was located by task L200, or the position of the terminal pitch peak otherwise. It may also be desirable for task L310 to initialize a lag multiplier m (e.g., to a value of one).

Figure 22A:
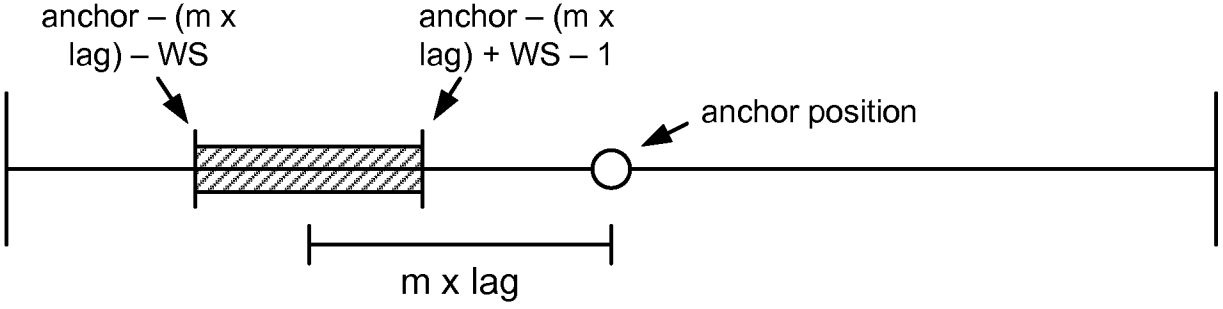
FIG. 22A illustrates a search operation of task L320.

Task L320 selects the candidate sample and calculates the candidate distance. Task L320 may be configured to search for these candidates within a window as shown in FIG. 22A, where the large bounded horizontal line indicates the current frame, the left large vertical line indicates the frame start, the right large vertical line indicates the frame end, the dot indicates the anchor position, and the shaded box indicates the search window. In this example, the window is centered at a sample whose distance from the anchor position is the product of the current lag estimate and the lag multiplier m, and the window extends WS samples to the left (i.e., backward in time) and (WS−1) samples to the right (i.e., forward in time).

Task L320 may be configured to initialize the window size parameter WS to a value of one-fifth of the current lag estimate. It may be desirable for window size parameter WS to have at least a minimum value, such as twelve samples. Alternatively, if a pitch peak adjacent to the terminal pitch peak has not been found yet, it may be desirable for task L320 to initialize window size parameter WS to a possibly larger value, such as one-half of the current lag estimate.

To find the candidate sample, task L320 searches the window to find the sample having the maximum value and records this sample's location and value. Task L320 may be configured to select the sample whose value has the highest amplitude within the search window. Alternatively, task L320 may be configured to select the sample whose value has the highest magnitude, or the highest energy, within the search window.

The candidate distance corresponds to the sample within the search window at which the correlation with the anchor position is highest. To find this sample, task L320 correlates a neighborhood of each sample in the window with a similar neighborhood of the anchor position and records the maximum correlation result and the corresponding distance. Task L320 is typically configured to correlate a segment of length N4 samples that is centered at each test sample with a segment of equal length that is centered at the anchor position. In one example, the value of N4 is eleven samples. It may be desirable for task L320 to perform a normalized correlation.

Figure 22B:
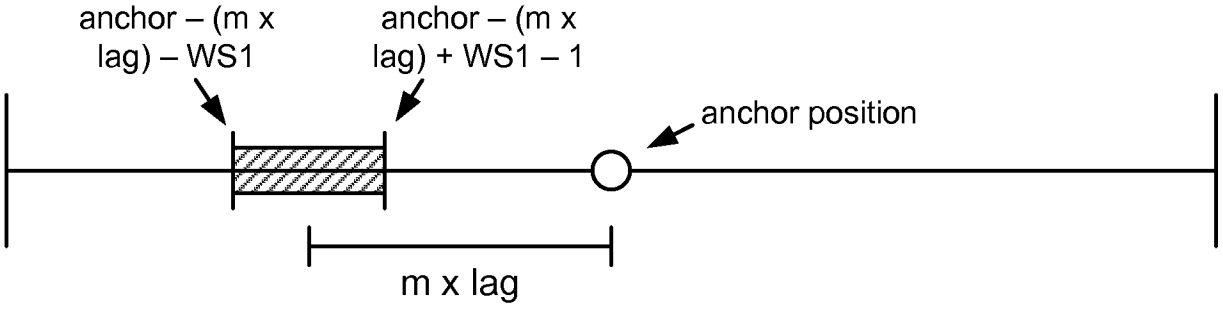
FIGS. 22B and 22C illustrate alternative search operations of task L320.
Figure 22C:
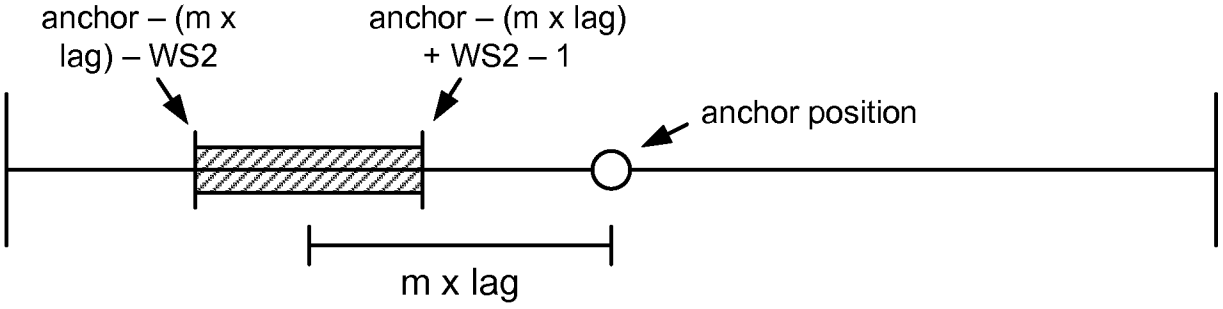

As stated above, task T320 may be configured to use the same search window to find the candidate sample and the candidate distance. However, task T320 may also be configured to use different search windows for these two operations. FIG. 22B shows an example in which task L320 performs the search for the candidate sample over a window having a size parameter WS1, and FIG. 22C shows an example in which the same instance of task L320 performs the search for the candidate distance over a window having a size parameter WS2 of a different value.

Figure 23:
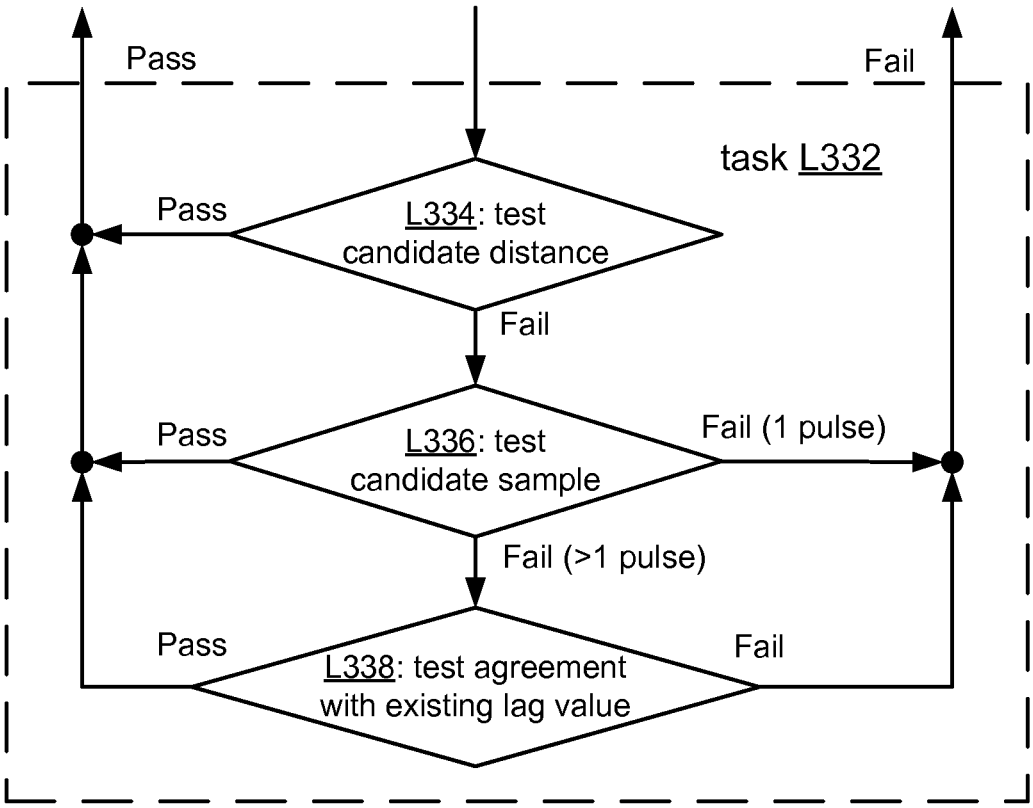
FIG. 23 shows a flowchart of an implementation L332 of task L330.

Task L302 includes a subtask L330 that selects one among the candidate sample and the sample that corresponds to the candidate distance as a pitch peak. FIG. 23 shows a flowchart of an implementation L332 of task L330 that includes subtasks L334, L336, and L338.

Figures 24A, 24B:
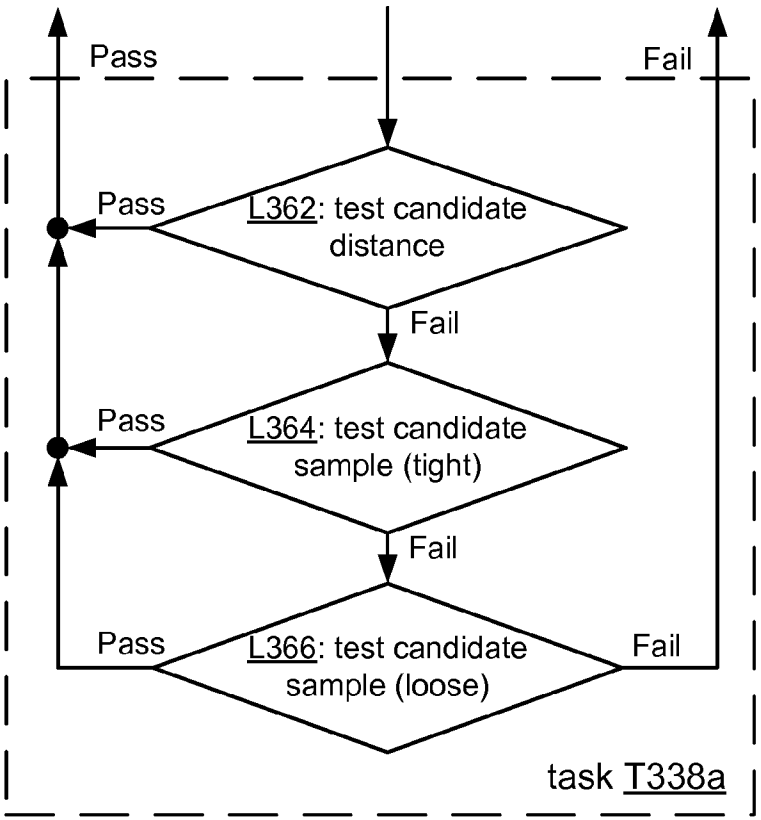
FIG. 24A shows four different sets of test conditions that may be used by an implementation of task L334.
FIG. 24B shows a flowchart for an implementation L338*a* of task L338.
Figure 25:
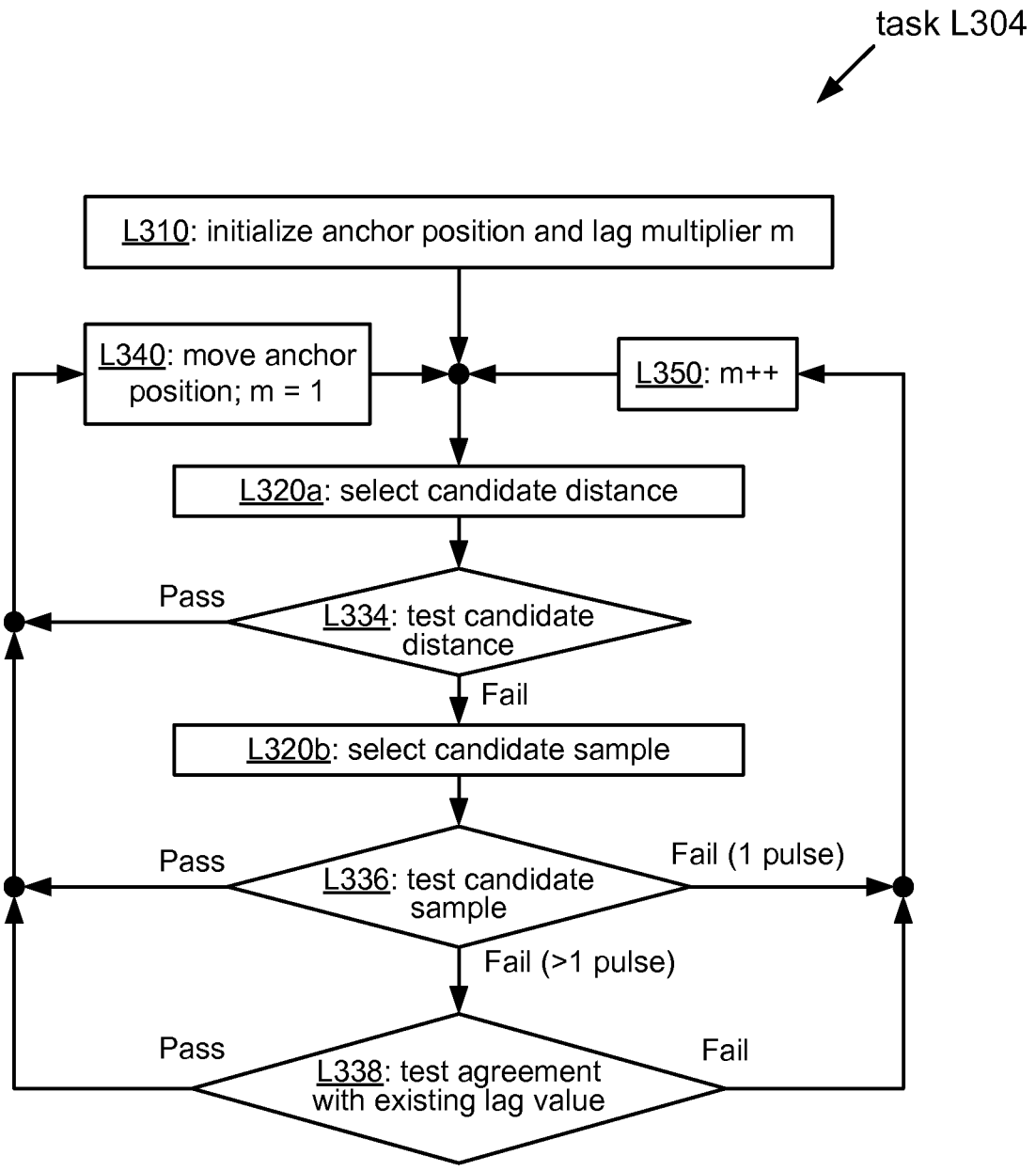
FIG. 25 shows a flowchart for an implementation L304 of task L300.

Task L334 tests the candidate distance. Task L334 is typically configured to compare the correlation result to a threshold value. It may also be desirable for task L334 to compare a measure based on the energy of the corresponding sample (e.g., the ratio of sample energy to frame average energy) to a threshold value. For a case in which only one pitch pulse has been identified, task L334 may be configured to verify that the candidate distance is at least equal to a minimum value (e.g., a minimum allowable lag value, such as twenty samples). The columns of the table of FIG. 24A show four different sets of test conditions based on the values of such parameters that may be used by an implementation of task L334 to determine whether to accept the sample that corresponds to the candidate distance as a pitch peak.

For a case in which task L334 accepts the sample that corresponds to the candidate distance as a pitch peak, it may be desirable to adjust the peak location to the left or right (for example, by one sample) if that sample has a higher amplitude (alternatively, a higher magnitude). Alternatively or additionally, it may be desirable in such a case for task L334 to set the value of window size parameter WS to a smaller value (e.g., ten samples) for further iterations of task L300 (or to set one or both of parameters WS1 and WS2 to such a value). If the new pitch peak is only the second one confirmed for the frame, it may also be desirable for task L334 to calculate the current lag estimate as the distance between the anchor position and the peak location.

Task L302 includes a subtask L336 that tests the candidate sample. Task L336 may be configured to determine whether a measure of the sample energy (e.g., the ratio of sample energy to frame average energy) exceeds (alternatively, is not less than) a threshold value. It may be desirable to vary the threshold value depending on how many pitch peaks have been confirmed for the frame. For example, it may be desirable for task L336 to use a lower threshold value (e.g., T−3) if only one pitch peak has been confirmed for the frame, and to use a higher threshold value (e.g., T) if more than one pitch peak has already been confirmed for the frame.

For a case in which task L336 selects the candidate sample as the second confirmed pitch peak, it may also be desirable for task L336 to adjust the peak location to the left or right (for example, by one sample) based on results of correlation with the terminal pitch peak. In such case, task L336 may be configured to correlate a segment of length N5 samples that is centered at each such sample with a segment of equal length that is centered at the terminal pitch peak (in one example, the value of N5 is eleven samples). Alternatively or additionally, it may be desirable in such a case for task L336 to set the value of window size parameter WS to a smaller value (e.g., ten samples) for further iterations of task L300 (or to set one or both of parameters WS1 and WS2 to such a value).

For a case in which both of test tasks L334 and L336 have failed and only one pitch peak has been confirmed for the frame, task L302 may be configured to increment the value of lag estimate multiplier m (via task L350), to iterate task L320 at the new value of m to select a new candidate sample and a new candidate distance, and to repeat task L332 for the new candidates.

As shown in FIG. 23, task L336 may be arranged to execute upon failure of candidate distance test task L334. In another implementation of task T332, candidate sample test task L336 may be arranged to execute first, such that candidate distance test task L334 executes only upon failure of task L336.

Task L332 also includes a subtask L338. For a case in which both of test tasks L334 and L336 have failed and more than one pitch peak has already been confirmed for the frame, task L338 tests agreement of one or both of the candidates with the current lag estimate.

FIG. 24B shows a flowchart for an implementation L338*a* of task L338. Task L338*a* includes a subtask L362 that tests the candidate distance. If the absolute difference between the candidate distance and the current lag estimate is less than (alternatively, not greater than) a threshold value, then task L362 accepts the candidate distance. In one example, the threshold value is three samples. It may also be desirable for task L362 to verify that the correlation result and/or the energy of the corresponding sample are acceptably high. In one such example, task L362 accepts a candidate distance that is less than (alternatively, not greater than) the threshold value if the correlation result is not less than 0.35 and the ratio of sample energy to frame average energy is not less than 0.5. For a case in which task L362 accepts the candidate distance, it may also be desirable for task L362 to adjust the peak location to the left or right (e.g., by one sample) if that sample has a higher amplitude (alternatively, a higher magnitude).

Task L338*a* also includes a subtask L364 that tests the lag agreement of the candidate sample. If the absolute difference between (A) the distance between the candidate sample and the closest pitch peak and (B) the current lag estimate is less than (alternatively, not greater than) a threshold value, then task L364 accepts the candidate sample. In one example, the threshold value is a low value, such as two samples. It may also be desirable for task L364 to verify that the energy of the candidate sample is acceptably high. In one such example, task L364 accepts the candidate sample if it passes the lag agreement test and if the ratio of sample energy to frame average energy is not less than (T−5).

The implementation of task L338*a* shown in FIG. 24B also includes another subtask L366, which tests the lag agreement of the candidate sample against a looser bound than the low threshold value of task L364. If the absolute difference between (A) the distance between the candidate sample and the closest confirmed peak and (B) the current lag estimate is less than (alternatively, not greater than) a threshold value, then task L366 accepts the candidate sample. In one example, the threshold value is (0.175*lag). It may also be desirable for task L366 to verify that the energy of the candidate sample is acceptably high. In one such example, task L366 accepts the candidate sample if the ratio of sample energy to frame average energy is not less than (T−3).

If both of the candidate sample and the candidate distance fail all tests, task T302 increments the lag estimate multiplier m (via task T350), iterates task L320 at the new value of m to select a new candidate sample and a new candidate distance, and repeats task L330 for the new candidates until the frame boundary is reached. Once a new pitch peak has been confirmed, it may be desirable to search for another peak in the same direction until the frame boundary is reached. In this case, task L340 moves the anchor position to the new pitch peak and resets the value of lag estimate multiplier m to one. When the frame boundary is reached, it may be desirable to initialize the anchor position to the terminal pitch peak position and repeat task L300 in the opposite direction.

A large reduction in the lag estimate from one frame to the next may indicate a pitch overflow error. Such an error is caused by a drop in pitch frequency such that the lag value for the current frame exceeds the maximum allowable lag value. It may be desirable for method M300 to compare an absolute or relative difference between the previous and current lag estimates to a threshold value (e.g., when a new lag estimate is calculated, or at the end of the method) and to keep only the largest pitch peak of the frame if an error is detected. In one example, the threshold value is equal to 50% of the previous lag estimate.

For frames classified as transient (e.g., frames having a large pitch change, typically toward the end of a word) that have two pulses with a large magnitude squared ratio, it may be desirable to correlate over the entire current lag estimate, rather than over just a small window, before accepting the smaller peak as the a pitch peak. Such a case may arise with male voices, which typically have secondary peaks that may correlate well with the main peak over a small window. One of both of tasks L200 and L300 may be implemented to include such an operation.

It is expressly noted that lag estimation task L200 of method M300 may be the same task as lag estimation task E130 of method M100. It is expressly noted that terminal pitch peak location task L100 of method M300 may be the same task as terminal pitch peak position calculation task E120 of method M100. For an application in which both of methods M100 and M300 are executed, it may be desirable to arrange pitch pulse shape selection task E110 to execute upon conclusion of method M300.

Figure 27A:
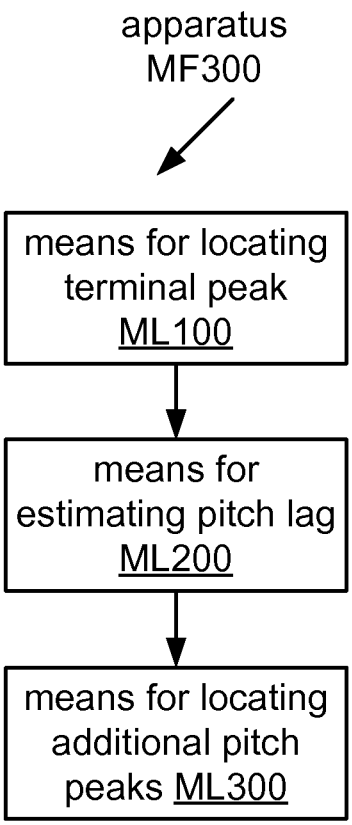
FIG. 27A shows a block diagram of an apparatus MF300 according to a general configuration.

FIG. 27A shows a block diagram of an apparatus MF300 that is configured to detect pitch peaks of a frame of a speech signal. Apparatus MF300 includes means ML100 for locating a terminal pitch peak of the frame (e.g., as described above with reference to various implementations of task L100). Apparatus MF300 includes means ML200 for estimating a pitch lag of the frame (e.g., as described above with reference to various implementations of task L200). Apparatus MF300 includes means ML300 for locating additional pitch peaks of the frame (e.g., as described above with reference to various implementations of task L300).

Figure 27B:
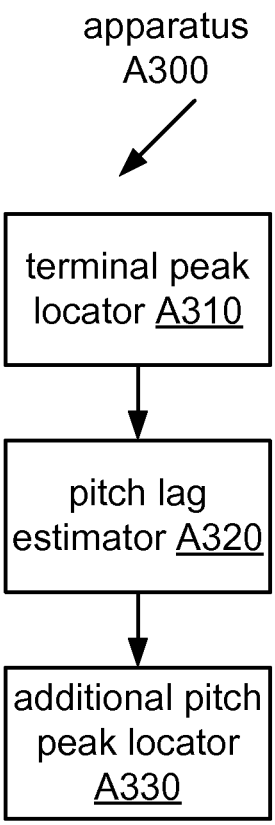
FIG. 27B shows a block diagram of an apparatus A300 according to a general configuration.

FIG. 27B shows a block diagram of an apparatus A300 that is configured to detect pitch peaks of a frame of a speech signal. Apparatus A300 includes a terminal pitch peak locator A310 that is configured to locate a terminal pitch peak of the frame (e.g., as described above with reference to various implementations of task L100). Apparatus A300 includes a pitch lag estimator A320 that is configured to estimate a pitch lag of the frame (e.g., as described above with reference to various implementations of task L200). Apparatus A300 includes an additional pitch peak locator A330 that is configured to locate additional pitch peaks of the frame (e.g., as described above with reference to various implementations of task L300).

Figure 27C:
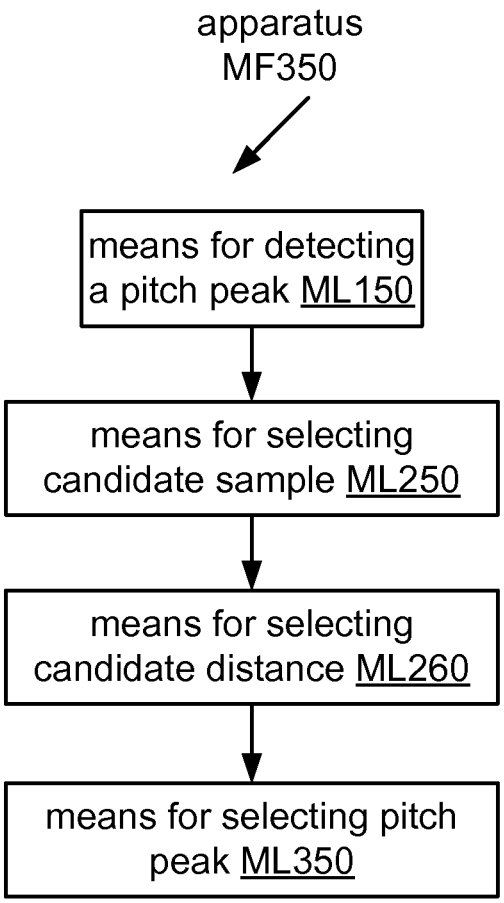
FIG. 27C shows a block diagram of an apparatus MF350 according to a general configuration.

FIG. 27C shows a block diagram of an apparatus MF350 that is configured to detect pitch peaks of a frame of a speech signal. Apparatus MF350 includes means ML150 for detecting a pitch peak of the frame (e.g., as described above with reference to various implementations of task L100). Apparatus MF350 includes means ML250 for selecting a candidate sample (e.g., as described above with reference to various implementations of task L320 and L320*b*). Apparatus MF350 includes means ML260 for selecting a candidate distance (e.g., as described above with reference to various implementations of task L320 and L320*a*). Apparatus MF350 includes means ML350 for selecting, as a pitch peak of the frame, one among the candidate sample and a sample that corresponds to the candidate distance (e.g., as described above with reference to various implementations of task L330).

Figure 27D:
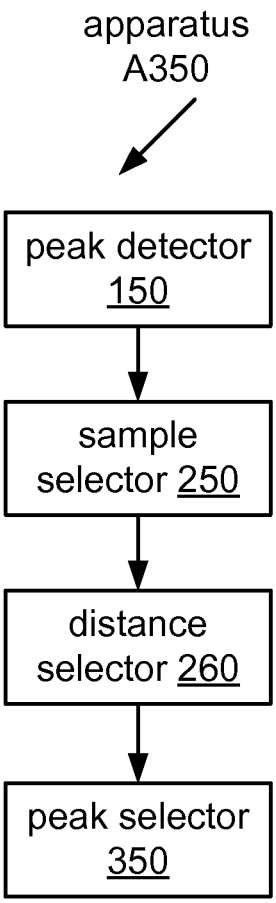
FIG. 27D shows a block diagram of an apparatus A350 according to a general configuration.

FIG. 27D shows a block diagram of an apparatus A350 that is configured to detect pitch peaks of a frame of a speech signal. Apparatus A350 includes a peak detector 150 configured to detect a pitch peak of the frame (e.g., as described above with reference to various implementations of task L100). Apparatus A350 includes a sample selector 250 configured to select a candidate sample (e.g., as described above with reference to various implementations of task L320 and L320*b*). Apparatus A350 includes a distance selector 260 configured to select a candidate distance (e.g., as described above with reference to various implementations of task L320 and L320*a*). Apparatus A350 includes a peak selector 350 configured to select, as a pitch peak of the frame, one among the candidate sample and a sample that corresponds to the candidate distance (e.g., as described above with reference to various implementations of task L330).

It may be desirable to implement speech encoder AE10, task E100, first frame encoder 100, and/or means FE100 to produce an encoded frame that uniquely indicates the position of the terminal pitch pulse of the frame. The position of the terminal pitch pulse, combined with the lag value, provides important phase information for decoding the following frame, which may lack such time-synchrony information (e.g., a frame encoded using a coding scheme such as QPPP). It may also be desirable to minimize the number of bits needed to convey such position information. Although eight bits (generally, $\lceil \log_2 N \rceil$ bits) would normally be needed to represent a unique position in a 160-bit (generally, N-bit) frame, a method as described herein may be used to encode the position of the terminal pitch pulse in only seven bits (generally, $\lfloor \log_2 N \rfloor$ bits). This method reserves one of the seven-bit values (for example, 127 (generally, $2^{\lfloor log_2 N \rfloor}-1$)) for use as a pitch pulse position mode value. In this description, the term "mode value" indicates a possible value of a parameter (e.g., pitch pulse position or estimated pitch period) which is co-opted to indicate a change of operating mode instead of an actual value of the parameter.

Figure 29A:
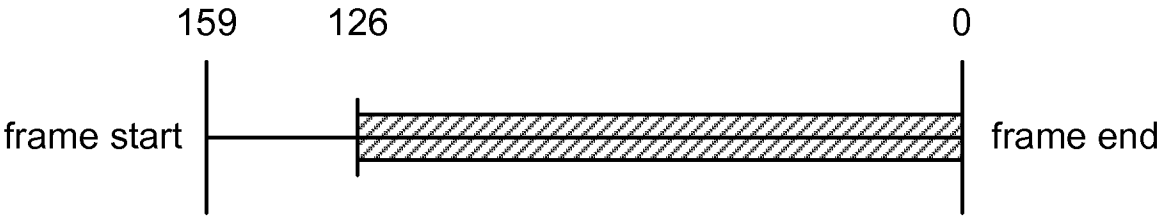
FIGS. 29A-D show various regions of a 160-bit frame.

For a situation in which the position of the terminal pitch pulse is given relative to the last sample (i.e., the final boundary of the frame), the frame will match one of the following three cases:

Case 1: The position of the terminal pitch pulse relative to the last sample of the frame is less than $(2^{\lfloor log_2 N \rfloor}-1)$ (e.g., less than 127, for a 160-bit frame as shown in FIG. 29A), and the frame contains more than one pitch pulse. In this case, the position of the terminal pitch pulse is encoded into $\lfloor \log_2 N \rfloor$ bits (seven bits), and the pitch lag is also transmitted (e.g., in seven bits).

Case 2: The position of the terminal pitch pulse relative to the last sample of the frame is less than $(2^{\lfloor log_2 N \rfloor}-1)$ (e.g., less than 127, for a 160-bit frame as shown in FIG. 29A), and the frame contains only one pitch pulse. In this case, the position of the terminal pitch pulse is encoded into $\lfloor \log_2 N \rfloor$ bits (e.g., seven bits), and the pitch lag is set to a lag mode value (in this example, $(2^{\lfloor log_2 N \rfloor}-1)$ (e.g., 127)).

Figure 29B:
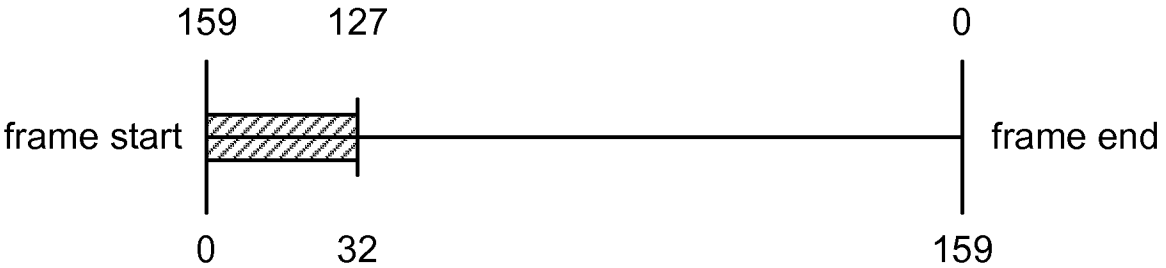

Case 3: If the position of the terminal pitch pulse relative to the last sample of the frame is greater than $(2^{\lfloor log_2 N \rfloor}-2)$ (e.g., greater than 126, for a 160-bit frame as shown in FIG. 29B), it is unlikely that the frame contains more than one pitch pulse. For a 160-bit frame and a sampling rate of 8 kHz, this would imply activity at a pitch of at least 250 Hz in about the first twenty percent of the frame, with no pitch pulses in the remainder of the frame. It would be unlikely for such a frame to be classified as an onset frame. In this case, the pitch pulse position mode value (e.g., $2^{\lfloor log_2 N \rfloor}-1$ or 127 as noted above) is transmitted in place of the actual pulse position, and the lag bits are used to carry the position of the terminal pitch pulse with respect to the first sample of the frame (i.e., the initial boundary of the frame). A corresponding decoder may be configured to test whether the position bits of the encoded frame indicate the pitch pulse position mode value (e.g., a pulse position of $(2^{\lfloor log_2 N \rfloor}-1)$). If so, the decoder may then obtain the position of the terminal pitch pulse with respect to the first sample of the frame from the lag bits of the encoded frame instead.

In case 3 as applied to a 160-bit frame, thirty-three such positions are possible (i.e., zero through 32). By rounding one of the positions into another (e.g., by rounding position 159 to position 158, or by rounding position 127 to position 128), the actual position can be transmitted in only five bits, leaving two of the seven lag bits of the encoded frame free to carry other information. Such a scheme of rounding one or more of the pitch pulse positions into other pitch pulse positions may also be used for frames of any other length to reduce the total number of unique pitch pulse positions to be encoded, possibly by one-half (e.g., by rounding each pair of adjacent positions into a single position for encoding) or even more.

Figure 28:
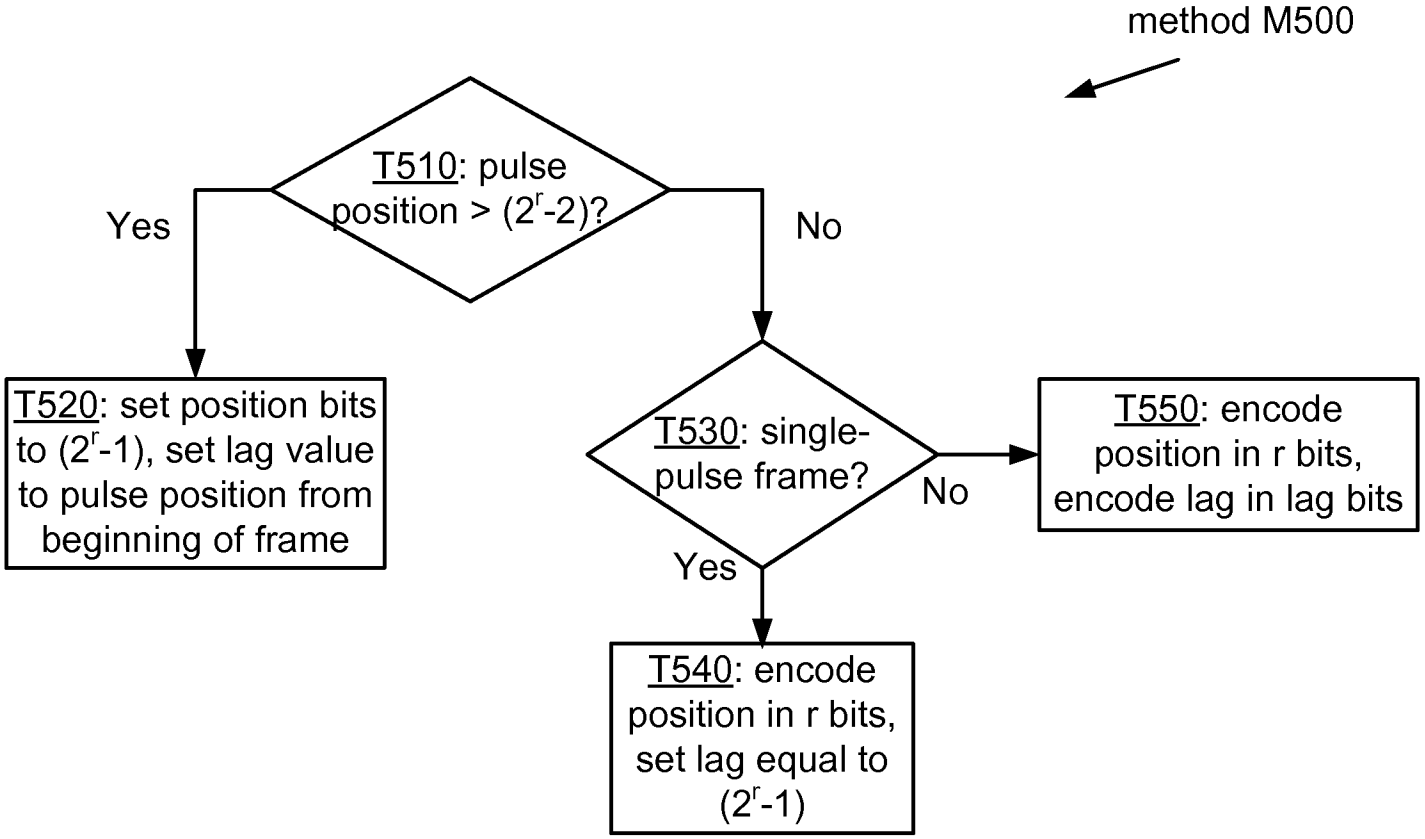
FIG. 28 shows a flowchart of a method M500 according to a general configuration.

FIG. 28 shows a flowchart of a method M500 according to a general configuration that operates according to the three cases above. Method M500 is configured to encode the position of the terminal pitch pulse in a q-bit frame using r bits, where r is less than $\log_2 q$. In one example as discussed above, q is equal to 160 and r is equal to seven. Method M500 may be performed within an implementation of speech encoder AE10 (for example, within an implementation of task E100, an implementation of first frame encoder 100, and/or an implementation of means FE100). Such a method may be applied generally for any integer value of r greater than one. For speech applications, r usually has a value in the range of from six to nine (corresponding to values of q of from 65 to 1023).

Method M500 includes tasks T510, T520, and T530. Task T510 determines whether the terminal pitch pulse position (relative to the last sample of the frame) is greater than $(2^r-2)$ (e.g., greater than 126). If the result is true, then the frame matches case 3 above. In this case, task T520 sets the terminal pitch pulse position bits (e.g., of a packet that carries the encoded frame) to the pitch pulse position mode value (e.g., $2^r-1$ or 127 as noted above) and sets the lag bits (e.g., of the packet) equal to the position of the terminal pitch pulse relative to the first sample of the frame.

If the result of task T510 is false, then task T530 determines whether the frame contains only one pitch pulse. If the result of task T530 is true, then the frame matches case 2 above, and there is no need to transmit a lag value. In this case, task T540 sets the lag bits (e.g., of the packet) to the lag mode value (e.g., $2^r-1$).

If the result of task T530 is false, then the frame contains more than one pitch pulse and the position of the terminal pitch pulse relative to the end of the frame is not greater than $(2^r-2)$ (e.g., is not greater than 126). Such a frame matches case 1 above, and task T550 encodes the position in r bits and encodes the lag value into the lag bits.

Figure 29C:
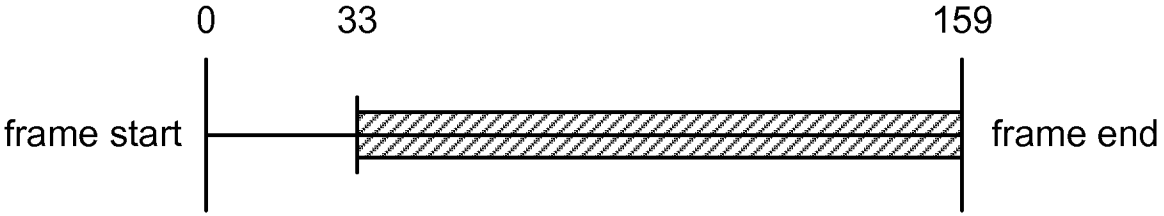

For a situation in which the position of the terminal pitch pulse is given relative to the first sample (i.e., the initial boundary), the frame will match one of the following three cases:

Case 1: The position of the terminal pitch pulse relative to the first sample of the frame is greater than $(N-2^{\lfloor \log_2 N \rfloor})$ (e.g., greater than 32, for a 160-bit frame as shown in FIG. 29C), and the frame contains more than one pitch pulse. In this case, the position of the terminal pitch pulse minus $(N-2^{\lfloor \log_2 N \rfloor})$ is encoded into $\lfloor \log_2 N \rfloor$ bits (e.g., seven bits), and the pitch lag is also transmitted (e.g., in seven bits).

Case 2: The position of the terminal pitch pulse relative to the first sample of the frame is greater than $(N-2^{\lfloor \log_2 N \rfloor})$ (e.g., greater than 32, for a 160-bit frame as shown in FIG. 29C), and the frame contains only one pitch pulse. In this case, the position of the terminal pitch pulse minus $(N-2^{\lfloor \log_2 N \rfloor})$ is encoded into $\lfloor \log_2 N \rfloor$ bits (e.g., seven bits), and the pitch lag is set to the lag mode value (in this example, $2^{\lfloor \log_2 N \rfloor}-1$ (e.g., 127)).

Figure 29D:
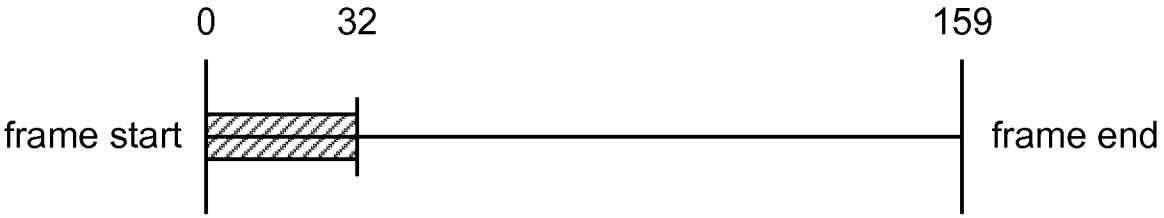

Case 3: If the position of the terminal pitch pulse is not greater than $(N-2^{\lfloor \log_2 N \rfloor})$ (e.g., not greater than 32, for a 160-bit frame as shown in FIG. 29D), it is unlikely that the frame contains more than one pitch pulse. For a 160-bit frame and a sampling rate of 8 kHz, this would imply activity at a pitch of at least 250 Hz in about the first twenty percent of the frame, with no pitch pulses in the remainder of the frame. It would be unlikely for such a frame to be classified as an onset frame. In this case, the pitch pulse position mode value (e.g., $2^{\lfloor \log_2 N \rfloor}-1$ or 127) is transmitted in place of the actual pulse position, and the lag bits are used to transmit the position of the terminal pitch pulse with respect to the first sample of the frame (i.e., the initial boundary). A corresponding decoder may be configured to test whether the position bits of the encoded frame indicate the pitch pulse position mode value (e.g., a pulse position of $(2^{\lfloor \log_2 N \rfloor}-1)$). If so, the decoder may then obtain the position of the terminal pitch pulse with respect to the first sample of the frame from the lag bits of the encoded frame instead.

In case 3 as applied to a 160-bit frame, thirty-three such positions are possible (zero through 32). By rounding one of the positions into another (e.g., by rounding position 0 to position 1, or by rounding position 32 to position 31), the actual position can be transmitted in only five bits, leaving two of the seven lag bits of the encoded frame free to carry other information. Such a scheme of rounding one or more of the pulse positions into other pulse positions may also be used for frames of any other length to reduce the total number of unique positions to be encoded, possibly by one-half (e.g., by rounding each pair of adjacent positions into a single position for encoding) or even more. One of skill in the art will recognize that method M500 may be modified for a situation in which the position of the terminal pitch pulse is given relative to the first sample.

Figure 30A:
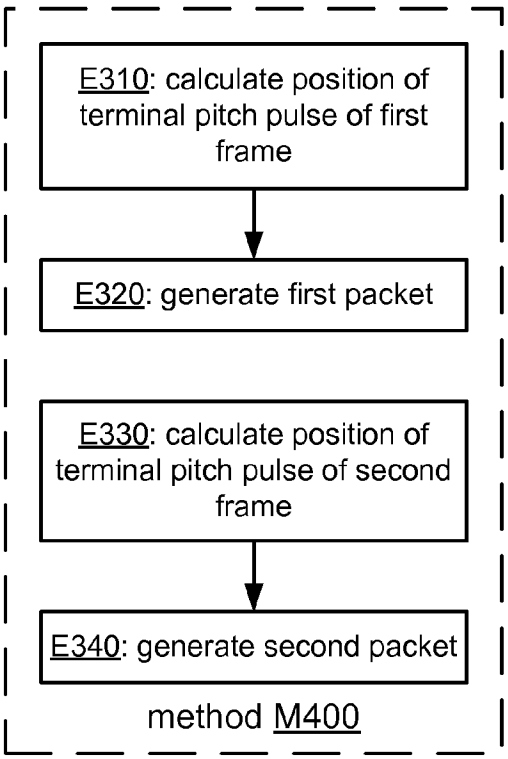
FIG. 30A shows a flowchart of a method M400 according to a general configuration.

FIG. 30A shows a flowchart of a method of processing speech signal frames M400 according to a general configuration that includes tasks E310 and E320. Method M400 may be performed within an implementation of speech encoder AE10 (for example, within an implementation of task E100, an implementation of first frame encoder 100, and/or an implementation of means FE100). Task E310 calculates a position within a first speech signal frame ("the first position"). The first position is the position of a terminal pitch pulse of the frame with respect to the last sample of the frame (alternatively, with respect to the first sample of the frame). Task E310 may be implemented as an instance of pulse position calculation task E120 or L100 as described herein. Task E320 generates a first packet that carries the first speech signal frame and includes the first position.

Method M400 also includes tasks E330 and E340. Task E330 calculates a position within a second speech signal frame ("the second position"). The second position is the position of a terminal pitch pulse of the frame with respect to one among (A) the first sample of the frame and (B) the last sample of the frame. Task E330 may be implemented as an instance of pulse position calculation task E120 as described herein. Task E340 generates a second packet that carries the second speech signal frame and includes a third position within the frame. The third position is the position of the terminal pitch pulse with respect to the other among the first sample of the frame and the last sample of the frame. In other words, if task T330 calculates the second position with respect to the last sample, then the third position is with respect to the first sample, and vice versa.

In one particular example, the first position is the position of the final pitch pulse of the first speech signal frame with respect to the final sample of the frame, the second position is the position of the final pitch pulse of the second speech signal frame with respect to the final sample of the frame, and the third position is the position of the final pitch pulse of the second speech signal frame with respect to the first sample of the frame.

The speech signal frames processed by method M400 are typically frames of an LPC residual signal. The first and second speech signal frames may be from the same voice communication session or may be from different voice communication sessions. For example, the first and second speech signal frames may be from a speech signal that is spoken by one person or may be from two different speech signals that are each spoken by a different person. The speech signal frames may undergo other processing operations (e.g., perceptual weighting) before and/or after the pitch pulse positions are calculated.

It may be desirable for both of the first and second packets to conform to a packet description (also called a packet template) that indicates corresponding locations within the packet for different items of information. An operation of generating a packet (e.g., as performed by tasks E320 and E340) may include writing different items of information to a buffer according to such a packet template. Generating a packet according to such a template may be desirable to facilitate decoding of the packet (e.g., by associating values carried by the packet with corresponding parameters according to the locations of the values within the packet).

The length of the packet template may be equal to the length of an encoded frame (e.g., forty bits for a quarter-rate coding scheme). In one such example, the packet template includes a region of seventeen bits that is used to indicate LSP values and encoding mode, a region of seven bits that is used to indicate the position of the terminal pitch pulse, a region of seven bits that is used to indicate the estimated pitch period, a region of seven bits that is used to indicate pulse shape, and a region of two bits that is used to indicate gain profile. Other examples include templates in which the region for LSP values is smaller and the region for gain profile is correspondingly larger. Alternatively, the packet template may be longer than an encoded frame (e.g., for a case in which the packet carries more than one encoded frame). A packet generating operation, or a packet generator configured to perform such an operation, may also be configured to produce packets of different lengths (e.g., for a case in which some frame information is encoded less frequently than other frame information).

Figure 31A:
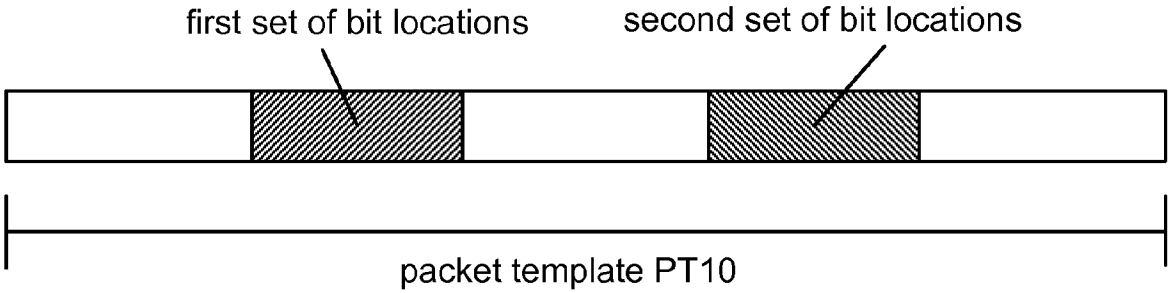
FIG. 31A shows one example of a packet template PT10.
Figure 31B:
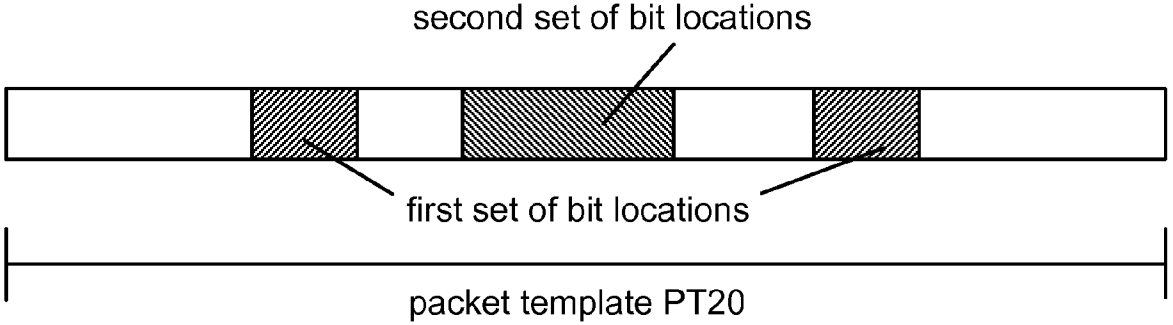
FIG. 31B shows an example of another packet template PT20.
Figure 31C:
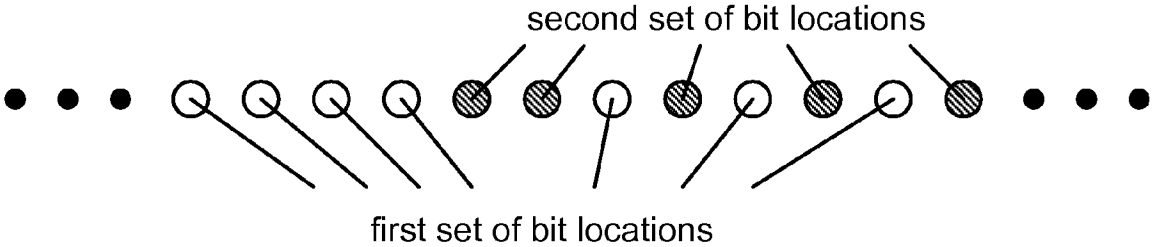
FIG. 31C illustrates two disjoint sets of bit locations that are partly interleaved.

In one general case, method M400 is implemented to use a packet template that includes first and second sets of bit locations. In such a case, task E320 may be configured to generate the first packet such that the first position occupies the first set of bit locations, and task E340 may be configured to generate the second packet such that the third position occupies the second set of bit locations. It may be desirable for the first and second sets of bit locations to be disjoint (i.e., such that no bit of the packet is in both sets). FIG. 31A shows one example of a packet template PT10 that includes first and second sets of bit locations that are disjoint. In this example, each of the first and second sets is a consecutive series of bit locations. In general, however, the bit locations within a set need not be adjacent to one another. FIG. 31B shows an example of another packet template PT20 that includes first and second sets of bit locations that are disjoint. In this example, the first set includes two series of bit locations that are separated from one another by one or more other bit locations. The two disjoint sets of bit locations in the packet template may even be at least partly interleaved, as illustrated for example in FIG. 31C.

Figure 30B:
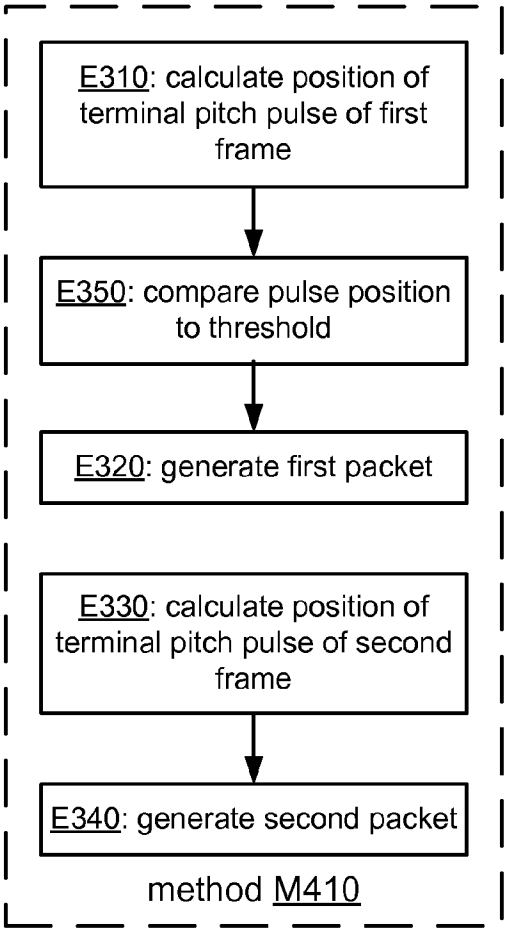
FIG. 30B shows a flowchart of an implementation M410 of method M400.

FIG. 30B shows a flowchart of an implementation M410 of method M400. Method M410 includes task E350, which compares the first position to a threshold value. Task E350 produces a result that has a first state when the first position is less than the threshold value and has a second state when the first position is greater than the threshold value. In such case, task E320 may be configured to generate the first packet in response to the result of task E350 having the first state.

In one example, the result of task E350 has the first state when the first position is less than the threshold value and has the second state otherwise (i.e., when the first position is not less than the threshold value). In another example, the result of task E350 has the first state when the first position is not greater than the threshold value and has the second state otherwise (i.e., when the first position is greater than the threshold value). Task E350 may be implemented as an instance of task T510 as described herein.

Figure 30C:
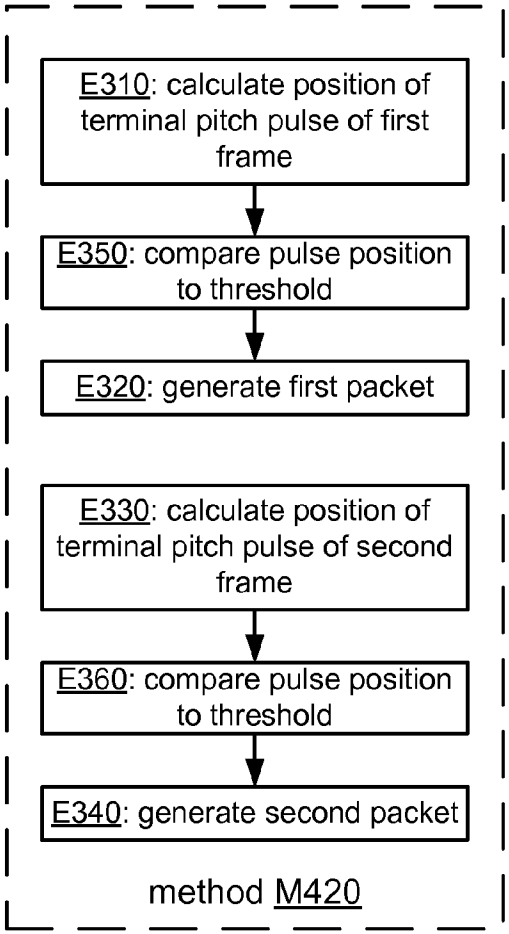
FIG. 30C shows a flowchart of an implementation M420 of method M400.

FIG. 30C shows a flowchart of an implentation M420 of method M410. Method M420 includes task E360, which compares the second position to the threshold value. Task E360 produces a result that has a first state when the second position is less than the threshold value and has a second state when the second position is greater than the threshold value. In such case, task E340 may be configured to generate the second packet in response to the result of task E360 having the second state.

In one example, the result of task E360 has the first state when the second position is less than the threshold value and has the second state otherwise (i.e., when the second position is not less than the threshold value). In another example, the result of task E360 has the first state when the second position is not greater than the threshold value and has the second state otherwise (i.e., when the second position is greater than the threshold value). Task E360 may be implemented as an instance of task T510 as described herein.

Method M400 is typically configured to obtain the third position based on the second position. For example, method M400 may include a task that calculates the third position by subtracting the second position from the frame length and decrementing the result, or by subtracting the second position from a value that is one less than the frame length, or by performing another operation that is based on the second position and the frame length. However, method M400 may otherwise be configured to obtain the third position according to any of the pitch pulse position calculation operations described herein (e.g., with reference to task E120).

Figure 32A:
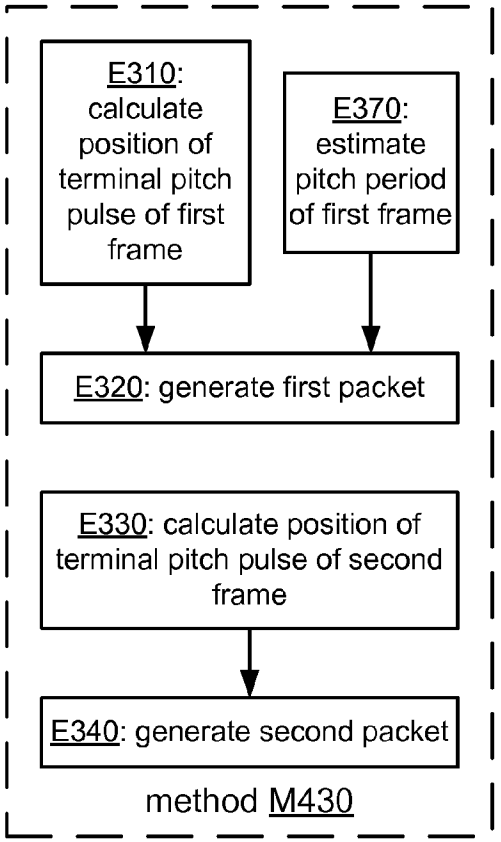
FIG. 32A shows a flowchart of an implementation M430 of method M400.

FIG. 32A shows a flowchart of an implementation M430 of method M400. Method M430 includes task E370, which estimates a pitch period of the frame. Task E370 may be implemented as an instance of pitch period estimation task E130 or L200 as described herein. In this case, packet generation task E320 is implemented such that the first packet includes an encoded pitch period value that indicates the estimated pitch period. For example, task E320 may be configured such that the encoded pitch period value occupies the second set of bit locations of the packet. Method M430 may be configured to calculate the encoded pitch period value (e.g., within task E370) such that it indicates the estimated pitch period as an offset relative to a minimum pitch period value (e.g., twenty). For example, method M430 (e.g., task E370) may be configured to calculate the encoded pitch period value by subtracting the minimum pitch period value from the estimated pitch period.

Figure 32B:
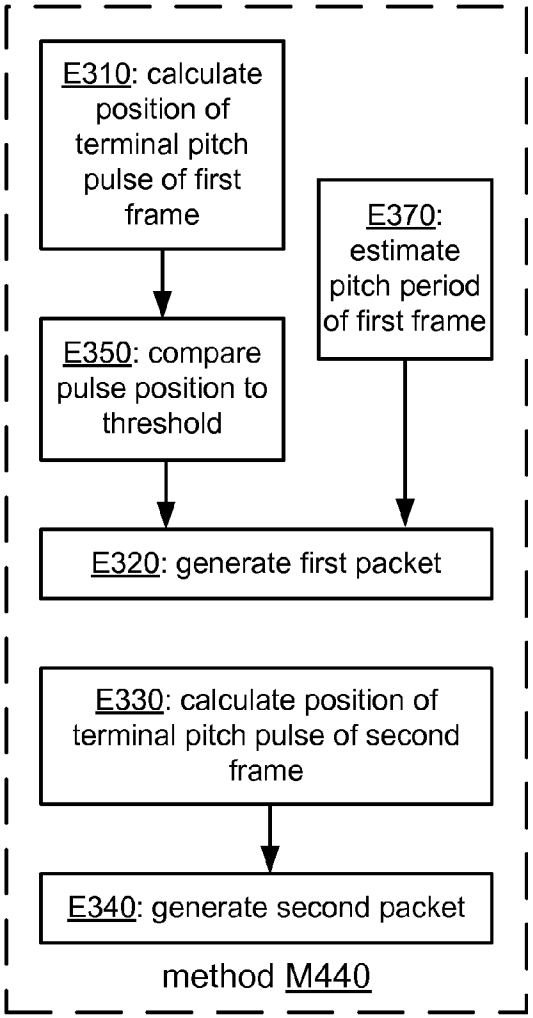
FIG. 32B shows a flowchart of an implementation M440 of method M400.
Figure 32C:
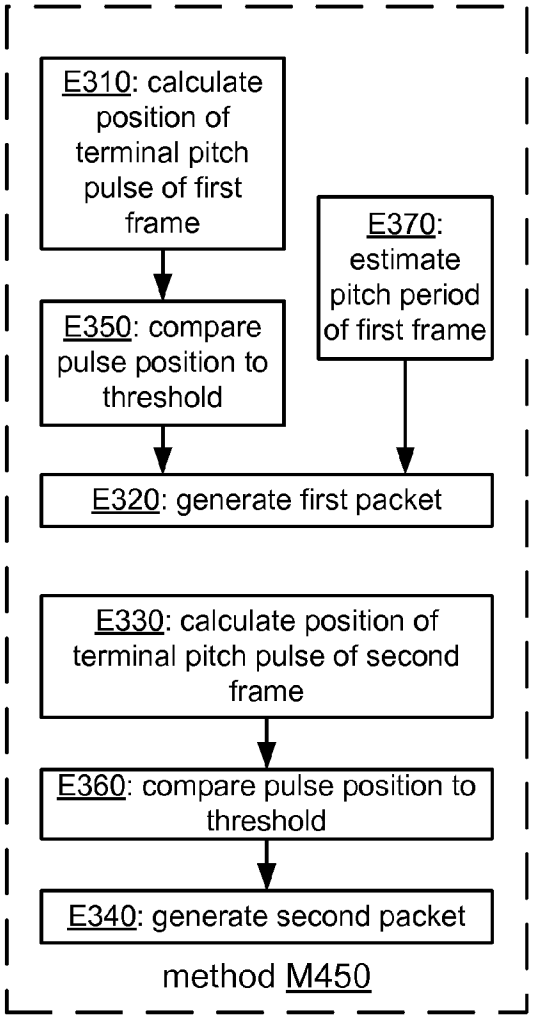
FIG. 32C shows a flowchart of an implementation M450 of method M400.

FIG. 32B shows a flowchart of an implementation M440 of method M430 that also includes comparison task E350 as described herein. FIG. 32C shows a flowchart of an implementation M450 of method M440 that also includes comparison task E360 as described herein.

Figure 33A:
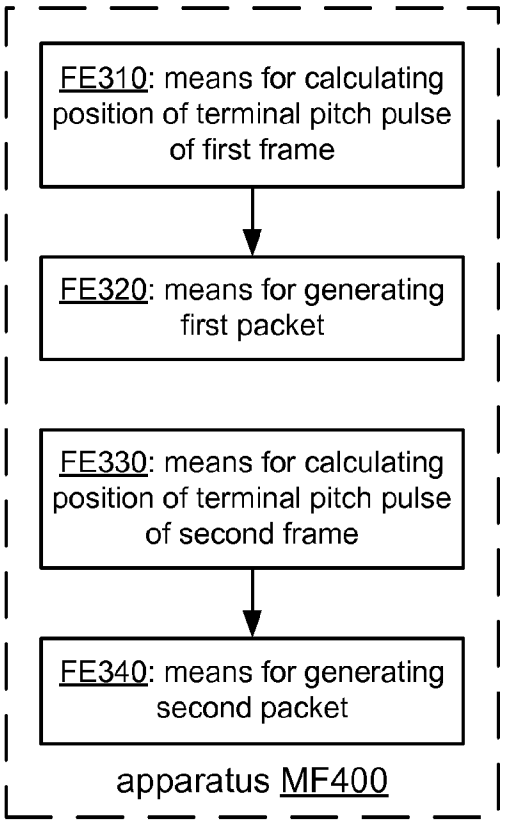
FIG. 33A shows a block diagram of an apparatus MF400 according to a general configuration.

FIG. 33A shows a block diagram of an apparatus MF400 that is configured to process speech signal frames. Apparatus MF100 includes means for calculating the first position FE310 (e.g., as described above with reference to various implementations of task E310, E120, and/or L100) and means for generating a first packet FE320 (e.g., as described above with reference to various implementations of task E320). Apparatus MF100 includes means for calculating the second position FE330 (e.g., as described above with reference to various implementations of task E330, E120, and/or L100) and means for generating a second packet FE340 (e.g., as described above with reference to various implementations of task E340). Apparatus MF400 may also include means for calculating the third position (e.g., as described above with reference to method M400).

Figure 33B:
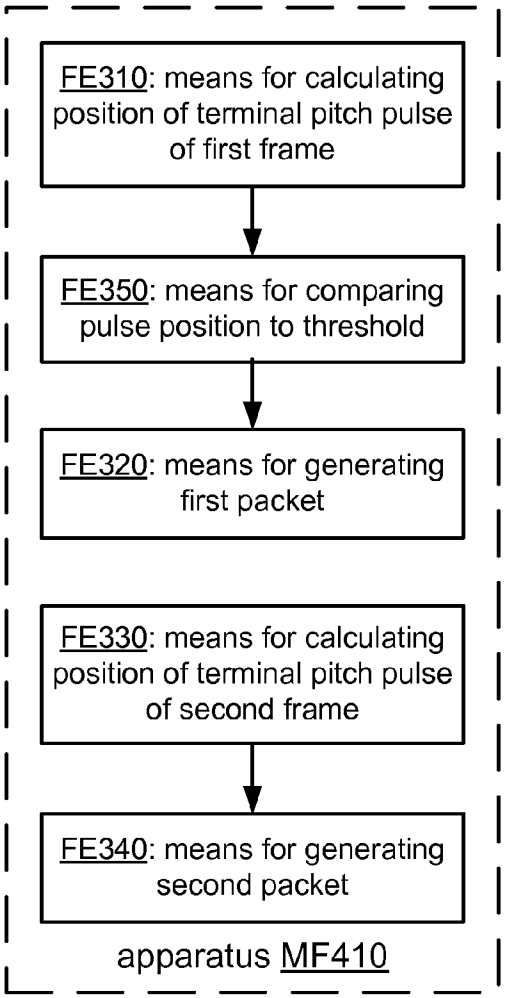
FIG. 33B shows a block diagram of an implementation MF410 of apparatus MF400.
Figure 33C:
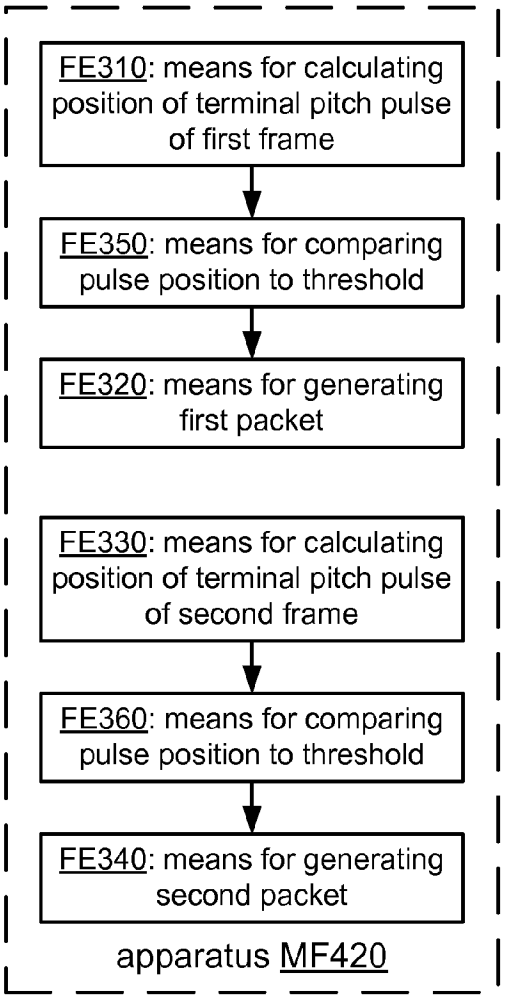
FIG. 33C shows a block diagram of an implementation MF420 of apparatus MF400.

FIG. 33B shows a block diagram of an implementation MF410 of apparatus MF400 that also includes means for comparing the first position to a threshold value FE350 (e.g., as described above with reference to various implementations of task E350). FIG. 33C shows a block diagram of an implementation MF420 of apparatus MF410 that also includes means for comparing the second position to the threshold value FE360 (e.g., as described above with reference to various implementations of task E360).

Figure 34A:
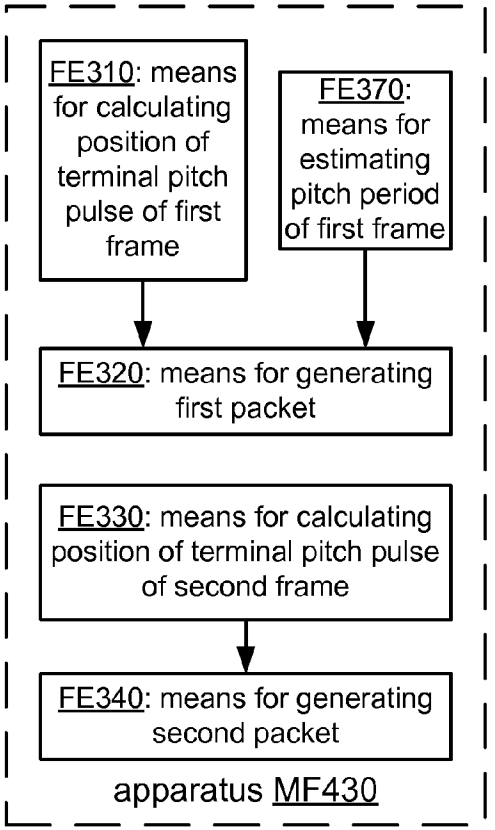
FIG. 34A shows a block diagram of an implementation MF430 of apparatus MF400.
Figure 34B:
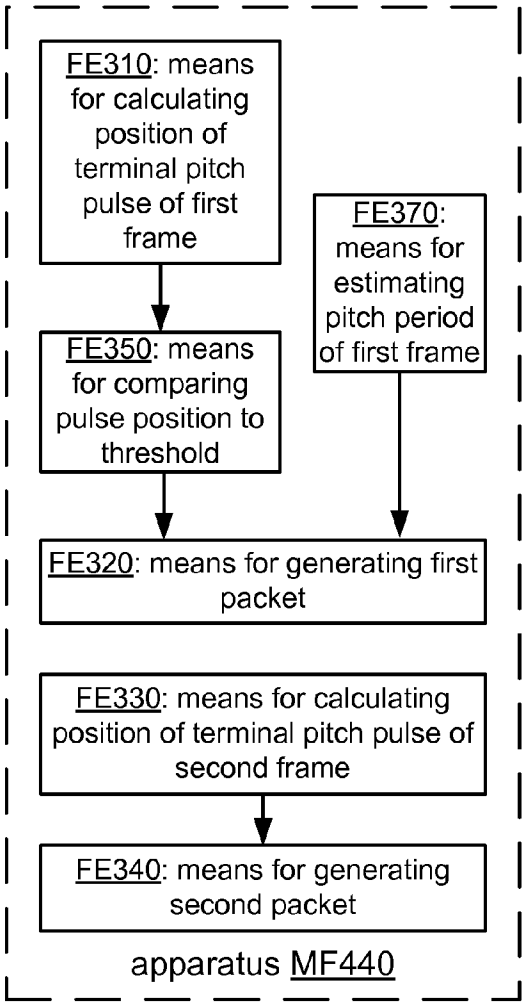
FIG. 34B shows a block diagram of an implementation MF440 of apparatus MF400.
Figure 34C:
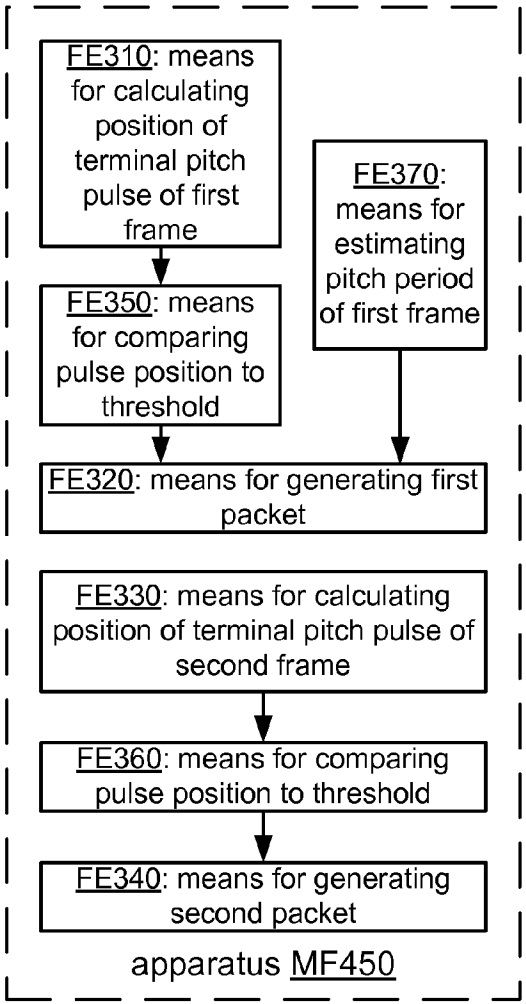
FIG. 34C shows a block diagram of an implementation MF450 of apparatus MF400.

FIG. 34A shows a block diagram of an implementation MF430 of apparatus MF400. Apparatus MF430 includes means for estimating a pitch period of the first frame FE370 (e.g., as described above with reference to various implementations of task E370, E130, and/or L200). FIG. 34B shows a block diagram of an implementation MF440 of apparatus MF430 that includes means FE370. FIG. 34C shows a block diagram of an implementation MF450 of apparatus MF440 that includes means FE360.

Figure 35A:
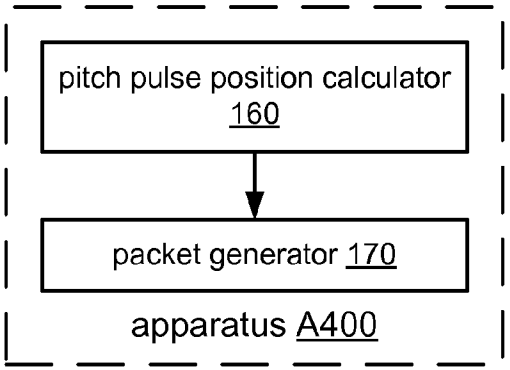
FIG. 35A shows a block diagram of an apparatus A400 according to a general configuration.

FIG. 35A shows a block diagram of an apparatus for processing speech signal frames (e.g., a frame encoder) A400 according to a general configuration that includes a pitch pulse position calculator 160 and a packet generator 170. Pitch pulse position calculator 160 is configured to calculate a first position within a first speech signal frame (e.g., as described above with reference to task E310, E120, and/or L100) and to calculate a second position within a second speech signal frame (e.g., as described above with reference to task E330, E120, and/or L100). For example, pitch pulse position calculator 160 may be implemented as an instance of pitch pulse position calculator 120 or terminal peak locator A310 as described herein. Packet generator 170 is configured to generate a first packet that represents the first speech signal frame and includes the first position (e.g., as described above with reference to task E320) and to generate a second packet that represents the second speech signal frame and includes a third position within the second speech signal frame (e.g., as described above with reference to task E340).

Packet generator 170 may be configured to generate a packet to include information that indicates other parameter values of the encoded frame, such as encoding mode, pulse shape, one or more LSP vectors, and/or gain profile. Packet generator 170 may be configured to receive such information from other elements of apparatus A400 and/or from other elements of a device that includes apparatus A400. For example, apparatus A400 may be configured to perform LPC analysis (e.g., to generate the speech signal frames) or to receive LPC analysis parameters (e.g., one or more LSP vectors) from another element, such as an instance of residual generator RG10.

Figure 35B:
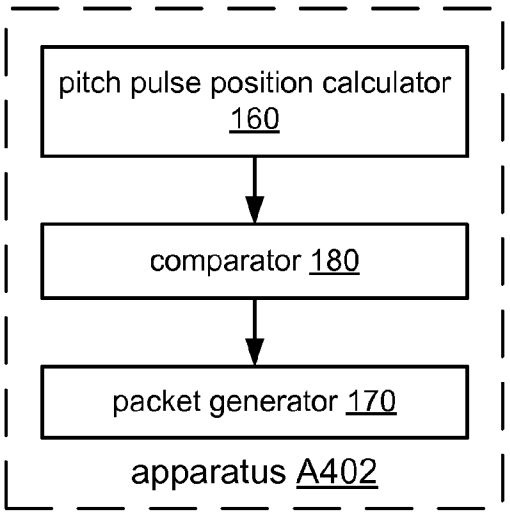
FIG. 35B shows a block diagram of an implementation A402 of apparatus A400.

FIG. 35B shows a block diagram of an implementation A402 of apparatus A400 that also includes a comparator 180. Comparator 180 is configured to compare the first position to a threshold value and to produce a first output that has a first state when the first position is less than the threshold value and a second state when the first position is greater than the threshold value (e.g., as described above with reference to various implementations of task E350). In this case, packet generator 170 may be configured to generate the first packet in response to the first output having the first state.

Comparator 180 may also be configured to compare the second position to the threshold value and to produce a second output that has a first state when the second position is less than the threshold value and a second state when the second position is greater than the threshold value (e.g., as described above with reference to various implementations of task E360). In this case, packet generator 170 may be configured to generate the second packet in response to the second output having the second state.

Figure 35C:
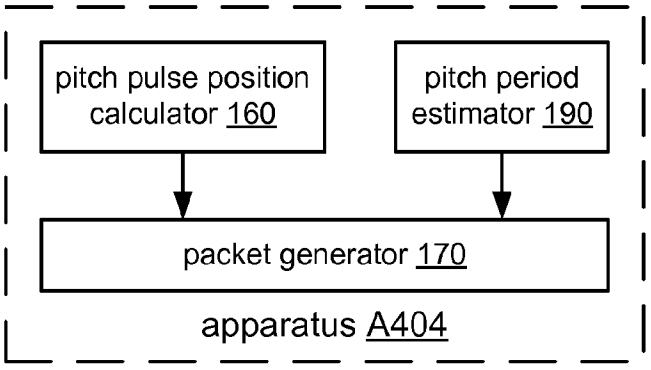
FIG. 35C shows a block diagram of an implementation A404 of apparatus A400.
Figure 35D:
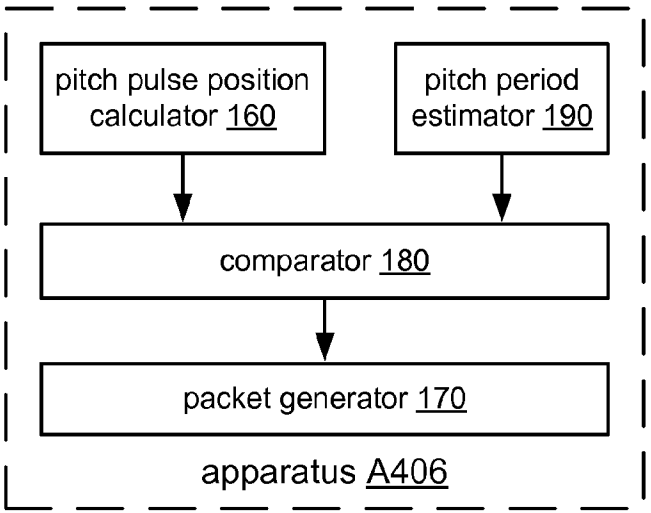
FIG. 35D shows a block diagram of an implementation A406 of apparatus A400.

FIG. 35C shows a block diagram of an implementation A404 of apparatus A400 that includes a pitch period estimator 190 configured to estimate a pitch period of the first speech signal frame (e.g., as described above with reference to task E370, E130, and/or L200). For example, pitch period estimator 190 may be implemented as an instance of pitch period estimator 130 or pitch lag estimator A320 as described herein. In this case, packet generator 170 is configured to generate the first packet such that a set of bits that indicate the estimated pitch period occupies the second set of bit locations. FIG. 35D shows a block diagram of an implementation A406 of apparatus A402 that includes pitch period estimator 190.

Speech encoder AE10 may be implemented to include apparatus A400. For example, first frame encoder 104 of speech encoder AE20 may be implemented to include an instance of apparatus A400 such that pitch pulse position calculator 120 also serves as calculator 160 (with pitch period estimator 130 possibly serving also as estimator 190).

Figure 36B:
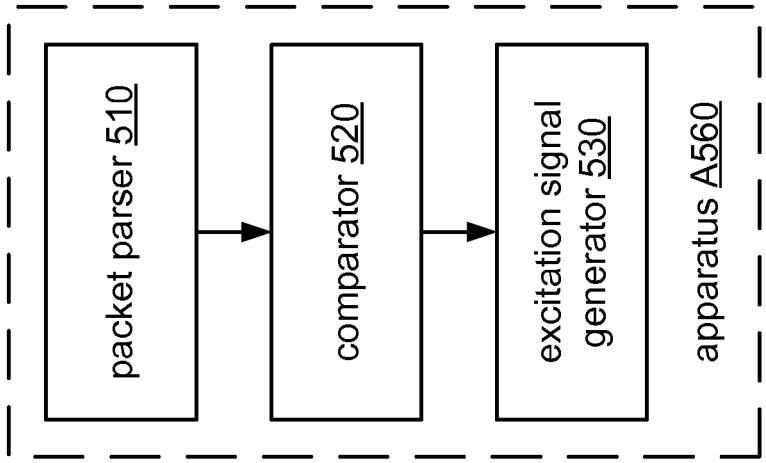
FIG. 36B shows a block diagram of an apparatus A560 according to a general configuration
Figure 36A:
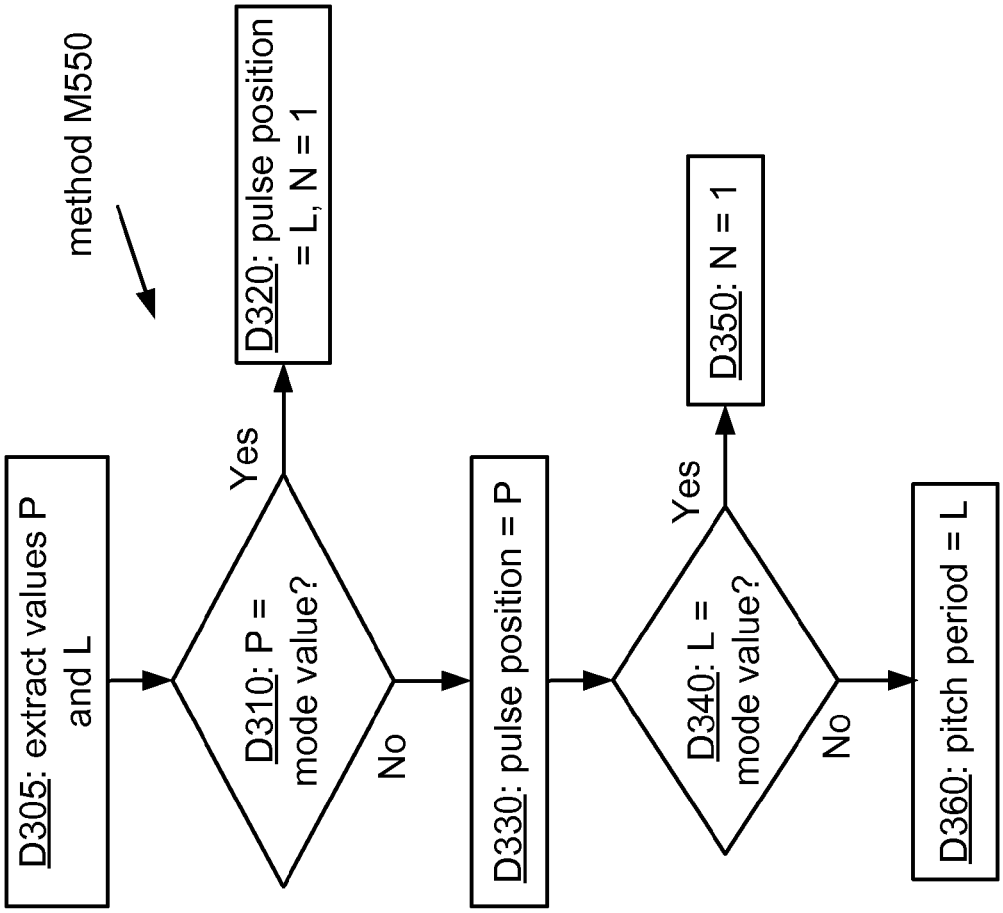
FIG. 36A shows a flowchart of a method M550 according to a general configuration.

FIG. 36A shows a flowchart of a method of decoding an encoded frame (e.g., a packet) M550 according to a general configuration. Method M550 includes tasks D305, D310, D320, D330, D340, D350, and D360. Task D305 extracts values P and L from the encoded frame. For a case in which the encoded frame conforms to a packet template as described herein, task D305 may be configured to extract P from a first set of bit locations of the encoded frame and to extract L from a second set of bit locations of the encoded frame. Task D310 compares P to a pitch position mode value. If P is equal to the pitch position mode value, then task D320 obtains from L a pulse position relative to one among the first and last samples of the decoded frame. Task D320 also assigns a value of one to the number N of pulses in the frame. If P is not equal to the pitch position mode value, then task D330 obtains from P a pulse position relative to the other among the first and last samples of the decoded frame. Task D340 compares L to a pitch period mode value. If L is equal to the pitch period mode value, then task D350 assigns a value of one to the number N of pulses in the frame. Otherwise, task D360 obtains a pitch period value from L. In one example, task D360 is configured to calculate the pitch period value by adding a minimum pitch period value to L. A frame decoder 300 or means FD100 as described herein may be configured to perform method M550.

Figure 37:
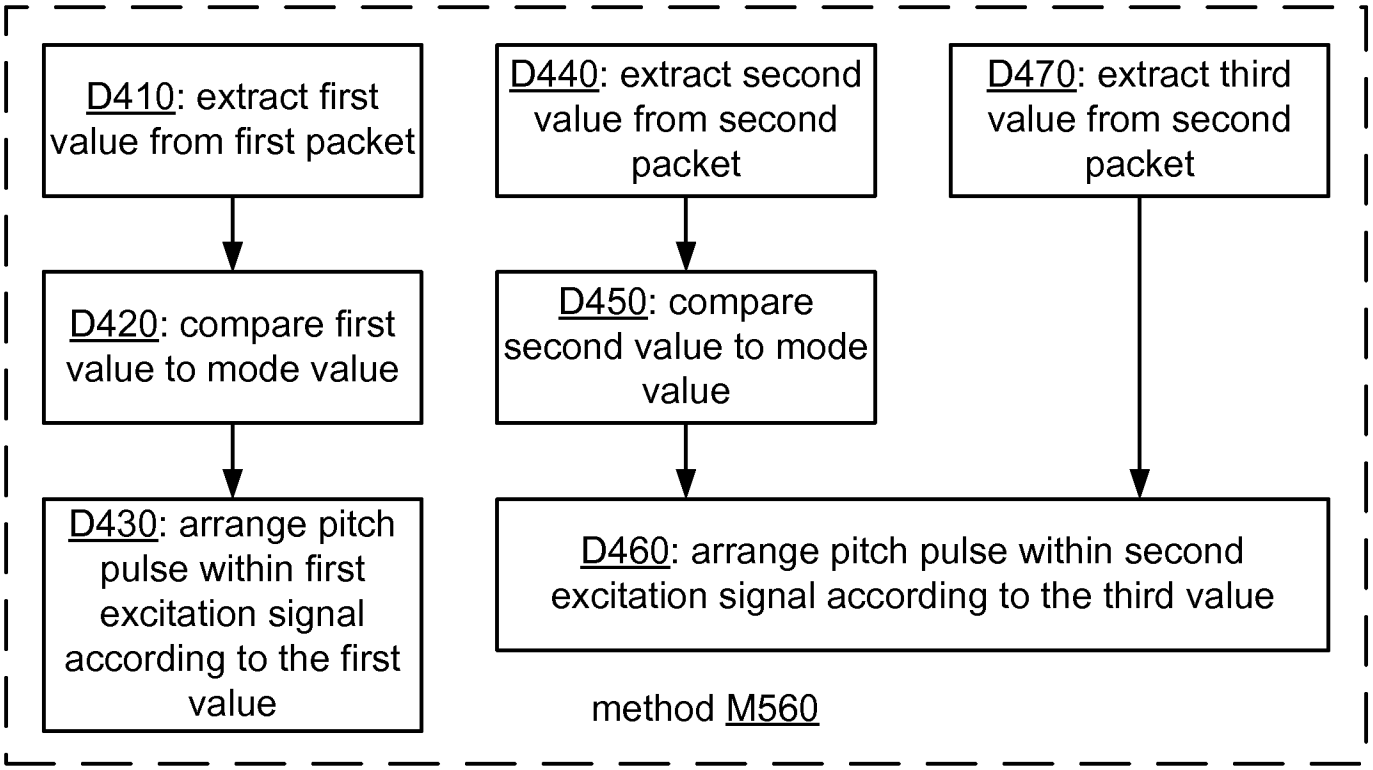
FIG. 37 shows a flowchart of a method M560 according to a general configuration.

FIG. 37 shows a flowchart of a method of decoding packets M560 according to a general configuration that includes tasks D410, D420, and D430. Task D410 extracts a first value from a first packet (e.g., as produced by an implementation of method M400). For a case in which the first packet conforms to a template as described herein, task D410 may be configured to extract the first value from a first set of bit locations of the packet. Task D420 compares the first value to a pitch pulse position mode value. Task D420 may be configured to produce a result that has a first state when the first value is equal to the pitch pulse position mode value and a second state otherwise. Task D430 arranges a pitch pulse within a first excitation signal according to the first value. Task D430 may be implemented as an instance of task D110 as described herein and may be configured to execute in response to a result of task D420 having the second state. Task D430 may be configured to arrange the pitch pulse within the first excitation signal such that the location of its peak relative to one among the first and last samples coincides with the first value.

Method M560 also includes tasks D440, D450, D460, and D470. Task D440 extracts a second value from a second packet. For a case in which the second packet conforms to a template as described herein, task D440 may be configured to extract the second value from a first set of bit locations of the packet. Task D470 extracts a third value from the second packet. For a case in which the packet conforms to a template as described herein, task D470 may be configured to extract the third value from a second set of bit locations of the packet. Task D450 compares the second value to the pitch pulse position mode value. Task D450 may be configured to produce a result that has a first state when the second value is equal to the pitch pulse position mode value and a second state otherwise. Task D460 arranges a pitch pulse within a second excitation signal according to the third value. Task D460 may be implemented as another instance of task D110 as described herein and may be configured to execute in response to a result of task D450 having the first state.

Task D460 may be configured to arrange the pitch pulse within the second excitation signal such that the location of its peak relative to the other among the first and last samples coincides with the third value. For example, if task D430 arranges a pitch pulse within the first excitation signal such that the location of its peak relative to the last sample of the first excitation signal coincides with the first value, then task D460 may be configured to arrange a pitch pulse within the second excitation signal such that the location of its peak relative to the first sample of the second excitation signal coincides with the third value, and vice versa. A frame decoder 300 or means FD100 as described herein may be configured to perform method M560.

Figure 38:
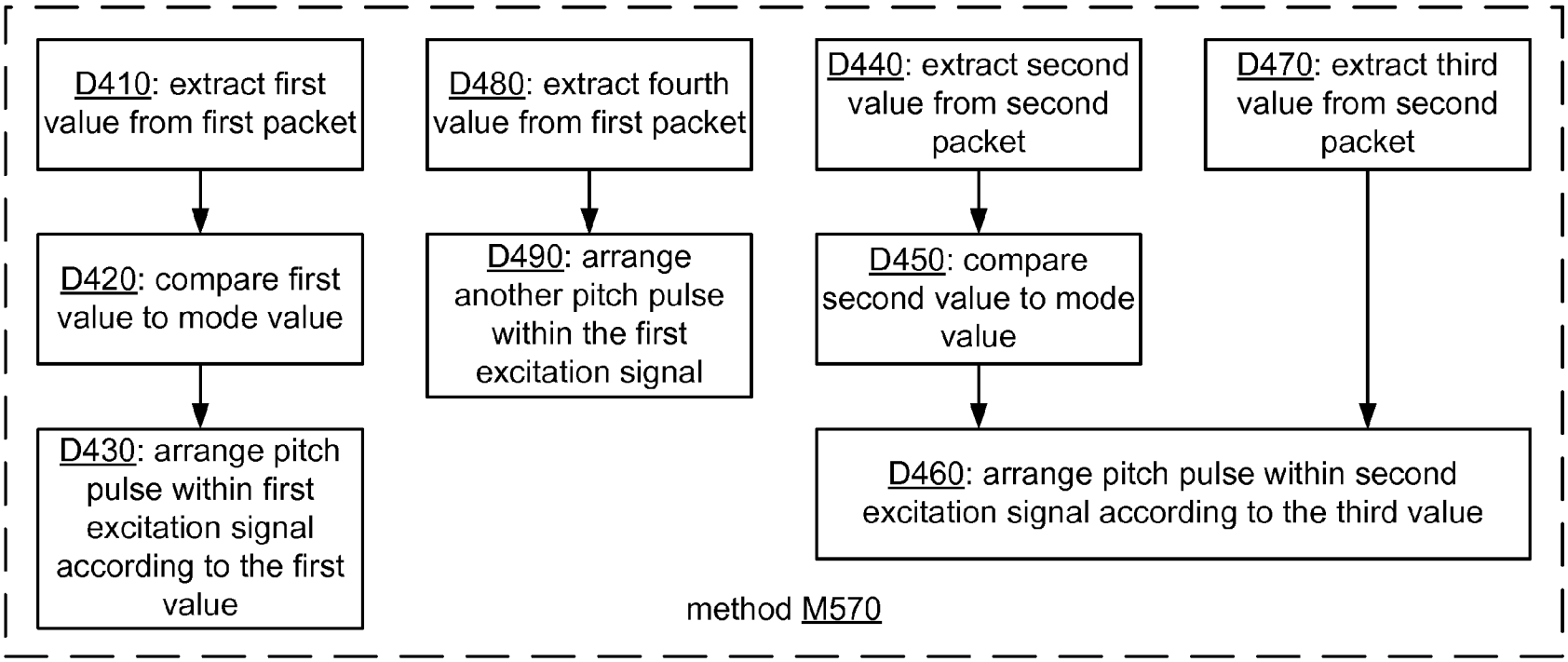
FIG. 38 shows a flowchart of an implementation M570 of method M560.

FIG. 38 shows a flowchart of an implementation M570 of method M560 that includes tasks D480 and D490. Task D480 extracts a fourth value from the first packet. For a case in which the first packet conforms to a template as described herein, task D480 may be configured to extract the fourth value (e.g., an encoded pitch period value) from a second set of bit locations of the packet. Based on the fourth value, task D490 arranges another pitch pulse ("a second pitch pulse") within the first excitation signal. Task D490 may also be configured to arrange the second pitch pulse within the first excitation signal based on the first value. For example, task D490 may be configured to arrange the second pitch pulse within the first excitation signal relative to the first arranged pitch pulse. Task D490 may be implemented as an instance of task D120 as described herein.

Task D490 may be configured to arrange the second pitch peak such that the distance between the two pitch peaks is equal to a pitch period value based on the fourth value. In such case, task D480 or task D490 may be configured to calculate the pitch period value. For example, task D480 or task D490 may be configured to calculate the pitch period value by adding a minimum pitch period value to the fourth value.

Figure 39:
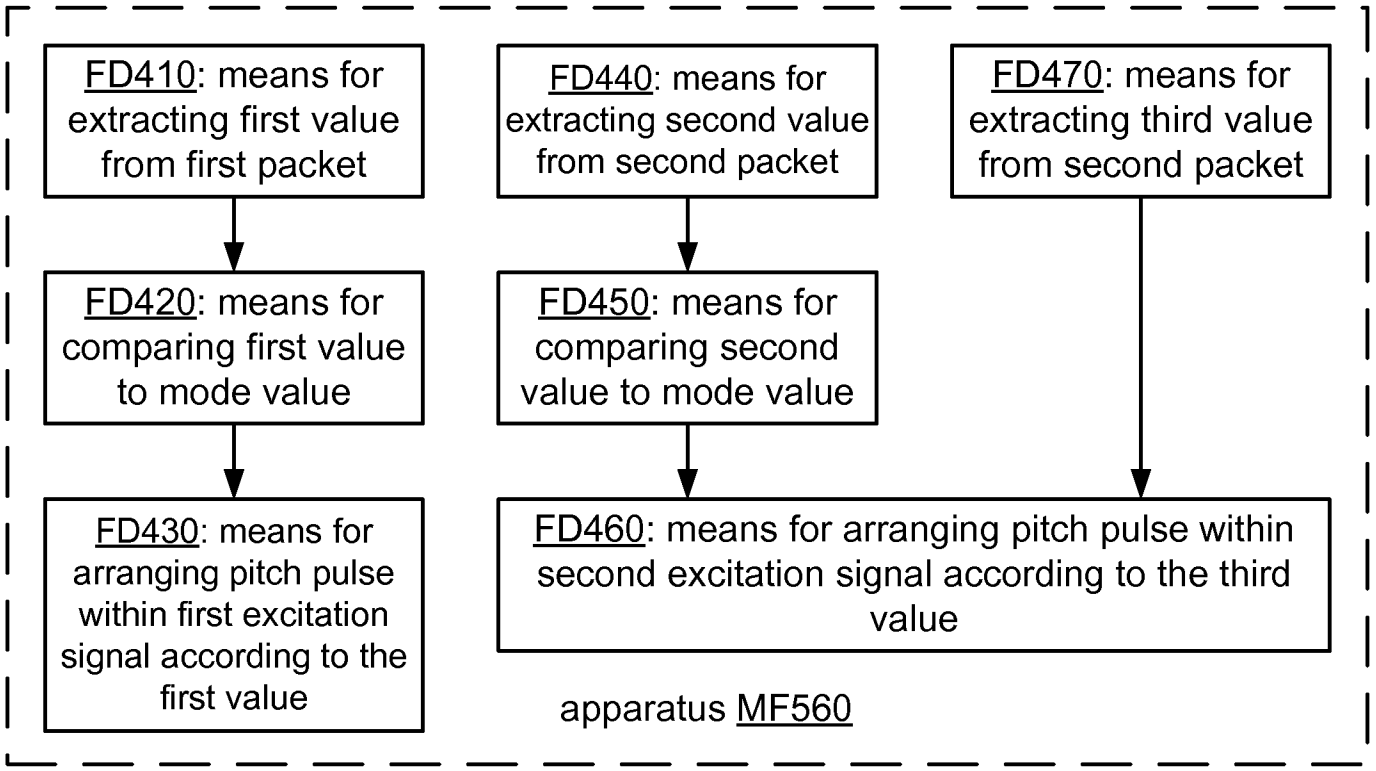
FIG. 39 shows a block diagram of an apparatus MF560 according to a general configuration.

FIG. 39 shows a block diagram of an apparatus for decoding packets MF560. Apparatus MF560 includes means FD410 for extracting a first value from a first packet (e.g., as described above with reference to various implementations of task D410), means FD420 for comparing the first value to a pitch pulse position mode value (e.g., as described above with reference to various implementations of task D420), and means FD430 for arranging a pitch pulse within a first excitation signal according to the first value (e.g., as described above with reference to various implementations of task D430). Means FD430 may be implemented as an instance of means FD110 as described herein. Apparatus MF560 also includes means FD440 for extracting a second value from a second packet (e.g., as described above with reference to various implementations of task D440), means FD470 for extracting a third value from the second packet (e.g., as described above with reference to various implementations of task D470), means FD450 for comparing the second value to the pitch pulse position mode value (e.g., as described above with reference to various implementations of task D450), and means FD460 for arranging a pitch pulse within a second excitation signal according to the third value (e.g., as described above with reference to various implementations of task D460). Means FD460 may be implemented as another instance of means FD110.

Figure 40:
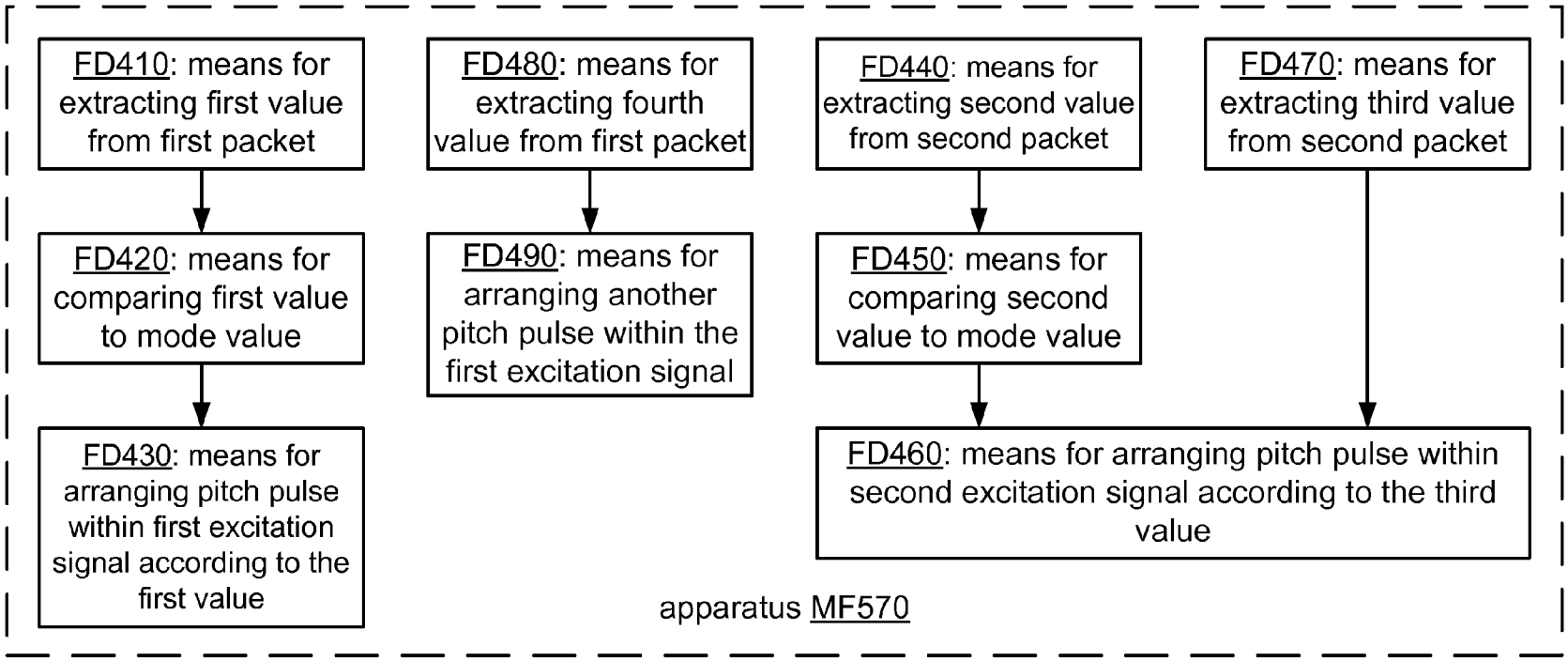
FIG. 40 shows a block diagram of an implementation MF570 of apparatus MF560.

FIG. 40 shows a block diagram of an implementation MF570 of apparatus MF560. Apparatus MF570 includes means FD480 for extracting a fourth value from the first packet (e.g., as described above with reference to various implementations of task D480) and means FD490 for arranging another pitch pulse within the first excitation signal based on the fourth value (e.g., as described above with reference to various implementations of task D490). Means FD490 may be implemented as an instance of means FD120 as described herein.

FIG. 36B shows a block diagram of an apparatus for decoding packets A560. Apparatus A560 includes a packet parser 510 configured to extract a first value from a first packet (e.g., as described above with reference to various implementations of task D410), a comparator 520 configured to compare the first value to a pitch pulse position mode value (e.g., as described above with reference to various implementations of task D420), and an excitation signal generator 530 configured to arrange a pitch pulse within a first excitation signal according to the first value (e.g., as described above with reference to various implementations of task D430). Packet parser 510 is also configured to extract a second value from a second packet (e.g., as described above with reference to various implementations of task D440) and to extract a third value from the second packet (e.g., as described above with reference to various implementations of task D470). Comparator 520 is also configured to compare the second value to the pitch pulse position mode value (e.g., as described above with reference to various implementations of task D450). Excitation signal generator 530 is also configured to arrange a pitch pulse within a second excitation signal according to the third value (e.g., as described above with reference to various implementations of task D460). Excitation signal generator 530 may be implemented as an instance of first excitation signal generator 310 as described herein.

In another implementation of apparatus A560, packet parser 510 is also configured to extract a fourth value from the first packet (e.g., as described above with reference to various implementations of task D480), and excitation signal generator 530 is also configured to arrange another pitch pulse within the first excitation signal based on the fourth value (e.g., as described above with reference to various implementations of task D490).

Speech decoder AD110 may be implemented to include apparatus A560. For example, first frame decoder 304 of speech decoder AD20 may be implemented to include an instance of apparatus A560 such that first excitation signal generator 310 also serves as excitation signal generator 530.

Quarter-rate allows forty bits per frame. In one example of a transitional frame coding format (e.g., a packet template) as applied by an implementation of encoding task E100, encoder 100, or means FE100, a region of seventeen bits is used to indicate LSP values and encoding mode, a region of seven bits is used to indicate the position of the terminal pitch pulse, a region of seven bits is used to indicate lag, a region of seven bits is used to indicate pulse shape, and a region of two bits is used to indicate gain profile. Other examples include formats in which the region for LSP values is smaller and the region for gain profile is correspondingly larger.

A corresponding decoder (e.g., an implementation of decoder 300 or 560, or means FD100 or MF560, or a device performing an implementation of decoding method M550 or M560 or decoding task D100) may be configured to construct an excitation signal from the pulse shape VQ table output by copying the indicated pulse shape vector to each of the locations indicated by the terminal pitch pulse location and the lag value and scaling the resulting signal according to the gain VQ table output. For a case in which the indicated pulse shape vector is longer than the lag value, any overlap between adjacent pulses may be handled by averaging each pair of overlapped values, by selecting one value of each pair (e.g., the highest or lowest value, or the value belonging to the pulse on the left or on the right), or by simply discarding the samples beyond the lag value. Similarly, when arranging the first or last pitch pulse of an excitation signal (e.g., according to a pitch pulse peak location and/or a lag estimate), any samples that fall outside the frame boundary may be averaged with the corresponding samples of the adjacent frame or simply discarded.

The pitch pulses of an excitation signal are not simply impulses or spikes. Rather, a pitch pulse typically has an amplitude profile or shape over time that is speaker-dependent, and preserving this shape may be important for speaker recognition. It may be desirable to encode a good representation of pitch pulse shape to serve as a reference (e.g., a prototype) for subsequent voiced frames.

The shapes of the pitch pulses provide information that is perceptually important for speaker identification and recognition. In order to provide this information to the decoder, a transitional frame coding mode (e.g., as performed by an implementation of task E100, encoded 100, or means FE100) may be configured to include pitch pulse shape information in the encoded frame. Encoding the pitch pulse shape may present a problem of quantizing a vector whose dimension is variable. For example, the length of the pitch period in the residual, and thus the length of the pitch pulse, may vary over a wide range. In one example as described above, the allowable pitch lag value ranges from 20 to 146 samples.

Figure 41:
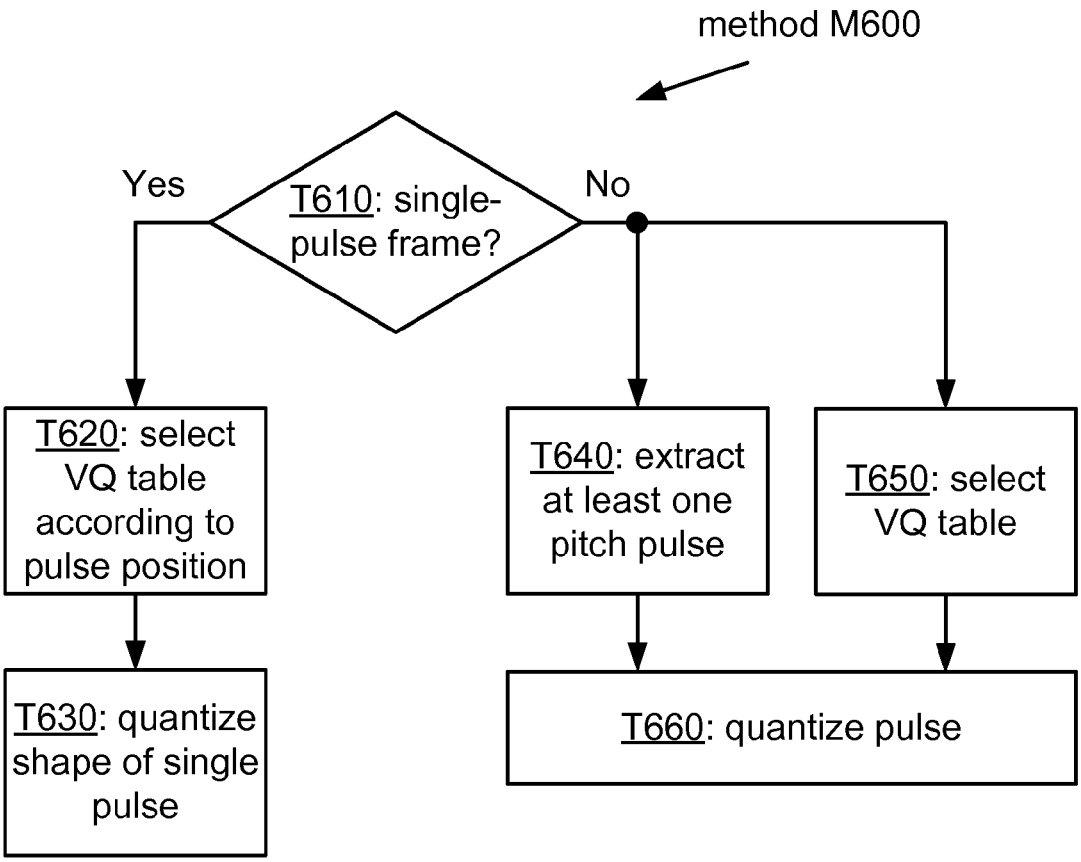
FIG. 41 shows a flowchart of a method M600 according to a general configuration.

It may be desirable to encode the shape of a pitch pulse without converting the pulse to the frequency domain. FIG. 41 shows a flowchart of a method M600 of encoding a frame according to a general configuration that may be performed within an implementation of task E100, by an implementation of first frame encoder 100, and/or by an implementation of means FE100. Method M600 includes tasks T610, T620, T630, T640, and T650. Task T610 selects one among two processing paths, depending on whether the frame has a single pitch pulse or multiple pitch pulses. Before performing task T610, it may be desirable to perform at least enough of a method for detecting pitch pulses (e.g., method M300) to determine whether the frame has a single pitch pulse or multiple pitch pulses.

For a single-pulse frame, task T620 selects one of a set of different single-pulse vector quantization (VQ) tables. In this example, task T620 is configured to select the VQ table according to the position of the pitch pulse within the frame (e.g., as calculated by task E120 or L100, means FE120 or ML100, pitch pulse position calculator 120, or terminal peak locator A310). Task T630 then quantizes the pulse shape by selecting a vector of the selected VQ table (e.g., by finding the best match within the selected VQ table and outputting a corresponding index).

Task T630 may be configured to select the pulse shape vector that is closest in energy to the pulse shape to be matched. The pulse shape to be matched may be the entire frame, or some smaller portion of the frame which includes the peak (e.g., the segment within some distance of the peak, such as one-quarter of the frame length). Before performing the matching operation, it may be desirable to normalize the amplitude of the pulse shape to be matched.

In one example, task T630 is configured to calculate a difference between the pulse shape to be matched and each pulse shape vector of the selected table, and to select the pulse shape vector that corresponds to the difference with the smallest energy. In another example, task T630 is configured to select the pulse shape vector whose energy is closest to that of the pulse shape to be matched. In such cases, the energy of a sequence of samples (such as a pitch pulse or other vector) may be calculated as the sum of the squared samples. Task T630 may be implemented as an instance of pulse shape selection task E110 as described herein.

Each table in the set of single-pulse VQ tables has a vector dimension that may be as large as the length of the frame (e.g., 160 samples). It may be desirable for each table to have the same vector dimension as the pulse shapes which are to be matched to vectors in that table. In one particular example, the set of single-pulse VQ tables includes three tables, each having up to 128 entries, such that the pulse shape may be encoded as a seven-bit index.

A corresponding decoder (e.g., an implementation of decoder 300, MF560, or A560, or means FD100 or a device performing an implementation of decoding task D100 or method M560) may be configured to identify a frame as single-pulse if the pulse position value of the encoded frame (e.g., as determined by extraction task D305 or D440, means FD440, or packet parser 510 as described herein) is equal to a pitch pulse position mode value (e.g., $(2^r-1)$ or 127). Such a decision may be based on an output of comparison task D310 or D450, means FD450, or comparator 520 as described herein. Alternatively or additionally, such a decoder may be configured to identify a frame as single-pulse if the lag value is equal to a pitch period mode value (e.g., $(2^r-1)$ or 127).

Task T640 extracts at least one pitch pulse to be matched from the multiple-pulse frame. For example, task T640 may be configured to extract the pitch pulse with the maximum gain (e.g., the pitch pulse that contains the highest peak). It may be desirable for the length of the extracted pitch pulse to be equal to the estimated pitch period (as calculated, e.g., by task E370, E130, or L200). When extracting the pulse, it may be desirable to make sure that the peak is not the first or last sample of the extracted pulse, which could lead to a discontinuity and/or omission of one or more important samples. In some cases, information after the peak may be more important to speech quality than information before it, so it may be desirable to extract the pulse so that the peak is near the beginning. In one example, task T640 extracts the shape from the pitch period that begins two samples before the pitch peak. Such an approach allows capturing samples that occur after the peak and may contain important shape information. In another example, it may be desirable to capture more samples before the peak, which may also contain important information. In a further example, task T640 is configured to extract the pitch period that is centered at the peak. It may be desirable for task T640 to extract more than one pitch pulse from the frame (e.g., to extract the two pitch pulses having the highest peaks) and to calculate an average pulse shape to be matched from the extracted pitch pulses. It may be desirable for task T640 and/or task T660 to normalize the amplitude of the pulse shape to be matched before performing pulse shape vector selection.

For a multi-pulse frame, task T650 selects a pulse shape VQ table based on the lag value (or the length of the extracted prototype). It may be desirable to provide a set of nine or ten pulse shape VQ tables to encode multi-pulse frames. Each of the VQ tables in the set has a different vector dimension and is associated with a different lag range or "bin". In such case, task T650 determines which bin contains the current estimated pitch period (as calculated, e.g., by task E370, E130, or L200) and selects the VQ table that corresponds to that bin. If the current estimated pitch period equals 105 samples, for example, task T650 may select a VQ table that corresponds to a bin that includes a lag range of from 101 to 110 samples. In one example, each of the multi-pulse pulse shape VQ tables has up to 128 entries, such that the pulse shape may be encoded as a seven-bit index. Typically, all of the pulse shape vectors in a VQ table will have the same vector dimension, while each of the VQ tables will typically have a different vector dimension (e.g., equal to the largest value in the lag range of the corresponding bin).

Task T660 quantizes the pulse shape by selecting a vector of the selected VQ table (e.g., by finding the best match within the selected VQ table and outputting a corresponding index). Because the length of the pulse shape to be quantized may not exactly match the length of the table entries, task T660 may be configured to zero-pad the pulse shape (e.g., at the end) to match the corresponding table vector size before selecting the best match from the table. Alternatively or additionally, task T660 may be configured to truncate the pulse shape to match the corresponding table vector size before selecting the best match from the table.

Figure 42A:
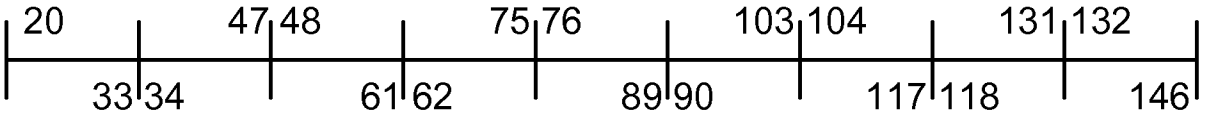
FIG. 42A shows an example of a uniform division of a lag range into bins.

The range of possible (allowable) lag values may be divided into bins in a uniform manner or in a nonuniform manner. In one example of a uniform division as illustrated in FIG. 42A, the lag range of 20 to 146 samples is divided into the following nine bins: 20-33, 34-47, 48-61, 62-75, 76-89, 90-103, 104-117, 118-131, and 132-146 samples. In this example, all of the bins have a width of fourteen samples except the last bin, which has a width of fifteen samples.

Figure 42B:
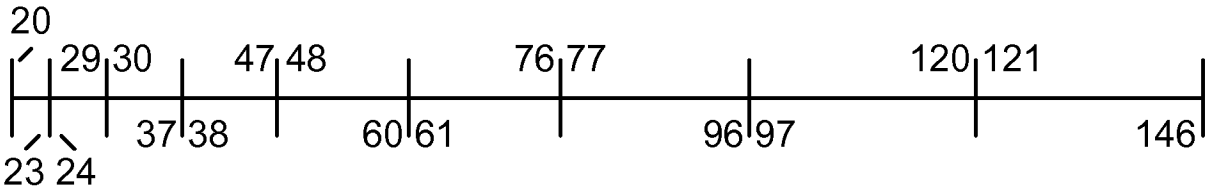
FIG. 42B shows an example of a nonuniform division of a lag range into bins.

A uniform division as set forth above may lead to reduced quality at high pitch frequencies as compared to the quality at low pitch frequencies. In the example above, task T660 may be configured to extend (e.g., to zero-pad) a pitch pulse having a length of twenty samples by 65% before matching, while a pitch pulse having a length of 132 samples might be extended (e.g., zero-padded) by only 11%. One potential advantage of using a nonuniform division is to equalize the maximum relative extension among the different lag bins. In one example of a nonuniform division as illustrated in FIG. 42B, the lag range of 20 to 146 samples is divided into the following nine bins: 20-23, 24-29, 30-37, 38-47, 48-60, 61-76, 77-96, 97-120, and 121-146 samples. In this case, task T660 may be configured to extend (e.g., to zero-pad) a pitch pulse having a length of twenty samples by 15% before matching and to extend (e.g., zero-pad) a pitch pulse having a length of 121 samples by 21%. In this division scheme, the maximum extension of any pitch pulse in the range of 20-146 samples is only 25%.

A corresponding decoder (e.g., an implementation of decoder 300, MF560, or A560, or means FD100 or a device performing an implementation of decoding task D100 or method M560) may be configured to obtain a lag value and a pulse shape index value from the encoded frame, to use the lag value to select the appropriate pulse shape VQ table, and to use the pulse shape index value to select the desired pulse shape from the selected pulse shape VQ table.

Figure 43C:
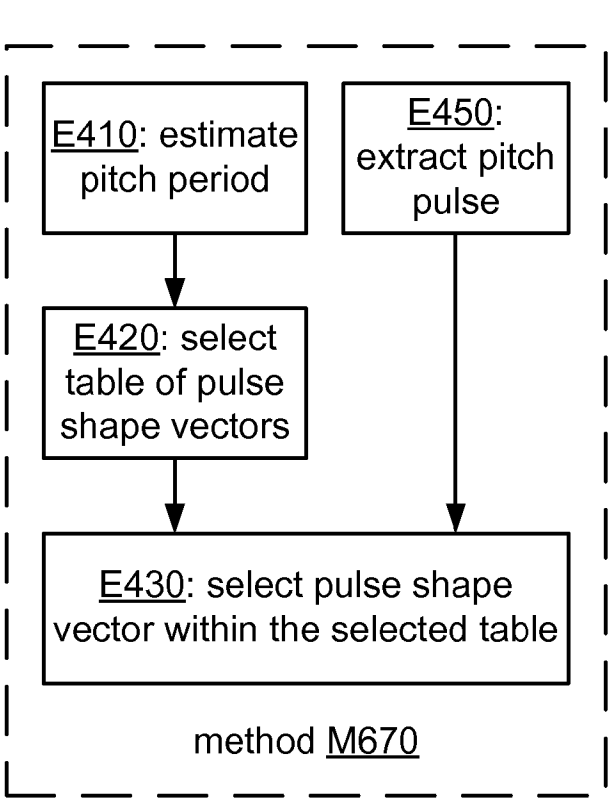
FIG. 43C shows a flowchart of an implementation M670 of method M650.
Figure 43B:
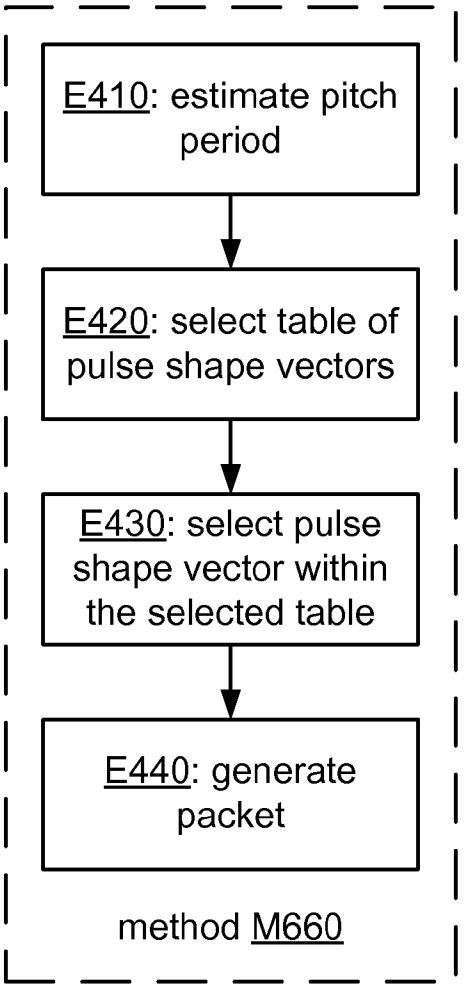
FIG. 43B shows a flowchart of an implementation M660 of method M650.
Figure 43A:
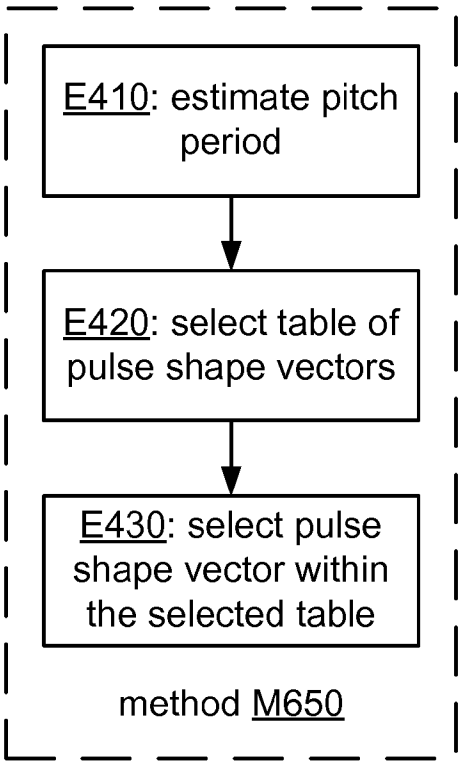
FIG. 43A shows a flowchart of a method M650 according to a general configuration.

FIG. 43A shows a flowchart of a method of encoding a shape of a pitch pulse M650 according to a general configuration that includes tasks E410, E420, and E430. Task E410 estimates a pitch period of a speech signal frame (e.g., a frame of an LPC residual). Task E410 may be implemented as an instance of pitch period estimation task E130, L200, and/or E370 as described herein. Based on the estimated pitch period, task E420 selects one among a plurality of tables of pulse shape vectors. Task E420 may be implemented as an instance of task T650 as described herein. Based on information from at least one pitch pulse of the speech signal frame, task E430 selects a pulse shape vector in the selected table of pulse shape vectors. Task E430 may be implemented as an instance of task T660 as described herein.

Table selection task E420 may be configured to compare a value based on the estimated pitch period to each of a plurality of different values. In order to determine which of a set of lag range bins as described herein includes the estimated pitch period, for example, task E420 may be configured to compare the estimated pitch period to the upper ranges (or lower ranges) of each of two or more of the set of bins.

Vector selection task E430 may be configured to select, in the selected table of pulse shape vectors, the pulse shape vector that is closest in energy to the pitch pulse to be matched. In one example, task E430 is configured to calculate a difference between the pitch pulse to be matched and each pulse shape vector of the selected table, and to select the pulse shape vector that corresponds to the difference with the smallest energy. In another example, task E430 is configured to select the pulse shape vector whose energy is closest to that of the pitch pulse to be matched. In such cases, the energy of a sequence of samples (such as a pitch pulse or other vector) may be calculated as the sum of the squared samples.

FIG. 43B shows a flowchart of an implementation M660 of method M650 that includes a task E440. Task E440 generates a packet that includes (A) a first value that is based on the estimated pitch period and (B) a second value (e.g., a table index) that identifies the selected pulse shape vector in the selected table. The first value may indicate the estimated pitch period as an offset relative to a minimum pitch period value (e.g., twenty). For example, method M660 (e.g., task E410) may be configured to calculate the first value by subtracting the minimum pitch period value from the estimated pitch period.

Task E440 may be configured to generate the packet to include the first and second values in respective disjoint sets of bit locations. For example, task E440 may be configured to generate the packet according to a template having a first set of bit positions and a second set of bit positions as described herein, the first and second sets being disjoint. In such case, task E440 may be implemented as an instance of packet generation task E320 as described herein. Such an implementation of task E440 may be configured to generate the packet to include a pitch pulse position in the first set of bit locations, the first value in the second set of bit locations, and the second value in a third set of bit locations that is disjoint with the first and second sets.

FIG. 43C shows a flowchart of an implementation M670 of method M650 that includes a task E450. Task E450 extracts a pitch pulse from among a plurality of pitch pulses of the speech signal frame. Task E450 may be implemented as an instance of task T640 as described herein. Task E450 may be configured to select the pitch pulse based on an energy measure. For example, task E450 may be configured to select the pitch pulse whose peak has the highest energy, or the pitch pulse having the highest energy. In method M670, vector selection task E430 may be configured to select the pulse shape vector that is the best match to the extracted pitch pulse (or to a pulse shape that is based on the extracted pitch pulse, such as an average of the extracted pitch pulse and another extracted pitch pulse).

Figure 46A:
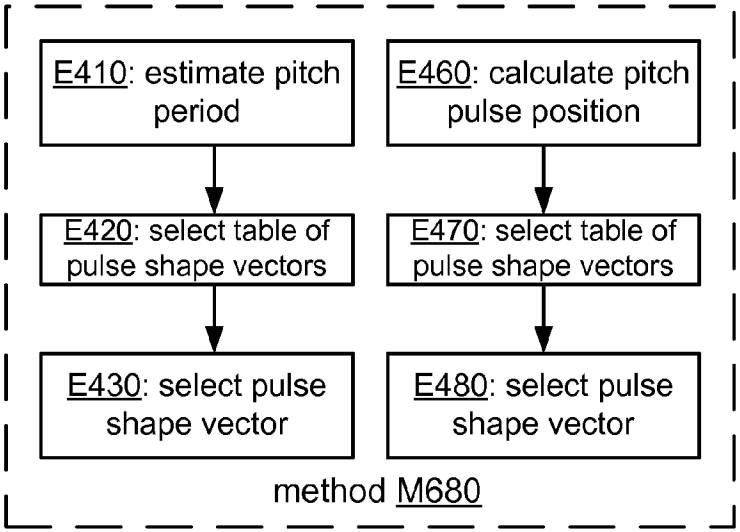
FIG. 46A shows a flowchart of an implementation M680 of method M650.

FIG. 46A shows a flowchart of an implementation M680 of method M650 that includes tasks E460, E470, and E480. Task E460 calculates a position of a pitch pulse of a second speech signal frame (e.g., a frame of an LPC residual). The first and second speech signal frames may be from the same voice communication session or may be from different voice communication sessions. For example, the first and second speech signal frames may be from a speech signal that is spoken by one person or may be from two different speech signals that are each spoken by a different person. The speech signal frames may undergo other processing operations (e.g., perceptual weighting) before and/or after the pitch pulse positions are calculated.

Based on the calculated pitch pulse position, task E470 selects one among a plurality of tables of pulse shape vectors. Task E470 may be implemented as an instance of task T620 as described herein. Task E470 may be executed in response to a determination (e.g., by task E460 or otherwise by method M680) that the second speech signal frame contains only one pitch pulse. Based on information from the second speech signal frame, task E480 selects a pulse shape vector in the selected table of pulse shape vectors. Task E480 may be implemented as an instance of task T630 as described herein.

Figure 44A:
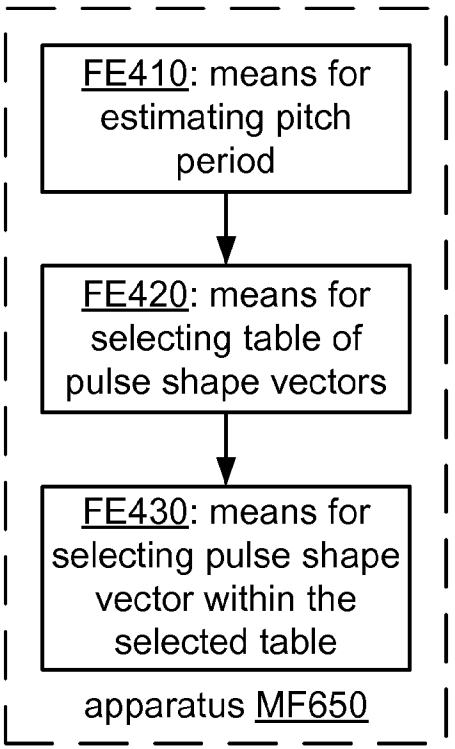
FIG. 44A shows a block diagram of an apparatus MF650 according to a general configuration.

FIG. 44A shows a block diagram of an apparatus MF650 for encoding a shape of a pitch pulse. Apparatus MF650 includes means FE410 for estimating a pitch period of a speech signal frame (e.g., as described above with reference to various implementations of task E410, E130, L200, and/or E370), means FE420 for selecting a table of pulse shape vectors (e.g., as described above with reference to various implementations of task E420 and/or T650), and means FE430 for selecting a pulse shape vector in the selected table (e.g., as described above with reference to various implementation of task E430 and/or T660).

Figure 44B:
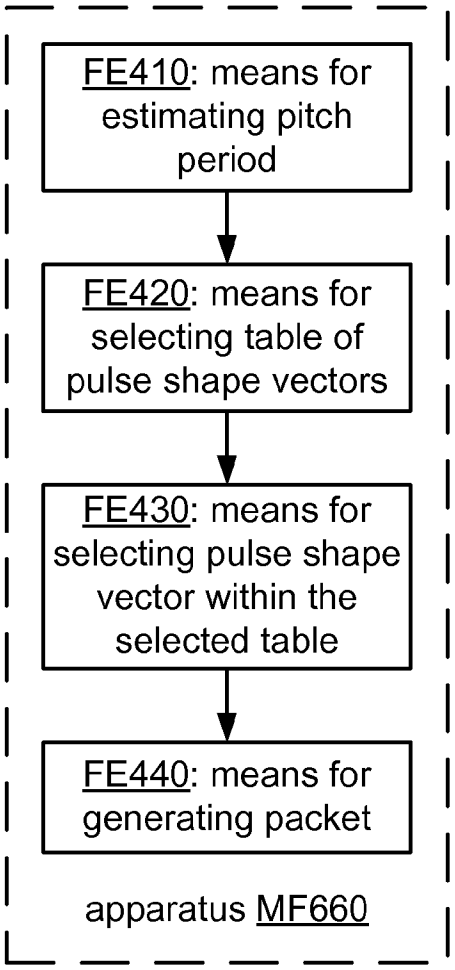
FIG. 44B shows a block diagram of an implementation MF660 of apparatus MF650.
Figure 44C:
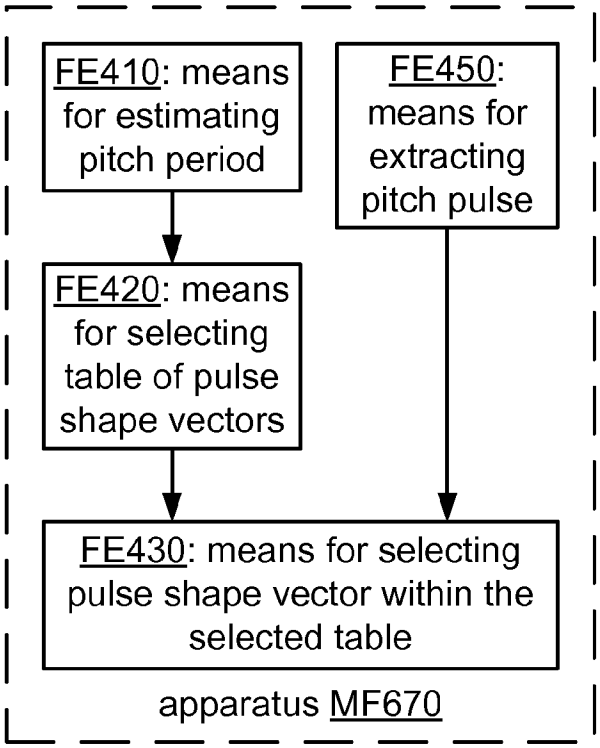
FIG. 44C shows a block diagram of an implementation MF670 of apparatus MF650

FIG. 44B shows a block diagram of an implementation MF660 of apparatus MF650. Apparatus MF660 includes means FE440 for generating a packet that includes (A) a first value that is based on the estimated pitch period and (B) a second value that identifies the selected pulse shape vector in the selected table (e.g., as described above with reference to task E440). FIG. 44C shows a block diagram of an implementation MF670 of apparatus MF650 that includes means FE450 for extracting a pitch pulse from among a plurality of pitch pulses of the speech signal frame (e.g., as described above with reference to task E450).

Figure 46B:
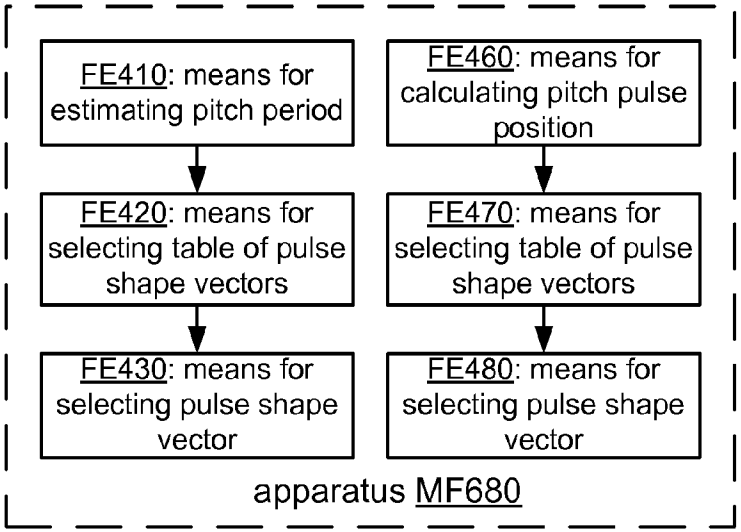
FIG. 46B shows a block diagram of an implementation MF680 of apparatus MF650.

FIG. 46B shows a block diagram of an implementation MF680 of apparatus MF650. Apparatus MF680 includes means FE460 for calculating a position of a pitch pulse of a second speech signal frame (e.g., as described above with reference to task E460), means FE470 for selecting one among a plurality of tables of pulse shape vectors based on the calculated pitch pulse position (e.g., as described above with reference to task E470), and means FE480 for selecting a pulse shape vector in the selected table of pulse shape vectors based on information from the second speech signal frame (e.g., as described above with reference to task E480).

Figure 45B:
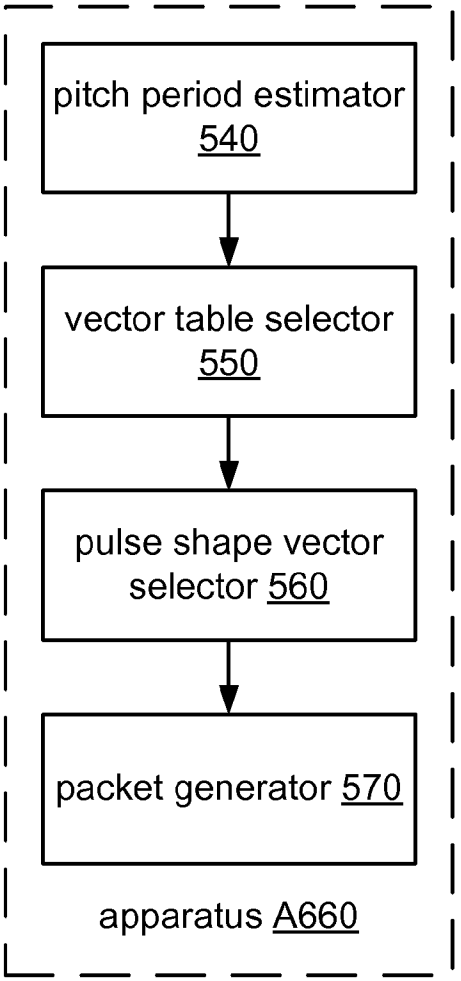
FIG. 45B shows a block diagram of an implementation A660 of apparatus A650.
Figure 45A:
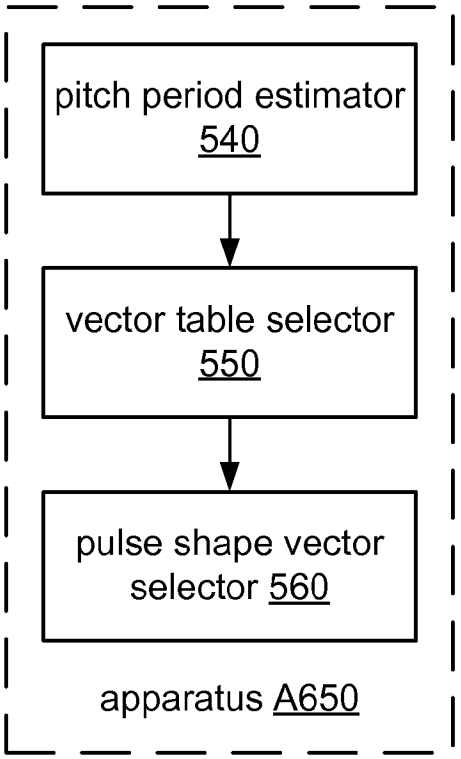
FIG. 45A shows a block diagram of an apparatus A650 according to a general configuration.

FIG. 45A shows a block diagram of an apparatus A650 for encoding a shape of a pitch pulse. Apparatus A650 includes a pitch period estimator 540 configured to estimate a pitch period of a speech signal frame (e.g., as described above with reference to various implementations of task E410, E130, L200, and/or E370). For example, pitch period estimator 540 may be implemented as an instance of pitch period estimator 130, 190, or A320 as described herein. Apparatus A650 also includes a vector table selector 550 configured to select, based on the estimated pitch period, a table of pulse shape vectors (e.g., as described above with reference to various implementations of task E420 and/or T650). Apparatus A650 also includes a pulse shape vector selector 560 configured to select, based on information from at least one pitch pulse of the speech signal frame, a pulse shape vector in the selected table (e.g., as described above with reference to various implementation of task E430 and/or T660).

Figure 45C:
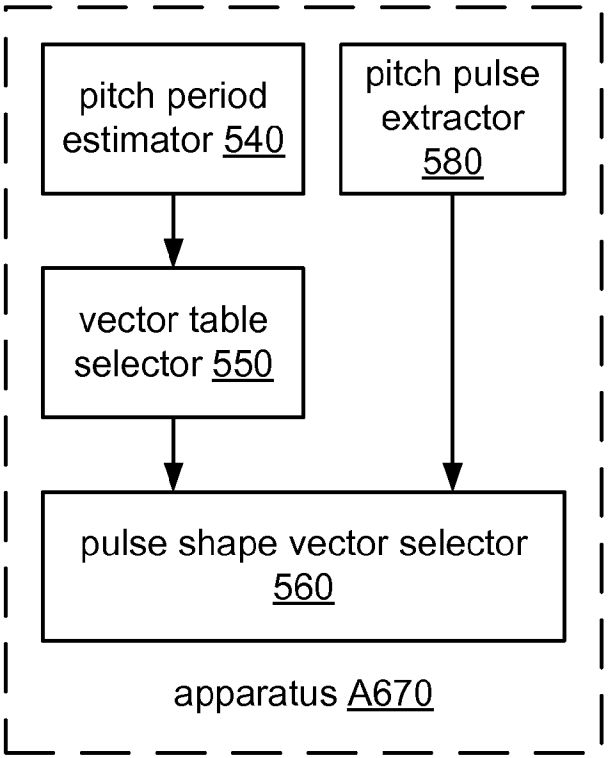
FIG. 45C shows a block diagram of an implementation A670 of apparatus A650.

FIG. 45B shows a block diagram of an implementation A660 of apparatus A650 that includes a packet generator 570 configured to generate a packet that includes (A) a first value that is based on the estimated pitch period and (B) a second value that identifies the selected pulse shape vector in the selected table (e.g., as described above with reference to task E440). Packet generator 570 may be implemented as an instance of packet generator 170 as described herein. FIG. 45C shows a block diagram of an implementation A670 of apparatus A650 that includes a pitch pulse extractor 580 configured to extract a pitch pulse from among a plurality of pitch pulses of the speech signal frame (e.g., as described above with reference to task E450).

Figure 46C:
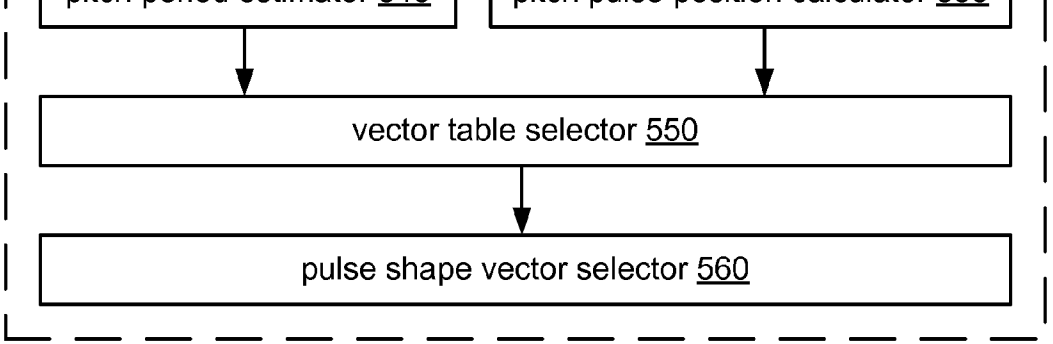
FIG. 46C shows a block diagram of an implementation A680 of apparatus A650.

FIG. 46C shows a block diagram of an implementation A680 of apparatus A650. Apparatus A680 includes a pitch pulse position calculator 590 configured to calculate a position of a pitch pulse of a second speech signal frame (e.g., as described above with reference to task E460). For example, pitch pulse position calculator 590 may be implemented as an instance of pitch pulse position calculator 120 or 160 or terminal peak locator A310 as described herein. In this case, vector table selector 550 is also configured to select one among a plurality of tables of pulse shape vectors based on the calculated pitch pulse position (e.g., as described above with reference to task E470), and pulse shape vector selector 560 is also configured to select a pulse shape vector in the selected table of pulse shape vectors based on information from the second speech signal frame (e.g., as described above with reference to task E480).

Speech encoder AE10 may be implemented to include apparatus A650. For example, first frame encoder 104 of speech encoder AE20 may be implemented to include an instance of apparatus A650 such that pitch period estimator 130 also serves as estimator 540. Such an implementation of first frame encoder 104 may also include an instance of apparatus A400 (for example, an instance of apparatus A402, such that packet generator 170 also serves as packet generator 570).

Figure 47B:
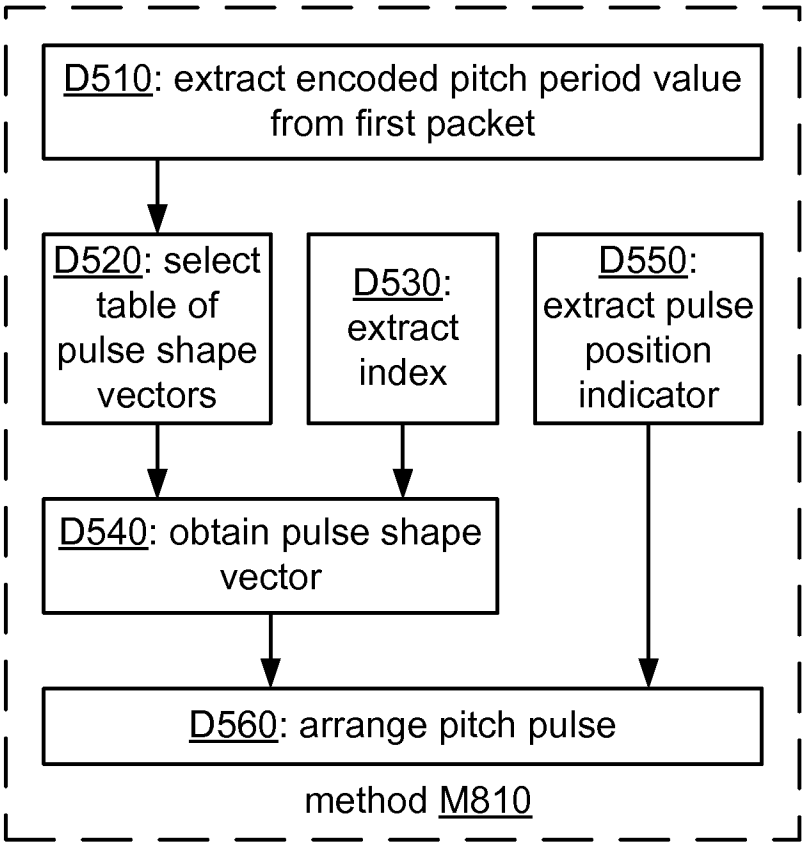
FIG. 47B shows a flowchart of an implementation M810 of method M800.
Figure 47A:
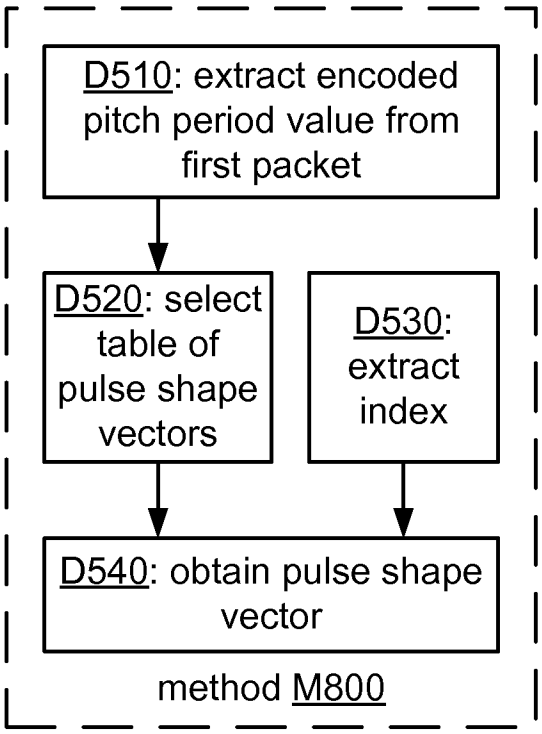
FIG. 47A shows a flowchart of a method M800 according to a general configuration.

FIG. 47A shows a block diagram of a method of decoding a shape of a pitch pulse M800 according to a general configuration. Method M800 includes tasks D510, D520, D530, and D540. Task D510 extracts an encoded pitch period value from a packet of an encoded speech signal (e.g., as produced by an implementation of method M660). Task D510 may be implemented as an instance of task D480 as described herein. Based on the encoded pitch period value, task D520 selects one of a plurality of tables of pulse shape vectors. Task D530 extracts an index from the packet. Based on the index, task D540 obtains a pulse shape vector from the selected table.

FIG. 47B shows a block diagram of an implementation M810 of method M800 that includes tasks D550 and D560. Task D550 extracts a pitch pulse position indicator from the packet. Task D550 may be implemented as an instance of task D410 as described herein. Based on the pitch pulse position indicator, task D560 arranges a pitch pulse that is based on the pulse shape vector within an excitation signal. Task D560 may be implemented as an instance of task D430 as described herein.

Figure 48B:
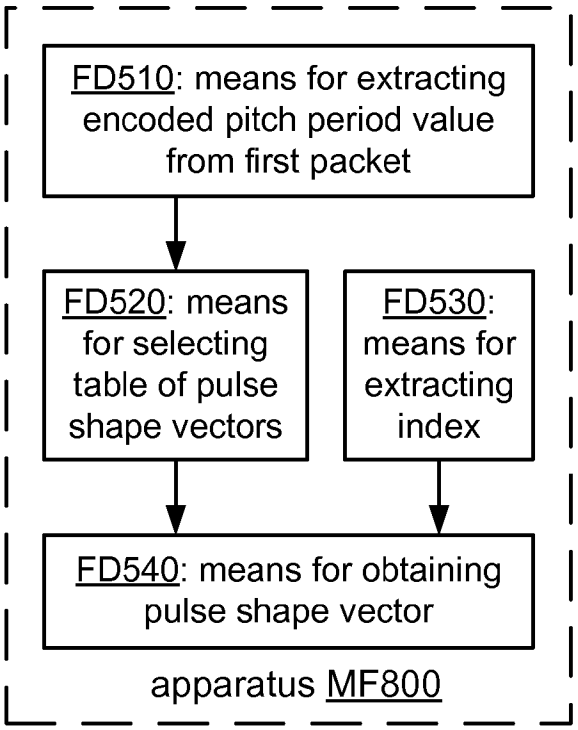
FIG. 48B shows a block diagram of an apparatus MF800 according to a general configuration.
Figure 48A:
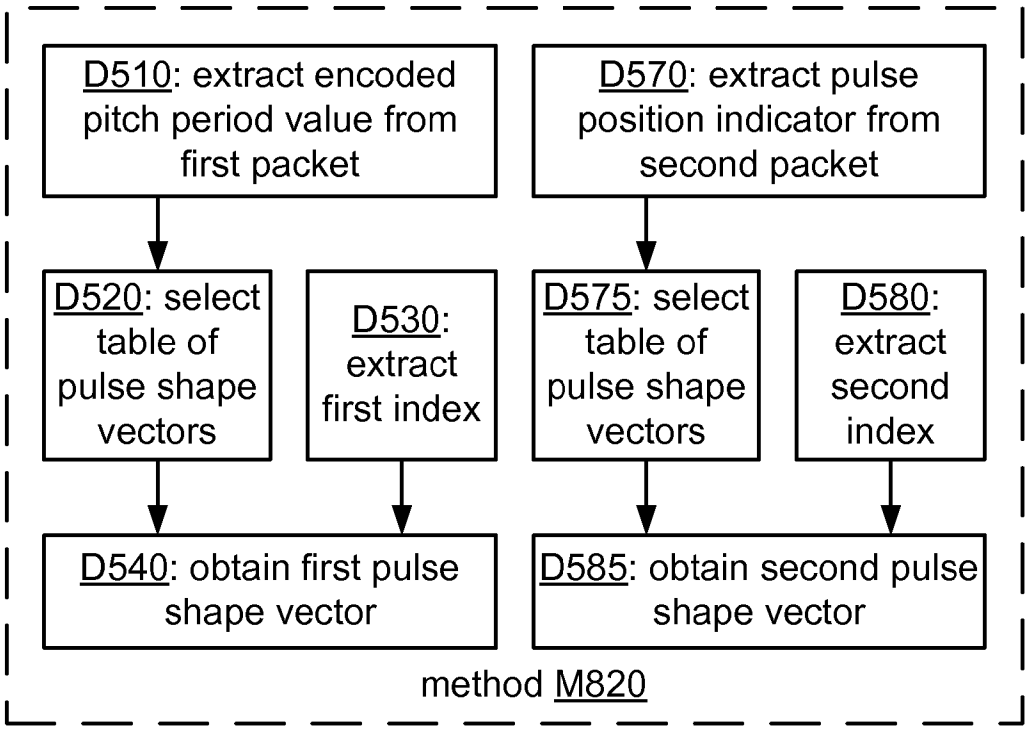
FIG. 48A shows a flowchart of an implementation M820 of method M800.

FIG. 48A shows a block diagram of an implementation M820 of method M800 that includes tasks D570, D575, D580, and D585. Task D570 extracts a pitch pulse position indicator from a second packet. The second packet may be from the same voice communication session as the first packet or may be from a different voice communication session. Task D570 may be implemented as an instance of task D410 as described herein. Based on the pitch pulse position indicator from the second packet, task D575 selects one of a second plurality of tables of pulse shape vectors. Task D580 extracts an index from the second packet. Based on the index from the second packet, task D585 obtains a pulse shape vector from the selected one of the second plurality of tables. Method M820 may also be configured to generate an excitation signal based on the obtained pulse shape vector.

FIG. 48B shows a block diagram of an apparatus MF800 for decoding a shape of a pitch pulse. Apparatus MF800 includes means FD510 for extracting an encoded pitch period value from a packet (e.g., as described herein with reference to various implementations of task D510), means FD520 for selecting one of a plurality of tables of pulse shape vectors (e.g., as described herein with reference to various implementations of task D520), means FD530 for extracting an index from the packet (e.g., as described herein with reference to various implementations of task D530), and means FD540 for obtaining a pulse shape vector from the selected table (e.g., as described herein with reference to various implementations of task D540).

Figures 49A, 49B:
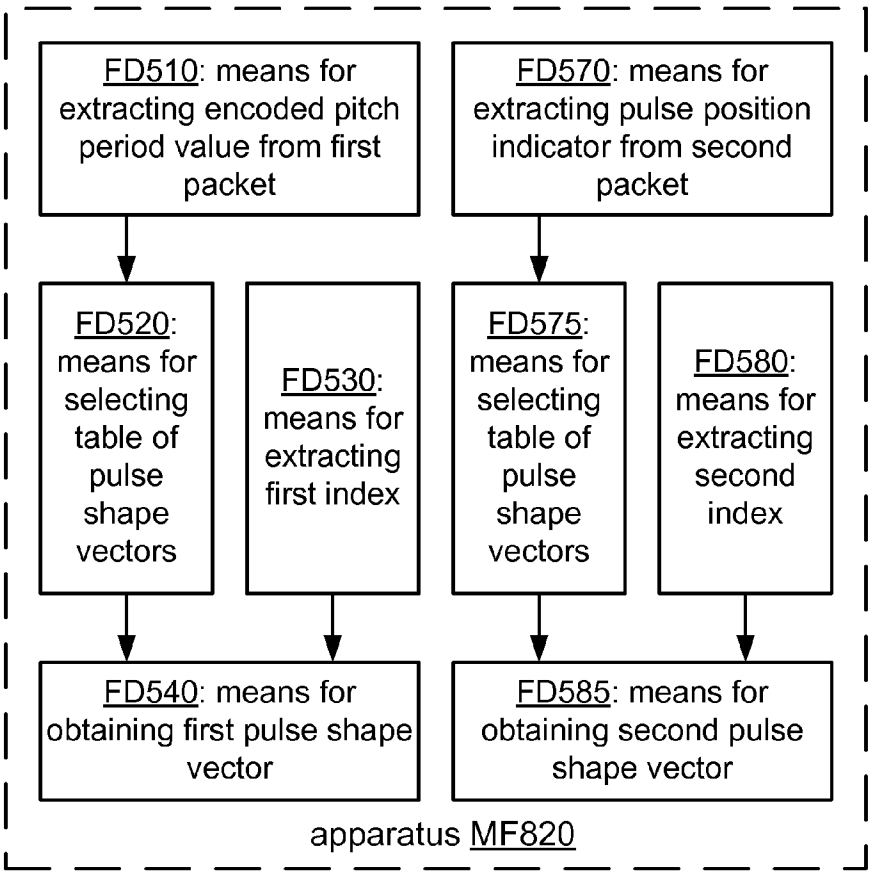
FIG. 49A shows a block diagram of an implementation MF810 of apparatus MF800.
FIG. 49B shows a block diagram of an implementation MF820 of apparatus MF800.

FIG. 49A shows a block diagram of an implementation MF810 of apparatus MF800. Apparatus MF810 includes means FD550 for extracting a pitch pulse position indicator from the packet (e.g., as described herein with reference to various implementations of task D550) and means FD560 for arranging a pitch pulse that is based on the pulse shape vector within an excitation signal (e.g., as described herein with reference to various implementations of task D560).

FIG. 49B shows a block diagram of an implementation MF820 of apparatus MF800. Apparatus MF820 includes means FD570 for extracting a pitch pulse position indicator from a second packet (e.g., as described herein with reference to various implementations of task D570) and means FD575 for selecting one of a second plurality of tables of pulse shape vectors based on the position indicator from the second packet (e.g., as described herein with reference to various implementations of task D575). Apparatus MF820 also includes means FD580 for extracting an index from the second packet (e.g., as described herein with reference to various implementations of task D580) and means FD585 for obtaining a pulse shape vector from the selected one of the second plurality of tables based on the index from the second packet (e.g., as described herein with reference to various implementations of task D585).

Figure 50B:
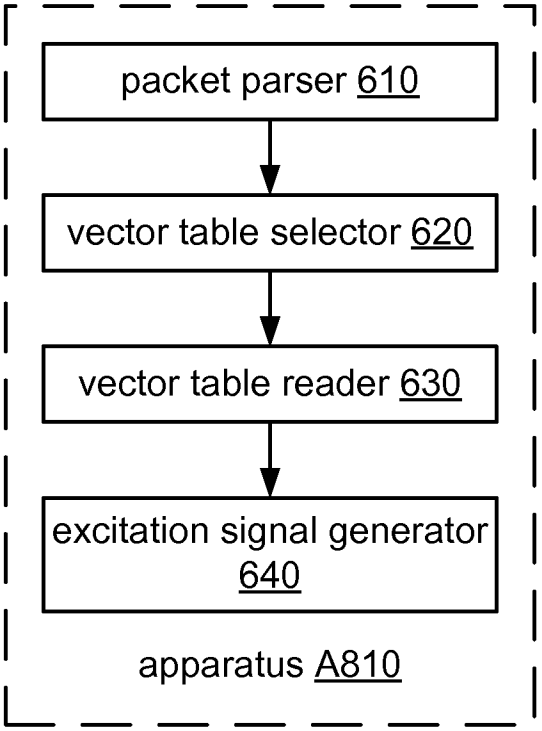
FIG. 50B shows a block diagram of an implementation A810 of apparatus A800.
Figure 50A:
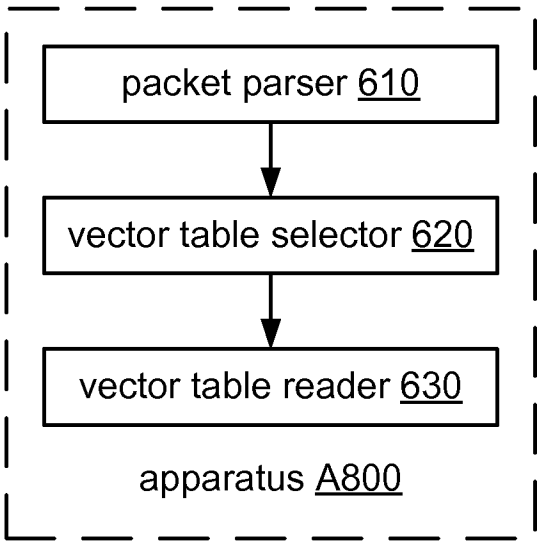
FIG. 50A shows a block diagram of an apparatus A800 according to a general configuration.

FIG. 50A shows a block diagram of an apparatus A800 for decoding a shape of a pitch pulse. Apparatus A800 includes a packet parser 610 configured to extract an encoded pitch period value from a packet (e.g., as described herein with reference to various implementations of task D510) and to extract an index from the packet (e.g., as described herein with reference to various implementations of task D530). Packet parser 620 may be implemented as an instance of packet parser 510 as described herein. Apparatus A800 also includes a vector table selector 620 configured to select one of a plurality of tables of pulse shape vectors (e.g., as described herein with reference to various implementations of task D520) and a vector table reader 630 configured to obtain a pulse shape vector from the selected table (e.g., as described herein with reference to various implementations of task D540).

Packet parser 610 may also be configured to extract a pulse position indicator and an index from a second packet (e.g., as described herein with reference to various implementations of tasks D570 and D580). Vector table selector 620 may also be configured to select one of a plurality of tables of pulse shape vectors based on the position indicator from the second packet (e.g., as described herein with reference to various implementations of task D575). Vector table reader 630 may also be configured to obtain a pulse shape vector from the selected one of the second plurality of tables based on the index from the second packet (e.g., as described herein with reference to various implementations of task D585). FIG. 50B shows a block diagram of an implementation A810 of apparatus A800 that includes an excitation signal generator 640 configured to arrange a pitch pulse that is based on the pulse shape vector within an excitation signal (e.g., as described herein with reference to various implementations of task D560). Excitation signal generator 640 may be implemented as an instance of excitation signal generator 310 and/or 530 as described herein.

Speech encoder AE10 may be implemented to include apparatus A800. For example, first frame encoder 104 of speech encoder AE20 may be implemented to include an instance of apparatus A800. Such an implementation of first frame encoder 104 may also include an instance of apparatus A560, in which case packet parser 510 may also serve as packet parser 620 and/or excitation signal generator 530 may also serve as excitation signal generator 640.

A speech encoder according to a configuration (e.g., according to an implementation of speech encoder AE20) uses three or four coding schemes to encode different classes of frames: a quarter-rate NELP (QNELP) coding scheme, a quarter-rate PPP (QPPP) coding scheme, and a transitional frame coding scheme as described above. The QNELP coding scheme is used to encode unvoiced frames and down-transient frames. The QNELP coding scheme, or an eighth-rate NELP coding scheme, may be used to encode silence frames (e.g., background noise). The QPPP coding scheme is used to encode voiced frames. The transitional frame coding scheme may be used to encode up-transient (i.e., onset) frames and transient frames. The table of FIG. 26 shows an example of a bit allocation for each of these four coding schemes.

Modern vocoders typically perform classification of speech frames. For example, such a vocoder may operate according to a scheme that classifies a frame as one of the six different classes discussed above: silence, unvoiced, voiced, transient, down-transient, and up-transient. Examples of such schemes are described in U.S. Publ. Pat. Appl. No. 2002/0111798 (Huang). One example of such a classification scheme is also described in Section 4.8 (pp. 4-57 to 4-71) of the 3GPP2 (Third Generation Partnership Project 2) document "Enhanced Variable Rate Codec, Speech Service Options 3, 68, and 70 for Wideband Spread Spectrum Digital Systems" (3GPP2 C.S0014-C, January 2007, available online at www-dot-3gpp2-dot-org). This scheme classifies frames using the features listed in the table of FIG. 51, and this section 4.8 is hereby incorporated by reference as an example of an "EVRC classification scheme" as described herein. A similar example of an EVRC classification scheme is described in the code listings of FIGS. 55-63.

The parameters E, EL, and EH that appear in the table of FIG. 51 may be calculated as follows (for a 160-bit frame):

$$E = \sum_{n=0}^{159} s^2(n),\ EL = \sum_{n=0}^{159} s_L^2(n),\ EH = \sum_{n=0}^{159} s_H^2(n),$$

where $s_L(n)$ and $s_H(n)$ are low-pass filtered (using a $12^{th}$ order pole-zero low-pass filter) and high-pass filtered (using a $12^{th}$ order pole-zero high-pass filter) versions of the input speech signal, respectively. Other features that may be used in an EVRC classification scheme include the previous frame mode decision ("prev_mode"), the presence of stationary voiced speech in the previous frame ("prev_voiced"), and a voice activity detection result for the current frame ("curr_va").

Figure 52:
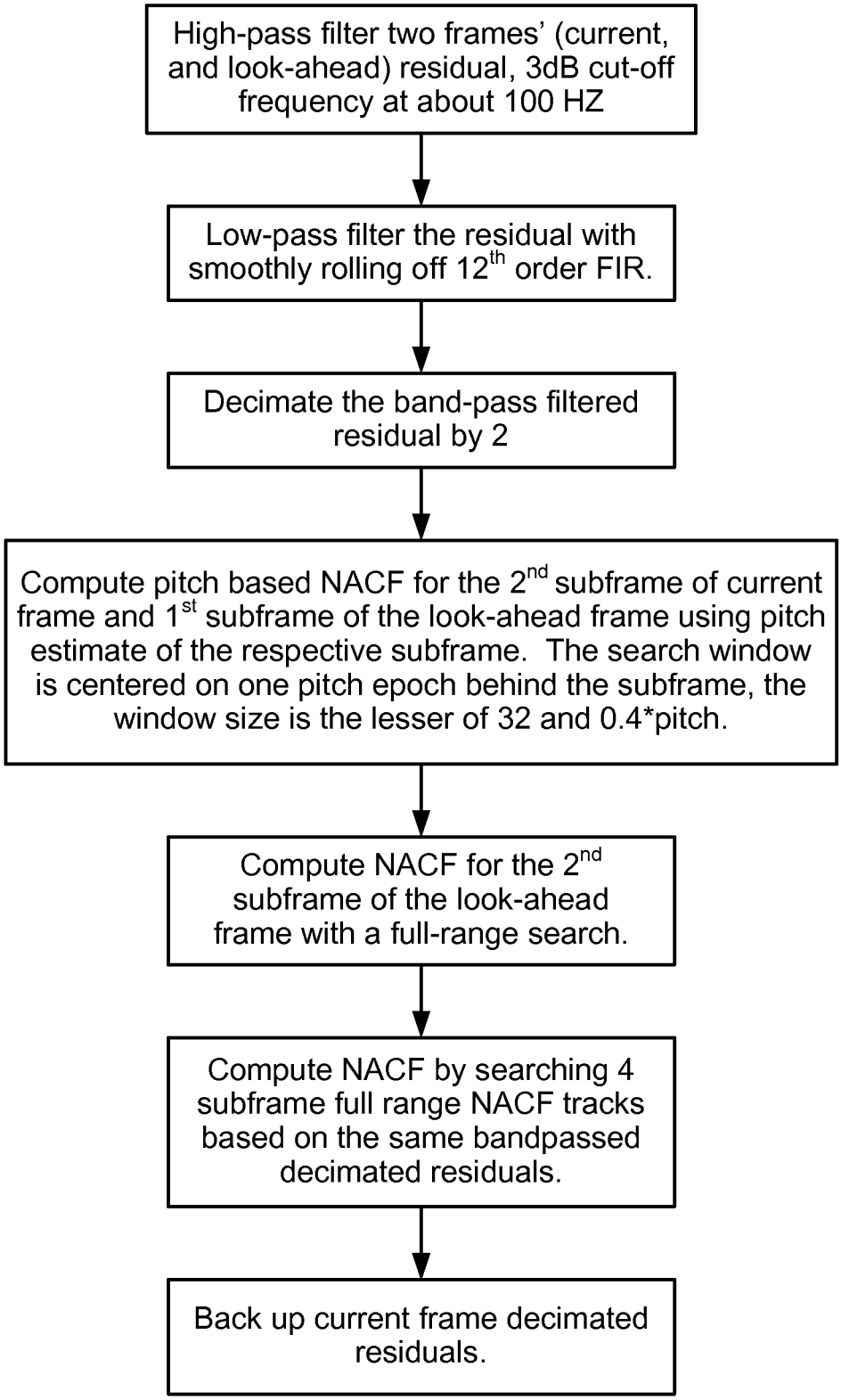
FIG. 52 shows a flowchart of a procedure for computing a pitch-based normalized autocorrelation function.

An important feature used in the classification scheme is the pitch-based normalized autocorrelation function (NACF). FIG. 52 shows a flowchart of a procedure for computing the pitch-based NACF. First, the LPC residual of the current frame and of the next frame (also called the look-ahead frame) is filtered through a third-order highpass filter having a 3-dB cut-off frequency at about 100 Hz. It may be desirable to compute this residual using unquantized LPC coefficient values. Then the filtered residual is low-pass filtered with a finite-impulse-response (FIR) filter of length 13 and decimated by a factor of two. The decimated signal is denoted by $r_d(n)$.

The NACFs for two subframes of the current frame are computed as $$nacf(k) = \max \frac{\operatorname{sign}\left(\sum_{n=0}^{40-1} [r_d(40k+n) r_d(40k+n-lag(k)+i)]\right) \left(\sum_{n=0}^{40-1} [r_d(40k+n) r_d(40k+n-lag(k)+i)]\right)^2}{\left(\sum_{n=0}^{40-1} [r_d(40k+n) r_d(40k+n)]\right) \left(\sum_{n=0}^{40-1} [r_d(40k+n-lag(k)+i) r_d(40k+n-lag(k)+i)]\right)}$$

for k=1, 2, with the maximization done over all integer i such that $$-\frac{1+\max[6, \min(0.2 \times lag(k), 16)]}{2} \le i \le \frac{1+\max[6, \min(0.2 \times lag(k), 16)]}{2},$$

where lag(k) is a lag value for subframe k as estimated by a pitch estimation routine (e.g., a correlation-based technique). These values for the first and second subframes of the current frame may also be referenced as nacf_at_pitch[2] (also written as "nacf_ap[2]") and nacf_ap[3], respectively. The NACF values that were calculated according to the expression above for the first and second subframes of the previous frame may be referenced as nacf_ap[0] and nacf_ap[1], respectively.

The NACF for the look-ahead frame is computed as $$nacf(2) = \max \frac{\operatorname{sign}\left(\sum_{n=0}^{80-1} [r_d(80+n) r_d(80+n-i)]\right) \left(\sum_{n=0}^{80-1} [r_d(80+n) r_d(80+n-i)]\right)^2}{\left(\sum_{n=0}^{80-1} [r_d(80+n) r_d(80+n)]\right) \left(\sum_{n=0}^{80-1} [r_d(80+n-i) r_d(80k+n-i)]\right)},$$

with the maximization being done over all integer i such that $$\frac{20}{2} \le i \le \frac{120}{2}.$$

This value may also be referenced as nacf_ap[4].

Figure 53:
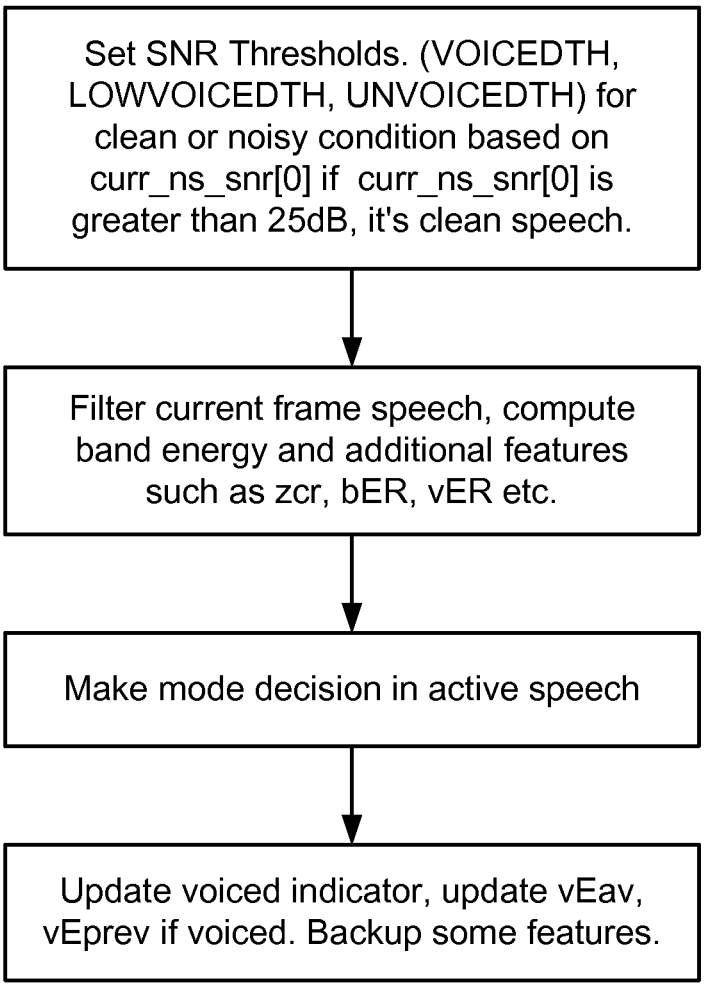
FIG. 53 is a flowchart that illustrates a frame classification scheme at a high level.
Figure 54:
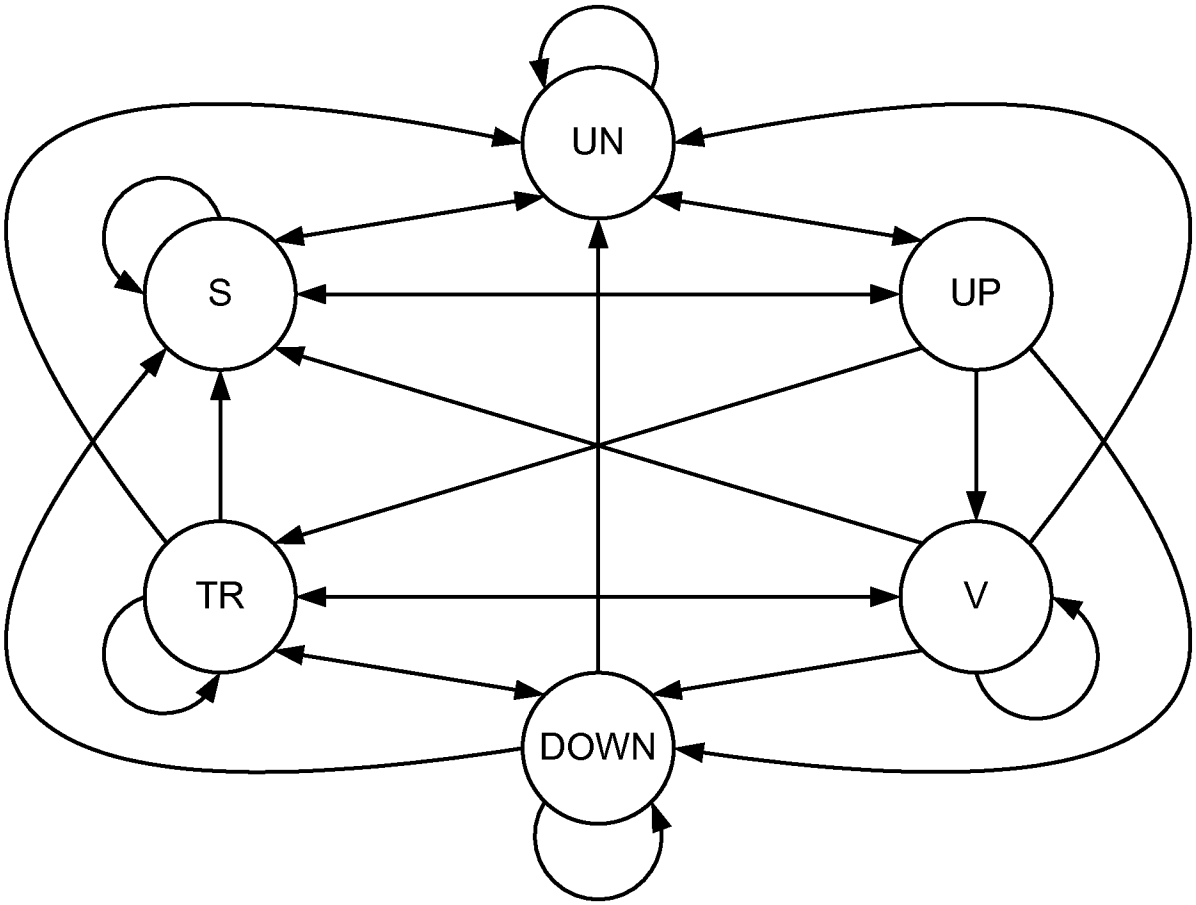
FIG. 54 is a state diagram that illustrates possible transitions between states in a frame classification scheme.

FIG. 53 is a flowchart that illustrates an EVRC classification scheme at a high level. The mode decision may be considered as a transition between states based on the previous mode decision and on features such as NACFs, where the states are the different frame classifications. FIG. 54 is a state diagram that illustrates the possible transitions between states in the EVRC classification scheme, where the labels S, UN, UP, TR, V, and DOWN denote the frame classifications silence, unvoiced, up-transient, transient, voiced, and down-transient, respectively.

An EVRC classification scheme may be implemented by selecting one of three different procedures, depending on a relation between nacf_at_pitch[2] (the second subframe NACF of the current frame, also written as "nacf_ap[2]") and the threshold values VOICEDTH and UNVOICEDTH. The code listing that extends across FIGS. 55 and 56 describes a procedure that may be used when nacf_ap[2]>VOICEDTH. The code listing that extends across FIGS. 57-59 describes a procedure that may be used when nacf_ap[2]<UNVOICEDTH. The code listing that extends across FIGS. 60-63 describes a procedure that may be used when nacf_ap[2]>=UNVOICEDTH and nacf_ap[2]<=VOICEDTH.

It may be desirable to vary the values of the thresholds VOICEDTH, LOWVOICEDTH, and UNVOICEDTH according to the value of the feature curr_ns_snr[0]. For example, if the value of curr_ns_snr[0] is not less than an SNR threshold of 25 dB, then the following threshold values for clean speech may be applied: VOICEDTH=0.75, LOWVOICEDTH=0.5, UNVOICEDTH=0.35; and if the value of curr_ns_snr[0] is less than an SNR threshold of 25 dB, then the following threshold values for noisy speech may be applied: VOICEDTH=0.65, LOWVOICEDTH=0.5, UNVOICEDTH=0.35.

Accurate classification of frames may be especially important to ensure good quality in a low-rate vocoder. For example, it may be desirable to use a transitional frame coding mode as described herein only if the onset frame has at least one distinct peak or pulse. Such a feature may be important for reliable pulse detection, without which the transitional frame coding mode may produce a distorted result. It may be desirable to encode frames that lack at least one distinct peak or pulse using a NELP coding scheme rather than a PPP or transitional frame coding scheme. For example, it may be desirable to reclassify such a transient or up-transient frame as an unvoiced frame.

Such a reclassification may be based on one or more normalized autocorrelation function (NACF) values and/or other features. The reclassification may also be based on features that are not used in an EVRC classification scheme, such as a peak-to-RMS energy value of the frame ("maximum sample/RMS energy") and/or the actual number of pitch pulses in the frame ("peak count"). Any one or more of the eight conditions shown in the table of FIG. 64, and/or any one or more of the ten conditions shown in the table of FIG. 65, may be used for reclassifying an up-transient frame as an unvoiced frame. Any one or more of the eleven conditions shown in the table of FIG. 66, and/or any one or more of the eleven conditions shown in the table of FIG. 67, may be used for reclassifying a transient frame as an unvoiced frame. Any one or more of the four conditions shown in the table of FIG. 68 may be used for reclassifying a voiced frame as an unvoiced frame. It may also be desirable to limit such reclassification to frames that are relatively free of low-band noise. For example, it may be desirable to reclassify a frame according to any of the conditions in FIG. 65, 67, or 68, or any of the seven right-most conditions of FIG. 66, only if the value of curr_ns_snr[0] is not less than 25 dB.

Conversely, it may be desirable to reclassify an unvoiced frame that includes at least one distinct peak or pulse as an up-transient or transient frame. Such a reclassification may be based on one or more normalized autocorrelation function (NACF) values and/or other features. The reclassification may also be based on features that are not used in an EVRC classification scheme, such as a peak-to-RMS energy value of the frame and/or peak count. Any one or more of the seven conditions shown in the table of FIG. 69 may be used for reclassifying an unvoiced frame as an up-transient frame. Any one or more of the nine conditions shown in the table of FIG. 70 may be used for reclassifying an unvoiced frame as a transient frame. The condition shown in the table of FIG. 71A may be used for reclassifying a down-transient frame as a voiced frame. The condition shown in the table of FIG. 71B may be used for reclassifying a down-transient frame as a transient frame.

As an alternative to frame reclassification, a method of frame classification such as an EVRC classification scheme may be modified to produce a classification result that is equal to a combination of the EVRC classification scheme and one or more of the reclassification conditions described above and/or set forth in FIGS. 64-71B.

Figure 72:
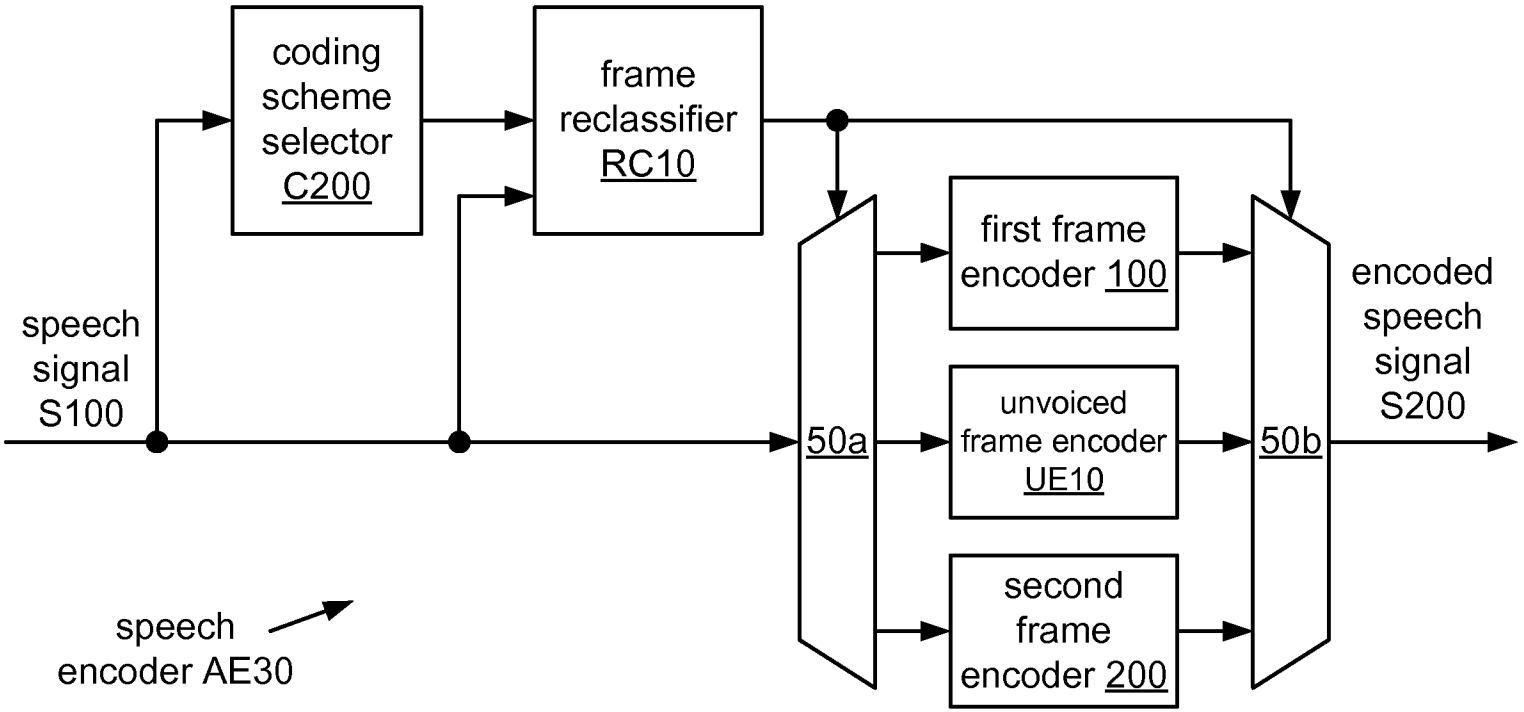
FIG. 72 shows a block diagram of an implementation AE30 of speech encoder AE20.

FIG. 72 shows a block diagram of an implementation AE30 of speech encoder AE20. Coding scheme selector C200 may be configured to apply a classification scheme such as the EVRC classification scheme described in the code listings of FIGS. 55-63. Speech encoder AE30 includes a frame reclassifier RC10 that is configured to reclassify frames according to one or more of the conditions described above and/or set forth in FIGS. 64-71B. Frame reclassifier RC10 may be configured to receive a frame classification and/or values of other frame features from coding scheme selector C200. Frame reclassifier RC10 may also be configured to calculate values of additional frame features (e.g., peak-to-RMS energy value, peak count). Alternatively, speech encoder AE30 may be implemented to include an implementation of coding scheme selector C200 that produces a classification result equal to a combination of an EVRC classification scheme and one or more of the reclassification conditions described above and/or set forth in FIGS. 64-71B.

Figure 73A:
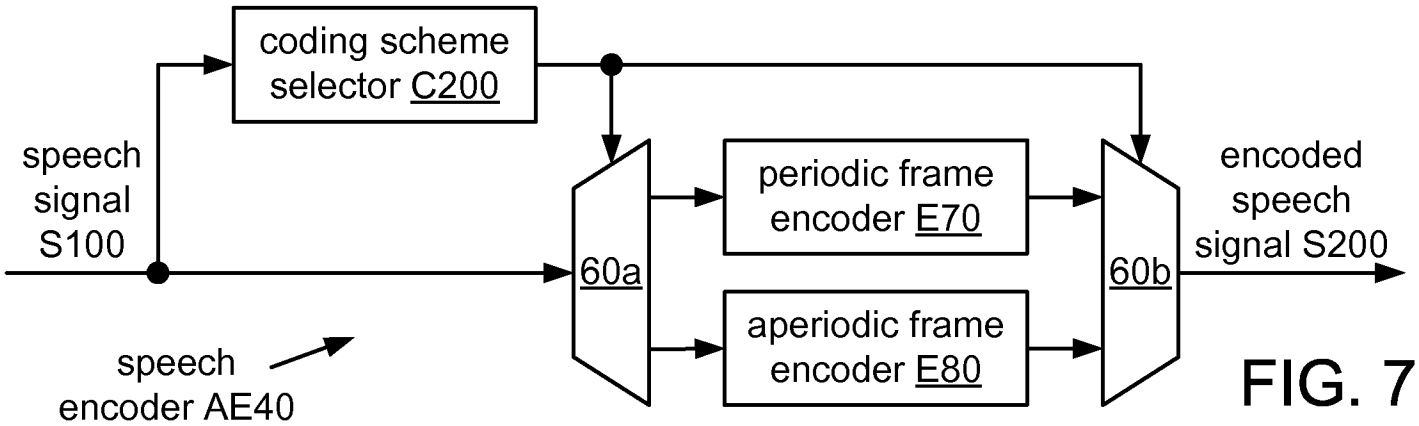
FIG. 73A shows a block diagram of an implementation AE40 of speech encoder AE10.

FIG. 73A shows a block diagram of an implementation AE40 of speech encoder AE10. Speech encoder AE40 includes a periodic frame encoder E70 configured to encode periodic frames and an aperiodic frame encoder E80 configured to encode aperiodic frames. For example, speech encoder AE40 may include an implementation of coding scheme selector C200 that is configured to direct selectors 60*a*, 60*b* to select periodic frame encoder E70 for frames classified as voiced, transient, up-transient, or down-transient, and to select aperiodic frame encoder E80 for frames classified as unvoiced or silence. The coding scheme selector C200 of speech encoder AE40 may implemented to produce a classification result that is equal to a combination of an EVRC classification scheme and one or more of the reclassification conditions described above and/or set forth in FIGS. 64-71B.

Figure 73B:
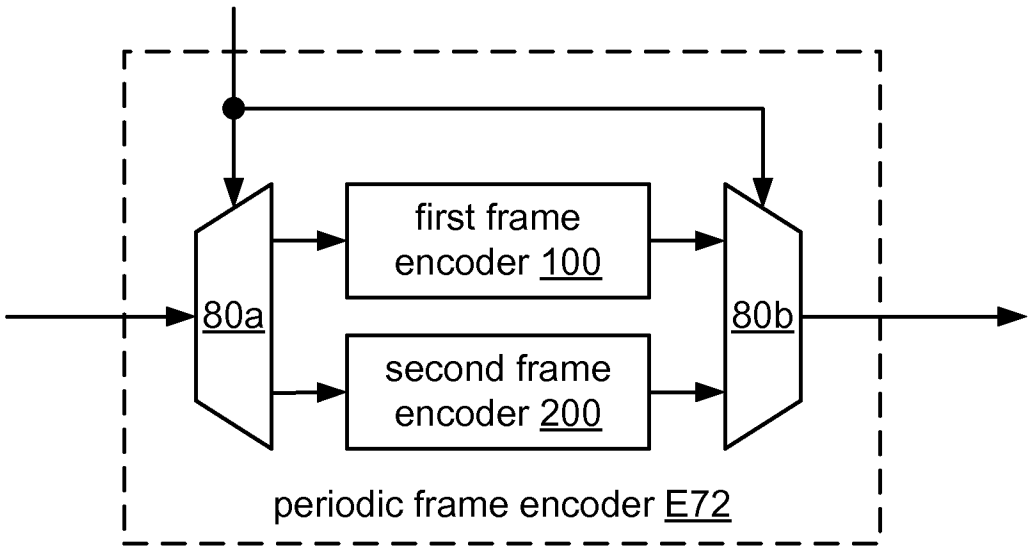
FIG. 73B shows a block diagram of an implementation E72 of periodic frame encoder E70.

FIG. 73B shows a block diagram of an implementation E72 of periodic frame encoder E70. Encoder E72 includes implementations of first frame encoder 100 and second frame encoder 200 as described herein. Encoder E72 also includes selectors 80*a*, 80*b* that are configured to select one of encoders 100 and 200 for the current frame according to a classification result from coding scheme selector C200. It may be desirable to configure periodic frame encoder E72 to select second frame encoder 200 (e.g., a QPPP encoder) as the default encoder for periodic frames. Aperiodic frame encoder E80 may be similarly implemented to select one among an unvoiced frame encoder (e.g., a QNELP encoder) and a silence frame encoder (e.g., an eighth-rate NELP encoder). Alternatively, aperiodic frame encoder E80 may be implemented as an instance of unvoiced frame encoder UE10.

Figure 74:
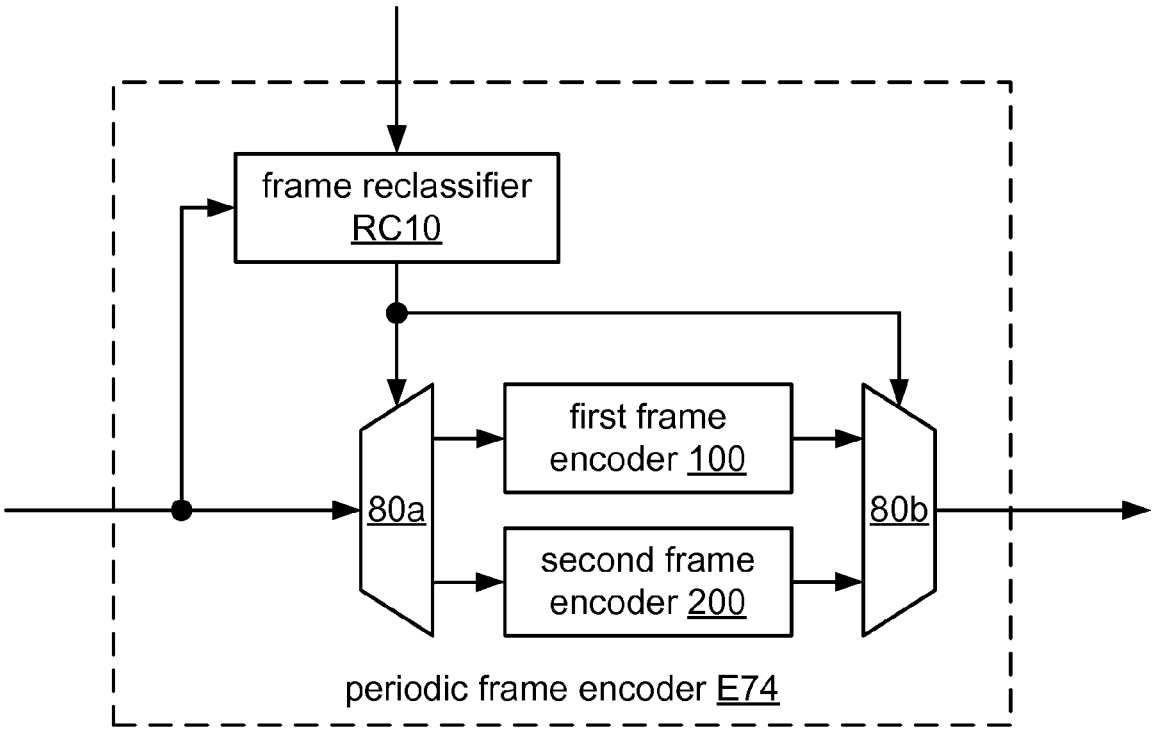
FIG. 74 shows a block diagram of an implementation E74 of periodic frame encoder E72.
Figure 75A:
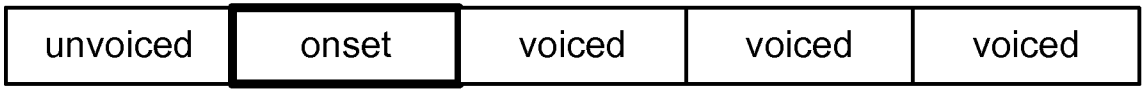
FIGS. 75A-D show some typical frame sequences in which the use of a transitional frame coding mode may be desirable.
Figure 75B:
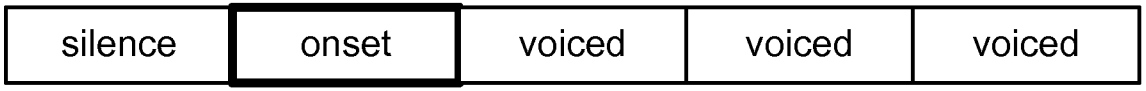
Figure 75C:
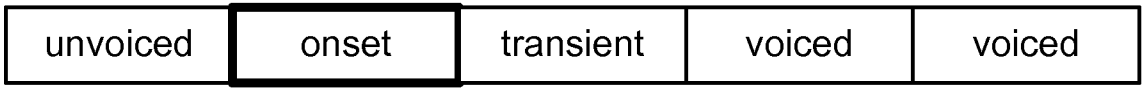
Figure 75D:
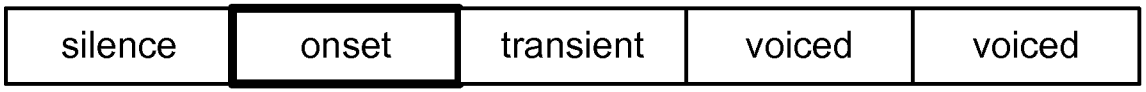

FIG. 74 shows a block diagram of an implementation E74 of periodic frame encoder E72. Encoder E74 includes an instance of frame reclassifier RC10 that is configured to reclassify frames according to one or more of the conditions described above and/or set forth in FIGS. 64-71B and to control selectors 80*a*, 80*b* to select one of encoders 100 and 200 for the current frame according to a result of the reclassification. In a further example, coding scheme selector C200 may be configured to include frame reclassifier RC10, or to perform a classification scheme equal to a combination of an EVRC classification scheme and one or more of the reclassification conditions described above and/or set forth in FIGS. 64-71B, and to select first frame encoder 100 as indicated by such classification or reclassification.

It may be desirable to use a transitional frame coding mode as described above to encode transient and/or up-transient frames. FIGS. 75A-D show some typical frame sequences in which the use of a transitional frame coding mode as described herein may be desirable. In these examples, use of the transitional frame coding mode would typically be indicated for the frame that is outlined in bold. Such a coding mode typically performs well on fully or partially voiced frames that have a relatively constant pitch period and sharp pulses. Quality of the decoded speech may be reduced, however, when the frame lacks sharp pulses or when the frame precedes the actual onset of voicing. In some cases, it may be desirable to skip or cancel use of the transitional frame coding mode, or otherwise to delay use of this coding mode until a later frame (e.g., the following frame).

Pulse misdetection may cause pitch error, missing pulses, and/or insertion of extraneous pulses. Such errors may lead to distortion such as pops, clicks, and/or other discontinuities in the decoded speech. Therefore, it may be desirable to verify that the frame is suitable for transitional frame coding, and cancelling the use of a transitional frame coding mode when the frame is not suitable may help to reduce such problems.

It may be determined that a transient or up-transient frame is unsuitable for the transitional frame coding mode. For example, the frame may lack a distinct, sharp pulse. In such case, it may be desirable to use the transitional frame coding mode to encode the first suitable voiced frame that follows the unsuitable frame. For example, if an onset frame lacks a distinct sharp pulse, it may be desirable to perform transitional frame coding on the first suitable voiced frame that follows. Such a technique may help to ensure a good reference for subsequent voiced frames.

In some cases, use of a transitional frame coding mode may lead to pulse gain mismatch problems and/or pulse shape mismatch problems. Only a limited number of bits are available to encode these parameters, and the current frame may not provide a good reference even though transitional frame coding is otherwise indicated. Cancelling unnecessary use of a transitional frame coding mode may help to reduce such problems. Therefore, it may be desirable to verify that a transitional frame coding mode is more suitable for the current frame than another coding mode.

For a case in which the use of transitional frame coding is skipped or cancelled, it may be desirable to use the transitional frame coding mode to encode the first suitable frame that follows, as such action may help to provide a good reference for subsequent voiced frames. For example, it may be desirable to force transitional frame coding on the very next frame, if it is at least partially voiced.

The need for transitional frame coding, and/or the suitability of a frame for transitional frame coding, may be determined based on criteria such as current frame classification, previous frame classification, initial lag value (e.g., as determined by a pitch estimation routine, such as a correlation-based technique, one example of which is described in section 4.6.3 of the 3GPP2 document C.S0014-C referenced herein), modified lag value (e.g., as determined by a pulse detection operation such as method M300), lag value of a previous frame, and/or NACF values.

It may be desirable to use a transitional frame coding mode near the start of a voiced segment, as the result of using QPPP without a good reference may be unpredictable. In some cases, however, QPPP may be expected to provide a better result than a transitional frame coding mode. For example, in some cases, the use of a transitional frame coding mode may be expected to yield a poor reference or even to cause a more objectionable result than using QPPP.

It may be desirable to skip transitional frame coding if it is not necessary for the current frame. In such case, it may be desirable to default to a voiced coding mode, such as QPPP (e.g., to preserve the continuity of the QPPP). Unnecessary use of a transitional frame coding mode may lead to problems of mismatch in pulse gain and/or pulse shape in later frames (e.g., due to the limited bit budget for these features). A voiced coding mode having limited time-synchrony, such as QPPP, may be especially sensitive to such errors.

After encoding a frame using a transitional frame coding scheme, it may be desirable to check the encoded result, and to reject the use of transitional frame coding on the frame if the encoded result is poor. For a frame that is mostly unvoiced and becomes voiced only near the end, the transitional coding mode may be configured to encode the unvoiced portion without pulses (e.g., as zero or a low value), or the transitional coding mode may be configured to fill at least part of the unvoiced portion with pulses. If the unvoiced portion is encoded without pulses, the frame may produce an audible click or discontinuity in the decoded signal. In such case, it may be desirable to use a NELP coding scheme for the frame instead. It may be desirable to avoid using NELP on a voiced segment, however, as it may cause distortion. If a transitional coding mode is cancelled for a frame, in most cases it may be desirable to use a voiced coding mode (e.g., QPPP) rather than an unvoiced coding mode (e.g. QNELP) to encode the frame. As described above, a selection to use transitional coding mode may be implemented as a selection between the transitional coding mode and a voiced coding mode. While the result of using QPPP without a good reference may be unpredictable (e.g., the phase of the frame may be derived from a preceding unvoiced frame), it is unlikely to produce a click or discontinuity in the decoded signal. In such case, use of the transitional coding mode may be postponed until the next frame.

It may be desirable to override a decision to use a transitional coding mode for a frame when a pitch discontinuity between frames is detected. In one example, a task T710 checks for pitch continuity with the previous frame (e.g., checks for a pitch doubling error). If the frame is classified as voiced or transient, and the lag value indicated for the current frame by the pulse detection routine is much less than (e.g., is about ½, ⅓, or ¼ of) the lag value indicated for the previous frame by the pulse detection routine, then the task cancels the decision to use the transitional coding mode.

In another example, a task T720 checks for pitch overflow as compared to previous frame. Pitch overflow occurs when the speech has a very low pitch frequency that results in a lag value higher than the maximum allowable lag. Such a task may be configured to cancel the decision to use the transitional coding mode if the lag value for the previous frame was large (e.g., more than 100 samples) and the lag values indicated for the current frame by the pitch estimation and pulse detection routines are both much less than the previous pitch (e.g., more than 50% less). In such case, it may also be desirable to keep only the largest pitch pulse of the frame as a single pulse. Alternatively, the frame may be encoded using the previous lag estimate and a voiced and/or relative coding mode (e.g., task E200, QPPP).

It may be desirable to override a decision to use a transitional coding mode for a frame when an inconsistency among results from two different routines is detected. In one example, a task T730 checks for consistency between a lag value from a pitch estimation routine (e.g., a correlation-based technique as described, for example, in section 4.6.3 of the 3GPP2 document C.S0014-C referenced herein) and an estimated pitch period from a pulse detection routine (e.g., method M300), in the presence of strong NACF. A very high NACF at pitch for the second pulse detected indicates a good pitch estimate, such that an inconsistency between the two lag estimates would be unexpected. Such a task may be configured to cancel the decision to use a transitional coding mode if the lag estimate from the pulse detection routine is very different from (e.g., greater than 1.6 times, or one hundred sixty percent of) the lag estimate from the pitch estimation routine.

In another example, a task T740 checks for agreement between the lag value and the position of the terminal pulse. It may be desirable to cancel a decision to use a transitional frame coding mode when one or more of the peak positions, as encoded using the lag estimate (which may be an average of the distance between the peaks), are too different from the corresponding actual peak positions. Task T740 may be configured to use the position of the terminal pulse and the lag value calculated by the pulse detection routine to calculate reconstructed pitch pulse positions, to compare each of the reconstructed positions to the actual pitch peak positions as detected by the pulse detection algorithm, and to cancel the decision to use transitional frame coding if any of the differences is too large (e.g., is greater than eight samples).

In a further example, a task T750 checks for agreement between lag value and pulse position. Such a task may be configured to cancel the decision to use transitional frame coding if the final pitch peak is more than one lag period away from the final frame boundary. For example, such a task may be configured to cancel the decision to use transitional frame coding if the distance between the position of the final pitch pulse and the end of the frame is greater than the final lag estimate (e.g., a lag value calculated by lag estimation task L200 and/or method M300). Such a condition may indicate a pulse misdetection or a lag that is not yet stabilized.

If the current frame has two pulses and is classified as transient, and if a ratio of the squared magnitudes of the peaks of the two pulses is large, it may be desirable to correlate the two pulses over the entire lag value and to reject the smaller peak unless the correlation result is greater than (alternatively, not less than) a corresponding threshold value. If the smaller peak is rejected, it may also be desirable to cancel a decision to use transitional frame coding for the frame.

FIG. 76 shows a code listing for two routines that may be used to cancel a decision to use transitional frame coding for a frame. In this listing, mod_lag indicates the lag value from the pulse detection routine; orig_lag indicates the lag value from the pitch estimation routine; pdelay_transient_coding indicates the lag value from the pulse detection routine for the previous frame; PREV_TRANSIENT_FRAME_E indicates whether a transitional coding mode was used for the previous frame; and loc[0] indicates the position of the final pitch peak of the frame.

FIG. 77 shows four different conditions that may be used to cancel a decision to use transitional frame coding. In this table, curr_mode indicates the current frame classification; prev_mode indicates the frame classification for the previous frame; number_of_pulses indicates the number of pulses in the current frame; prev_no_of_pulses indicates the number of pulses in the previous frame; pitch_doubling indicates whether a pitch doubling error has been detected in the current frame; delta_lag_intra indicates the absolute value (e.g., integer) of the difference between the lag values from a pitch estimation routine (e.g., a correlation-based technique as described, for example, in section 4.6.3 of the 3GPP2 document C.S0014-C referenced herein) and a pulse detection routine such as, for example, method M300 (or, if pitch doubling was detected, the absolute value of the difference between the half the lag value from the pitch estimation routine and the lag value from the pulse detection routine); delta_lag_inter indicates the absolute value (e.g., floating point) of the difference between the final lag value of the previous frame and the lag value from the pitch estimation routine (or half that lag value, if pitch doubling was detected) for the current frame; NEED_TRANS indicates whether the use of a transitional frame coding mode for the current frame was indicated during coding of the previous frame; TRANS_USED indicates whether the transitional coding mode was used to encode the previous frame; and fully_voiced indicates whether the integer part of the distance between the position of the terminal pitch pulse and the opposite end of the frame, as divided by the final lag value, is equal to number_of_pulses minus one. Examples of values for the thresholds include T1A=[0.1*(lag value from the pulse detection routine)+0.5], T1B=[0.05*(lag value from the pulse detection routine)+0.5], T2A=[0.2*(final lag value for the previous frame)], and T2B=[0.15*(final lag value for the previous frame)].

Figure 78:
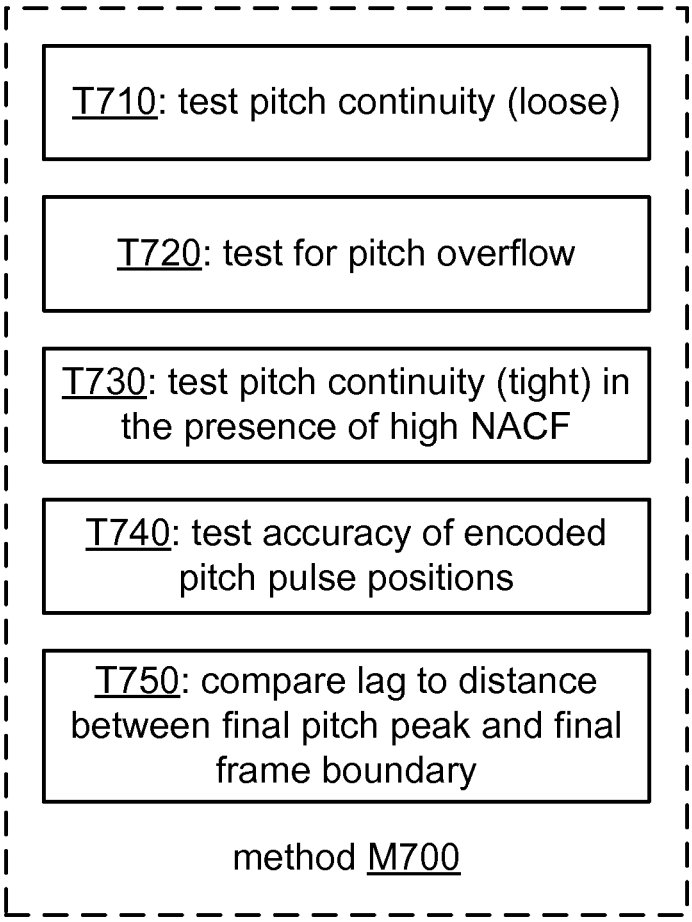
FIG. 78 shows a diagram of a method M700 according to a general configuration.

Frame reclassifier RC10 may be implemented to include one or more of the provisions described above for canceling a decision to use a transitional coding mode, such as tasks T710-T750, the code listing in FIG. 76, and the conditions shown in FIG. 77. For example, frame reclassifier RC10 may be implemented to perform method M700 as shown in FIG. 78, and to cancel a decision to use a transitional coding mode if any of test tasks T710-T750 fails.

Figure 79A:
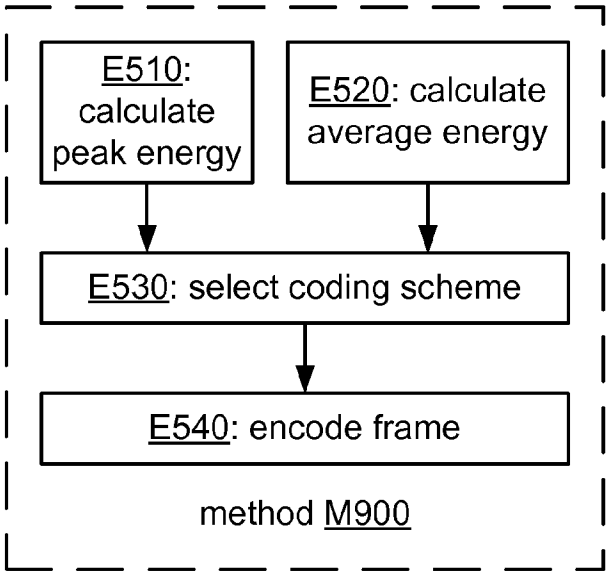
FIG. 79A shows a flowchart of a method M900 according to a general configuration.

FIG. 79A shows a flowchart of a method M900 of encoding a speech signal frame according to a general configuration that includes tasks E510, E520, E530, and E540. Task E510 calculates a peak energy of a residual of the frame (e.g., an LPC residual). Task E510 may be configured to calculate the peak energy by squaring the value of the sample that has the greatest amplitude (alternatively, the sample that has the greatest magnitude). Task E520 calculates an average energy of the residual. Task E520 may be configured to calculate the average energy by summing the squared values of the samples and dividing the sum by the number of samples in the frame. Based on a relation between the calculated peak energy and the calculated average energy, task E530 selects either a noise-excited coding scheme (e.g., a NELP scheme as described herein) or a nondifferential pitch prototype coding scheme (e.g., as described herein with reference to task E100). Task E540 encodes the frame according to the coding scheme selected by task E530. If task E530 selects the nondifferential pitch prototype coding scheme, then task E540 includes producing an encoded frame that includes representations of a time-domain shape of a pitch pulse of the frame, a position of a pitch pulse of the frame, and an estimated pitch period of the frame. For example, task E540 may be implemented to include an instance of task E100 as described herein.

Typically, the relation between the calculated peak energy and the calculated average energy upon which task E530 is based is the ratio of peak-to-RMS energy. Such a ratio may be calculated by task E530 or by another task of method M900. As part of the coding scheme selection decision, task E530 may be configured to compare this ratio to a threshold value, which may change according to the current value of one or more other parameters. For example, FIGS. 64-67, 69, and 70 show examples in which different values are used for this threshold value (e.g., 14, 16, 24, 25, 35, 40, or 60) according to the values of other parameters.

Figure 79B:
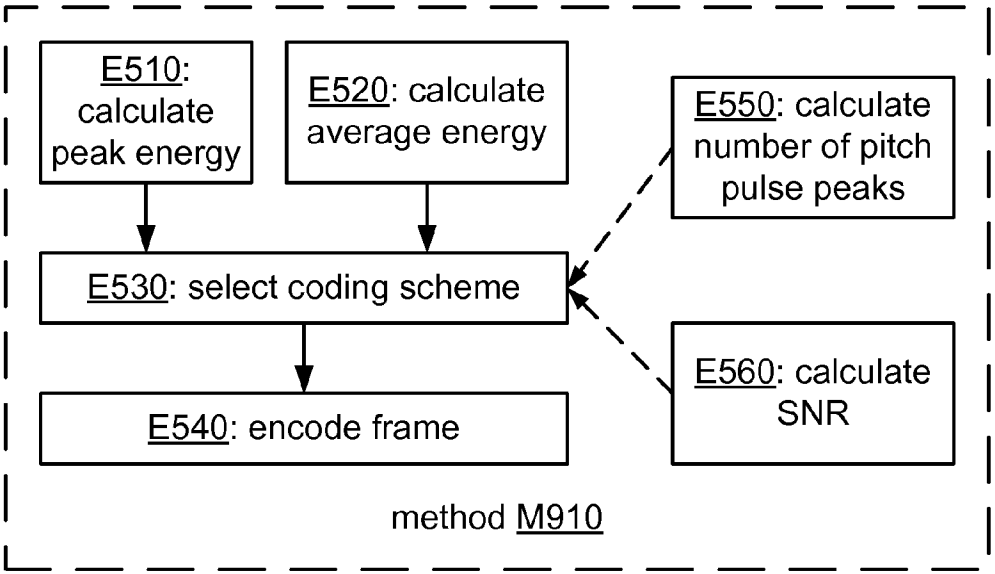
FIG. 79B shows a flowchart of an implementation M910 of method M900.

FIG. 79B shows a flowchart of an implementation M910 of method M900. In this case, task E530 is configured to select the coding scheme based on the relation between peak and average energy and based on one or more other parameter values as well. Method M910 includes one or more tasks that calculate values of additional parameters, such as the number of pitch peaks in the frame (task E550) and/or an SNR of the frame (task E560). As part of the coding scheme selection decision, task E530 may be configured to compare such a parameter value to a threshold value, which may change according to the current value of one or more other parameters. FIGS. 65 and 66 show examples in which different threshold values (e.g., 4 or 5) are used to evaluate the current peak count value as calculated by task E550. Task E550 may be implemented as an instance of method M300 as described herein. Task E560 may be configured to calculate the SNR of the frame or the SNR of a portion of the frame, such as a lowband or highband portion (e.g., curr_ns_nsr[0] or curr_ns_snr[1] as shown in FIG. 51). For example, task E560 may be configured to calculate curr_ns_snr[0] (i.e., the SNR of the 0-2 kHz band). In one particular example, task E530 is configured to select the noise-excited coding scheme according to any of the conditions of FIG. 65 or 67, or any of the seven right-most conditions of FIG. 66, but only if the value of curr_ns_snr[0] is not less than a threshold value (e.g., 25 dB).

Figure 80A:
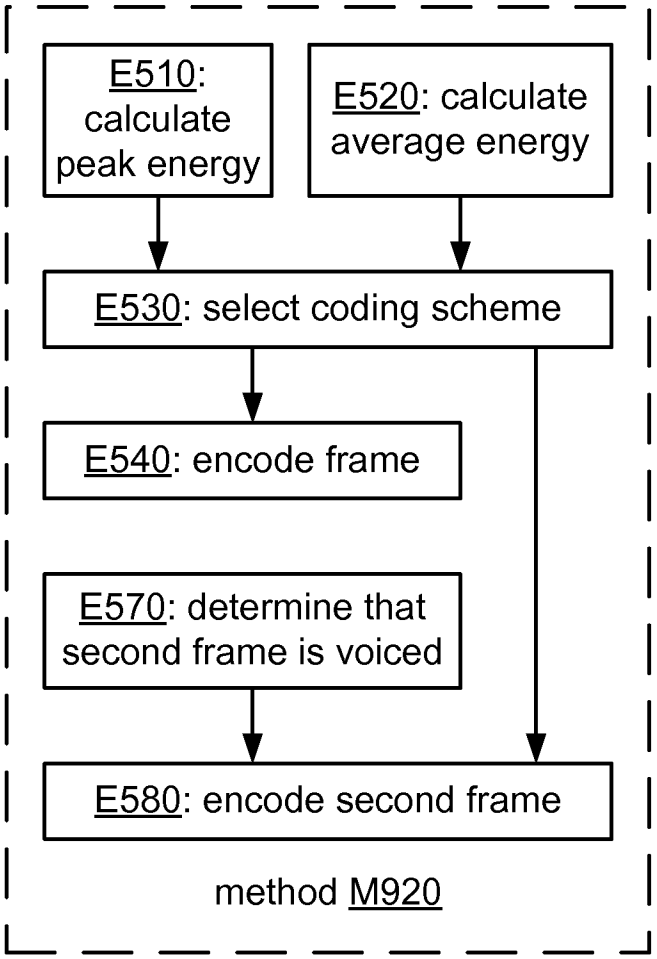
FIG. 80A shows a flowchart of an implementation M920 of method M900.

FIG. 80A shows a flowchart of an implementation M920 of method M900 that includes tasks E570 and E580. Task E570 determines that the next frame of the speech signal ("the second frame") is voiced (e.g., is highly periodic). For example, task E570 may be configured to perform a version of an EVRC classification as described herein on the second frame. If task E530 selected the noise-excited coding scheme for the first frame (i.e., the frame encoded in task E540), then task E580 encodes the second frame according to the nondifferential pitch prototype coding scheme. Task E580 may be implemented as an instance of task E100 as described herein.

Method M920 may also be implemented to include a task that performs a differential encoding operation on a third frame that immediately follows the second frame. Such a task may include producing an encoded frame that includes representations of (A) a differential between a pitch pulse shape of the third frame and a pitch pulse shape of the second frame and (B) a differential between a pitch period of the third frame and a pitch period of the second frame. Such a task may be implemented as an instance of task E200 as described herein.

Figure 80B:
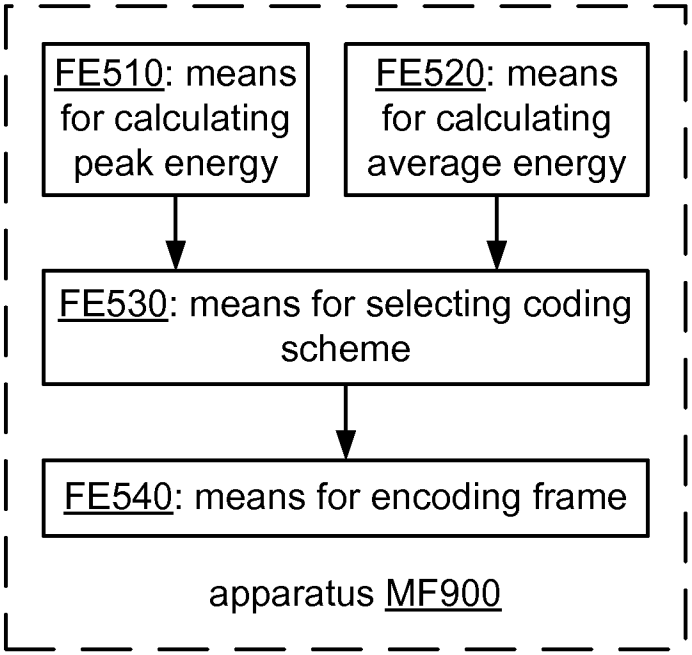
FIG. 80B shows a block diagram of an apparatus MF900 according to a general configuration.
Figure 81B:
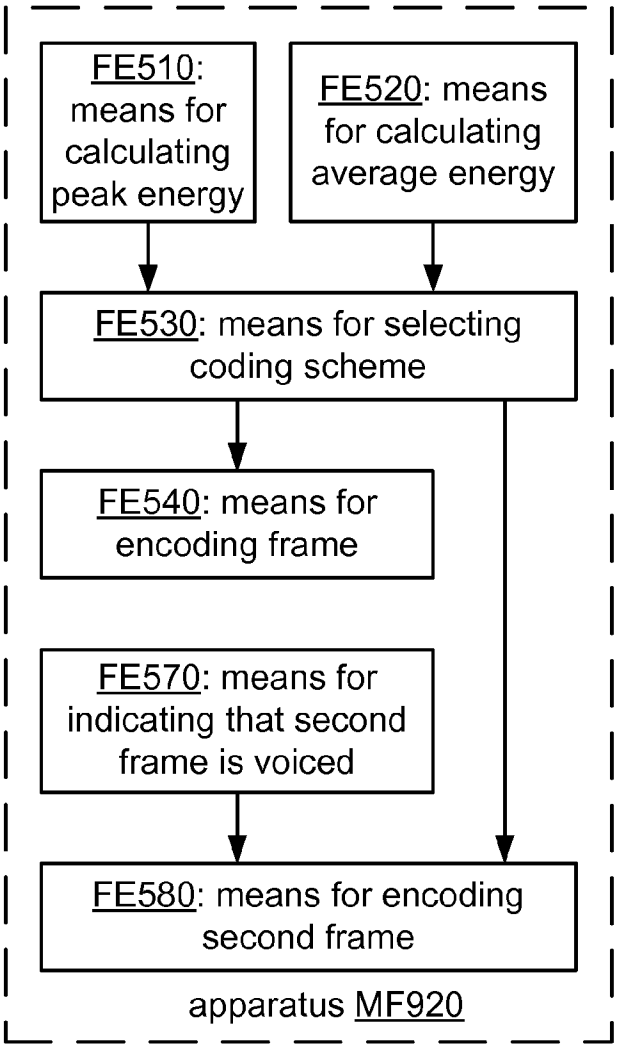
FIG. 81B shows a block diagram of an implementation MF920 of apparatus MF900.
Figure 81A:
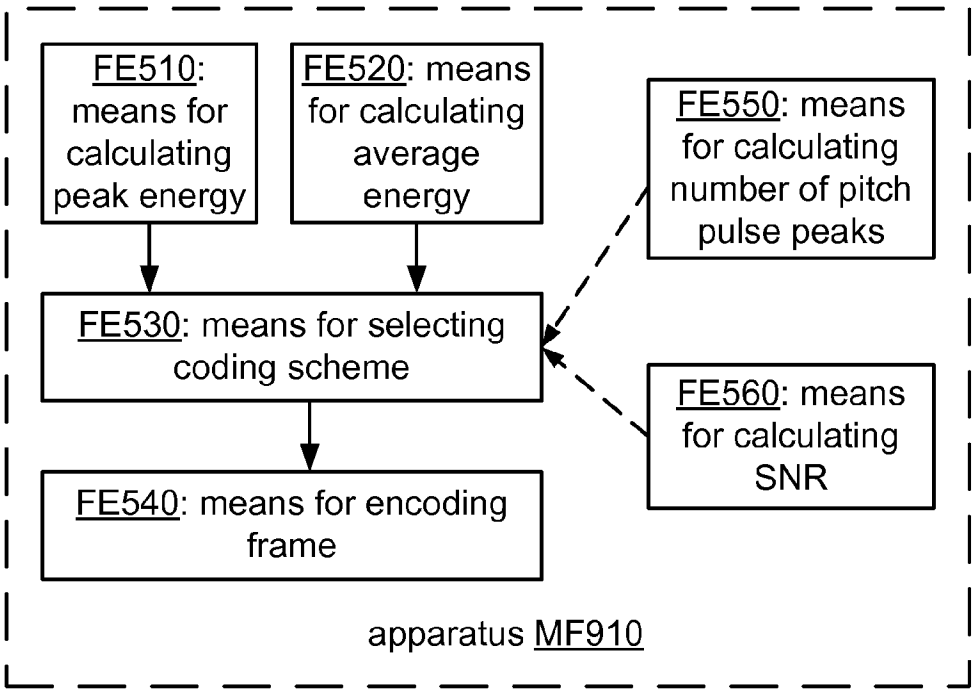
FIG. 81A shows a block diagram of an implementation MF910 of apparatus MF900.

FIG. 80B shows a block diagram of an apparatus MF900 for encoding a speech signal frame. Apparatus MF900 includes means for calculating peak energy FE510 (e.g., as described above with reference to various implementations of task E510), means for calculating average energy FE520 (e.g., as described above with reference to various implementations of task E520), means for selecting a coding scheme FE530 (e.g., as described above with reference to various implementations of task E530), and means for encoding the frame FE540 (e.g., as described above with reference to various implementations of task E540). FIG. 81A shows a block diagram of an implementation MF910 of apparatus MF900 that includes one or more additional means, such as means for calculating a number of pitch pulse peaks of the frame FE550 (e.g., as described above with reference to various implementations of task E550) and/or means for calculating an SNR of the frame FE560 (e.g., as described above with reference to various implementations of task E560). FIG. 81B shows a block diagram of an implementation MF920 of apparatus MF900 that includes means for indicating that a second frame of the speech signal is voiced FE570 (e.g., as described above with reference to various implementations of task E570) and means for encoding the second frame FE580 (e.g., as described above with reference to various implementations of task E580).

Figure 82B:
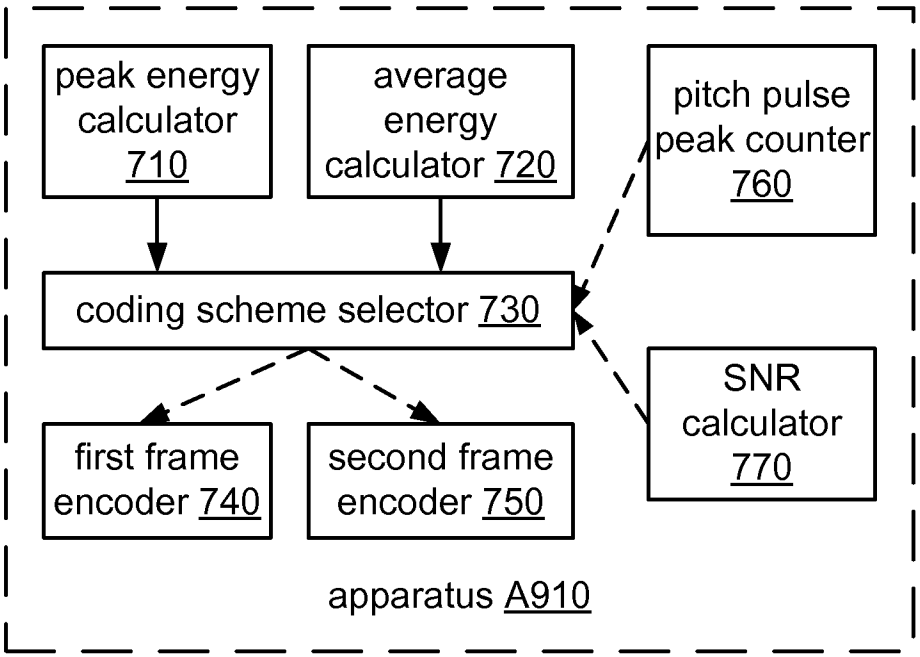
Figure 82A:
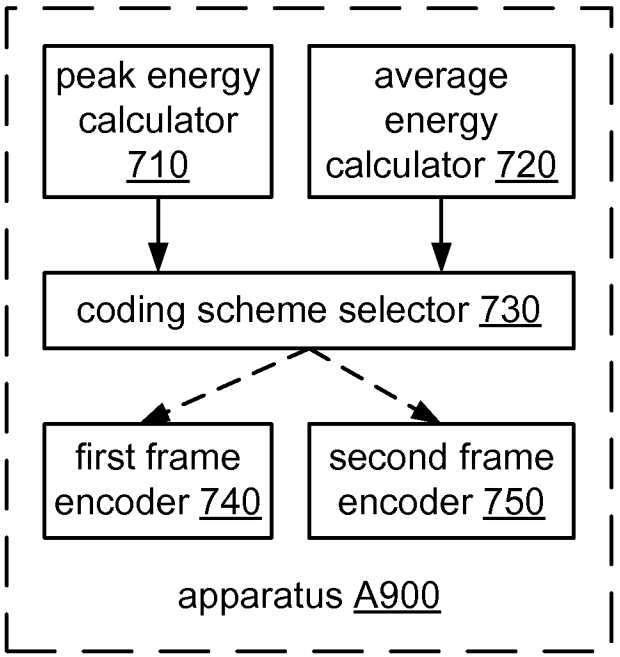

FIG. 82A shows a block diagram of an apparatus A900 for encoding a speech signal frame according to a general configuration. Apparatus A900 includes a peak energy calculator 710 configured to calculate a peak energy of the frame (e.g., as described above with reference to task E510) and an average energy calculator 720 configured to calculate an average energy of the frame (e.g., as described above with reference to task E520). Apparatus A900 includes a first frame encoder 740 that is selectably configured to encode the frame according to a noise-excited coding scheme (e.g., a NELP coding scheme). Encoder 740 may be implemented as an instance of unvoiced frame encoder UE10 or aperiodic frame encoder E80 as described herein. Apparatus A900 also includes a second frame encoder 750 that is selectably configured to encode the frame according to a nondifferential pitch prototype coding scheme. Encoder 750 is configured to produce an encoded frame that includes representations of a time-domain shape of a pitch pulse of the frame, a position of a pitch pulse of the frame, and an estimated pitch period of the frame. Encoder 750 may be implemented as an instance of frame encoder 100, apparatus A400, or apparatus A650 as described herein and/or may be implemented to include calculators 710 and/or 720. Apparatus A900 also includes a coding scheme selector 730 that is configured to selectably cause one of frame encoders 740 and 750 to encode the frame, where the selection is based on a relation between the calculated peak energy and the calculated average energy (e.g., as described above with reference to various implementations of task E530). Coding scheme selector 730 may be implemented as an instance of coding scheme selector C200 or C300 as described herein and may include an instance of frame reclassifier RC10 as described herein.

Speech encoder AE10 may be implemented to include apparatus A900. For example, coding scheme selector C200 of speech encoder AE20, AE30, or AE40 may be implemented to include an instance of coding scheme selector 730 as described herein.

FIG. 82B shows a block diagram of an implementation A910 of apparatus A900. In this case, coding scheme selector 730 is configured to select the coding scheme based on the relation between peak and average energy and based on one or more other parameter values as well (e.g., as described herein with reference to task E530 as implemented in method M910). Apparatus A910 includes one or more elements that calculate values of additional parameters. For example, apparatus A910 may include a pitch pulse peak counter 760 configured to calculate the number of pitch peaks in the frame (e.g., as described above with reference to task E550 or apparatus A300). Additionally or alternatively, apparatus A910 may include an SNR calculator 770 configured to calculate an SNR of the frame (e.g., as described above with reference to task E560). Coding scheme selector 730 may be implemented to include counter 760 and/or SNR calculator 770.

For convenience, the speech signal frame discussed above with reference to apparatus A900 is now referred to as "the first frame," and the frame that follows it in the speech signal is referred to as "the second frame." Coding scheme selector 730 may be configured to perform a frame classification operation on the second frame (e.g., as described herein with reference to task E570 as implemented in method M920). For example, coding scheme selector 730 may be configured, in response to selecting the noise-excited coding scheme for the first frame and determining that the second frame is voiced, to cause second frame encoder 750 to encode the second frame (i.e., according to the nondifferential pitch prototype coding scheme).

Figure 83B:
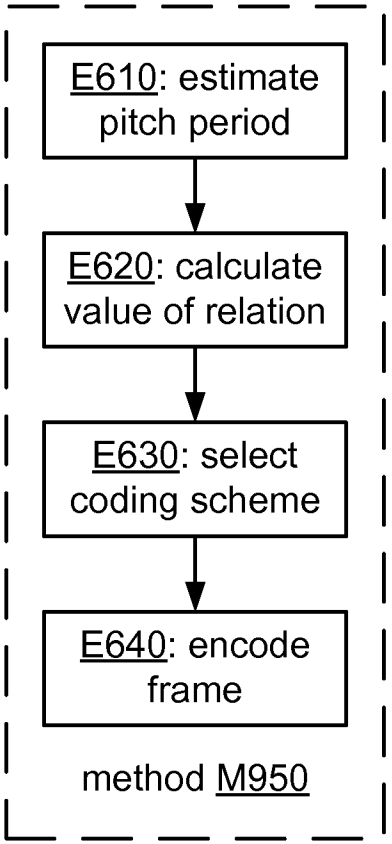
Figure 83A:
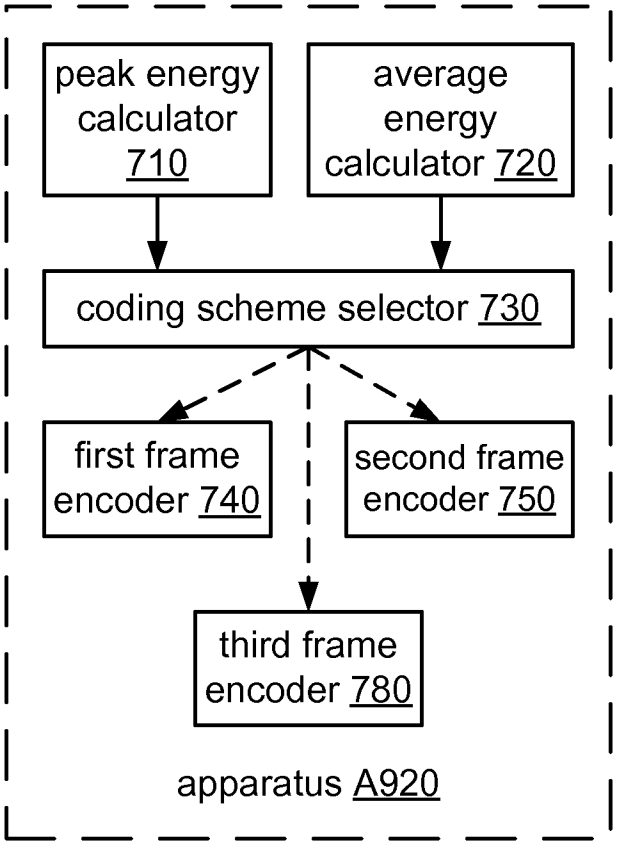

FIG. 83A shows a block diagram of an implementation A920 of apparatus A900 that includes a third frame encoder 780 configured to perform a differential encoding operation on a frame (e.g., as described herein with reference to task E200). In other words, encoder 780 is configured to produce an encoded frame that includes representations of (A) a differential between a pitch pulse shape of the current frame and a pitch pulse shape of the previous frame and (B) a differential between a pitch period of the current frame and a pitch period of the previous frame. Apparatus A920 may be implemented such that encoder 780 performs the differential encoding operation on a third frame that immediately follows the second frame in the speech signal.

FIG. 83B shows a flowchart of a method M950 of encoding a speech signal frame according to a general configuration that includes tasks E610, E620, E630, and E640. Task E610 estimates a pitch period of the frame. Task E610 may be implemented as an instance of task E130, L200, E370, or E410 as described herein. Task E620 calculates a value of a relation between a first value and a second value, where the first value is based on the estimated pitch period and the second value is based on another parameter of the frame. Based on the calculated value, task E630 selects either a noise-excited coding scheme (e.g., a NELP scheme as described herein) or a nondifferential pitch prototype coding scheme (e.g., as described herein with reference to task E100). Task E640 encodes the frame according to the coding scheme selected by task E630. If task E630 selects the nondifferential pitch prototype coding scheme, then task E640 includes producing an encoded frame that includes representations of a time-domain shape of a pitch pulse of the frame, a position of a pitch pulse of the frame, and an estimated pitch period of the frame. For example, task E640 may be implemented to include an instance of task E100 as described herein.

FIG. 84A shows a flowchart of an implementation M960 of method M950. Method M960 includes one or more tasks that calculate other parameters of the frame. Method M960 may include a task E650 that calculates a position of a terminal pitch pulse of the frame. Task E650 may be implemented as an instance of task E120, L100, E310, or E460 as described herein. For a case in which the terminal pitch pulse is the final pitch pulse of the frame, task E620 may be configured to confirm that the distance between the terminal pitch pulse and the last sample of the frame is not greater than the estimated pitch period. If task E650 calculates the pulse position relative to the last sample, then this confirmation may be performed by comparing the values of the pulse position and the estimated pitch period. For example, the condition is confirmed if subtracting the estimated pitch period from such a pulse position leaves a result that is at least equal to zero. For a case in which the terminal pitch pulse is the initial pitch pulse of the frame, task E620 may be configured to confirm that the distance between the terminal pitch pulse and the first sample of the frame is not greater than the estimated pitch period. In either of these cases, task E630 may be configured to select the noise-excited coding scheme if the confirmation fails (e.g., as described herein with reference to task T750).

In addition to terminal pitch pulse position calculation task E650, method M960 may include a task E670 that locates a plurality of other pitch pulses of the frame. In this case, task E650 may be configured to calculate a plurality of pitch pulse positions based on the estimated pitch period and the calculated pitch pulse position, and task E620 may be configured to evaluate how well the positions of the located pitch pulses agree with the calculated pitch pulse positions. For example, task E630 may be configured to select the noise-excited coding scheme if task E620 determines that any of the differences between (A) a position of a located pitch pulse and (B) a corresponding calculated pitch pulse position is greater than a threshold value, such as eight samples (e.g., as described above with reference to task T740).

Additionally or alternatively to either of the above examples, method M960 may include a task E660 that calculates a lag value that maximizes an autocorrelation value of a residual (e.g., an LPC residual) of the frame. Calculation of such a lag value (or "pitch delay") is described in section 4.6.3 (pp. 4-44 to 4-49) of the 3GPP2 document C.S0014-C referenced above, which section is hereby incorporated by reference as an example of such calculation. In this case, task E620 may be configured to confirm that the estimated pitch period is not greater than a specified proportion (e.g., one hundred sixty percent) of the calculated lag value. Task E630 may be configured to select the noise-excited coding scheme if the confirmation fails. In related implementations of method M960, task E630 may be configured to select the noise-excited coding scheme if the confirmation fails and one or more NACF values for the current frame are also sufficiently high (e.g., as described above with reference to task T730).

Additionally or alternatively to any of the above examples, task E620 may be configured to compare a value based on the estimated pitch period to a pitch period of a previous frame of the speech signal (e.g., the last frame before the current one). In such case, task E630 may be configured to select the noise-excited coding scheme if the estimated pitch period is much less than (e.g., about one-half, one-third, or one-quarter of) the pitch period of the previous frame (e.g., as described above with reference to task T710). Additionally or in the alternative, task E630 may be configured to select the noise-excited coding scheme if the previous pitch period was large (e.g., more than one hundred samples) and the estimated pitch period is less than half of the previous pitch period (e.g., as described above with reference to task T720).

FIG. 84B shows a flowchart of an implementation M970 of method M950 that includes tasks E680 and E690. Task E680 determines that the next frame of the speech signal ("the second frame") is voiced (e.g., is highly periodic). (In this case, the frame encoded in task E640 is referred to as "the first frame.") For example, task E680 may be configured to perform a version of an EVRC classification as described herein on the second frame. If task E630 selected the noise-excited coding scheme for the first frame, then task E690 encodes the second frame according to the nondifferential pitch prototype coding scheme. Task E690 may be implemented as an instance of task E100 as described herein.

Method M970 may also be implemented to include a task that performs a differential encoding operation on a third frame that immediately follows the second frame. Such a task may include producing an encoded frame that includes representations of (A) a differential between a pitch pulse shape of the third frame and a pitch pulse shape of the second frame and (B) a differential between a pitch period of the third frame and a pitch period of the second frame. Such a task may be implemented as an instance of task E200 as described herein.

Figure 85B:
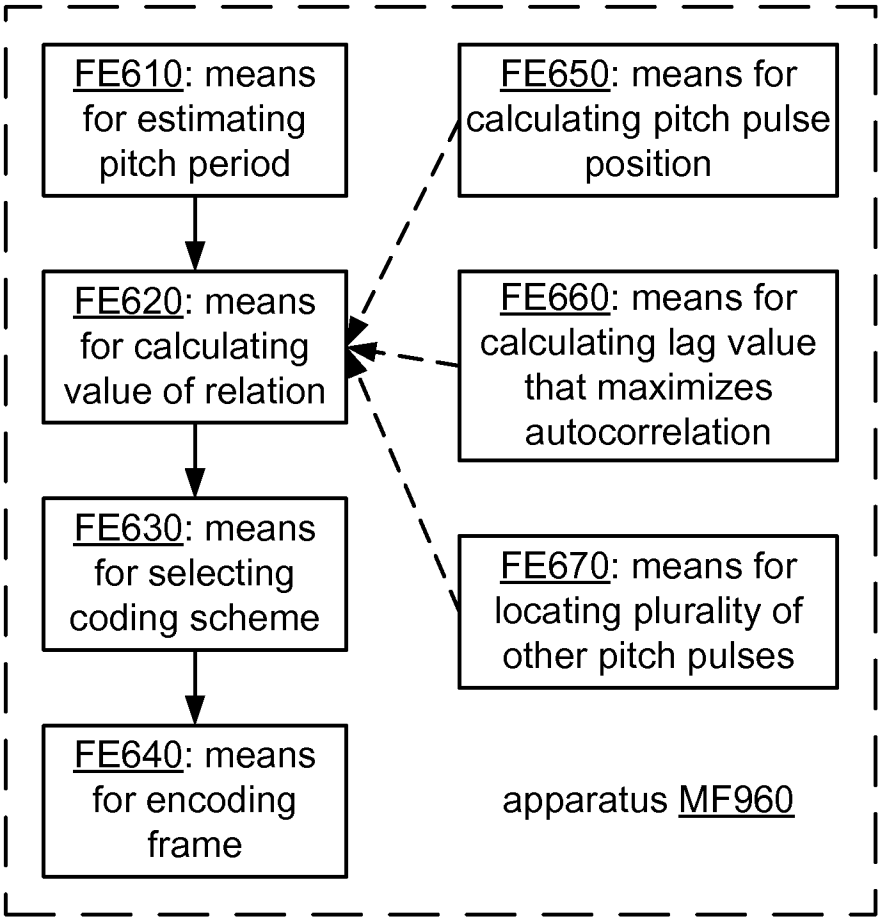
Figure 85A:
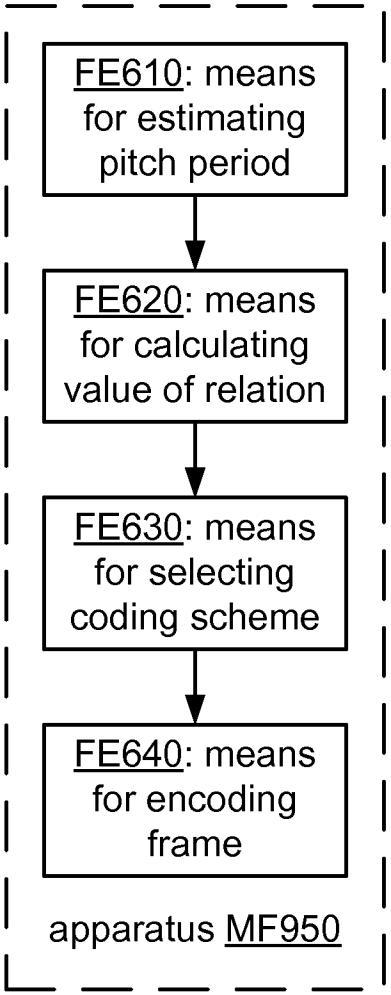

FIG. 85A shows a block diagram of an apparatus MF950 for encoding a speech signal frame. Apparatus MF950 includes means FE610 for estimating a pitch period of the frame (e.g., as described above with reference to various implementations of task E610), means FE620 for calculating a value of a relation between (A) a first value that is based on the estimated pitch period and (B) a second value that is based on another parameter of the frame (e.g., as described above with reference to various implementations of task E620), means FE630 for selecting a coding scheme based on the calculated value (e.g., as described above with reference to various implementations of task E630), and means FE640 for encoding the frame according to the selected coding scheme (e.g., as described above with reference to various implementations of task E640).

FIG. 85B shows a block diagram of an implementation MF960 of apparatus MF950 that includes one or more additional means, such as means FE650 for calculating a position of a terminal pitch pulse of the frame (e.g., as described above with reference to various implementations of task E650), means FE660 for calculating a lag value that maximizes an autocorrelation value of a residual of the frame (e.g., as described above with reference to various implementations of task E660), and/or means FE670 for locating a plurality of other pitch pulses of the frame (e.g., as described above with reference to various implementations of task E670). FIG. 86A shows a block diagram of an implementation MF970 of apparatus MF950 that includes means for indicating that a second frame of the speech signal is voiced FE680 (e.g., as described above with reference to various implementations of task E680) and means for encoding the second frame FE690 (e.g., as described above with reference to various implementations of task E690).

Figure 86B:
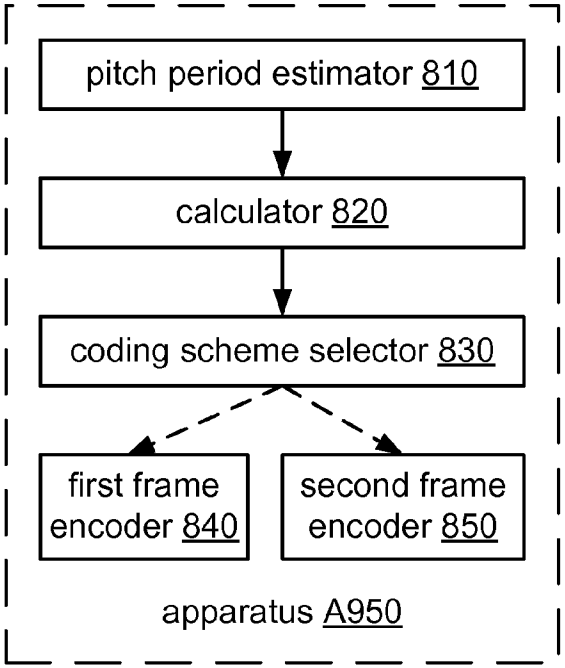
Figure 86A:
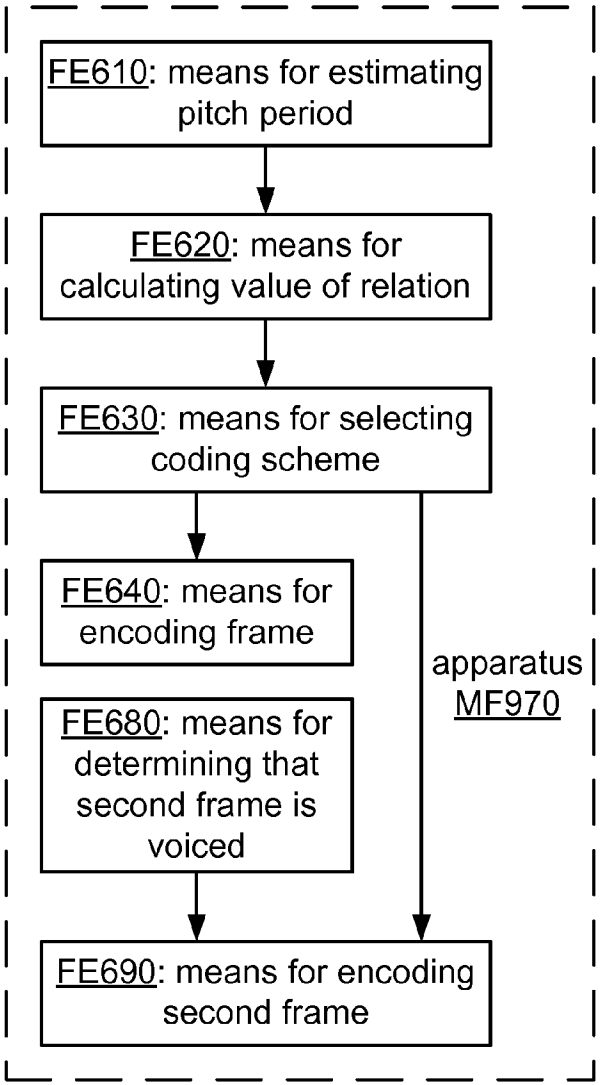

FIG. 86B shows a block diagram of an apparatus A950 for encoding a speech signal frame according to a general configuration. Apparatus A950 includes a pitch period estimator 810 configured to estimate a pitch period of the frame. Estimator 810 may be implemented as an instance of estimator 130, 190, A320, or 540 as described herein. Apparatus A950 also includes a calculator 820 configured to calculate a value of a relation between (A) a first value that is based on the estimated pitch period and (B) a second value that is based on another parameter of the frame. Apparatus M950 includes a first frame encoder 840 that is selectably configured to encode the frame according to a noise-excited coding scheme (e.g., a NELP coding scheme). Encoder 840 may be implemented as an instance of unvoiced frame encoder UE10 or aperiodic frame encoder E80 as described herein. Apparatus A950 also includes a second frame encoder 850 that is selectably configured to encode the frame according to a nondifferential pitch prototype coding scheme. Encoder 850 is configured to produce an encoded frame that includes representations of a time-domain shape of a pitch pulse of the frame, a position of a pitch pulse of the frame, and an estimated pitch period of the frame. Encoder 850 may be implemented as an instance of frame encoder 100, apparatus A400, or apparatus A650 as described herein and/or may be implemented to include estimator 810 and/or calculator 820. Apparatus A950 also includes a coding scheme selector 830 that is configured to selectably cause, based on the calculated value, one of frame encoders 840 and 850 to encode the frame (e.g., as described above with reference to various implementations of task E630). Coding scheme selector 830 may be implemented as an instance of coding scheme selector C200 or C300 as described herein and may include an instance of frame reclassifier RC10 as described herein.

Speech encoder AE10 may be implemented to include apparatus A950. For example, coding scheme selector C200 of speech encoder AE20, AE30, or AE40 may be implemented to include an instance of coding scheme selector 830 as described herein.

Figure 87B:
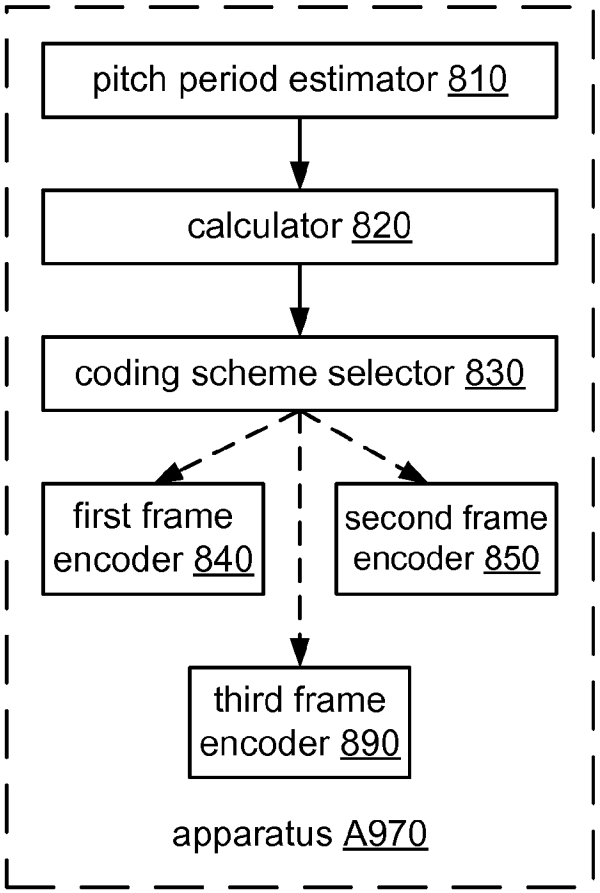
Figure 87A:
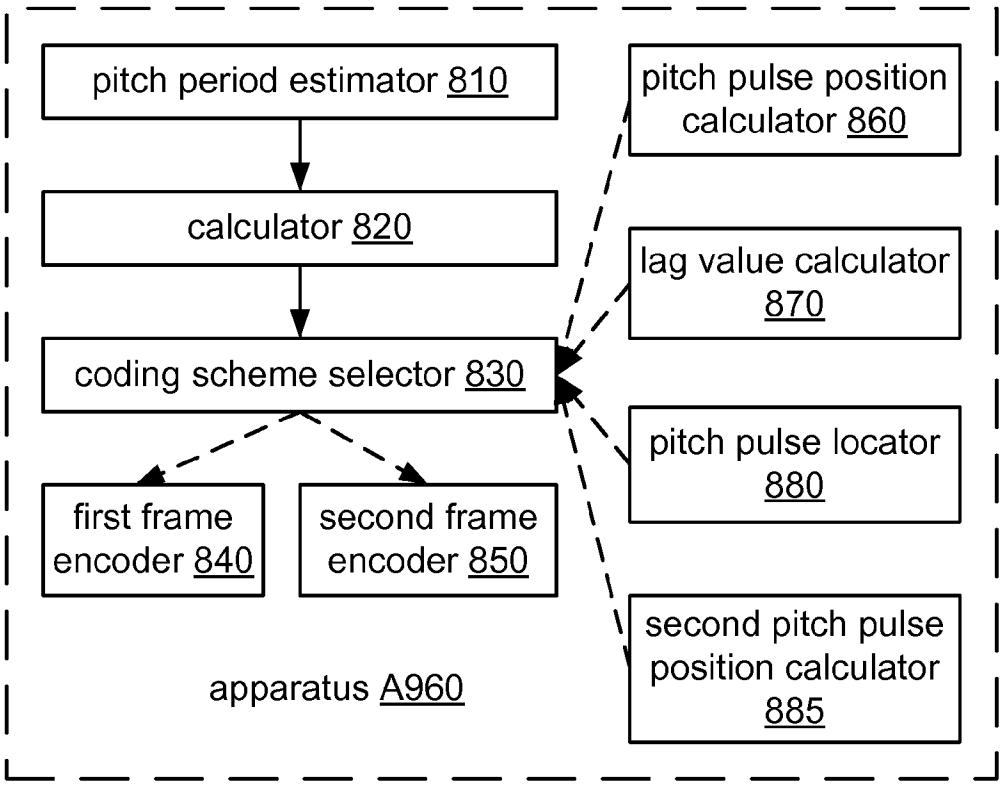

FIG. 87A shows a block diagram of an implementation A960 of apparatus A950. Apparatus A960 includes one or more elements that calculate other parameters of the frame. Apparatus A960 may include a pitch pulse position calculator 860 that is configured to calculate a position of a terminal pitch pulse of the frame. Pitch pulse position calculator 860 may be implemented as an instance of calculator 120, 160, or 590 or peak detector 150 as described herein. For a case in which the terminal pitch pulse is the final pitch pulse of the frame, calculator 820 may be configured to confirm that the distance between the terminal pitch pulse and the last sample of the frame is not greater than the estimated pitch period. If pitch pulse position calculator 860 calculates the pulse position relative to the last sample, then calculator 820 may perform this confirmation by comparing the values of the pulse position and the estimated pitch period. For example, the condition is confirmed if subtracting the estimated pitch period from such a pulse position leaves a result that is at least equal to zero. For a case in which the terminal pitch pulse is the initial pitch pulse of the frame, calculator 820 may be configured to confirm that the distance between the terminal pitch pulse and the first sample of the frame is not greater than the estimated pitch period. In either of these cases, coding scheme selector 830 may be configured to select the noise-excited coding scheme if the confirmation fails (e.g., as described herein with reference to task T750).

In addition to terminal pitch pulse position calculator 860, apparatus A960 may include a pitch pulse locator 880 that is configured to locate a plurality of other pitch pulses of the frame. In this case, apparatus A960 may include a second pitch pulse position calculator 885 configured to calculate a plurality of pitch pulse positions, based on the estimated pitch period and the calculated pitch pulse position, and calculator 820 may be configured to evaluate how well the positions of the located pitch pulses agree with the calculated pitch pulse positions. For example, coding scheme selector 830 may be configured to select the noise-excited coding scheme if calculator 820 determines that any of the differences between (A) a position of a located pitch pulse and (B) a corresponding calculated pitch pulse position is greater than a threshold value, such as eight samples (e.g., as described above with reference to task T740).

Additionally or alternatively to either of the above examples, apparatus A960 may include a lag value calculator 870 configured to calculate a lag value that maximizes an autocorrelation value of a residual of the frame (e.g., as described above with reference to task E660). In this case, calculator 820 may be configured to confirm that the estimated pitch period is not greater than a specified proportion (e.g., one hundred sixty percent) of the calculated lag value. Coding scheme selector 830 may be configured to select the noise-excited coding scheme if the confirmation fails. In related implementations of apparatus A960, coding scheme selector 830 may be configured to select the noise-excited coding scheme if the confirmation fails and one or more NACF values for the current frame are also sufficiently high (e.g., as described above with reference to task T730).

Additionally or alternatively to any of the above examples, calculator 820 may be configured to compare a value based on the estimated pitch period to a pitch period of a previous frame of the speech signal (e.g., the last frame before the current one). In such case, coding scheme selector 830 may be configured to select the noise-excited coding scheme if the estimated pitch period is much less than (e.g., about one-half, one-third, or one-quarter of) the pitch period of the previous frame (e.g., as described above with reference to task T710). Additionally or in the alternative, coding scheme selector 830 may be configured to select the noise-excited coding scheme if the previous pitch period was large (e.g., more than one hundred samples) and the estimated pitch period is less than half of the previous pitch period (e.g., as described above with reference to task T720).

For convenience, the speech signal frame discussed above with reference to apparatus A950 is now referred to as "the first frame," and the frame that follows it in the speech signal is referred to as "the second frame." Coding scheme selector 830 may be configured to perform a frame classification operation on the second frame (e.g., as described herein with reference to task E680 as implemented in method M960). For example, coding scheme selector 830 may be configured, in response to selecting the noise-excited coding scheme for the first frame and determining that the second frame is voiced, to cause second frame encoder 850 to encode the second frame (i.e., according to the nondifferential pitch prototype coding scheme).

FIG. 87B shows a block diagram of an implementation A970 of apparatus A950 that includes a third frame encoder 890 configured to perform a differential encoding operation on a frame (e.g., as described herein with reference to task E200). In other words, encoder 890 is configured to produce an encoded frame that includes representations of (A) a differential between a pitch pulse shape of the current frame and a pitch pulse shape of the previous frame and (B) a differential between a pitch period of the current frame and a pitch period of the previous frame. Apparatus A970 may be implemented such that encoder 890 performs the differential encoding operation on a third frame that immediately follows the second frame in the speech signal.

In a typical application of an implementation of a method as described herein (e.g., method M100, M200, M300, M400, M500, M550, M560, M600, M650, M700, M800, M900, or M950, or another routine or code listing), an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.) that is readable and/or executable by a machine (e.g., a computer) including an array of logic elements (e.g., a processor, microprocessor, microcontroller, or other finite state machine). The tasks of an implementation of such a method may also be performed by more than one such array or machine. In these or other implementations, the tasks may be performed within a device for wireless communications, such as a mobile user terminal or other device having such communications capability. Such a device may be configured to communicate with circuit-switched and/or packet-switched networks (e.g., using one or more protocols such as VoIP (voice over Internet Protocol)). For example, such a device may include RF circuitry configured to transmit a signal that includes encoded frames (e.g., packets) and/or to receive such a signal. Such a device may also be configured to perform one or more other operations on the encoded frames or packets before RF transmission, such as interleaving, puncturing, convolutional coding, error correction coding, and/or applying one or more layers of network protocol and/or to perform the complement of such operations after RF reception.

The various elements of implementations of an apparatus described herein (e.g., apparatus A100, A200, A300, A400, A500, A560, A600, A650, A700, A800, A900, speech encoder AE20, speech decoder AD20, or elements thereof) may be implemented as electronic and/or optical devices residing, for example, on the same chip or among two or more chips in a chipset, although other arrangements without such limitation are also contemplated. One or more elements of such an apparatus may be implemented in whole or in part as one or more sets of instructions arranged to execute on one or more fixed or programmable arrays of logic elements (e.g., transistors, gates) such as microprocessors, embedded processors, IP cores, digital signal processors, FPGAs (field-programmable gate arrays), ASSPs (application-specific standard products), and ASICs (application-specific integrated circuits).

It is possible for one or more elements of an implementation of such an apparatus to be used to perform tasks or execute other sets of instructions that are not directly related to an operation of the apparatus, such as a task relating to another operation of a device or system in which the apparatus is embedded. It is also possible for one or more elements of an implementation of an apparatus described herein to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The foregoing presentation of the described configurations is provided to enable any person skilled in the art to make or use the methods and other structures disclosed herein. The flowcharts and other structures shown and described herein are examples only, and other variants of these structures are also within the scope of the disclosure. Various modifications to these configurations are possible, and the generic principles presented herein may be applied to other configurations as well.

Each of the configurations described herein may be implemented in part or in whole as a hard-wired circuit, as a circuit configuration fabricated into an application-specific integrated circuit, or as a firmware program loaded into nonvolatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

Each of the methods disclosed herein may also be tangibly embodied (for example, in one or more data storage media as listed above) as one or more sets of instructions readable and/or executable by a machine including an array of logic elements (e.g., a processor, microprocessor, microcontroller, or other finite state machine). Thus, the present disclosure is not intended to be limited to the configurations shown above but rather is to be accorded the widest scope consistent with the principles and novel features disclosed in any fashion herein, including in the attached claims as filed, which form a part of the original disclosure.

What is claimed is:

1. A method of encoding a speech signal frame, said method comprising:

calculating a peak energy of a residual of the frame by squaring a value of a sample in the frame having a greatest magnitude;

calculating an average energy of the residual by summing squared values of a number of samples in the frame and dividing the sum by the number of samples in the frame;

based on a relation between the calculated peak energy and the calculated average energy, selecting one from the set of (A) a noise-excited coding scheme and (B) a nondifferential pitch prototype coding scheme; and encoding the frame according to the selected coding scheme, wherein encoding the frame according to the nondifferential pitch prototype coding scheme includes producing an encoded frame that includes representations of a time-domain shape of a pitch pulse of the frame, a position of a pitch pulse of the frame, and an estimated pitch period of the frame.

2. The method according to claim 1, wherein the noise-excited coding scheme is a noise-excited linear prediction (NELP) coding scheme.

3. The method according to claim 1, wherein said method includes calculating the number of pitch pulse peaks in the frame, and wherein said selecting is based on the calculated number of pitch pulse peaks in the frame.

4. The method according to claim 3, wherein said method includes comparing the calculated number of pitch peaks in the frame to a threshold value, and wherein said selecting is based on a result of said comparing.

5. The method according to claim 1, wherein said selecting is based on a signal-to-noise ratio of at least a portion of the frame.

6. The method according to claim 5, wherein said selecting is based on a signal-to-noise ratio of a lowband portion of the frame.

7. The method according to claim 1, wherein said method comprises:

determining that a second frame of the speech signal, which immediately follows said frame in the speech signal, is voiced; and for a case in which said selecting selects the unvoiced coding scheme, and in response to said determining, encoding the second frame according to the nondifferential coding mode.

8. The method according to claim 7, wherein said method includes performing a differential encoding operation on a third frame of the speech signal, which immediately follows said second frame in the speech signal, and wherein said performing a differential encoding operation on the third frame includes producing an encoded frame that includes representations of (A) a differential between a pitch pulse shape of the third frame and a pitch pulse shape of the second frame and (B) a differential between a pitch period of the third frame and a pitch period of the second frame.

9. An apparatus for encoding a speech signal frame, said apparatus comprising:

means for calculating a peak energy of a residual of the frame by squaring a value of a sample in the frame having a greatest magnitude;

means for calculating an average energy of the residual by summing squared values of a number of samples in the frame and dividing the sum by the number of samples in the frame;

means for selecting, based on a relation between the calculated peak energy and the calculated average energy, one from the set of (A) a noise-excited coding scheme and (B) a nondifferential pitch prototype coding scheme; and means for encoding the frame according to the selected coding scheme, wherein encoding the frame according to the nondifferential pitch prototype coding scheme includes producing an encoded frame that includes representations of a time-domain shape of a pitch pulse of the frame, a position of a pitch pulse of the frame, and an estimated pitch period of the frame.

10. The apparatus according to claim 9, wherein the noise-excited coding scheme is a noise-excited linear prediction (NELP) coding scheme.

11. The apparatus according to claim 9, wherein said apparatus includes means for calculating the number of pitch pulse peaks in the frame, and wherein said means for selecting is configured to select said one from the set of (A) a noise-excited coding scheme and (B) a nondifferential pitch prototype coding scheme based on the calculated number of pitch pulse peaks in the frame.

12. The apparatus according to claim 9, wherein said means for selecting is configured to select said one from the set of (A) a noise-excited coding scheme and (B) a nondifferential pitch prototype coding scheme based on a signal-to-noise ratio of a lowband portion of the frame.

13. The apparatus according to claim 9, wherein said apparatus comprises:

means for indicating that a second frame of the speech signal, which immediately follows said frame in the speech signal, is voiced; and means for encoding the second frame according to the nondifferential coding mode in response to (A) selection of the unvoiced coding scheme by said means for selecting and (B) an indication, by said means for indicating, that the second frame is voiced.

14. The apparatus according to claim 13, wherein said apparatus includes means for performing a differential encoding operation on a third frame of the speech signal, which immediately follows said second frame in the speech signal, and wherein said means for performing a differential encoding operation on the third frame includes producing an encoded frame that includes representations of (A) a differential between a pitch pulse shape of the third frame and a pitch pulse shape of the second frame and (B) a differential between a pitch period of the third frame and a pitch period of the second frame.

15. A non-transitory computer-readable medium comprising instructions which when executed by a processor cause the processor to:

calculate a peak energy of a residual of the frame of a speech signal by squaring a value of a sample in the frame having a greatest magnitude;

calculate an average energy of the residual by summing squared values of a number of samples in the frame and dividing the sum by the number of samples in the frame;

select, based on a relation between the calculated peak energy and the calculated average energy, one from the set of (A) a noise-excited coding scheme and (B) a nondifferential pitch prototype coding scheme; and encode the frame according to the selected coding scheme, wherein said instructions which cause the processor to encode the frame according to the nondifferential pitch prototype coding scheme include instructions which cause the processor to produce an encoded frame that includes representations of a time-domain shape of a pitch pulse of the frame, a position of a pitch pulse of the frame, and an estimated pitch period of the frame.

16. The computer-readable medium according to claim 15, wherein the noise-excited coding scheme is a noise-excited linear prediction (NELP) coding scheme.

17. The computer-readable medium according to claim 15, wherein said medium includes instructions which cause the processor to calculate the number of pitch pulse peaks in the frame, and wherein said instructions which cause the processor to select include instructions which cause the processor to select said one from the set of (A) a noise-excited coding scheme and (B) a nondifferential pitch prototype coding scheme based on the calculated number of pitch pulse peaks in the frame.

18. The computer-readable medium according to claim 15, wherein said instructions which cause the processor to select include instructions which cause the processor to select said one from the set of (A) a noise-excited coding scheme and (B) a nondifferential pitch prototype coding scheme based on a signal-to-noise ratio of a lowband portion of the frame.

19. The computer-readable medium according to claim 15, wherein said medium comprises instructions which when executed by a processor cause the processor to:

indicate that a second frame of the speech signal, which immediately follows said frame in the speech signal, is voiced; and encode the second frame according to the nondifferential coding mode in response to (A) selection of the unvoiced coding scheme by said instructions which cause the processor to select and (B) an indication, by said instructions which cause the processor to indicate, that the second frame is voiced.

20. The computer-readable medium according to claim 19, wherein said medium includes instructions which cause the processor to perform a differential encoding operation on a third frame of the speech signal, which immediately follows said second frame in the speech signal, and wherein said instructions which cause the processor to perform a differential encoding operation on the third frame include instructions which cause the processor to produce an encoded frame that includes representations of (A) a differential between a pitch pulse shape of the third frame and a pitch pulse shape of the second frame and (B) a differential between a pitch period of the third frame and a pitch period of the second frame.

21. An apparatus for encoding a speech signal frame, said apparatus comprising:

a peak energy calculator configured to calculate a peak energy of a residual of the frame by squaring a value of a sample in the frame having a greatest magnitude;

an average energy calculator configured to calculate an average energy of the residual by summing squared values of a number of samples in the frame and dividing the sum by the number of samples in the frame;

a first frame encoder selectably configured to encode the frame according to a noise-excited coding scheme;

a second frame encoder selectably configured to encode the frame according to a nondifferential pitch prototype coding scheme; and a coding scheme selector configured to selectably cause, based on a relation between the calculated peak energy and the calculated average energy, one of the first and second frame encoders to encode the frame, wherein said second frame encoder is configured to produce an encoded frame that includes representations of a time-domain shape of a pitch pulse of the frame, a position of a pitch pulse of the frame, and an estimated pitch period of the frame.

22. The apparatus according to claim 21, wherein the noise-excited coding scheme is a noise-excited linear prediction (NELP) coding scheme.

23. The apparatus according to claim 21, wherein said apparatus includes a pitch pulse peak counter configured to calculate the number of pitch pulse peaks in the frame, and wherein said coding scheme selector is configured to select said one of the first and second frame encoders based on the calculated number of pitch pulse peaks in the frame.

24. The apparatus according to claim 21, wherein said coding scheme selector is configured to select said one of the first and second frame encoders based on a signal-to-noise ratio of a lowband portion of the frame.

25. The apparatus according to claim 21, wherein said coding scheme selector is configured to determine that a second frame of the speech signal, which immediately follows said frame in the speech signal, is voiced, and wherein said coding scheme selector is configured to cause the second frame encoder to encode the second frame in response to (A) selectably causing the first frame encoder to encode the frame and (B) the determination that the second frame is voiced.

26. The apparatus according to claim 25, wherein said apparatus includes a third frame encoder configured to perform a differential encoding operation on a third frame of the speech signal, which immediately follows said second frame in the speech signal, and wherein said third frame encoder is configured to produce an encoded frame that includes representations of (A) a differential between a pitch pulse shape of the third frame and a pitch pulse shape of the second frame and (B) a differential between a pitch period of the third frame and a pitch period of the second frame.

27. A method of encoding a speech signal frame, said method comprising:

estimating a pitch period of the frame, wherein the estimating comprises calculating a peak energy of a residual of the frame by squaring a value of a sample in the frame having a greatest magnitude;

calculating a value of a relation between (A) a first value that is based on the estimated pitch period and (B) a second value that is based on another parameter of the frame;

based on the calculated value, selecting one from the set of (A) a noise-excited coding scheme and (B) a nondifferential pitch prototype coding scheme; and encoding the frame according to the selected coding scheme, wherein encoding the frame according to the nondifferential pitch prototype coding scheme includes producing an encoded frame that includes representations of a time-domain shape of a pitch pulse of the frame, a position of a pitch pulse of the frame, and the estimated pitch period.

28. The method according to claim 27, wherein the noise-excited coding scheme is a noise-excited linear prediction (NELP) coding scheme.

29. The method according to claim 27, wherein the other parameter is a position of a terminal pitch pulse of the frame, and wherein said calculating comprises comparing the first value and the second value.

30. The method according to claim 27, wherein the other parameter is a lag value that maximizes an autocorrelation function of a residual of the frame, and wherein said calculating comprises comparing the first value and the second value.

31. The method according to claim 27, wherein said method comprises:

calculating a position of a terminal pitch pulse of the frame;

locating a plurality of other pitch pulses of the frame; and based on the estimated pitch period and the calculated position of the terminal pitch pulse, calculating a plurality of pitch pulse positions, wherein said calculating a value comprises comparing (A) the positions of the located pitch pulses to (B) the calculated pitch pulse positions.

32. The method according to claim 27, wherein said selecting is based on a result of comparing a value based on the estimated pitch period to a pitch period of a previous frame.

33. The method according to claim 27, wherein said method comprises:

determining that a second frame of the speech signal, which immediately follows said frame in the speech signal, is voiced; and for a case in which said selecting selects the unvoiced coding scheme, and in response to said determining, encoding the second frame according to the nondifferential coding mode.

34. The method according to claim 33, wherein said method includes performing a differential encoding operation on a third frame of the speech signal, which immediately follows said second frame in the speech signal, and wherein said performing a differential encoding operation on the third frame includes producing an encoded frame that includes representations of (A) a differential between a pitch pulse shape of the third frame and a pitch pulse shape of the second frame and (B) a differential between a pitch period of the third frame and a pitch period of the second frame.

35. An apparatus for encoding a speech signal frame, said apparatus comprising:

means for estimating a pitch period of the frame, wherein the estimating comprises calculating a peak energy of a residual of the frame by squaring a value of a sample in the frame having a greatest magnitude;

means for calculating a value of a relation between (A) a first value that is based on the estimated pitch period and (B) a second value that is based on another parameter of the frame;

means for selecting, based on the calculated value, one from the set of (A) a noise-excited coding scheme and (B) a nondifferential pitch prototype coding scheme; and means for encoding the frame according to the selected coding scheme, wherein encoding the frame according to the nondifferential pitch prototype coding scheme includes producing an encoded frame that includes representations of a time-domain shape of a pitch pulse of the frame, a position of a pitch pulse of the frame, and the estimated pitch period.

36. The apparatus according to claim 35, wherein the noise-excited coding scheme is a noise-excited linear prediction (NELP) coding scheme.

37. The apparatus according to claim 35, wherein the other parameter is a position of a terminal pitch pulse of the frame, and wherein said means for calculating is configured to compare the first value and the second value.

38. The apparatus according to claim 35, wherein the other parameter is a lag value that maximizes an autocorrelation function of a residual of the frame, and wherein said means for calculating is configured to compare the first value and the second value.

39. The apparatus according to claim 35, wherein said apparatus comprises:

means for calculating a position of a terminal pitch pulse of the frame;

means for locating a plurality of other pitch pulses of the frame; and means for calculating, based on the estimated pitch period and the calculated position of the terminal pitch pulse, a plurality of pitch pulse positions, wherein said means for calculating a value is configured to compare (A) the positions of the located pitch pulses to (B) the calculated pitch pulse positions.

40. The apparatus according to claim 35, wherein said means for selecting is configured to select said one from the set of (A) a noise-excited coding scheme and (B) a nondifferential pitch prototype coding scheme based on a result of comparing a value based on the estimated pitch period to a pitch period of a previous frame.

41. The apparatus according to claim 35, wherein said apparatus comprises:

means for indicating that a second frame of the speech signal, which immediately follows said frame in the speech signal, is voiced; and means for encoding the second frame according to the nondifferential coding mode in response to (A) selection of the unvoiced coding scheme by said means for selecting and (B) an indication, by said means for indicating, that the second frame is voiced.

42. The apparatus according to claim 41, wherein said apparatus includes means for performing a differential encoding operation on a third frame of the speech signal, which immediately follows said second frame in the speech signal, and wherein said means for performing a differential encoding operation on the third frame includes producing an encoded frame that includes representations of (A) a differential between a pitch pulse shape of the third frame and a pitch pulse shape of the second frame and (B) a differential between a pitch period of the third frame and a pitch period of the second frame.

43. A non-transitory computer-readable medium comprising instructions which when executed by a processor cause the processor to:

estimate a pitch period of the frame, wherein the estimating comprises calculating a peak energy of a residual of the frame by squaring a value of a sample in the frame having a greatest magnitude;

calculate a value of a relation between (A) a first value that is based on the estimated pitch period and (B) a second value that is based on another parameter of the frame;

select, based on the calculated value, one from the set of (A) a noise-excited coding scheme and (B) a nondifferential pitch prototype coding scheme; and encode the frame according to the selected coding scheme, wherein said instructions which cause the processor to encode the frame according to the nondifferential pitch prototype coding scheme include instructions which cause the processor to produce an encoded frame that includes representations of a time-domain shape of a pitch pulse of the frame, a position of a pitch pulse of the frame, and the estimated pitch period.

44. The computer-readable medium according to claim 43, wherein the noise-excited coding scheme is a noise-excited linear prediction (NELP) coding scheme.

45. The computer-readable medium according to claim 43, wherein the other parameter is a position of a terminal pitch pulse of the frame, and wherein said instructions which cause the processor to calculate include instructions which cause the processor to compare the first value and the second value.

46. The computer-readable medium according to claim 43, wherein the other parameter is a lag value that maximizes an autocorrelation function of a residual of the frame, and wherein said instructions which cause the processor to calculate include instructions which cause the processor to compare the first value and the second value.

47. The computer-readable medium according to claim 43, wherein said medium comprises instructions which when executed by a processor cause the processor to:

calculate a position of a terminal pitch pulse of the frame;

locate a plurality of other pitch pulses of the frame; and calculate, based on the estimated pitch period and the calculated position of the terminal pitch pulse, a plurality of pitch pulse positions, wherein said instructions which cause the processor to calculate a value include instructions which cause the processor to compare (A) the positions of the located pitch pulses to (B) the calculated pitch pulse positions.

48. The computer-readable medium according to claim 43, wherein said instructions which cause the processor to select include instructions which cause the processor to select said one from the set of (A) a noise-excited coding scheme and (B)

a nondifferential pitch prototype coding scheme based on a result of comparing a value based on the estimated pitch period to a pitch period of a previous frame.

49. The computer-readable medium according to claim 43, wherein said medium comprises instructions which when executed by a processor cause the processor to:

indicate that a second frame of the speech signal, which immediately follows said frame in the speech signal, is voiced; and encode the second frame according to the nondifferential coding mode in response to (A) selection of the unvoiced coding scheme by said instructions which cause the processor to select and (B) an indication, by said instructions which cause the processor to indicate, that the second frame is voiced.

50. The computer-readable medium according to claim 49, wherein said medium includes instructions which cause the processor to perform a differential encoding operation on a third frame of the speech signal, which immediately follows said second frame in the speech signal, and wherein said instructions which cause the processor to perform a differential encoding operation on the third frame include instructions which cause the processor to produce an encoded frame that includes representations of (A) a differential between a pitch pulse shape of the third frame and a pitch pulse shape of the second frame and (B) a differential between a pitch period of the third frame and a pitch period of the second frame.

51. An apparatus for encoding a speech signal frame, said apparatus comprising:

a pitch period estimator configured to estimate a pitch period of the frame, wherein the estimating comprises calculating a peak energy of a residual of the frame by squaring a value of a sample in the frame having a greatest magnitude;

a calculator configured to calculate a value of a relation between (A) a first value that is based on the estimated pitch period and (B) a second value that is based on another parameter of the frame;

a first frame encoder selectably configured to encode the frame according to a noise-excited coding scheme;

a second frame encoder selectably configured to encode the frame according to a nondifferential pitch prototype coding scheme; and a coding scheme selector configured to selectably cause, based on the calculated value, one among the first and second frame encoders to encode the frame, wherein said second frame encoder is configured to produce an encoded frame that includes representations of a time-domain shape of a pitch pulse of the frame, a position of a pitch pulse of the frame, and a estimated pitch period of the frame.

52. The apparatus according to claim 51, wherein the noise-excited coding scheme is a noise-excited linear prediction (NELP) coding scheme.

53. The apparatus according to claim 51, wherein the other parameter is a position of a terminal pitch pulse of the frame, and wherein said calculator is configured to compare the first value and the second value.

54. The apparatus according to claim 51, wherein the other parameter is a lag value that maximizes an autocorrelation function of a residual of the frame, and wherein said calculator is configured to compare the first value and the second value.

55. The apparatus according to claim 51, wherein said apparatus comprises:

a first pitch pulse position calculator configured to calculating a position of a terminal pitch pulse of the frame;

a pitch pulse locator configured to locate a plurality of other pitch pulses of the frame; and a second pitch pulse position calculator configured to calculate, based on the estimated pitch period and the calculated position of the terminal pitch pulse, a plurality of pitch pulse positions, wherein said calculator is configured to compare (A) the positions of the located pitch pulses to (B) the calculated pitch pulse positions.

56. The apparatus according to claim 51, wherein said coding scheme selector is configured to select said one from the set of (A) a noise-excited coding scheme and (B) a nondifferential pitch prototype coding scheme based on a result of comparing a value based on the estimated pitch period to a pitch period of a previous frame.

57. The apparatus according to claim 51, wherein said coding scheme selector is configured to determine that a second frame of the speech signal, which immediately follows said frame in the speech signal, is voiced, and wherein said coding scheme selector is configured to cause the second frame encoder to encode the second frame in response to (A) selectably causing the first frame encoder to encode the frame and (B) the determination that the second frame is voiced.

58. The apparatus according to claim 57, wherein said apparatus includes a third frame encoder configured to perform a differential encoding operation on a third frame of the speech signal, which immediately follows said second frame in the speech signal, and wherein said third frame encoder is configured to produce an encoded frame that includes representations of (A) a differential between a pitch pulse shape of the third frame and a pitch pulse shape of the second frame and (B) a differential between a pitch period of the third frame and a pitch period of the second frame.

* * * * *